US012458070B2

(12) United States Patent
Lord et al.

(10) Patent No.: US 12,458,070 B2
(45) Date of Patent: Nov. 4, 2025

(54) AEROSOL DELIVERY SYSTEM

(71) Applicant: Imperial Tobacco Limited, Bristol (GB)

(72) Inventors: Chris Lord, Liverpool (GB); Thomas Sudlow, Liverpool (GB); Ben Illidge, Liverpool (GB); Alfred Madden, Liverpool (GB); Ben Astbury, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 733 days.

(21) Appl. No.: 17/478,574

(22) Filed: Sep. 17, 2021

(65) Prior Publication Data

US 2022/0030942 A1 Feb. 3, 2022

Related U.S. Application Data

(63) Continuation of application No. PCT/EP2020/057314, filed on Mar. 17, 2020, and a
(Continued)

(30) Foreign Application Priority Data

Mar. 21, 2019 (EP) ..... 19164440
Mar. 21, 2019 (EP) ..... 19164447
(Continued)

(51) Int. Cl.
*A24F 40/44* (2020.01)
*A24F 40/10* (2020.01)
(Continued)

(52) U.S. Cl.
CPC ..... *A24F 40/44* (2020.01); *A24F 40/10* (2020.01); *A24F 40/42* (2020.01); *A24F 40/46* (2020.01); *A24F 40/485* (2020.01); *A24F 40/70* (2020.01)

(58) Field of Classification Search
CPC ..... A24F 40/44; A24F 40/10; A24F 40/42; A24F 40/46; A24F 40/485; A24F 40/70
See application file for complete search history.

(56) References Cited

U.S. PATENT DOCUMENTS

2003/0108342 A1 6/2003 Sherwood et al.
2007/0102013 A1 5/2007 Adams et al.
(Continued)

FOREIGN PATENT DOCUMENTS

CN 203662018 U 6/2014
CN 104382238 A 3/2015
(Continued)

OTHER PUBLICATIONS

European Patent Office; Extended European Search Report regarding European Patent Application No. EP19164448.3, filed Mar. 21, 2019, dated Sep. 30, 2019.
(Continued)

*Primary Examiner* — Michael H. Wilson
*Assistant Examiner* — Jennifer A Kessie
(74) *Attorney, Agent, or Firm* — DUNLAP CODDING, P.C.

(57) ABSTRACT

There is disclosed an aerosol-generation apparatus having a heater and a fluid-transfer article, the fluid-transfer article including a first region holding an aerosol precursor and transferring said aerosol precursor to an activation surface of a second region of said article, the activation surface being disposed at an end of the article configured for thermal interaction with a heating surface of the heater. The activa-
(Continued)

tion surface has at least one channel therein and is configured such that, when the fluid transfer article is arranged with respect to the heating surface for thermal interaction therebetween, the channel(s) opposes the heating surface and opens towards said heating surface. The heater has a substrate forming the heating surface and at least one heating element on a part of that heating surface. The channel(s) opposes a part of the heating surface other than part of the heating surface on which the heating element is formed.

16 Claims, 115 Drawing Sheets

Related U.S. Application Data continuation of application No. PCT/EP2020/057352, filed on Mar. 17, 2020, and a continuation of application No. PCT/EP2020/057288, filed on Mar. 17, 2020, and a continuation of application No. PCT/EP2020/057332, filed on Mar. 17, 2020, and a continuation of application No. PCT/EP2020/057343, filed on Mar. 17, 2020, and a continuation of application No. PCT/EP2020/057320, filed on Mar. 17, 2020, and a continuation of application No. PCT/EP2020/057339, filed on Mar. 17, 2020, and a continuation of application No. PCT/EP2020/057303, filed on Mar. 17, 2020, and a continuation of application No. PCT/EP2020/057316, filed on Mar. 17, 2020, and a continuation of application No. PCT/EP2020/057310, filed on Mar. 17, 2020, and a continuation of application No. PCT/EP2020/057331, filed on Mar. 17, 2020.

(30) Foreign Application Priority Data

| | | |
|---|---|---|
| Mar. 21, 2019 | (EP) | 19164448 |
| Mar. 21, 2019 | (EP) | 19164454 |
| Mar. 21, 2019 | (EP) | 19164457 |
| Mar. 21, 2019 | (EP) | 19164458 |
| Mar. 21, 2019 | (EP) | 19164461 |
| Mar. 21, 2019 | (EP) | 19164462 |
| Mar. 21, 2019 | (EP) | 19164465 |
| Mar. 21, 2019 | (EP) | 19164466 |
| Mar. 21, 2019 | (EP) | 19164474 |

(51) Int. Cl.

| | |
|---|---|
| ***A24F 40/42*** | (2020.01) |
| ***A24F 40/46*** | (2020.01) |
| ***A24F 40/485*** | (2020.01) |
| ***A24F 40/70*** | (2020.01) |

(56) References Cited

U.S. PATENT DOCUMENTS

| | | | | |
|---|---|---|---|---|
| 2009/0194607 | A1 | 8/2009 | Nichols et al. | |
| 2011/0226236 | A1 | 9/2011 | Buchberger | |
| 2013/0037041 | A1 | 2/2013 | Worm et al. | |
| 2013/0333700 | A1 | 12/2013 | Buchberger et al. | |
| 2014/0007863 | A1 | 1/2014 | Chen | |
| 2014/0014126 | A1 | 1/2014 | Peleg et al. | |
| 2014/0238396 | A1 | 8/2014 | Buchberger | |
| 2014/0238424 | A1 | 8/2014 | Macko et al. | |
| 2015/0027459 | A1 | 1/2015 | Collett et al. | |
| 2015/0027472 | A1 | 1/2015 | Amir | |
| 2015/0136156 | A1 | 5/2015 | Liu | |
| 2015/0245669 | A1 | 9/2015 | Cadieux et al. | |
| 2015/0272218 | A1 | 10/2015 | Chen | |
| 2016/0143365 | A1 | 5/2016 | Liu | |
| 2017/0006916 | A1 | 1/2017 | Liu | |
| 2017/0027227 | A1 | 2/2017 | Lipowicz | |
| 2017/0027233 | A1 | 2/2017 | Mironov | |
| 2017/0035109 | A1 | 2/2017 | Liu | |
| 2017/0049154 | A1 | 2/2017 | Batista | |
| 2017/0079332 | A1 | 3/2017 | Li et al. | |
| 2017/0188626 | A1 | 7/2017 | Davis et al. | |
| 2017/0188629 | A1 | 7/2017 | Dickens et al. | |
| 2017/0340014 | A1* | 11/2017 | Batista | A24F 40/485 |
| 2017/0367402 | A1 | 12/2017 | Lau et al. | |
| 2017/0367407 | A1 | 12/2017 | Althorpe et al. | |
| 2017/0367411 | A1 | 12/2017 | Duc | |
| 2018/0020721 | A1 | 1/2018 | Garthaffner et al. | |
| 2018/0027879 | A1 | 2/2018 | Gavrielov et al. | |
| 2018/0042301 | A1 | 2/2018 | Rostami | |
| 2018/0116284 | A1 | 5/2018 | Biel et al. | |
| 2018/0140018 | A1 | 5/2018 | Hu et al. | |
| 2018/0168225 | A1 | 6/2018 | Zinovik et al. | |
| 2018/0177240 | A1 | 6/2018 | Duque et al. | |
| 2018/0184710 | A1 | 7/2018 | Tucker et al. | |
| 2018/0184712 | A1 | 7/2018 | Fraser et al. | |
| 2018/0289058 | A1* | 10/2018 | Chen | A24F 40/46 |
| 2018/0296777 | A1 | 10/2018 | Terry et al. | |
| 2019/0053539 | A1 | 2/2019 | Davis et al. | |

FOREIGN PATENT DOCUMENTS

| | | | |
|---|---|---|---|
| CN | 204232300 | U | 4/2015 |
| CN | 205922888 | U | 2/2017 |
| CN | 206079033 | U | 4/2017 |
| CN | 107692328 | A | 2/2018 |
| CN | 108185535 | A | 6/2018 |
| CN | 207613199 | U | 7/2018 |
| CN | 108378428 | A | 8/2018 |
| CN | 207707306 | U | 8/2018 |
| CN | 108514158 | A | 9/2018 |
| CN | 208550027 | U | 3/2019 |
| EP | 2965642 | A1 | 1/2016 |
| EP | 3020292 | A1 | 5/2016 |
| EP | 3311683 | A1 | 4/2018 |
| GB | 2561958 | A | 10/2018 |
| WO | WO2013083634 | A1 | 6/2013 |
| WO | WO 2014059790 | A1 | 4/2014 |
| WO | WO 2015117704 | A1 | 8/2015 |
| WO | WO2015117705 | A2 | 8/2015 |
| WO | WO2016079155 | A1 | 5/2016 |
| WO | WO2016108174 | A1 | 7/2016 |
| WO | WO 2016154792 | A1 | 10/2016 |
| WO | WO2016161554 | A1 | 10/2016 |
| WO | WO2017001352 | A2 | 1/2017 |
| WO | WO2017076590 | A1 | 5/2017 |
| WO | WO 2017167521 | A1 | 10/2017 |
| WO | WO2017207419 | A1 | 12/2017 |
| WO | WO2017207586 | A1 | 12/2017 |
| WO | WO2017214876 | A1 | 12/2017 |
| WO | WO 2018001106 | A1 | 1/2018 |
| WO | WO2018029186 | A1 | 2/2018 |
| WO | WO 2018058883 | A1 | 4/2018 |
| WO | WO2018114441 | A1 | 6/2018 |
| WO | WO2018197511 | A1 | 11/2018 |
| WO | WO2018197513 | A1 | 11/2018 |
| WO | WO2018197515 | A1 | 11/2018 |
| WO | WO2018211035 | A1 | 11/2018 |

OTHER PUBLICATIONS

European Patent Office; Extended European Search Report regarding European Patent Application No. EP19164461.6, filed Mar. 21, 2019, dated Sep. 30, 2019.

European Patent Office; Extended European Search Report regarding European Patent Application No. EP19164462.4, filed Mar. 21, 2019, dated Sep. 30, 2019.

European Patent Office; Extended European Search Report regarding European Patent Application No. EP19164440.0, filed Mar. 21, 2019, dated Oct. 1, 2019.

(56) References Cited

OTHER PUBLICATIONS

European Patent Office; Extended European Search Report regarding European Patent Application No. EP19164447.5, filed Mar. 21, 2019, dated Oct. 8, 2019.
European Patent Office; Extended European Search Report regarding European Patent Application No. EP19164465.7, filed Mar. 21, 2019, dated Oct. 4, 2019.
European Patent Office; Extended European Search Report regarding European Patent Application No. EP19164466.5, filed Mar. 21, 2019, dated Oct. 4, 2019.
European Patent Office; Extended European Search Report regarding European Patent Application No. EP19164454.1, filed Mar. 21, 2019, dated Oct. 7, 2019.
European Patent Office; Extended European Search Report regarding European Patent Application No. EP19164474.9, filed Mar. 21, 2019, dated Oct. 7, 2019.
European Patent Office; Extended European Search Report regarding European Patent Application No. EP19164458.2, filed Mar. 21, 2019, dated Oct. 8, 2019.
EPO acting as the International Searching Authority; International Search Report and Written Opinion in PCT/EP2020/057332; filed Mar. 17, 2020, dated Jun. 4, 2020.
European Patent Office; Extended European Search Report regarding European Patent Application No. EP19164457.4, filed Mar. 21, 2019, dated Oct. 1, 2019.
International Search Report and Written Opinion (PCT/EP2020/057288); Jul. 6, 2020; 9 pgs.
International Search Report and Written Opinion (PCT/EP2020/057332); Jun. 4, 2020; 14 pgs.
International Search Report and Written Opinion (PCT/EP2020/057320); Jul. 7, 2020; 8 pgs.
International Search Report and Written Opinion (PCT/EP2020/057331); May 11, 2020; 8 pgs.
International Search Report and Written Opinion (PCT/EP2020/057339); Jun. 3, 2020; 10 pgs.
International Search Report and Written Opinion (PCT/EP2020/057343); Jun. 15, 2020; 8 pgs.
International Search Report and Written Opinion (PCT/EP2020/057352); May 29, 2020; 12 pgs.
International Search Report and Written Opinion (PCT/EP2020/057303); Jun. 26, 2020; 12 pgs.
International Search Report and Written Opinion (PCT/EP2020/057310); Jul. 28, 2020; 8 pgs.
International Search Report and Written Opinion (PCT/EP2020/057314); Jun. 9, 2020; 7 pgs.
International Search Report and Written Opinion (PCT/EP2020/057316); May 29, 2020; 25 pgs.
European Patent Office, Extended European Search Report regarding European Patent Application No. 23177698.0, filed Mar. 17, 2020, dated Mar. 4, 2024.

* cited by examiner

AEROSOL DELIVERY SYSTEM

CROSS REFERENCE TO RELATED APPLICATIONS/INCORPORATION BY REFERENCE STATEMENT

This application is a non-provisional application claiming benefit to the international application no. PCT/EP2020/57288 filed on Mar. 17, 2020, which claims priority to EP 19164447.5 filed on Mar. 21, 2019. This application also claims benefit to the international application no. PCT/EP2020/57303 filed on Mar. 17, 2020, which claims priority to EP 19164454.1 filed on Mar. 21, 2019. This application also claims benefit to the international application no. PCT/EP2020/57310 filed on Mar. 17, 2020, which claims priority to EP 19164457.4 filed on Mar. 21, 2019. This application also claims benefit to the international application no. PCT/EP2020/57314 filed on Mar. 17, 2020, which claims priority to EP 19164440.0 filed on Mar. 21, 2019. This application also claims benefit to the international application no. PCT/EP2020/57316 filed on Mar. 17, 2020, which claims priority to EP 19164466.5 filed on Mar. 21, 2019. This application also claims benefit to the international application no. PCT/EP2020/57320 filed on Mar. 17, 2020, which claims priority to EP 19164458.2 filed on Mar. 21, 2019. This application also claims benefit to the international application no. PCT/EP2020/57331 filed on Mar. 17, 2020, which claims priority to EP 19164461.6 filed on Mar. 21, 2019. This application also claims benefit to the international application no. PCT/EP2020/57332 filed on Mar. 17, 2020, which claims priority to EP 19164462.4 filed on Mar. 21, 2019. This application also claims benefit to the international application no. PCT/EP2020/57339 filed on Mar. 17, 2020, which claims priority to EP 19164474.9 filed on Mar. 21, 2019. This application also claims benefit to the international application no. PCT/EP2020/57343 filed on Mar. 17, 2020, which claims priority to EP 19164448.3 filed on Mar. 21, 2019. This application also claims benefit to the international application no. PCT/EP2020/57352 filed on Mar. 17, 2020, which claims priority to EP 19164465.7 filed on Mar. 21, 2019. The entire contents of each of the above referenced applications are hereby incorporated herein by reference in their entirety.

FIELD OF THE DISCLOSURE

The present disclosure relates to an aerosol delivery system and an aerosol-generation apparatus for an aerosol delivery system. In particular, the present disclosure relates to an aerosol delivery system including a heater configured to heat an aerosol precursor to generate an aerosolized composition for inhalation by a user, and to an aerosol-generation apparatus therefor.

The present disclosure also relates to a fluid transfer article. In particular, the present disclosure relates to a fluid transfer article having a precursor with a viscosity profile such that it is retained in the fluid transfer article at 25° C. and may be drawn from the fluid transfer article when there is a lower pressure external to the fluid transfer article at higher temperatures.

BACKGROUND

Pharmaceutical medicament, physiologically active substances and flavorings for example may be delivered to the human body by inhalation through the mouth and/or nose. Such material or substances may be delivered directly to the mucosa or mucous membrane lining the nasal and oral passages and/or the pulmonary system. For example, nicotine is consumed for therapeutic or recreational purposes and may be delivered to the body in a number of ways. Nicotine replacement therapies are aimed at people who wish to stop smoking and overcome their dependence on nicotine. Nicotine is delivered to the body in the form of aerosol delivery devices and systems, also known as smoking-substitute devices or nicotine delivery devices. Such devices may be non-powered or powered.

Devices or systems that are non-powered may comprise nicotine replacement therapy devices such as "inhalators", e.g., Nicorette® Inhalator. These generally have the appearance of a plastic cigarette and are used by people who crave the behavior associated with consumption of combustible tobacco—the so-called hand-to-mouth aspect—of smoking tobacco. Inhalators generally allow nicotine-containing aerosol to be inhaled through an elongate tube in which a container containing a nicotine carrier, for example, a substrate, is located. An air stream caused by suction through the tube by the user carries nicotine vapors into the lungs of the user to satisfy a nicotine craving. The container may comprise a replaceable cartridge, which includes a cartridge housing and a passageway in the housing in which a nicotine reservoir is located. The reservoir holds a measured amount of nicotine in the form of the nicotine carrier. The measured amount of nicotine is an amount suitable for delivering a specific number of "doses". The form of the nicotine carrier is such as to allow nicotine vapor to be released into a fluid stream passing around or through the reservoir. This process is known as aerosolization and or atomization. Aerosolization is the process or act of converting a physical substance into the form of particles small and light enough to be carried on the air, i.e., into an aerosol. Atomization is the process or act of separating or reducing a physical substance into fine particles and may include the generation of aerosols. The passageway generally has an opening at each end for communication with the exterior of the housing and for allowing the fluid stream through the passageway. A nicotine-impermeable barrier seals the reservoir from atmosphere. The barrier includes passageway barrier portions for sealing the passageway on both sides of the reservoir. These barrier portions are frangible so as to be penetrable for opening the passageway to atmosphere.

A device or a system that is powered can fall into two sub-categories. In both subcategories, such devices or systems may comprise electronic devices or systems that permit a user to simulate the act of smoking by producing an aerosol mist or vapor that is drawn into the lungs through the mouth and then exhaled. The electronic devices or systems typically cause the vaporization of a liquid containing nicotine and entrainment of the vapor into an airstream. Vaporization of an element or compound is a phase transition from the liquid phase to vapor, i.e., evaporation or boiling. In use, the user experiences a similar satisfaction and physical sensation to those experienced from a traditional smoking or tobacco product, and exhales an aerosol mist or vapor of similar appearance to the smoke exhaled when using such traditional smoking or tobacco products. A person of ordinary skill in the art will appreciate that devices or systems of the second, powered category as used herein include, but are not limited to, electronic nicotine delivery systems, electronic cigarettes, e-cigarettes, e-cigs, vaping cigarettes, pipes, cigars, cigarillos, vaporizers and devices of a similar nature that function to produce an aerosol mist or vapor that is inhaled by a user. Such nicotine delivery devices or systems of the second category incorporate a liquid reservoir element generally including a vaporizer or misting element such as a heating element or other suitable element, and are known, inter alia, as atomizers, cartomizers, or clearomizers. Some electronic cigarettes are disposable; others are reusable, with replaceable and refillable parts.

Aerosol delivery devices or systems in a first sub-category of the second, powered category generally use heat and/or ultrasonic agitation to vaporize a solution comprising nicotine and/or other flavoring, propylene glycol and/or glycerin-based base into an aerosol mist of vapors for inhalation.

Aerosol delivery devices or systems in a second sub-category of the second, powered category may typically comprise devices or systems in which tobacco is heated rather than combusted. During use, volatile compounds may be released from the tobacco by heat transfer from the heat source and entrained in air drawn through the aerosol delivery device or system. Direct contact between a heat source of the aerosol delivery device or system and the tobacco heats the tobacco to form an aerosol. As the aerosol containing the released compounds passes through the device, it cools and condenses to form an aerosol for inhalation by the user. In such devices or systems, heating, as opposed to burning, the tobacco may reduce the odor that can arise through combustion and pyrolytic degradation of tobacco.

Aerosol delivery devices or systems falling into the first sub-category of powered devices or systems may typically comprise a powered unit, comprising a heater element, which is arranged to heat a portion of a carrier that holds an aerosol precursor. The carrier comprises a substrate formed of a "wicking" material, which can absorb aerosol precursor liquid from a reservoir and hold the aerosol precursor liquid. Upon activation of the heater element, aerosol precursor liquid in the portion of the carrier in the vicinity of the heater element is vaporized and released from the carrier into an airstream flowing around the heater and carrier. Released aerosol precursor is entrained into the airstream to be borne by the airstream to an outlet of the device or system, from where it can be inhaled by a user.

Typical aerosol precursors for aerosol delivery devices contain one or more solvents, and optionally one or more active ingredients and one or more additives. The one or more solvents are typically at least one non-aqueous solvent selected from one or both of a glycol and a glycerin. Typical active ingredients are nicotine and caffeine. Typical additives are scents, flavorings, colorings or efficacy enhancers.

Upon heating an aerosol precursor, the non-aqueous solvents therein form aerosol particles which the one or more active ingredients or one or more additives are bound to or dissolved in. The aerosol particles carry the one or more active ingredients or additives into the respiratory system of the user on inhalation. Setting the heating element to a lower temperature vaporizes the aerosol precursors to form a cooler, less dense aerosol cloud whereas setting the heating element to a higher temperature provides warmer, thicker aerosol clouds. Upon pulmonary administration, the one or more active ingredients bypass acid and bile in the stomach for expedited effect upon the central nervous system.

The heater element is typically a resistive coil heater, which is wrapped around a portion of the carrier and is usually located in the liquid reservoir of the device or system. Consequently, the surface of the heater may always be in contact with the aerosol precursor liquid, and long-term exposure may result in the degradation of either or both of the liquid and heater. Furthermore, residues may build up upon the surface of the heater element, which may result in undesirable toxicants being inhaled by the user. Furthermore, as the level of liquid in the reservoir diminishes through use, regions of the heater element may become exposed and overheat.

A smoking-substitute device is an electronic device that permits the user to simulate the act of smoking by producing an aerosol mist or vapor that is drawn into the lungs through the mouth and then exhaled. The inhaled aerosol mist or vapor typically bears nicotine and/or other flavorings without the odor and health risks associated with traditional smoking and tobacco products. In use, the user experiences a similar satisfaction and physical sensation to those experienced from a traditional smoking or tobacco product, and exhales an aerosol mist or vapor of similar appearance to the smoke exhaled when using such traditional smoking or tobacco products.

One approach for a smoking substitute device is the so-called "vaping" approach, in which a vaporizable liquid, typically referred to (and referred to herein) as "e-liquid", is heated by a heater to produce an aerosol vapor which is inhaled by a user. The e-liquid typically includes a base liquid as well as nicotine and/or flavorings. The resulting vapor therefore also typically contains nicotine and/or flavorings. The base liquid may include propylene glycol and/or vegetable glycerin.

A typical vaping smoking substitute device includes a mouthpiece, a power source (typically a battery), a tank for containing e-liquid, as well as a heater. In use, electrical energy is supplied from the power source to the heater, which heats the e-liquid to produce an aerosol (or "vapor") which is inhaled by a user through the mouthpiece.

Vaping smoking substitute devices can be configured in a variety of ways. For example, there are "closed system" vaping smoking substitute devices, which typically have a sealed tank and heating element. The tank is pre-filled with e liquid and is not intended to be refilled by an end user. One subset of closed system vaping smoking substitute devices includes a main body which includes the power source, wherein the main body is configured to be physically and electrically coupled to a consumable including the tank and the heater. The consumable may also be referred to as a cartomizer. In this way, when the tank of a consumable has been emptied, that consumable is disposed of. The main body can be reused by connecting it to a new, replacement, consumable. Another subset of closed system vaping smoking substitute devices is completely disposable, and intended for one-use only.

There are also "open system" vaping smoking substitute devices which typically have a tank that is configured to be refilled by a user. In this way the device can be used multiple times.

An example vaping smoking substitute device is the Myblu™ e-cigarette. The Myblu™ e cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid (also referred to as an aerosol precursor), as well as a heater, which for this device is a heating filament coiled around a portion of a wick. The wick is partially immersed in the e-liquid, and conveys e-liquid from the tank to the heating filament. The device is activated when a microprocessor on board the main body detects a user inhaling through the mouthpiece. When the device is activated, electrical energy is supplied from the power source to the heater, which heats e-liquid from the tank to produce a vapor which is inhaled by a user through the mouthpiece.

For a smoking substitute device, it is desirable to deliver nicotine into the user's lungs, where it can be absorbed into the bloodstream. As explained above, in the so-called "vaping" approach, "e-liquid" is heated by a heating device to produce an aerosol vapor which is inhaled by a user. Many e-cigarettes also deliver flavor to the user, to enhance the experience. Flavor compounds are contained in the e-liquid that is heated. Heating of the flavor compounds may be undesirable as the flavor compounds are inhaled into the user's lungs. Toxicology restrictions are placed on the amount of flavor that can be contained in the e-liquid. This can result in some e-liquid flavors delivering a weak and underwhelming taste sensation to consumers in the pursuit of safety.

In aerosol delivery devices, it is desirable to avoid large liquid droplets reaching a user's mouth.

The present disclosure has been devised in light of the above considerations.

SUMMARY OF THE DISCLOSURE

First Mode: An Aerosol-Generation Apparatus, Comprising a Fluid-Transfer Article Having an Activation Surface and Configured for Thermal Interaction with a Heating Surface At its most general, a first mode of the present disclosure proposes that an aerosol-generation apparatus is provided, which has a heater and a fluid-transfer article, with the fluid-transfer article having an activation surface at an end of the article and being configured for thermal interaction with a heating surface of the heater. The activation surface has at least one channel therein, which channel opposes the heating surface and is open towards the heating surface. The heater has a substrate and at least one heating element on a part of the substrate. The fluid-transfer article is positioned so that the or each channel faces a part of the substrate other than the part of the substrate of which the or each heating element is formed.

Thus, the or each heating element is not aligned with the or each channel. Instead, it is aligned with a part of the activation surface other than that the or each channel, so that the or each heating element is aligned with the part or parts of the activation surface which project towards the heater.

Thus, the present disclosure may provide an aerosol-generation apparatus comprising a heater and a fluid-transfer article, said fluid-transfer article having a first region for holding an aerosol precursor and for transferring said aerosol precursor to an activation surface of a second region of said article, said activation surface being disposed and configured for thermal interaction with a heating surface of said heater; said second region comprising at least one discontinuity in said activation surface to form a corresponding at least one channel between said second region and said heating surface and being configured such that, when the fluid transfer article is arranged with respect to said heating surface of the heater for thermal interaction therebetween, the or each said arcuate surface portion opposes said heating surface, opens towards said heating surface and provides an air-flow pathway across said heating surface wherein the heater comprises a substrate defining said heating surface, and at least one heating element formed on a part of said heating surface, and said at least one channel opposes a further part of said heating surface other than said part of said heating surface on which said heating element is formed.

The activation surface may be disposed at an end of the fluid-transfer article. Optionally, said activation surface is configured such that, when the fluid transfer article is arranged with respect to a said heating surface for thermal interaction therebetween, the or each said discontinuity is spaced apart from said heating surface.

Advantageously, the or each said channel is at least partly defined by a pair of spaced apart side walls, and an arcuate surface portion extending between said wall portions to form a ceiling portion of said channel.

Optionally, said arcuate surface portion blends smoothly with each of said side walls, thereby eliminating a sharp corner therebetween.

Alternatively, the or each channel may be at least partially defined by a pair of spaced apart side walls and a flat surface portion, said flat surface portion extending between said wall portions to form a ceiling portion of said channel. A further possibility is that the or each channel is at least partially defined by a pair of side walls, said side walls being inclined relative to each other to meet an apex portion of said channel.

Conveniently, said side walls are substantially planar.

Conveniently, at least said second region is formed from a polymeric wicking material.

Advantageously, said first and second regions are both formed from said polymeric wicking material.

Optionally, said polymeric wicking material is porous.

Conveniently, said polymeric wicking material is configured such that pore diameter in said first region is greater than pore diameter in said second region.

Advantageously, said polymeric wicking material is heat resistant.

Optionally, said polymeric wicking material is a hydrophilic material that is configured to transfer fluid from said first region to said second region.

Conveniently, said polymeric wicking material is of greater hydrophilicity in said second region than said first region.

According to another aspect of the first mode of the present disclosure, there may be provided an aerosol delivery system comprising an aerosol-generation apparatus as discussed above, and a carrier, which carrier has a housing containing the heater and the fluid-transfer article.

Preferably, the housing has an inlet and an outlet, with the air-flow pathway extending between the inlet and outlet.

The disclosure includes the combination of the aspects and preferred features of the first mode described except where such a combination is clearly impermissible or expressly avoided.

The skilled person will appreciate that except where mutually exclusive, a feature or parameter described in relation to any one of the above aspects of the first mode may be applied to any other aspect of the first mode. Furthermore, except where mutually exclusive, any feature or parameter of the first mode described herein may be applied to any aspect and/or combined with any other feature or parameter of the first mode described herein.

Second Mode: An Aerosol-Generation Apparatus has a Fluid-Transfer Article which Holds and Transfers Aerosol Precursor to an Activation Surface At its most general, a second mode of the present disclosure proposes that an aerosol-generation apparatus has a fluid-transfer article which holds aerosol precursor and which transfers that aerosol precursor to an activation surface. That activation surface is proximate but spaced from a heater of the aerosol-generation apparatus, so that an air-flow pathway is defined between the activation surface and the heater. At least that part of the fluid-transfer article forming the activation surface is made from a porous polymer material. Thus, unlike arrangements in which the heater is brought in to direct contact with the activation surface, the present disclosure has a space therebetween such that the activation surface and the heater do not make contact with one another. The present disclosure also uses porous polymer material to form the part of the fluid-transfer article forming the activation surface. It is part which has a wicking action.

Thus, according to the present disclosure, there may be provided an aerosol-generation apparatus comprising a heater and a fluid-transfer article, the fluid-transfer article comprising a first region for holding an aerosol precursor and for transferring said aerosol precursor to an activation surface of a second region of said fluid-transfer article, said second region being formed from a porous polymer material, said activation surface facing said heater with a space therebetween so as to interact thermally with said heater, said space defining an air-flow pathway between said activation surface said heater.

Said activation surface may be proximate but spaced from said heater.

Optionally, said activation surface may be disposed at an end of said fluid-transfer article.

Optionally, said activation surface and said heater are substantially equi-spaced apart across their entire extent. Said activation surface and said heater may comprise complimentary profiles.

The porous polymer material may comprise Polyetherimide (PEI) and/or Polyether ether ketone (PEEK) and/or Polytetrafluoroethylene (PTFE) and/or Polyimide (PI) and/or Polyethersulphone (PES) and/or Ultra-High Molecular Weight Polyethylene (UHMWPE) and/or Polypropylene (PP) and/or Polyethylene Terephthalate (PET). The aerosol-generation apparatus may form part of an aerosol delivery system which has a carrier and include a housing containing the heater and the fluid-transfer apparatus. The housing may have an inlet and outlet, with the air-flow pathway extending to the inlet and outlet.

The disclosure includes the combination of the aspects and preferred features of the second mode described except where such a combination is clearly impermissible or expressly avoided.

Third Mode: An Aerosol Generation Apparatus has a Fluid-Transfer Article with a First Region which Holds an Aerosol Precursor At its most general, a third mode of the present disclosure proposes that an aerosol generation apparatus has a fluid-transfer article with a first region which holds an aerosol precursor, the first region being arranged to transfer the aerosol precursor to a second region of the fluid-transfer article. That second region has two parts of different materials, one part being adjacent to the first region and the second part being of a material resistant to higher temperatures than the material of the first part. The first part has a plurality of holes therein and the second part extends across those holes so that aerosol precursor in the holes will pass to the second part of the second region. The second part is porous for passage therethrough of the aerosol precursor from the holes to an activation surface.

The aerosol-generation apparatus also has a heater, which heater is positioned relative to the activation surface so as to interact thermally therewith. In particular, the heater may be mounted proximate but spaced from the activation surface. An air-flow pathway may thus be defined between the heater and the activation surface. The heater and the fluid-transfer article (and specifically the activation surface of the fluid-transfer article) are separable.

The separability of the fluid-transfer article and the heater means that it is possible to replace the fluid-transfer article without having to replace the heater. Since the aerosol precursor will be consumed when the apparatus is used by a user, it will normally be necessary to replace or at least refill the fluid-transfer article periodically, as it acts as a reservoir for the aerosol precursor.

The two different materials of the second region of the fluid-transfer article allow one (the material of the second part) to be adapted to the heater, whilst the other (the material of the first part) may be a lower cost material.

As mentioned above the first part of the second region has a plurality of holes therein. Those holes do not act as capillaries, but instead may be of a size or sizes so that they cooperate with the second part of the second region to define non-capillary spaces in the second region in to which the aerosol precursor is able to flow. Thus, the aerosol precursor may pass from the first region in a non-capillary manner into the holes, and impinge on the second part of the second region. It may then pass through the second part due to the porous nature of the second part.

The second region of the fluid-transfer article may thus act as a wick, to cause aerosol precursor to move from the first region to the activation surface where it may be heated by the heater. The wick may have a two-layer structure, formed by the two parts of the second region. One of those parts is preferably being made of an inexpensive material through which the holes pass, and the second part is of a more heat resistant material, which will interact with the heater at the activation surface. Aerosol precursor will be drawn through the second region, partly because the holes will fill with aerosol precursor, and partly because of the porous nature of the second part of the second region.

Thus, according to the third mode of the present disclosure, there may be provided an aerosol-generation apparatus comprising a heater, and a fluid-transfer article, said fluid-transfer article comprising a first region for holding an aerosol precursor and for transferring said aerosol precursor to a second region of said fluid-transfer article, said second region comprising a first part of a first material, said first part being adjacent said first region and having a plurality of holes therein, and a second part of a second material different from the first material and being resistant to higher temperatures than said first material, said second part being adjacent to said first part and extending across said plurality of holes in said first part; wherein said plurality of holes are sized so that they cooperate with said second part of said second region to define non-capillary spaces in said second region into which said aerosol precursor is able to flow from said first region in a non-capillary manner, thereby to impinge on said second part; wherein said second part of said second region is porous for passage therethrough of said aerosol precursor from said plurality of holes to an activation surface of said second region, said activation surface being disposed so as to interact thermally with said heater, wherein said heater is mounted proximate but spaced from said activation surface to define an air-flow pathway between said heater and said activation surface, and wherein said heater and said fluid-transfer article are separable.

Optionally, said plurality of holes are sufficiently large so that they cooperate with said second part of said second region to define non-capillary spaces in said second region.

The heater is preferably a coil, mesh or foil.

Preferably, the spacing between the activation surface and the heater is between 0.5 mm and 0.05 mm.

Preferably, said first part of said second region is formed of a solid polymer material having said plurality of holes therein.

It is usually preferable that said second part of said second region is formed of fibrous material. That fibrous material may be ceramic fiber, glass fiber or carbon fiber. Alternatively, the second part of the second region may be porous glass or porous ceramic. Another possibility is that the second part of the second region is of a porous polymer material. Another possibility is for the first region of the fluid-transfer article to be a simple reservoir filled with liquid aerosol precursor, from which reservoir the liquid flows into the holes in the first part of the second region of the fluid-transfer article.

Preferably, the plurality of holes are molded holes. As mentioned above, it is desirable that the first part of the second region is formed of solid polymer material and it is convenient to mold the holes at the same time that the first part itself is molded.

The fluid-transfer article may act as a reservoir for aerosol precursor. One option is for the first region of said fluid-transfer article to be of porous polymer material.

The porous polymer material of the first region may comprise Polyetherimide (PEI) and/or Polyether ether ketone (PEEK) and/or Polytetrafluoroethylene (PTFE) and/or Polyimide (PI) and/or Polyethersulphone (PES) and/or Ultra-High Molecular Weight Polyethylene (UHMWPE) and/or Polypropylene (PP) and/or Polyethylene Terephthalate (PET). Similar materials may be used for the second part of the second region when that second region is made of a porous polymer material, as mentioned above.

Alternatively, the first region of the fluid-transfer article may be a tank defining a hollow reservoir which is filled with aerosol precursor when the apparatus is to be used.

The aerosol-generation apparatus may form part of an aerosol delivery system which has a carrier which includes a housing containing the fluid-transfer article. The aerosol delivery system may then include a further housing supporting the heater. The housing and the further housing may be mutually separable, to allow the carrier to be removed from the rest of the aerosol delivery system.

The further housing may have an inlet with the air-flow pathway extending to the inlet.

According to another aspect of the third mode of the present disclosure, there is provided an aerosol-generation apparatus comprising a heater, and a fluid-transfer article, said fluid-transfer article comprising a first region for holding an aerosol precursor and for transferring said aerosol precursor to a second region of said fluid-transfer article, said second region comprising a first part of a first material, said first part being adjacent said first region and having a plurality of holes therein, and a second part of a second material different from the first material and being resistant to higher temperatures than said first material, said second part being adjacent to said first part and extending across said plurality of holes in said first part; wherein said second part of said second region is porous for passage therethrough of said aerosol precursor from said plurality of holes to an activation surface of said second region, said activation surface being disposed so as to interact thermally with said heater; wherein said plurality of holes are sufficiently large so that they cooperate with said second part of said second region to define non-capillary spaces in said second region into which said aerosol precursor is able to flow from said first region in a non-capillary manner, thereby to impinge on said second part, and wherein said heater is mounted proximate but spaced from said activation surface to define an air-flow pathway between said heater and said activation surface, and wherein said heater and said fluid-transfer article are separable.

The disclosure includes the combination of the aspects and preferred features of the third mode described except where such a combination is clearly impermissible or expressly avoided.

Fourth Mode: An Aerosol Generation Apparatus has a Fluid-Transfer Article which Holds Aerosol Precursor and which Transfers that Aerosol Precursor to a Transfer Surface At its most general, a fourth mode of the present disclosure proposes that an aerosol generation apparatus has a fluid-transfer article which holds aerosol precursor and which transfers that aerosol precursor to a transfer surface. The fluid-transfer article is mounted adjacent (e.g., in contact with) a heater, so that the transfer surface is the closest part of the fluid-transfer article to the heater. The heater has a porous element, which allows aerosol precursor to pass from the transfer surface into the heater. The porous element has an activation surface on the opposite side of the porous element from the fluid-transfer article, on which activation surface is mounted at least one heating element for heating aerosol precursor which has reached the activation surface.

The separability of the fluid-transfer article and the heater means that the fluid-transfer article can be replaced without having to replace the heater. Since the aerosol precursor will be consumed when the apparatus is used by a user, it may be necessary to replace the fluid-transfer article, which acts as a reservoir for the aerosol precursor. The heater may remain and need not be replaced when the aerosol precursor is consumed.

The heater element or elements are normally mounted directly on the activation surface of the porous element of the heater. In such an arrangement, there will normally be an air-flow pathway adjacent the activation surface of the heater, so that vapor or aerosol/vapor mixture released from the activation surface by the heating effect of the heating element or elements may mix with the air-flow and pass to the user.

In such an arrangement, the air flow may have the effect of pulling liquid through the porous element from the fluid-transfer article onto the activation surface of the heater. This effect is assisted by the heating of the aerosol precursor by the heating element or elements, which causes the aerosol precursor to be liberated from the porous element as vapor or a vapor/aerosol mixture, thereby creating a flow of aerosol precursor through the porous heater.

Thus, according to the fourth mode of the present disclosure, there may be provided an aerosol-generation apparatus comprising a heater and a fluid-transfer article, said fluid-transfer article comprising a first region for holding an aerosol precursor and for transferring said aerosol precursor to a transfer surface of said fluid-transfer article, the heater comprising a porous element adjacent to but separable from said transfer surface of said fluid-transfer article and at least one heating element on an activation surface of said porous element, which activation surface is on the opposite side of the porous element from the fluid-transfer article.

Preferably, said heating element or elements are mounted on said activation surface. The heating element or elements are then preferably coil, mesh or foil. There may be an air-flow pathway adjacent the activation surface.

The transfer surface of the fluid-transfer article may be planar, with the heater having a matching planar surface adjacent thereto. Thus, it is straightforward for aerosol precursor to pass from the transfer surface to the heater. Alternatively, the transfer surface and the adjacent surface of the heater may be convoluted, with a convolution to the transfer surface and the convolutions of the heater surface matching to provide mutual engagement. For example, the heater may have upwardly protruding triangular or conical projections that fit inside corresponding triangular or conical recesses in the transfer surface. Castellated and sinusoidal arrangements are also possible. Such convoluted arrangements have the advantage that they increase the surface area for liquid transfer between the transfer surface and the heater, although they require more manufacturing to achieve good mutual engagement.

The fluid-transfer article may act as a reservoir for aerosol precursor. Preferably, said first region of fluid-transfer article is of porous polymer material. The porous element of the heater may also be formed from porous polymer material. Alternatively, the porous element of the heater may be of fibrous material, such as ceramic fiber, glass fiber or carbon fiber, or from porous glass or porous ceramic.

The porous polymer material may comprise Polyetherimide (PEI) and/or Polyether ether ketone (PEEK) and/or Polytetrafluoroethylene (PTFE) and/or Polyimide (PI) and/or Polyethersulphone (PES) and/or Ultra-High Molecular Weight Polyethylene (UHMWPE) and/or Polypropylene (PP) and/or Polyethylene Terephthalate (PET).

The aerosol-generation apparatus may form part of an aerosol delivery system which has a carrier which includes a housing containing the fluid-transfer apparatus. There may then be a further housing containing the heater, with the housing and the further housing being separable. The further housing may have an inlet and outlet, with the air-flow pathway extending to the inlet and outlet.

The further housing may have a plate which is spaced from the activation of the porous structure of the heater, with the air-flow pathway passing between the activation surface and the plate.

The plate may have a plurality of recesses in its surface facing the activation surface, with the air-flow pathway passing through the recesses.

The disclosure includes the combination of the aspects and preferred features of the fourth mode described except where such a combination is clearly impermissible or expressly avoided.

Fifth Mode: A Fluid Transfer Article Comprising a First Region Having an Aerosol Precursor and for Transferring Said Aerosol Precursor to an Activation Surface of a Second Region of Said Article In a first aspect of a fifth mode the present disclosure there is provided a fluid transfer article comprising a first region having an aerosol precursor and for transferring said aerosol precursor to an activation surface of a second region of said article, said activation surface being disposed at an end of said article configured for thermal interaction with a heater of an aerosol-generation apparatus, and the aerosol precursor having a first dynamic viscosity in an unheated state and a lower second dynamic viscosity in a heated state, wherein in the unheated state the aerosol precursor is substantially retained in the fluid transfer article, both at atmospheric pressure and when a pressure below atmospheric pressure is applied; and in the heated state the aerosol precursor is substantially drawn from the activation surface of said article when a pressure below atmospheric pressure is applied. Advantageously, this combination of features provides a fluid transfer article that does not substantially leak excess aerosol precursor when heated by a heating element.

Preferably, in the heated state, the aerosol precursor at the activation surface is at about 25° C., such as 20° C. or 30° C.

Preferably, in the heated state, the aerosol precursor is substantially retained in said article at atmospheric pressure. Advantageously, the fluid aerosol precursor and transfer article are so configured as to prevent passive leaking of the aerosol precursor when the fluid transfer article is in use.

Preferably, the aerosol precursor has a first dynamic viscosity in the unheated state of from 0.05 to 1.5 Pa-s. Advantageously, this viscosity profile provides good retention of the aerosol precursor in the fluid transfer article under ambient conditions.

Preferably, the aerosol precursor has a second dynamic viscosity, in a heated state, of from 0.01 to less than 0.05 Pa-s. Advantageously, this viscosity profile allows flow of the aerosol precursor from the fluid transfer article under heated conditions.

Preferably, the temperature difference between the unheated state and the heated state is 10° C. or more. Preferably, the temperature difference is 25° C. or more, such as 50° C. or more or 100° C. or more. Advantageously, this reduces the heat and/or time required to manipulate the aerosol precursor between the ambient retention state and the heated mobile state.

Preferably, the temperature at the activation surface in the heated state is 35 or more, such as 50° C., 75° C. or 100° C. or more. Advantageously, this reduces the heat and/or time required to manipulate the aerosol precursor between the ambient retention state and the heated mobile state.

Preferably, the pressure below atmospheric pressure is 0.7 atm to <1 atm. Advantageously, this lower external pressure draws aerosol precursor at the second dynamic viscosity from the fluid transfer article.

Preferably, 99% or more of the aerosol precursor is retained by the fluid transfer article when kept in the unheated state at 1 atm for 30 days. Advantageously, the fluid transfer article shows excellent retention of the aerosol precursor at ambient pressure and temperature.

Preferably, a fluid transfer article according to any one of the preceding claims wherein 99% or more of the aerosol precursor is retained by the fluid transfer article when kept in the unheated state at 0.8 atm for 24 hours. Advantageously, the fluid transfer article shows excellent retention of the aerosol precursor under a mild vacuum at ambient temperature.

Preferably, the first and second regions are porous. Advantageously, this contributes to improved control of the aerosol precursor within the fluid transfer article.

Preferably, the first and second regions each have a mean pore diameter of 250 μm or less, preferably 200 μm or less, more preferably 150 μm or less, more preferably 100 μm or less, more preferably 1 to 90 μm, more preferably 2 to 80 μm, more preferably 5 to 70 μm, more preferably 10 to 50 μm, more preferably 20 to 40 μm, more preferably 25 to 35 μm, more preferably 28 to 32 μm. Advantageously, such pore sizes contribute to improved control of the aerosol precursor within the fluid transfer article.

Preferably, the pore diameter in the first region is greater than the pore diameter in the second region. Advantageously, this allows increased amounts of aerosol precursor in the first region while the second region exposed towards the heater controls delivery of the aerosol precursor out of the fluid transfer article.

Optionally, the first and second regions, in accordance with various aspects of the fifth mode of the present disclosure, have pores with substantially the same spherical geometry and the pore size is the diameter of the largest cross-section for any particular pore space. For example, known porous materials applied in this field typically do not vary by more than about 15% from a mean size.

Determining average pore size can be done using various measuring instruments which are capable of accurately measuring pore size. For example, one instrument used to measure pore size and pore volume is the Mercury Intrusion Porosimeter.

Preferably, the first region is enclosed by the second region. Advantageously, this controls the delivery of the aerosol out of the fluid transfer article in all directions, for instance, when it is freestanding and not incorporated in any other device.

Preferably, the first region has a void volume ratio of 25 to 60%, preferably 26 to 50%, more preferably 27 to 40%, more preferably 28 to 35% more preferably 29 to 30%. Advantageously, this contributes to improved control of the aerosol precursor within the fluid transfer article.

Advantageously, pore diameters and/or void volume ratios are selected to obtain effective control of delivery of the aerosol to the air, maintain structural integrity of the relevant regions and prevent clogging.

Advantageously, larger pore sizes and/or high void volumes provide more storage capacity an excellent precursor aerosol transport kinetics. However, too large pore sizes or void volumes cause leaking upon inversion of the reservoir and also have less capacity for capillary transport of the liquid from the reservoir.

Advantageously, smaller pore sizes and/or low void volumes are more resistant to leakage and provide excellent structural integrity. However, too small pore sizes or void volumes result in poor aerosol precursor transport kinetics.

Advantageously, the first and second regions together have excellent wicking properties such that, when in use, the heating element of an aerosol-generation apparatus forms a temperature gradient throughout the fluid transfer article having a lower temperature distal to the heating element, such that the viscosity of aerosol precursor not proximal to the heating element is also lowered (at a temperature between the heated and unheated state) and is drawable towards the heating element to replace the aerosol precursor at the activation surface, adjacent to the heating element.

Preferably, the aerosol precursor comprises one or more solvents selected from water, propylene glycol, 1,3-butanediol, 1,3-propanediol, ethylene glycol, diethylene glycol and vegetable glycerin. Advantageously, this contributes to improved control of the aerosol precursor within the fluid transfer article.

Preferably, the aerosol precursor comprises 60 to 80% vegetable glycerin and 20 to 40% propylene glycol. Advantageously, vegetable glycerin forms a vapor that gives the impression of cigarette smoke. Vegetable glycerin also has a relatively higher dynamic viscosity that can contribute to retention of the aerosol precursor in the fluid transfer article in the unheated state.

Preferably, the aerosol precursor comprises 20 to 40% vegetable glycerin and 60 to 80% propylene glycol. Advantageously, propylene glycol vaporizes at a lower temperature than vegetable glycerin. Furthermore, an aerosol precursor having more propylene glycol than vegetable glycerin has a higher wicking rate, capillary efficiency, evaporates easier and provides less vapor. Propylene glycol also has a relatively lower dynamic viscosity that can contribute to mobility of the aerosol precursor in the heated state.

Preferably, the fluid transfer article is provided with a carrier comprising a housing containing said fluid-transfer article.

Preferably, there is an aerosol generation apparatus comprising the fluid transfer article of the first aspect of the fifth mode of the disclosure, the aerosol generation apparatus comprising a heater wherein said heater contacts the activation surface of the fluid transfer article so as to interact thermally with said activation surface; and wherein said heater and said activation surface are separable.

Preferably, there is provided a smoking substitute device comprising a fluid transfer article according to the first aspect of the fifth mode of the disclosure.

In a second aspect of the fifth mode, there is provided use of a fluid transfer article according to the first aspect of the fifth mode of the disclosure in a substitute smoking device.

Optionally, the aerosol generation apparatus has a fluid-transfer article according to the first aspect of the fifth mode of the disclosure. Optionally, the second region of the aerosol generation apparatus has two parts of different materials, one part being adjacent to the first region and the second part being of a material resistant to higher temperatures than the material of the first part. The first part has a plurality of holes therein and the second part extends across those holes so that aerosol precursor in the holes will pass to the second part of the second region. The second part is porous for passage therethrough of the aerosol precursor from the holes to an activation surface.

The aerosol-generation apparatus also has a heater, which heater contacts the activation surface so as to interact thermally therewith. The heater is not bonded to the activation surface, instead it may make abutting unbonded contact so that the heater and the activation surface are separable.

The separability of the fluid-transfer article and the heater means that it is possible to replace the fluid-transfer article without having to replace the heater. Since the aerosol precursor will be consumed when the apparatus is used by a user, it will normally be necessary to replace or at least refill the fluid-transfer article periodically, as it acts as a reservoir for the aerosol precursor.

The two different materials of the second region of the fluid-transfer article allow one (the material of the second part) to be adapted to the heater, whilst the other (the material of the first part) may be a lower cost material.

As mentioned above the first part of the second region has a plurality of holes therein. Those holes do not act as capillaries, but instead may be of a size or sizes so that they cooperate with the second part of the second region to define non-capillary spaces in the second region in to which the aerosol precursor is able to flow. Thus, the aerosol precursor may pass from the first region in a non-capillary manner into the holes, and impinge on the second part of the second region. It may then pass through the second part due to the porous nature of the second part.

The heater is mounted in contact with the activation surface of the second region. In such an arrangement, there will normally be an air-flow pathway adjacent at least part of the activation surface, so that vapor or aerosol/vapor mixture released from the activation surface by the heating effect of the heater may mix with the air-flow and pass to the user. Furthermore, in such an arrangement, the air-flow pathway will normally pass on the opposite side of the heater from the activation surface.

The second region of the fluid-transfer article may thus act as a wick, to cause aerosol precursor to move from the first region to the activation surface where it may be heated by the heater. The wick may have a two-layer structure, formed by the two parts of the second region. One of those parts is preferably being made of an inexpensive material through which the holes pass, and the second part is of a more heat resistant material, which will interact with the heater at the activation surface. Aerosol precursor will be drawn through the second region, partly because the holes will fill with aerosol precursor, and partly because of the porous nature of the second part of the second region.

Optionally, there may be provided an aerosol-generation apparatus comprising a heater and a fluid-transfer article according to the first aspect of the fifth mode of the disclosure, said second region of the fluid-transfer article comprising a first part of a first material, said first part being adjacent said first region and having a plurality of holes therein, and a second part of a second material different from the first material and being resistant to higher temperatures than said first material, said second part being adjacent to said first part and extending across said plurality of holes in said first part; wherein said plurality of holes are sized so that they cooperate with said second part of define non-capillary spaces in said second region into which said aerosol precursor is able to flow from said first region in a non-capillary manner thereby to impinge on said second part; wherein said second part of said second region is porous for passage therethrough of said aerosol precursor from said plurality of holes to an activation surface of said second region; wherein said heater contacts said activation surface so as to interact thermally with said activation surface; and wherein said heater and said activation surface are separable.

The heater is preferably a coil, mesh or foil. There may then be an air-flow pathway adjacent at least a part of the activation surface. Since the heater is in contact with the activation surface, a part of said air-flow pathway may be on the opposite of the heater from the activation surface.

Preferably, said first part of said second region is formed of a solid polymer material having said plurality of holes therein.

It is usually preferable that said second part of said second region is formed of fibrous material. That fibrous material may be ceramic fiber, glass fiber or carbon fiber. Alternatively, the second part of the second region may be porous glass or porous ceramic. Another possibility is that the second part of the second region is of a porous polymer material. Another possibility is for the first region of the fluid-transfer article to be a simple reservoir filled with liquid aerosol precursor, from which reservoir the liquid flows into the holes in the first part of the second region of the fluid-transfer article.

Preferably, the plurality of holes are molded holes. As mentioned above, it is desirable that the first part of the second region is formed of solid polymer material and it is convenient to mold the holes at the same time that the first part itself is molded.

The fluid-transfer article may act as a reservoir for aerosol precursor. One option is for the first region of said fluid-transfer article to be of porous polymer material.

The porous polymer material of the first region may comprise Polyetherimide (PEI) and/or Polyether ether ketone (PEEK) and/or Polytetrafluoroethylene (PTFE) and/or Polyimide (PI) and/or Polyethersulphone (PES) and/or Ultra-High Molecular Weight Polyethylene (UHMWPE) and/or Polypropylene (PP) and/or Polyethylene Terephthalate (PET). Similar materials may be used for the second part of the second region when that second region is made of a porous polymer material, as mentioned above.

Alternatively, the first region of the fluid-transfer article may be a simple hollow reservoir which is filled with aerosol precursor when the apparatus is to be used.

The aerosol-generation apparatus may form part of an aerosol delivery system which has a carrier which includes a housing containing the fluid-transfer article. The aerosol delivery system may then include a further housing supporting the heater. The housing and the further housing may be mutually separable, to allow the carrier to be removed from the rest of the aerosol delivery system.

The further housing may have an inlet with the air-flow pathway extending to the inlet. It may also have a plate mounted in the further housing at a position spaced from the heater so that the air-flow pathway passes between the activation surface and the plate. The plate may optionally have a plurality of recesses in its surface facing the activation surface with the air-flow pathway passing through said recesses.

The disclosure includes the combination of the aspects and preferred features of the fifth mode described except where such a combination is clearly impermissible or expressly avoided.

Sixth Mode: An Aerosol Generation Apparatus has a Fluid-Transfer Article with a First Region which Holds an Aerosol Precursor At its most general, a sixth mode of the present disclosure proposes that an aerosol generation apparatus has a fluid-transfer article with a first region which holds an aerosol precursor, the first region being arranged to transfer the aerosol precursor to a second region of the fluid-transfer article. That second region has two parts of different materials, one part being adjacent to the first region and the second part being of a material resistant to higher temperatures than the material of the first part. The first part has a plurality of holes therein and the second part extends across those holes so that aerosol precursor in the holes will pass to the second part of the second region. The second part is porous for passage therethrough of the aerosol precursor from the holes to an activation surface.

The second part of the second region has one or more recesses therein opening towards the heater and forming one or more gaps between the activation surface and the heater. The one or more gaps then form at least one air-flow pathway along the activation surface. The gaps may thus form channels in the second part of the second region at the activation surface, along which air may flow.

The aerosol-generation apparatus also has a heater, which heater preferably contacts a part of the activation surface so as to interact thermally therewith. The heater is not bonded to the activation surface, instead it may make abutting unbonded contact so that the heater and the activation surface are separable. Alternatively, the heater may be spaced from the activation surface.

The separability of the fluid-transfer article and the heater means that it is possible to replace the fluid-transfer article without having to replace the heater. Since the aerosol precursor will be consumed when the apparatus is used by a user, it will normally be necessary to replace or at least refill the fluid-transfer article periodically, as it acts as a reservoir for the aerosol precursor.

The two different materials of the second region of the fluid-transfer article allow one (the material of the second part) to be adapted to the heater, whilst the other (the material of the first part) may be a lower cost material.

As mentioned above the first part of the second region has a plurality of holes therein. Preferably, those holes do not act as capillaries, but instead may be of a size or sizes so that they cooperate with the second part of the second region to define non-capillary spaces in the second region in to which the aerosol precursor is able to flow. Thus, the aerosol precursor may pass from the first region in a non-capillary manner into the holes, and impinge on the second part of the second region. It may then pass through the second part due to the porous nature of the second part.

The second region of the fluid-transfer article may thus act as a wick, to cause aerosol precursor to move from the first region to the activation surface where it may be heated by the heater. The wick may have a two-layer structure, formed by the two parts of the second region. One of those parts is preferably being made of an inexpensive material through which the holes pass, and the second part is of a more heat resistant material, which will interact with the heater at the activation surface. Aerosol precursor will be drawn through the second region, partly because the holes will fill with aerosol precursor, and partly because of the porous nature of the second part of the second region.

Thus, according to the sixth mode of the present disclosure, there may be provided an aerosol-generation apparatus comprising a heater, and a fluid-transfer article, said fluid-transfer article comprising a first region for holding an aerosol precursor and for transferring said aerosol precursor to a second region of said fluid-transfer article, said second region comprising a first part of a first material, said first part being adjacent said first region and having a plurality of holes therein, and a second part of a second material different from the first material and being resistant to higher temperatures than said first material, said second part being adjacent to said first part and extending across said plurality of holes in said first part; wherein said second part of said second region is porous for passage therethrough of said aerosol precursor from said plurality of holes to an activation surface of said second region; said activation surface being disposed to as to interact thermally with said heater, and wherein said second part of said second region has at least one recess therein opening towards said heater, said at least one recess forming at least one gap between said activation surface and said heater, said at least one gap forming at least one air-flow pathway along said activation surface.

Preferably, said heater is mounted so as to be in contact with at least one part of said activation surface. Then, it is preferable that said heater and said activation surface are separable.

In the sixth mode of the present disclosure, it is normally desirable that said plurality of holes are sized to that they cooperate with said second part of said second region to define non-capillary spaces in said second region into which said aerosol precursor is able to flow from said first region in a non-capillary manner, thereby to impinge on said second part of said second region.

The heater is preferably a coil, mesh or foil.

Preferably, said first part of said second region is formed of a solid polymer material having said plurality of holes therein.

It is usually preferable that said second part of said second region is formed of fibrous material. That fibrous material may be ceramic fiber, glass fiber or carbon fiber. Alternatively, the second part of the second region may be porous glass or porous ceramic. Another possibility is that the second part of the second region is of a porous polymer material. Another possibility is for the first region of the fluid-transfer article to be a simple reservoir filled with liquid aerosol precursor, from which reservoir the liquid flows into the holes in the first part of the second region of the fluid-transfer article.

Preferably, the plurality of holes are molded holes. As mentioned above, it is desirable that the first part of the second region is formed of solid polymer material and it is then convenient to mold the holes at the same time that the first part itself is molded.

The fluid-transfer article may act as a reservoir for aerosol precursor. One option is for the first region of said fluid-transfer article to be of porous polymer material.

The porous polymer material of the first region may comprise Polyetherimide (PEI) and/or Polyether ether ketone (PEEK) and/or Polytetrafluoroethylene (PTFE) and/or Polyimide (PI) and/or Polyethersulphone (PES) and/or Ultra-High Molecular Weight Polyethylene (UHMWPE) and/or Polypropylene (PP) and/or Polyethylene Terephthalate (PET). Similar materials may be used for the second part of the second region when that second region is made of a porous polymer material, as mentioned above.

Alternatively, the first region of the fluid-transfer article may be a simple hollow reservoir which is filled with aerosol precursor when the apparatus is to be used.

The aerosol-generation apparatus may form part of an aerosol delivery system which has a carrier which includes a housing containing the fluid-transfer article. The aerosol delivery system may then include a further housing supporting the heater. The housing and the further housing may be mutually separable, to allow the carrier, and hence the fluid-transfer article, to be removed from the rest of the aerosol delivery system.

The further housing may have an inlet with the air-flow pathway extending to the inlet.

The disclosure includes the combination of the aspects and preferred features of the sixth mode described except where such a combination is clearly impermissible or expressly avoided.

Seventh Mode: An Aerosol-Generation Apparatus has a Heater and a Fluid-Transfer Article for Holding an Aerosol Precursor At its most general, a seventh mode of the present disclosure proposes that an aerosol-generation apparatus has a heater and a fluid-transfer article for holding an aerosol precursor. A heating surface of the heater has at least one channel therein which opposes the fluid-transfer article. Normally, the fluid-transfer article will be arranged to transfer the aerosol precursor to an activation surface, and it is that activation surface of the fluid-transfer article which interacts with the heating surface. The channel may thus be open towards the activation surface.

Thus, the channel may define a spacing between part of the heating surface and the activation surface, through which spacing air can flow. It may thus form an air-flow pathway. Aerosol precursor which reaches the activation surface may then be heated by the heater, to form a vapor or a vapor/aerosol mixture. That vapor or mixture may then mix with air in the air-flow pathway to pass to the user.

Optionally, there may be a plurality of such channels, which plurality of channels forms the air-flow pathway.

Thus, according to a first aspect of the seventh mode of the present disclosure, there may be provided an aerosol-generation apparatus comprising a heater and a fluid-transfer article, the fluid-transfer article having a first region for holding an aerosol precursor and for transferring said aerosol precursor to an activation surface of a second region of said article, said activation surface being configured for thermal interaction with a heating surface of said heater; said heating surface including at least one discontinuity therein forming a corresponding at least one channel, the or each said channel being configured for providing a fluid-flow pathway across said activation surface, said heater being configured such that, when the fluid transfer article is arranged with respect to said heating surface for thermal interaction therebetween, the or each said channel opposes said activation surface and opens towards said activation surface.

The activation surface may be disposed at an end of the fluid-transfer article.

Optionally, said heating surface is configured such that, when the fluid transfer article is arranged with respect to said heating surface for thermal interaction therebetween, the or each discontinuity is spaced apart from said activation surface.

Advantageously, the or each said channel may be at least partly defined by a pair of spaced apart side walls and an arcuate surface portion extending between said wall portions to form a ceiling portion of said channel.

Optionally, said arcuate surface portion blends smoothly with each of said side walls, thereby eliminating a sharp corner therebetween.

Alternatively, the or each channel may be at least partially defined by a pair of spaced apart side walls and a flat surface portion, said flat surface portion extending between said wall portions to form a ceiling portion of said channel. A further possibility is that the or each channel is at least partially defined by a pair of side walls, said side walls being inclined relative to each other to meet an apex portion of said channel.

Conveniently, said side walls are substantially planar.

Conveniently, at least said second region is formed from a polymeric wicking material.

Advantageously, said first and second regions are both formed from said polymeric wicking material.

Optionally, said polymeric wicking material is porous.

Conveniently, said polymeric wicking material is configured such that pore diameter in said first region is greater than pore diameter in said second region.

Advantageously, said polymeric wicking material is heat resistant.

Optionally, said polymeric wicking material is a hydrophilic material that is configured to transfer fluid from said first region to said second region.

Conveniently, said polymeric wicking material is of greater hydrophilicity in said second region than said first region.

According to another aspect of the seventh mode of the present disclosure, there may be provided an aerosol delivery system having an aerosol-generation apparatus as discussed above and a carrier, the carrier having a housing containing said heater and said fluid-transfer article.

Preferably, said housing has an inlet and an outlet. The air-flow pathway may then extend to said inlet and said outlet, said air-flow pathway passing said arcuate surface portion of said heating surface.

The disclosure includes the combination of the aspects and preferred features of the seventh mode described except where such a combination is clearly impermissible or expressly avoided.

Eighth Mode: An Aerosol-Generation Apparatus has a Fluid-Transfer Article which Holds Aerosol Precursor and which Transfers that Aerosol Precursor to an Activation Surface At its most general, an eighth mode the present disclosure proposes that an aerosol-generation apparatus has a fluid-transfer article which holds aerosol precursor and which transfers that aerosol precursor to an activation surface. That activation surface is in abutting unbonded contact with a heater of the aerosol-generation apparatus, and an air-flow pathway is defined on the opposite side of the heater from the activation surface. The fluid-transfer article is separable from the rest of the aerosol-generation apparatus.

Thus, when the fluid-transfer article is mounted to the rest of the aerosol-generation apparatus, the activation surface is in contact with the heater so that it will be heated when the heater is active. Since that contact is unbonded, the activation surface and heater are separable and will separate from one another when the fluid-transfer article is removed from the rest of the aerosol-generation apparatus. Since the aerosol precursor will be consumed as the user uses the apparatus, this will allow the fluid-transfer article to be removed, and be replaced or refilled with aerosol precursor, without needing to replace the heater.

Thus, according to the present disclosure, there may be provided an aerosol-generation apparatus comprising a heater and a separable fluid-transfer article, the fluid-transfer article comprising a first region for holding an aerosol precursor and for transferring said aerosol precursor to an activation surface of a second region of said fluid-transfer article, said activation surface being in abutting unbonded contact with said heater so as to interact thermally with said heater, the apparatus having an air-flow pathway on the opposite side of said heater from said activation surface.

The activation surface is preferably planar to allow it to make good contact with the heater. The heater is preferably a foil or mesh heater. The heater will normally need to have at least one gap forming an opening therein to enable heated aerosol precursor, in the form of vapor and/or a vapor/aerosol mixture, to pass through the heater from the activation surface to the air-flow pathway.

The second region of the fluid-transfer article which forms the activation surface will normally have a wicking effect, so that aerosol precursor in the fluid-transfer article will be transported to the activation surface. For example, second region may be formed of a porous polymer material. Alternatively, it may be formed of a fibrous material, such as glass or ceramic fiber material. Other alternatives include sintered glass, ceramic or carbon, or carbon or glass foam. The first part of the fluid-transfer article may act as a reservoir for the aerosol precursor. That region may simply be a tank for liquid, or may be of porous polymer material which holds the aerosol precursor.

The aerosol-generation apparatus may form part of an aerosol delivery system which has a carrier and which may include a housing containing the fluid-transfer apparatus. There may then be a further housing supporting the heater and in which a part of the air-flow pathway is formed. Thus, the fluid-transfer article may be separable from the rest of the apparatus by removing the carrier therefrom.

The disclosure includes the combination of the aspects and preferred features of the eighth mode described except where such a combination is clearly impermissible or expressly avoided.

Ninth Mode: An Aerosol Generation Apparatus has a Fluid-Transfer Article with a First Region which Holds an Aerosol Precursor At its most general, a ninth mode of the present disclosure proposes that an aerosol generation apparatus has a fluid-transfer article with a first region which holds an aerosol precursor, the first region being arranged to transfer the aerosol precursor to a second region of the fluid-transfer article. That second region has two parts of different materials, one part being adjacent to the first region and the second part being of a material resistant to higher temperatures than the material of the first part. The first part has a plurality of holes therein and the second part extends across those holes so that aerosol precursor in the holes will pass to the second part of the second region. The second part is porous for passage therethrough of the aerosol precursor from the holes to an activation surface.

The aerosol-generation apparatus also has a heater, which heater contacts the activation surface so as to interact thermally therewith. The heater is not bonded to the activation surface, instead it may make abutting unbonded contact so that the heater and the activation surface are separable.

The separability of the fluid-transfer article and the heater means that it is possible to replace the fluid-transfer article without having to replace the heater. Since the aerosol precursor will be consumed when the apparatus is used by a user, it will normally be necessary to replace or at least refill the fluid-transfer article periodically, as it acts as a reservoir for the aerosol precursor.

The two different materials of the second region of the fluid-transfer article allow one (the material of the second part) to be adapted to the heater, whilst the other (the material of the first part) may be a lower cost material.

As mentioned above the first part of the second region has a plurality of holes therein. Those holes do not act as capillaries, but instead may be of a size or sizes so that they cooperate with the second part of the second region to define non-capillary spaces in the second region in to which the aerosol precursor is able to flow. Thus, the aerosol precursor may pass from the first region in a non-capillary manner into the holes, and impinge on the second part of the second region. It may then pass through the second part due to the porous nature of the second part.

The heater is mounted in contact with the activation surface of the second region. In such an arrangement, there will normally be an air-flow pathway adjacent at least part of the activation surface, so that vapor or aerosol/vapor mixture released from the activation surface by the heating effect of the heater may mix with the air-flow and pass to the user. Furthermore, in such an arrangement, the air-flow pathway will normally pass on the opposite side of the heater from the activation surface.

The second region of the fluid-transfer article may thus act as a wick, to cause aerosol precursor to move from the first region to the activation surface where it may be heated by the heater. The wick may have a two-layer structure, formed by the two parts of the second region. One of those parts is preferably being made of an inexpensive material through which the holes pass, and the second part is of a more heat resistant material, which will interact with the heater at the activation surface. Aerosol precursor will be drawn through the second region, partly because the holes will fill with aerosol precursor, and partly because of the porous nature of the second part of the second region.

Thus, according to the ninth mode of the present disclosure, there may be provided an aerosol-generation apparatus comprising a heater and a fluid-transfer article, said fluid-transfer article comprising a first region for holding an aerosol precursor and for transferring said aerosol precursor to a second region of said fluid-transfer article, said second region comprising a first part of a first material, said first part being adjacent said first region and having a plurality of holes therein, and a second part of a second material different from the first material and being resistant to higher temperatures than said first material, said second part being adjacent to said first part and extending across said plurality of holes in said first part; wherein said plurality of holes are sized so that they cooperate with said second part of define non-capillary spaces in said second region into which said aerosol precursor is able to flow from said first region in a non-capillary manner thereby to impinge on said second part; wherein said second part of said second region is porous for passage therethrough of said aerosol precursor from said plurality of holes to an activation surface of said second region; wherein said heater contacts said activation surface so as to interact thermally with said activation surface; and wherein said heater and said activation surface are separable.

The heater is preferably a coil, mesh or foil. There may then be an air-flow pathway adjacent at least a part of the activation surface. Since the heater is in contact with the activation surface, a part of said air-flow pathway may be on the opposite of the heater from the activation surface.

Preferably, said first part of said second region is formed of a solid polymer material having said plurality of holes therein.

It is usually preferable that said second part of said second region is formed of fibrous material. That fibrous material may be ceramic fiber, glass fiber or carbon fiber. Alternatively, the second part of the second region may be porous glass or porous ceramic. Another possibility is that the second part of the second region is of a porous polymer material. Another possibility is for the first region of the fluid-transfer article to be a simple reservoir filled with liquid aerosol precursor, from which reservoir the liquid flows into the holes in the first part of the second region of the fluid-transfer article.

Preferably, the plurality of holes are molded holes. As mentioned above, it is desirable that the first part of the second region is formed of solid polymer material and it is convenient to mold the holes at the same time that the first part itself is molded.

The fluid-transfer article may act as a reservoir for aerosol precursor. One option is for the first region of said fluid-transfer article to be of porous polymer material.

The porous polymer material of the first region may comprise Polyetherimide (PEI) and/or Polyether ether ketone (PEEK) and/or Polytetrafluoroethylene (PTFE) and/or Polyimide (PI) and/or Polyethersulphone (PES) and/or Ultra-High Molecular Weight Polyethylene (UHMWPE) and/or Polypropylene (PP) and/or Polyethylene Terephthalate (PET). Similar materials may be used for the second part of the second region when that second region is made of a porous polymer material, as mentioned above.

Alternatively, the first region of the fluid-transfer article may be a simple hollow reservoir which is filled with aerosol precursor when the apparatus is to be used.

The aerosol-generation apparatus may form part of an aerosol delivery system which has a carrier which includes a housing containing the fluid-transfer article. The aerosol delivery system may then include a further housing supporting the heater. The housing and the further housing may be mutually separable, to allow the carrier to be removed from the rest of the aerosol delivery system.

The further housing may have an inlet with the air-flow pathway extending to the inlet. It may also have a plate mounted in the further housing at a position spaced from the heater so that the air-flow pathway passes between the activation surface and the plate. The plate may optionally have a plurality of recesses in its surface facing the activation surface with the air-flow pathway passing through said recesses.

The disclosure includes the combination of the aspects and preferred features of the ninth mode described except where such a combination is clearly impermissible or expressly avoided.

Tenth Mode: A Dried Conductive Fluid is Used to Form at Least One Heater Element on an Activation Surface of a Fluid-Transfer Article At its most general, a tenth mode of the present disclosure proposes that dried conductive fluid is used to form at least one heater element on an activation surface of a fluid-transfer article. The activation surface has at least one channel which opens outward. The fluid-transfer article may then act as a reservoir for holding an aerosol precursor, and for transferring that aerosol precursor to the activation surface. The aerosol precursor can then be heated by the heater element or elements to form vapor or a vapor/aerosol mixture which can then pass to a user.

The heater element or elements are preferably formed on parts of the activation surface other than the or each channel. The element or elements may prevent or restrict aerosol precursor leaving the fluid-transfer article from regions where they are formed, and so the or each channel provides a region where the aerosol precursor may leave the fluid-transfer article (e.g., as vapor or a mixture of vapor and aerosol) in an unrestricted way. The channel, or the channels together, may thus form an air-flow pathway along the activation surface. The heater elements may extend on to the side walls of the or each channel, to increase the heat transfer.

Thus, there may be provided an aerosol-generation apparatus comprising a heater and a fluid-transfer article, the fluid-transfer article having a first region for holding an aerosol precursor and for transferring said aerosol precursor to an activation surface of a second region of said article, wherein said second region comprises at least one discontinuity in said activation surface to form a corresponding at least one channel in said activation surface, the or each said channel being configured for providing an air-flow pathway across said activation surface and opening in a direction away from said first region, said heater having at least one heater element formed on said activation surface, said at least one heater element being of a dried conductive fluid with electrical connections thereto.

Optionally, said activation surface is disposed at an end of said article.

Preferably, wherein said at least one heater element is formed on parts of said activation surface other than the or each discontinuity, which forms the or each channel.

Normally, at least parts of said at least one heating element are formed on parts of said activation surface between said channels.

Advantageously, the or each said channel may be at least partly defined by a pair of spaced apart side walls, and an arcuate surface portion extending between said wall portions to form a ceiling portion of said channel.

Optionally, said arcuate surface portion blends smoothly with each of said side walls, thereby eliminating a sharp corner therebetween.

Alternatively, the or each channel may be at least partially defined by a pair of spaced apart side walls and a flat surface portion, said flat surface portion extending between said wall portions to form a ceiling portion of said channel. A further possibility is that the or each channel is at least partially defined by a pair of side walls, said side walls being inclined relative to each other to meet an apex portion of said channel.

In such arrangements, the at least one heater element may be formed on at least parts of said side walls, but preferably not on any ceiling portion.

Conveniently, said side walls are substantially planar.

Conveniently, at least said second region is formed from a polymeric wicking material.

Advantageously, said first and second regions are both formed from said polymeric wicking material.

Optionally, said polymeric wicking material is porous.

Conveniently, said polymeric wicking material is configured such that pore diameter in said first region is greater than pore diameter in said second region.

Advantageously, said polymeric wicking material is heat resistant.

Optionally, said polymeric wicking material is a hydrophilic material that is configured to transfer fluid from said first region to said second region.

Conveniently, said polymeric wicking material is of greater hydrophilicity in said second region than said first region.

According to a second aspect of the tenth mode of the present disclosure, there may be provided an aerosol-delivery system comprising an aerosol-generation apparatus as discussed above, and a carrier, the carrier having a housing containing the heater and the fluid-transfer article. In such an aerosol-delivery system, the housing may have an inlet and outlet, with the air-flow pathway extending to the inlet and outlet.

According to a third aspect of the tenth mode of the present disclosure, there may be provided a method of forming an aerosol-generation device comprising: forming a fluid-transfer article, the fluid-transfer article having a first region for holding an aerosol precursor and for transferring said aerosol precursor to an activation surface of a second region of said article, wherein said second region comprises at least one discontinuity in said activation surface to form a corresponding at least one channel in said activation surface, the or each said channel being configured for providing an air-flow pathway across said activation surface and opening in a direction away from said first region; dipping said activation surface in a conductive fluid to coat at least a part of said activation surface with said conductive fluid; drying said conductive fluid to form heater elements; and making electrical connection to said dried conductive fluid, thereby to form a heater on said fluid-transfer article.

The disclosure includes the combination of the aspects and preferred features of the tenth mode described except where such a combination is clearly impermissible or expressly avoided.

Eleventh Mode: A Heater of an Aerosol Delivery Device is Supported by a Resilient Sealing Body At its most general, an eleventh mode of the present disclosure proposes that a heater of an aerosol delivery device is supported by a resilient sealing body. The resilient sealing body seals to both a first casing containing a reservoir for holding aerosol precursor and a second casing which supports the heater. The first and second casings are separable and the sealing of the resilient sealing body to the first casing containing the reservoir is also releasable when the first casing is separated from the second casing.

The first casing may also support a wick arranged to receive aerosol precursor from the reservoir, with an activation surface of that wick making abutting unbonded contact with the heater so it would interact thermally therewith when the first and second casings are connected.

In this way, the resilient sealing body performs three functions, supporting the heater, and sealing each of the first and second casings. The sealing allows the first casing to be separated from the second casing, for example when the aerosol precursor in the reservoir with the first casing has been consumed. The heater remains with the second casing, held thereto by the resilient sealing body, so the heater does not need to be replaced when the first casing is removed. Thus, the second casing may form the casing of the main body, including the power source, in the second casing its contents may form a consumable.

Thus, the present disclosure may provide an aerosol delivery device comprising a first casing and a second casing separably connected to said first casing, said first casing containing a reservoir for holding an aerosol precursor, said first casing also supporting a wick arranged to receive aerosol precursor from said reservoir, said second casing supporting a heater, said heater making abutting unbonded contact with an activation surface of said wick so as to interact thermally with said activation surface; wherein said heater is supported by said second casing via a resilient sealing body, said resilient sealing body sealing to said second casing to be held thereby, and releasably sealing to said first casing such that the seal of said resilient sealing body is releasable when said first casing is separated from said second casing.

Preferably, the resilient sealing body has at least one bore (also referred to hereinafter as a passage) therethrough for passage of air from the interior of the second casing to the activation surface of the wick. That bore may have a mouth adjacent the heater and the activation surface, which mouth widens towards the activation surface. This contributes to a good distribution of air over the activation surface, to allow the air to mix with vaporized aerosol precursor, released from the wick due to the heating effect of the heater. Preferably, the resilient sealing body has a planar heater support surface, with the heater mounted thereon. That heater support service may have a slot therein, which may communicate with the bore referred to previously which allows for a passage of air through the resilient sealing body.

In addition to the bore described above, the resilient sealing body may have at least one further bore therethrough, being for the passage of one or more electrical leads from the heater to the interior of the second casing, for connection to an electrical power source. The electrical power source may be, for example, a battery.

It is desirable that the resilient sealing body is heat resistant, since it must withstand the heat generated by the heater. It may be, for example, of silicone material. The first casing preferably has an outlet, which may form a mouthpiece for the user, with there being a first air-flow pathway from the activation surface to the outlet. In a similar way, the second casing may have an inlet, with a second air-flow pathway from the inlet to the activation surface. The second air-flow pathway may pass through the bore (or some or all of the bores) in the resilient sealing body. In this way, when the user draws on the mouthpiece, air is drawn into the inlet and through the second air-flow pathway to the activation surface, where it mixes with the vaporized aerosol precursor, and the resulting mixture can then pass along the first air-flow pathway to the user.

The disclosure includes the combination of the aspects and preferred features of the eleventh mode described except where such a combination is clearly impermissible or expressly avoided.

SUMMARY OF THE FIGURES

So that the disclosure may be more readily understood, and so that further features thereof may be appreciated, embodiments of the disclosure will now be described by way of example with reference to the accompanying drawings.

FIG. 118 shows a detailed schematic sectional view of a part of a smoking substitute system of the eleventh mode.

FIG. 119 shows yet another arrangement of a smoking substitute system of the eleventh mode.

FIG. 120 shows a consumable part of another smoking substitute system of the eleventh mode.

FIG. 121 shows another consumable part of a smoking substitute system of the eleventh mode.

FIG. 122 shows detail of the consumable part of FIG. 121.

DETAILED DESCRIPTION OF THE FIGURES

First Mode: An Aerosol-Generation Apparatus, Comprising a Fluid-Transfer Article Having an Activation Surface and Configured for Thermal Interaction with a Heating Surface Aspects and embodiments of the first mode of the present disclosure will now be discussed with reference to the accompanying figures. Further aspects and embodiments of the first mode will be apparent to those skilled in the art. All documents mentioned in this text are incorporated herein by reference.

In general outline, one or more embodiments of the first mode in accordance with the present disclosure may provide a system for aerosol delivery in which an aerosol carrier may be inserted into a receptacle (e.g., a "heating chamber") of an apparatus for initiating and maintaining release of an aerosol from the aerosol carrier. Another end, or another end portion, of the aerosol carrier may protrude from the apparatus and can be inserted into the mouth of a user for the inhalation of aerosol released from the aerosol carrier cartridge during operation of the apparatus.

Hereinafter, and for convenience only, "system for aerosol delivery" shall be referred to as "aerosol delivery system".

Figure 1:
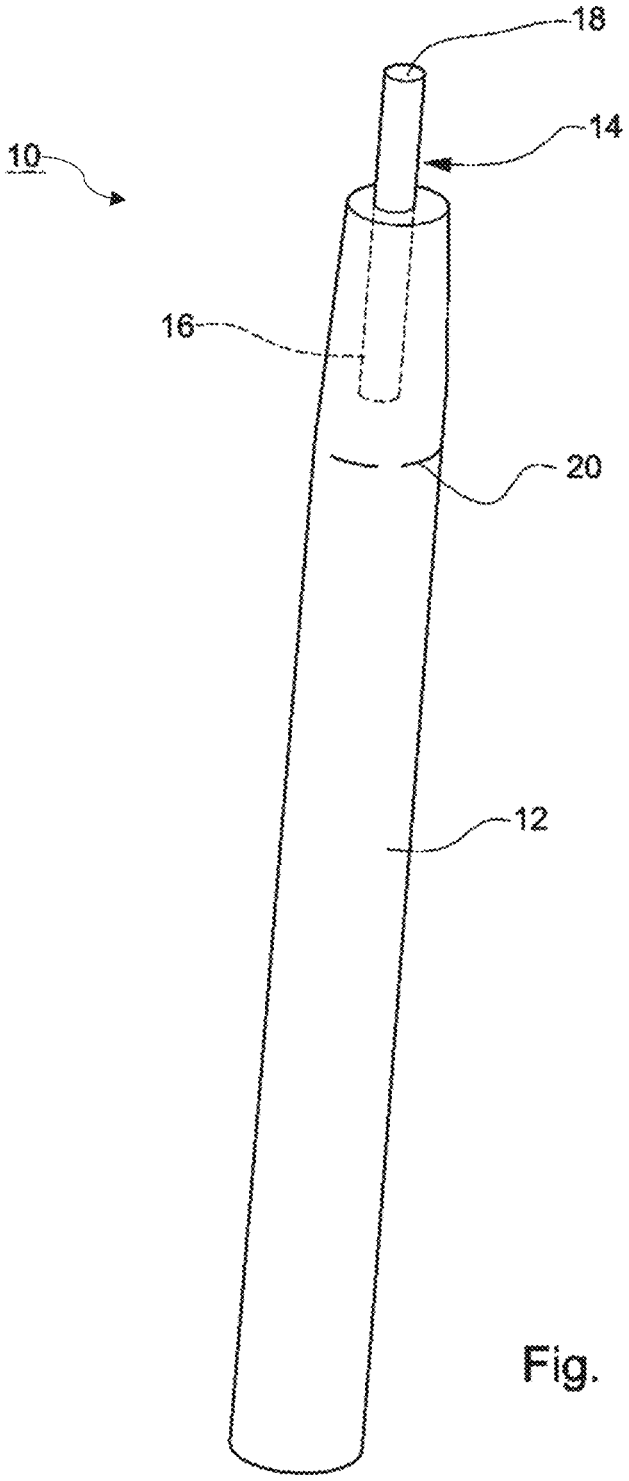
FIG. 1 is a perspective view illustration of a system for aerosol delivery according to one or more embodiments of the first mode of the present disclosure.

Referring now to FIG. 1, there is illustrated a perspective view of an aerosol delivery system 10 comprising an aerosol generation apparatus 12 operative to initiate and maintain release of aerosol from a fluid-transfer article in an aerosol carrier 14. In the arrangement of FIG. 1, the aerosol carrier 14 is shown with a first end 16 thereof and a portion of the length of the aerosol carrier 14 located within a receptacle of the apparatus 12. A remaining portion of the aerosol carrier 14 extends out of the receptacle. This remaining portion of the aerosol carrier 14, terminating at a second end 18 of the aerosol carrier, is configured for insertion into a user's mouth. A vapor and/or aerosol is produced when a heater (not shown in FIG. 1) of the apparatus 12 heats a fluid-transfer article in the aerosol carrier 14 to release a vapor and/or an aerosol, and this can be delivered to the user, when the user sucks or inhales, via a fluid passage in communication with an outlet of the aerosol carrier 14 from the fluid-transfer article to the second end 18.

The device 12 also comprises air-intake apertures 20 in the housing of the apparatus 12 to provide a passage for air to be drawn into the interior of the apparatus 12 (when the user sucks or inhales) for delivery to the first end 16 of the aerosol carrier 14, so that the air can be drawn across an activation surface of a fluid-transfer article located within a housing of the aerosol carrier cartridge 14 during use. Optionally, these apertures may be perforations in the housing of the apparatus 12.

A fluid-transfer article (not shown in FIG. 1, but described hereinafter with reference to FIGS. 5, 6, 7, 8, 9, 10, 11 and 12) is located within a housing of the aerosol carrier 14. The fluid-transfer article contains an aerosol precursor material, which may include at least one of: nicotine; a nicotine precursor material; a nicotine compound; and one or more flavorings. The fluid-transfer article is located within the housing of the aerosol carrier 14 to allow air drawn into the aerosol carrier 14 at, or proximal, the first end 16 to flow across an activation surface of the fluid-transfer article. As air passes across the activation surface of the fluid-transfer article, an aerosol may be entrained in the air stream from a substrate forming the fluid-transfer article, e.g., via diffusion from the substrate to the air stream and/or via vaporization of the aerosol precursor material and release from the fluid-transfer article under heating.

The substrate forming the fluid-transfer article 34 comprises a porous material where pores of the porous material hold, contain, carry, or bear the aerosol precursor material. In particular, the porous material of the fluid-transfer article may be a polymeric wicking material such as, for example, a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET). All such materials may be described as heat resistant polymeric wicking material in the context of the present disclosure.

The aerosol carrier 14 is removable from the apparatus 12 so that it may be disposed of when expired. After removal of a used aerosol carrier 14, a replacement aerosol carrier 14 can be inserted into the apparatus 12 to replace the used aerosol carrier 14.

Figure 2:
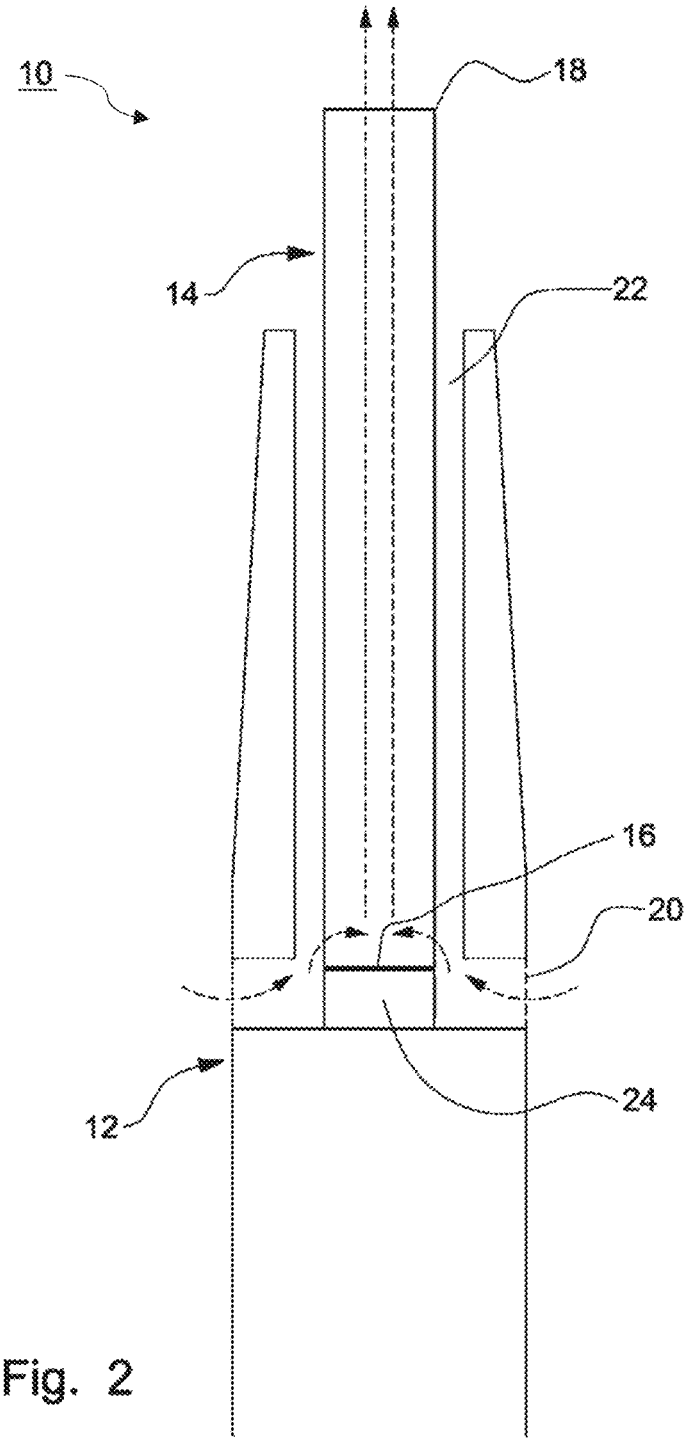
FIG. 2 is a cross-sectional side view illustration of part of an apparatus of the system for aerosol delivery of FIG. 1.

FIG. 2 is a cross-sectional side view illustration of a part of apparatus 12 of the aerosol delivery system 10. The apparatus 12 comprises a receptacle 22 in which is located a portion of the aerosol carrier 14. In one or more optional arrangements, the receptacle 22 may enclose the aerosol carrier 14. The apparatus 12 also comprise a heater 24, which opposes an activation surface of the fluid-transfer article (not shown in FIG. 2) of the aerosol carrier 14 when an aerosol carrier 14 is located within the receptacle 22.

Air flows into the apparatus 12 (in particular, into a closed end of the receptacle 22) via air-intake apertures 20. From the closed end of the receptacle 22, the air is drawn into the aerosol carrier 14 (under the action of the user inhaling or sucking on the second end 18) and expelled at the second end 18. As the airflows into the aerosol carrier 14, it passes across the activation surface of the fluid-transfer article. Heat from the heater 24, which opposes the activation surface of the fluid-transfer article, causes vaporization of aerosol precursor material at the activation surface of the fluid-transfer article and an aerosol is created in the air flowing over the activation surface. Thus, through the application of heat in the region of the activation surface of the fluid-transfer article, an aerosol is released, or liberated, from the fluid-transfer article, and is drawn from the material of the aerosol carrier unit by the air flowing across the activation surface and is transported in the air flow to via outlet conduits (not shown in FIG. 2) in the housing of the aerosol carrier 14 to the second end 18. The direction of air flow is illustrated by arrows in FIG. 2.

To achieve release of the captive aerosol from the fluid-transfer article, the fluid-transfer article of the aerosol carrier 14 is heated by the heater 24. As a user sucks or inhales on second end 18 of the aerosol carrier 14, the aerosol released from the fluid-transfer article and entrained in the air flowing across the activation surface of the fluid-transfer article is drawn through the outlet conduits (not shown) in the housing of the aerosol carrier 14 towards the second end 18 and onwards into the user's mouth.

Figure 3:
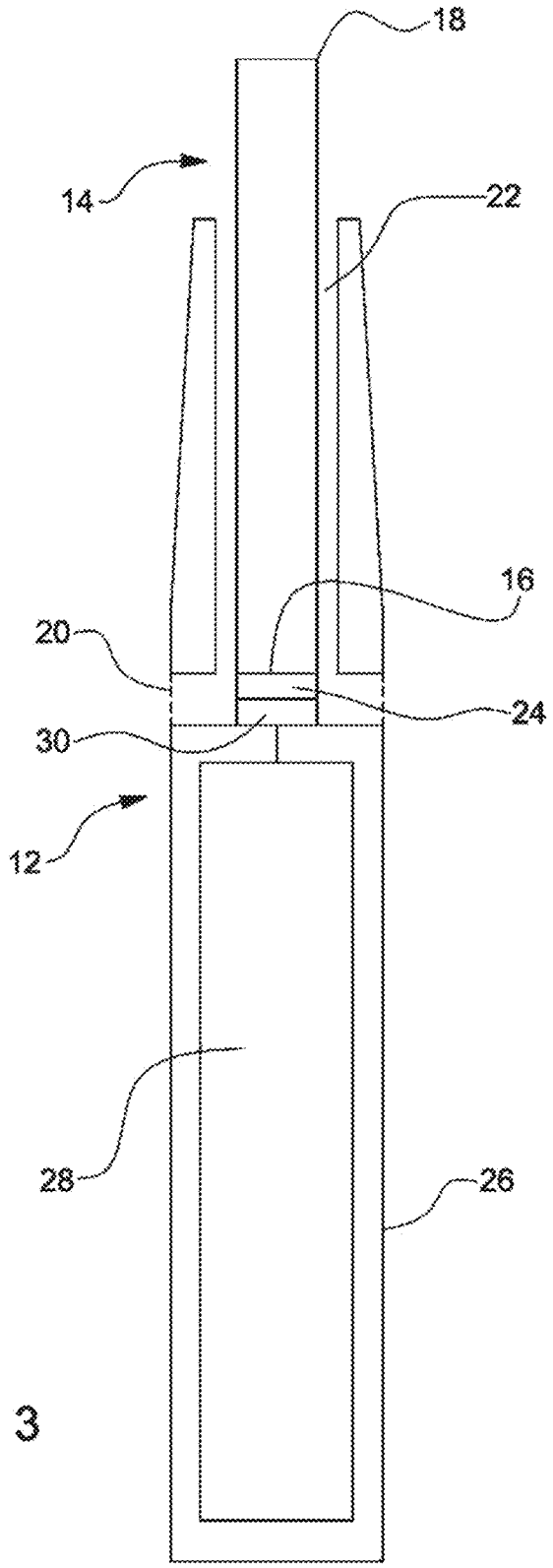
FIG. 3 is a cross-sectional side view illustration of the system and apparatus for aerosol delivery of FIG. 1.

Turning now to FIG. 3, a cross-sectional side view of the aerosol delivery system 10 is schematically illustrated showing the features described above in relation to FIGS. 1 and 2 in more detail. As can be seen, apparatus 12 comprises a housing 26, in which are located the receptacle 22 and heater 24. The housing 26 also contains control circuitry (not shown) operative by a user, or upon detection of air and/or vapor being drawn into the device 12 through air-intake apertures 20, i.e., when the user sucks or inhales. Additionally, the housing 26 comprises an electrical energy supply 28, for example a battery.

Optionally, the battery comprises a rechargeable lithium-ion battery. The housing 26 also comprises a coupling 30 for electrically (and optionally mechanically) coupling the electrical energy supply 28 to control circuitry (not shown) for powering and controlling operation of the heater 24.

Responsive to activation of the control circuitry of apparatus 12, the heater 24 heats the fluid-transfer article (not shown in FIG. 3) of aerosol carrier 14. This heating process initiates (and, through continued operation, maintains) release of vapors and/or an aerosol from the activation surface of the fluid-transfer article. The vapors and/or aerosol formed as a result of the heating process is entrained into a stream of air being drawn across the activation surface of the fluid-transfer article (as the user sucks or inhales). The stream of air with the entrained vapors and/or aerosol passes through the aerosol carrier 14 via outlet conduits (not shown) and exits the aerosol carrier 14 at second end 18 for delivery to the user.

This process is briefly described above in relation to FIG. 2, where arrows schematically denote the flow of the air stream into the device 12 and through the aerosol carrier 14, and the flow of the air stream with the entrained vapors and/or aerosol through the aerosol carrier cartridge 14.

Figure 4:
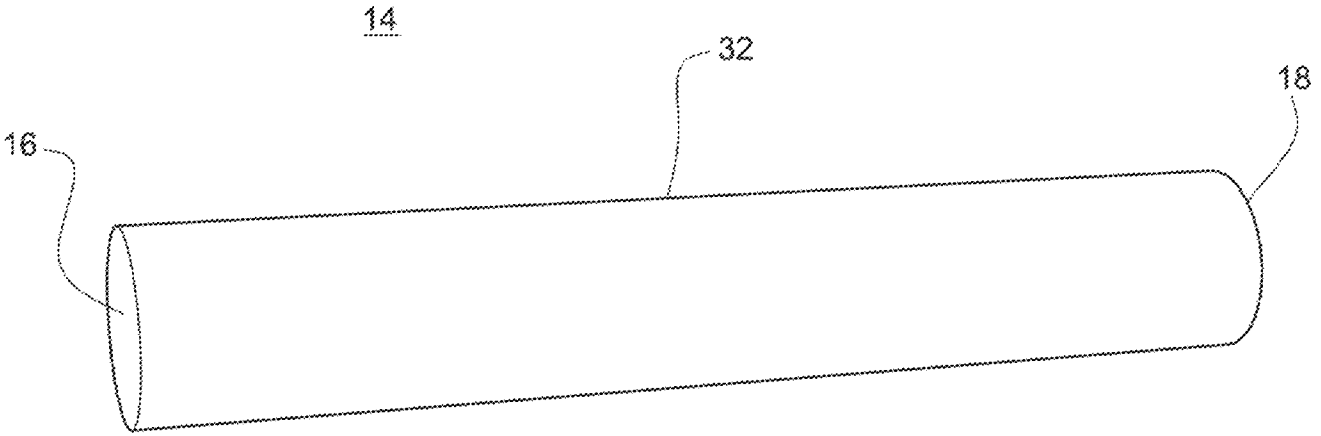
FIG. 4 is a perspective view illustration of an aerosol carrier for use in the system for aerosol delivery according to one or more embodiments of the first mode of the present disclosure.
Figure 5:
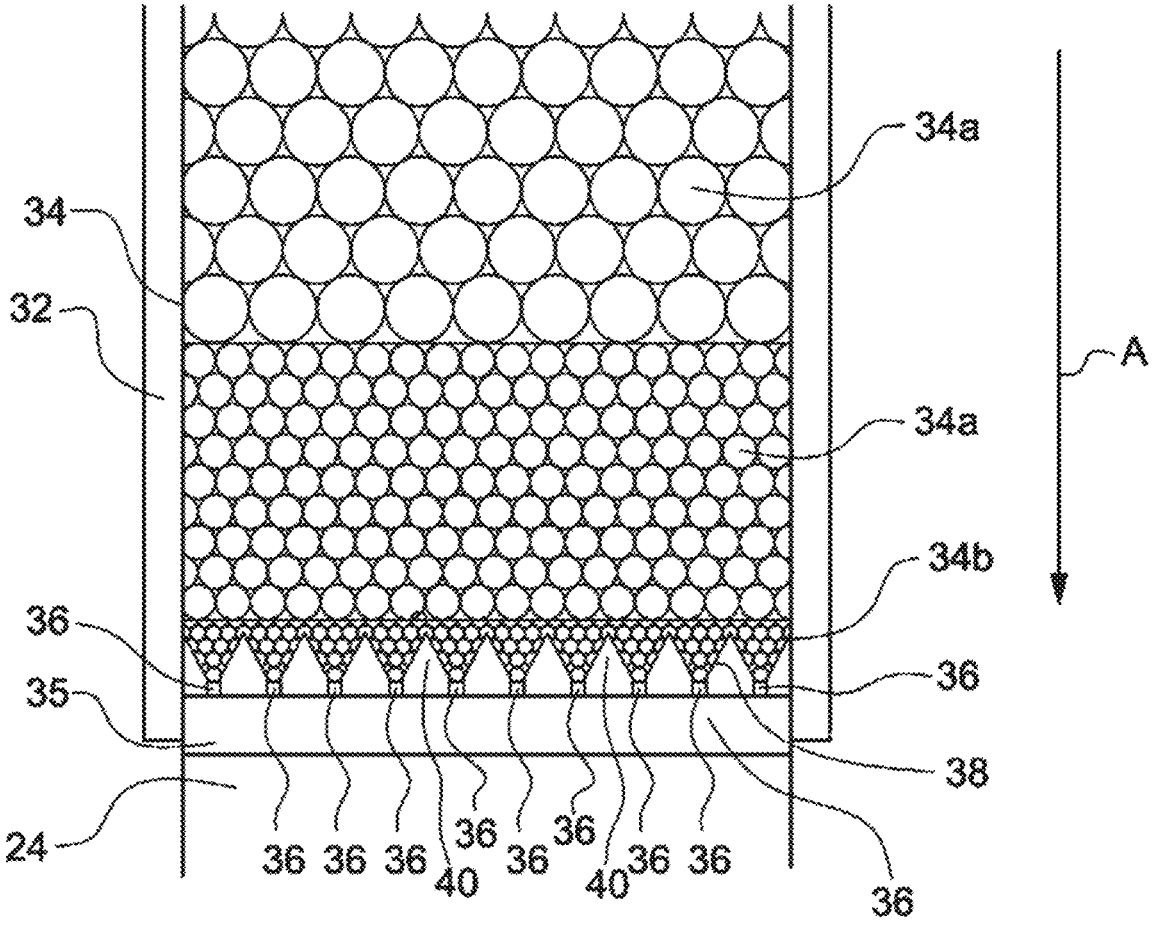
FIG. 5 is a cross-section side view of elements of an aerosol carrier and of part of an apparatus of the system for aerosol delivery according to one or more embodiments of the first mode of the present disclosure.
Figure 6:
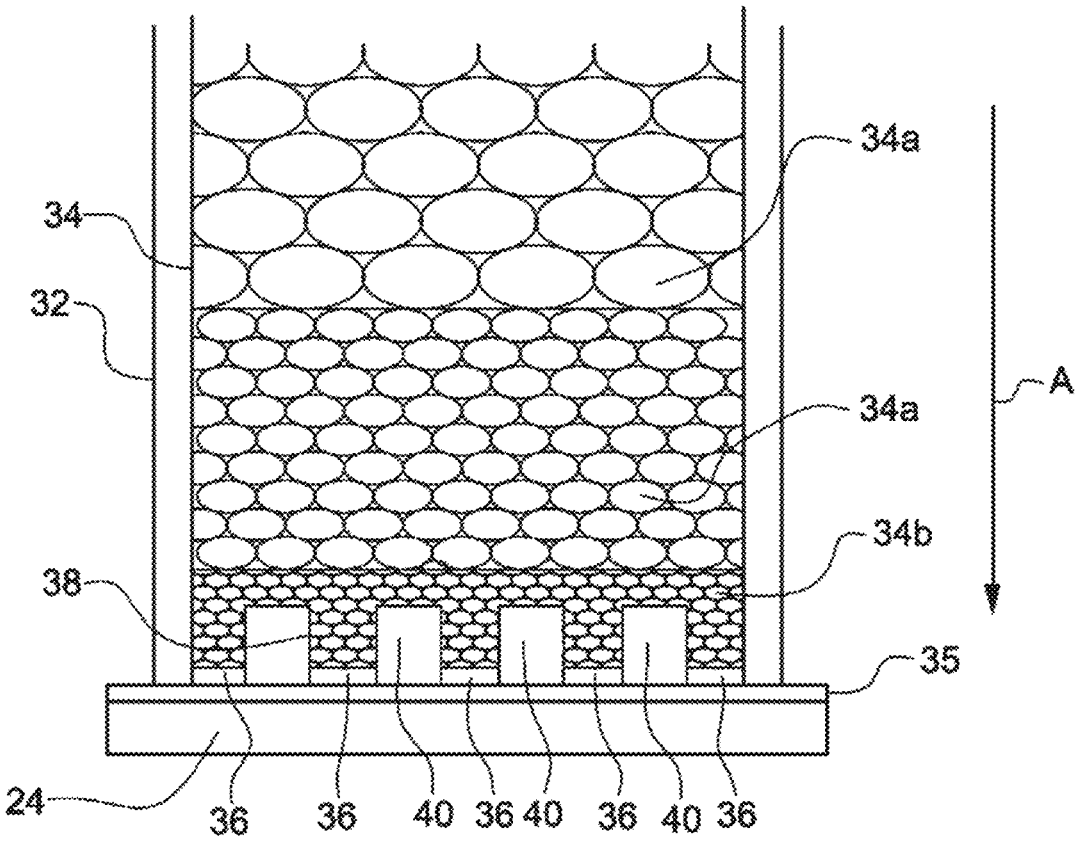
FIG. 6 is a cross-section side view of elements of an aerosol carrier and of part of an apparatus of the system for aerosol delivery according to one or more embodiments of the first mode of the present disclosure.

FIGS. 4 to 6 schematically illustrate the aerosol carrier 14 in more detail (and, in FIGS. 5 and 6, features within the receptacle in more detail). FIG. 4 illustrates an exterior of the aerosol carrier 14, FIG. 5 illustrates internal components of the aerosol carrier 14 in an optional arrangement, and FIG. 6 illustrates internal components of the aerosol carrier 14 in another optional arrangement.

FIG. 4 illustrates the exterior of the aerosol carrier 14, which comprises housing 32 for housing said fluid-transfer article (not shown) and at least one other internal component. The particular housing 32 illustrated in FIG. 4 comprises a tubular member, which may be generally cylindrical in form, and which is configured to be received within the receptacle of the apparatus. First end 16 of the aerosol carrier 14 is for location to oppose the heater of the apparatus, and second end 18 (and the region adjacent the second end 18) is configured for insertion into a user's mouth.

FIG. 5 illustrates some internal components of the aerosol carrier 14 and of the heater 24 of apparatus 12.

As described above, the aerosol carrier 14 comprises a fluid-transfer article 34. The aerosol carrier 14 optionally may comprise a conduction element 36 (as shown in FIG. 5). In one or more arrangements, the aerosol carrier 14 is located within the receptacle of the apparatus such that the activation surface of the fluid-transfer article opposes the heater of the apparatus and receives heat directly from the heater of the apparatus. In an optional arrangement, such as illustrated in FIG. 5 for example, the aerosol carrier 14 comprises a conduction element 36. When aerosol carrier 14 is located within the receptacle of the apparatus such that the activation surface of the fluid-transfer article is located to oppose the heater of the apparatus, the conduction element is disposed between the heater 24 and the activation surface of the fluid-transfer article. Heat may be transferred to the activation surface via conduction through conduction element 36 (i.e., application of heat to the activation surface is indirect).

Further components not shown in FIG. 5 and FIG. 6 (see FIGS. 11 and 12) comprise: an inlet conduit, via which air can be drawn into the aerosol carrier 14; an outlet conduit, via which an air stream entrained with aerosol can be drawn from the aerosol carrier 14; a filter element; and a reservoir for storing aerosol precursor material and for providing the aerosol precursor material to the fluid-transfer article 34.

In FIGS. 5 and 6, aerosol carrier is shown as comprising the fluid-transfer article 34 located within housing 32. The material forming the fluid transfer article 34 comprises a porous structure, where pore diameter size varies between one end of the fluid-transfer article 34 and another end of the fluid-transfer article. In the illustrative examples of FIGS. 5 and 6, the pore diameter size gradually decreases from a first end remote from heater 24 (the upper end as shown in the figure) to a second end proximal heater 24 (the lower end as shown in the figure). Although the figure illustrates the pore diameter size changing in a step-wise manner from the first to the second end (i.e., a first region with pores having a diameter of a first size, a second region with pores having a diameter of a second, smaller size, and a third region with pores having a diameter of a third, yet smaller size), the change in pore size from the first end to the second end may be gradual rather than step-wise. This configuration of pores having a decreasing diameter size from the first end and second end can provide a wicking effect, which can serve to draw fluid from the first end to the second end of the fluid-transfer article 34.

The fluid-transfer article 34 comprises a first region 34*a* for holding an aerosol precursor. In one or more arrangements, the first region 34*a* of the fluid-transfer article 34 comprises a reservoir for holding the aerosol precursor. The first region 34*a* can be the sole reservoir of the aerosol carrier 14, or it can be arranged in fluid communication with a separate reservoir, where aerosol precursor is stored for supply to the first region 34*a*.

The fluid-transfer article 34 also comprises a second region 34*b*. Aerosol precursor is drawn from the first region 34*a* to the second region 34*b* by the wicking effect of the substrate material forming the fluid transfer article. Thus, the first region 34*a* is configured to transfer the aerosol precursor to the second region 34*b* of the article 34.

At the second end of fluid-transfer article 34, the surface of the second region 34*b* defines an activation surface 38, which is disposed opposite a surface for conveying heat to the activation surface 38. In the illustrative examples of FIGS. 5 and 6, the opposing surface for conveying heat to the activation surface 38 comprises part of the heater 24 being a substrate 35 which has heating elements 36 thereon. The elements 36 will be powered individually, or may be connected together so that they are powered together. The heating elements 36 generate heat, when they are activated. Thus, those heating elements are located for thermal interaction with the second region 34*b*, and arranged to transfer heat from the activation surface 38.

The activation surface 38 is discontinuous such that at least one channel 40 is formed between the activation surface 38 and the heater 24. In some arrangements, the discontinuities may be such that the activation surface 38 is undulating.

In the illustrative examples of FIGS. 5 and 6, the activation surface 38 comprises a plurality of groove or valleys therein to form an undulating surface, the grooves or valleys being disposed in a parallel arrangement across the activation surface 38. Thus, there are a plurality of channels 40 between the activation surface 38 and the heater 24.

In the illustrative example of FIG. 5, the grooves or valleys in the activation surface 38 provide alternating peaks and troughs that give rise to a "saw-tooth" type profile. In one or more optional arrangements, the activation surface may comprise a "castellated" type profile (i.e., a "square wave" type profile), for example, such as illustrated in the example of FIG. 6. In one or more optional arrangements, the activation surface may comprise a "sinusoidal" type profile. The profile may comprise a mixture of two or more of the above profiles given as illustrative examples.

As can be seen in FIGS. 5 and 6 the heating elements are not aligned with the channels 40, but instead are aligned with the parts of the activation surface between the grooves or valleys, i.e., the parts of the second region 34*b* which are closest to the heater 24. There may be direct contact between those parts of the second region 34*b* and the heating elements 36. The heating elements 36 thus heat the activation surface 38 at the walls between the troughs or valleys, rather than being aligned with the troughs or valleys themselves. Heat may then reach the rest of the activation surface 38 by conduction through the second region 34*b* and also by radiation across the channels 40.

In the illustrative examples of FIGS. 5 and 6, the first region 34*a* of the fluid-transfer article 34 is located at an "upstream" end of the fluid-transfer article 34 and the second region 34*b* is located at a downstream" end of the fluid-transfer article 34. That is, aerosol precursor is wicked, or is drawn, from the "upstream" end of the fluid-transfer article 34 to the "downstream" end of the fluid-transfer article 34 (as denoted by arrow A in FIG. 5).

The aerosol precursor is configured to release an aerosol and/or vapor upon heating. Thus, when the activation surface 38 receives heat conveyed from heater 24, the aerosol precursor held at the activation surface 38 is heated. The aerosol precursor, which is captively held in material of the fluid-transfer article at the activation surface 38 is released into an air stream flowing through the channels 40 between the heater 24 and activation surface 38 as an aerosol and/or vapor.

The shape and/or configuration of the activation surface 38 and the associated shape(s) and/or configuration(s) of the one or more channels 40 formed between the activation surface 38 and heater 24 permit air to flow across the activation surface 38 (through the one or more channels 40) and also increase the surface area of the activation surface 38 of the fluid-transfer article 34 that is available for contact with a flow of air across the activation surface 38.

Figure 7:
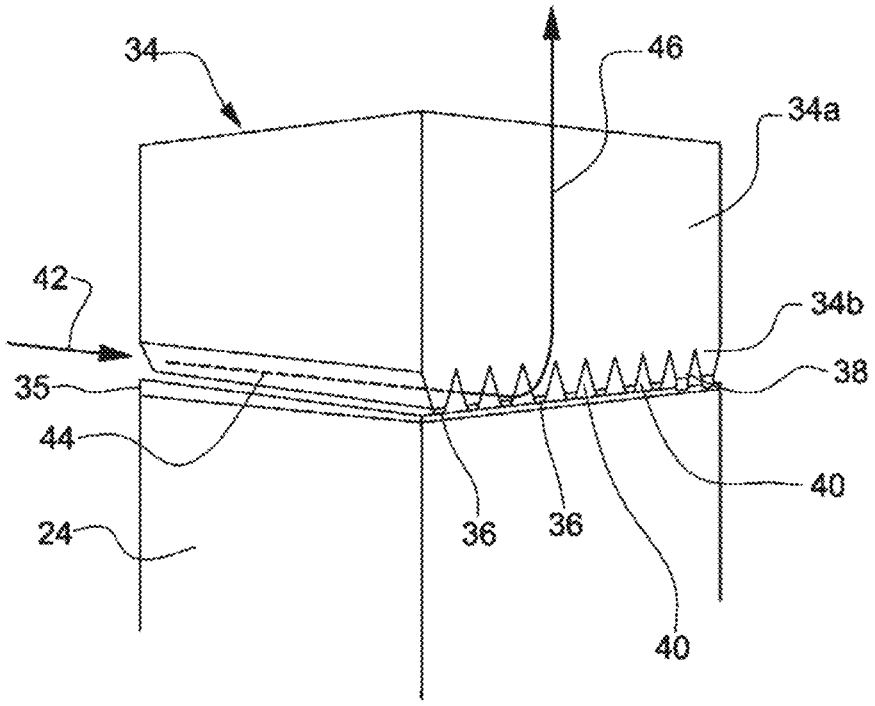
FIG. 7 is a perspective view illustration of the aerosol carrier and of part of an apparatus of the system for aerosol delivery according to one or more embodiments of the first mode of the present disclosure.
Figure 8:
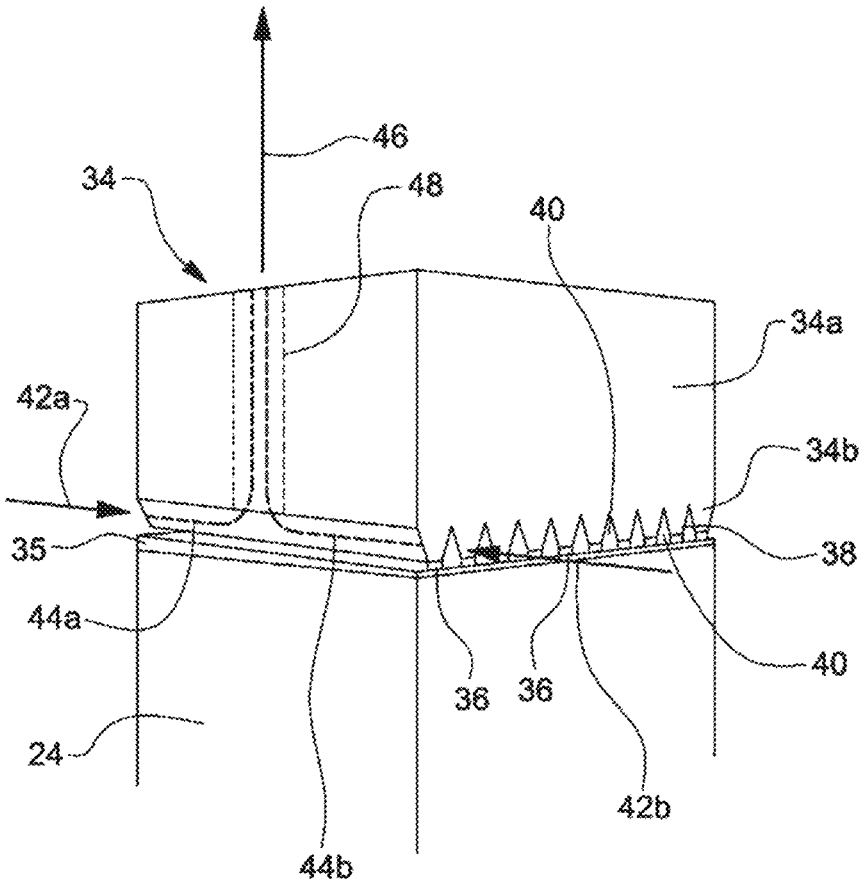
FIG. 8 is a perspective view illustration of the aerosol carrier and of part of an apparatus of the system for aerosol delivery according to one or more embodiments of the first mode of the present disclosure.

FIGS. 7 and 8 show perspective view illustrations of the fluid-transfer article 34 of aerosol carrier and a heater 24 of the apparatus of the system for aerosol delivery. In particular, these figures illustrate air flows across the activation surface 38 when the apparatus is in use in a first arrangement of the fluid-transfer article 34 (see FIG. 7), and in a second arrangement of the fluid-transfer article 34 (see FIG. 8).

In the illustrated example of use of the apparatus schematically illustrated in FIG. 7, when a user sucks on a mouthpiece of the apparatus, air is drawn into the carrier through inlet apertures (not shown) provided in a housing of the carrier. An incoming air stream 42 is directed to the activation surface 38 of the fluid-transfer article 34 (e.g., via a fluid communication pathway within the housing of the carrier). When the incoming air stream 42 reaches a first side of the activation surface 38, the incoming air stream 42 flows across the activation surface 38 via the one or more channels 40 formed between the activation surface 38 and heater 24. The air stream flowing through the one or more channels 40 is denoted by dashed line 44 in FIG. 7. As the air stream 44 flows through the one or more channels 40, aerosol precursor at activation surface 38, across which the air stream 44 flows, is released from the activation surface 38 by heat conveyed to the activation surface from the heater 24. Aerosol precursor released from the activation surface 38 in this manner is then entrained in the air stream 44 flowing through the one or more channels 40.

In use, the heater 24 of the apparatus 12 conveys heat to the fluid transfer article 34 to raise the temperature of the activation surface 38 to a sufficient temperature to release, or liberate, captive substances (i.e., the aerosol precursor) held at the activation surface 38 of the fluid-transfer article 34 to form a vapor and/or aerosol, which is drawn downstream across the activation surface 38 of the fluid-transfer article. As the air stream 44 continues its passage in the one or more channels 40, more released aerosol precursor is entrained within the air stream 44. When the air stream 44 entrained with aerosol precursor exits the one or more channels 40 at a second side of the activation surface 38, it is directed to an outlet, from where it can be inhaled by the user via a mouthpiece. An outgoing air stream 46 entrained with aerosol precursor is directed to the outlet (e.g., via a fluid communication pathway within the housing of the carrier).

Therefore, operation of the apparatus will cause heat from the heater 24 to be conveyed to the activation surface 38 of the fluid-transfer article. At a sufficiently high temperature, captive substances held at the activation surface 38 of the fluid-transfer article 34 are released, or liberated, to form a vapor and/or aerosol. Thus, when a user draws on a mouthpiece of the apparatus, the released substances from the fluid-transfer article are drawn away from the activation surface 38 (entrained in a stream of air) and condense to form an aerosol that is drawn through the gas communication pathway for delivery to an outlet, which is in fluid communication with the mouthpiece.

As the aerosol precursor is released from the activation surface 38, a wicking effect of the fluid-transfer article 34 causes aerosol precursor within the body of the fluid-transfer article to migrate to the activation surface 38 to replace the aerosol precursor released from the activation surface 38 into air stream 44.

Operation of the heater 24 is controlled by control circuitry (not shown), which is operable to actuate the heater 24 responsive to an actuation signal from a switch operable by a user or configured to detect when the user draws air through a mouthpiece of the apparatus by sucking or inhaling. In an optional arrangement, the control circuitry operates to actuate the heater 24 with as little delay as possible from receipt of the actuation signal from the switch, or detection of the user drawing air through the mouthpiece. This may affect near instantaneous heating of the activation surface 38 of the fluid-transfer article 34.

In the illustrated example of use of the apparatus schematically illustrated in FIG. 8, rather than the case of FIG. 7, where air is drawn toward the activation surface 38 from one side only (and exits from the one or more channels 40 at an opposite side), a gas communication pathway for an incoming air stream is configured to deliver the incoming air stream to the activation surface 38 from both sides of the fluid-transfer article, and thus from both ends of the channels 40 formed therein. In such an arrangement, a gas communication pathway for an outlet airstream may be provided through the body of the fluid-transfer article 34. An outlet fluid communication pathway for an outlet airstream in the illustrative example of FIG. 8 is denoted by reference number 48. Thus, in the illustrative example of FIG. 8, when a user draws on a mouthpiece of the apparatus, air is drawn into the carrier 14 through inlet apertures (not shown) provided in a housing of the carrier. An incoming air stream 42*a* from a first side is directed to a first side of the activation surface 38 of the fluid-transfer article 34 (e.g., via a gas communication pathway within the housing of the carrier 14).

An incoming air stream 42*b* from a second side is directed to a second side of the activation surface 38 of the fluid-transfer article 34 (e.g., via a gas communication pathway within the housing of the carrier 14). When the incoming air stream 42*a* from the first side reaches the first side of the activation surface 38, the incoming air stream 42*a* flows across the activation surface 38 via the one or more channels 40 formed between the activation surface 38 and the heater 24. Likewise, when the incoming air stream 42*b* from the second side reaches the second side of the activation surface 38, the incoming air stream 42*b* flows across the activation surface 38 via the one or more channels 40 formed between the activation surface 38 and the heater 24. The air streams 42*a*, 42*b* from each side flowing through the one or more channels 40 are denoted by dashed lines 44*a* and 44*b* in FIG. 8. As air streams 44*a* and 44*b* flow through the one or more channels 40, aerosol precursor in the activation surface 38, across which the airstreams 44*a* and 44*b* flow, is released from the activation surface 38 by heat conveyed to the activation surface from the heater 24. Aerosol precursor released from the activation surface 38 is entrained in air streams 44*a* and 44*b* flowing through the one or more channels 40.

In use, the heater 24 of the apparatus 12 conveys heat to the fluid-transfer article 34 to raise a temperature of the activation surface 38 to a sufficient temperature to release, or liberate, captive substances (i.e., the aerosol precursor) held at the activation surface 38 of the fluid-transfer article 34 to form a vapor and/or aerosol, which is drawn downstream across the activation surface 38 of the fluid-transfer article. As the air streams 44*a* and 44*b* continue their passages in the one or more channels 40, more released aerosol precursor is entrained within the air streams 44*a* and 44*b*. When the air streams 44*a* and 44*b* entrained with aerosol precursor meet at a mouth of the outlet fluid communication pathway 48, they enter the outlet fluid communication pathway 48 and continue until they exit outlet fluid communication pathway 48, either as a single outgoing air stream 46 (as shown), or as separate outgoing air streams. The outgoing air stream 46 is directed to an outlet, from where it can be inhaled by the user via a mouthpiece. The outgoing air stream 46 entrained with aerosol precursor is directed to the outlet (e.g., via a gas communication pathway within the housing of the carrier 14).

It should be noted that, in FIGS. 7 and 8, heater 24 similar to that in FIGS. 5 and 6, with a substrate 35 on which are formed heating elements 36. Those heating elements are not aligned with the channels 40, but are aligned with the walls between those channels 40.

Figure 9:
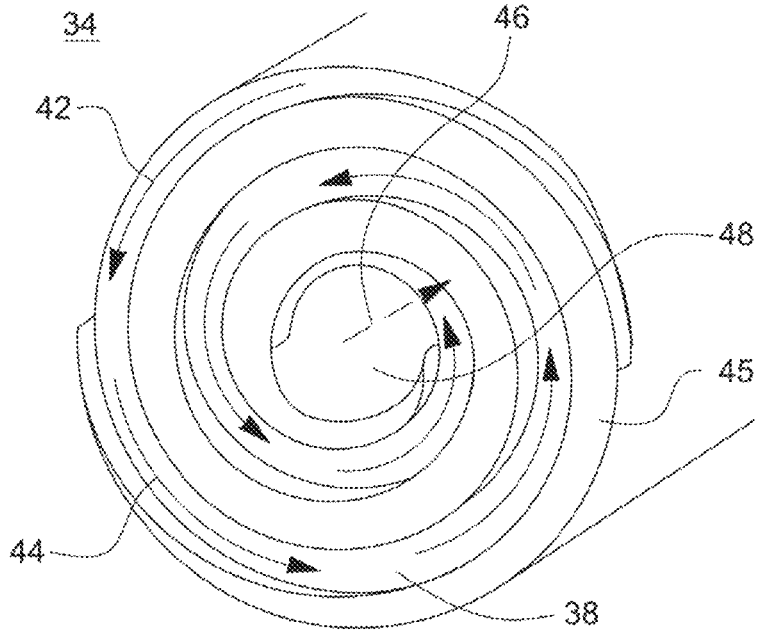
FIG. 9 is a perspective end view illustration of a fluid-transfer article of the aerosol carrier according to one or more embodiments of the first mode of the present disclosure.
Figure 10:
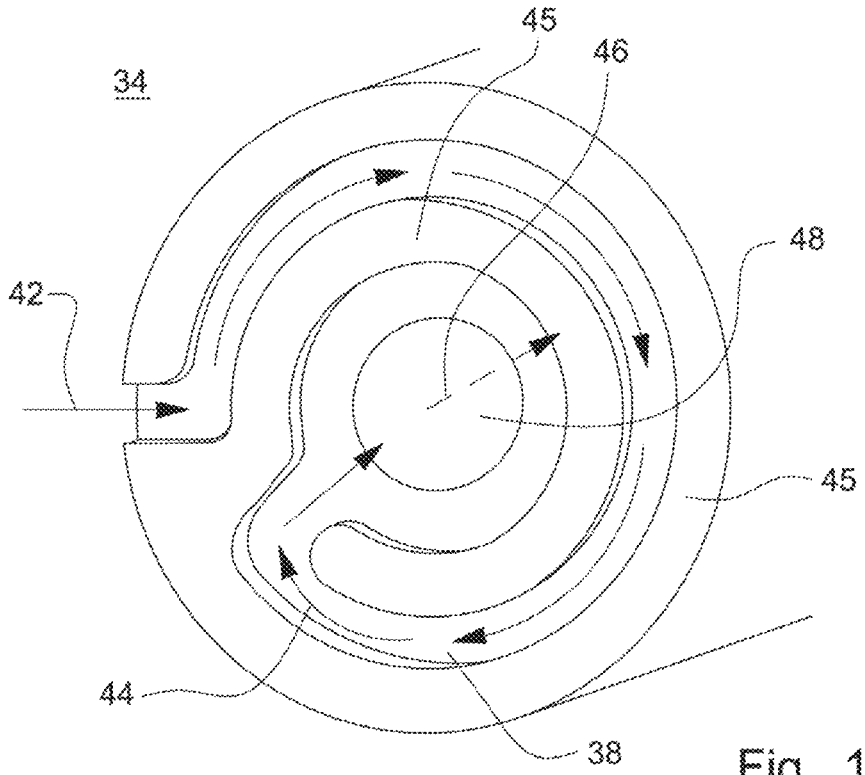
FIG. 10 is a perspective end view illustration of a fluid-transfer article of the aerosol carried according to one or more embodiments of the first mode of the present disclosure.

FIGS. 9 and 10 are perspective end view illustrations of a fluid-transfer article 34 of the aerosol carrier according to one or more arrangements. These figures show different types of channel configurations as illustrative examples. In both illustrative examples of a channel configuration, as shown in FIGS. 9 and 10, the fluid-transfer article 34 comprises a cylindrical member, which comprises a central bore extending therethrough for fluid communication between the activation surface 38 and an outlet, from where an outgoing air stream can be delivered for inhalation. The central bore serves as a fluid communication pathway 48 (e.g., as described above in relation to FIG. 9). Note that, in the arrangements of FIGS. 9 and 10, the channels 40 extend radially and the sectional views of FIGS. 9 and 10 are along the length of two channels on opposite radial positions relative to the central bore of the fluid-transfer article. The heating elements 36 are therefore not visible in FIGS. 9 and 10, although they will be in similar positions, relative to the channels, as the heating elements 36 and channels in FIGS. 5 to 8.

In both illustrative examples of FIGS. 9 and 10, an incoming air stream 42 is directed to a mouth of a channel 40 formed between the activation surface 38 of the fluid-transfer article 34 and conduction element (not shown), or between the activation surface 38 and a heater (not shown). In both illustrative examples of FIGS. 9 and 10, the mouth of the channel 40 is located at an outer edge of the fluid-transfer article 34 and an exit from the channel 40 (in fluid communication with the fluid communication pathway 48) is located toward a center of the fluid-transfer article. Therefore, the incoming air stream 42 enters the channel 40 via channel mouth at the outer edge of the fluid-transfer article 34 and moves toward the center of the fluid-transfer article 34 as directed by the channel 40. As described above, as the air stream passes across activation surface 38 through channel 40, aerosol precursor is released from the activation surface 38 and is entrained in air stream 44. Air stream 44 continues to flow through the channel 40 until it reaches an exit thereof, from where it enters the fluid communication pathway 48 and proceeds as an outgoing air stream 46 entrained with aerosol precursor toward the outlet.

In both illustrative examples of FIGS. 9 and 10, the valleys or grooves of the activation surface 38 that form part of the channel 40 are arranged to define a circuitous route 20 across the activation surface. In the illustrative examples, the route is a spiral path, but in optional arrangements, may be meandering or circuitous in some other manner. In optional arrangements, the activation surface may be located to face outwardly from the cylinder, such that the groove(s) or valley(s) may be in the outer surface of the cylinder forming the fluid-transfer article. These grooves or valleys may be arranged in parallel in a direction along the length of the cylinder. The groove(s) or valley(s) may be arranged in a spiral manner around the outside of the cylinder. In optional arrangements, the activation surface 38 may be located to face inwardly from the cylinder (i.e., surrounding the central bore), such that the groove(s) or valley(s) may be in the inner surface of the cylinder forming the fluid-transfer article 34. These grooves or valleys may be arranged in parallel in a direction along the length of the cylinder. The groove(s) or valley(s) may be arranged in a spiral manner around the inside of the cylinder.

Figure 11:
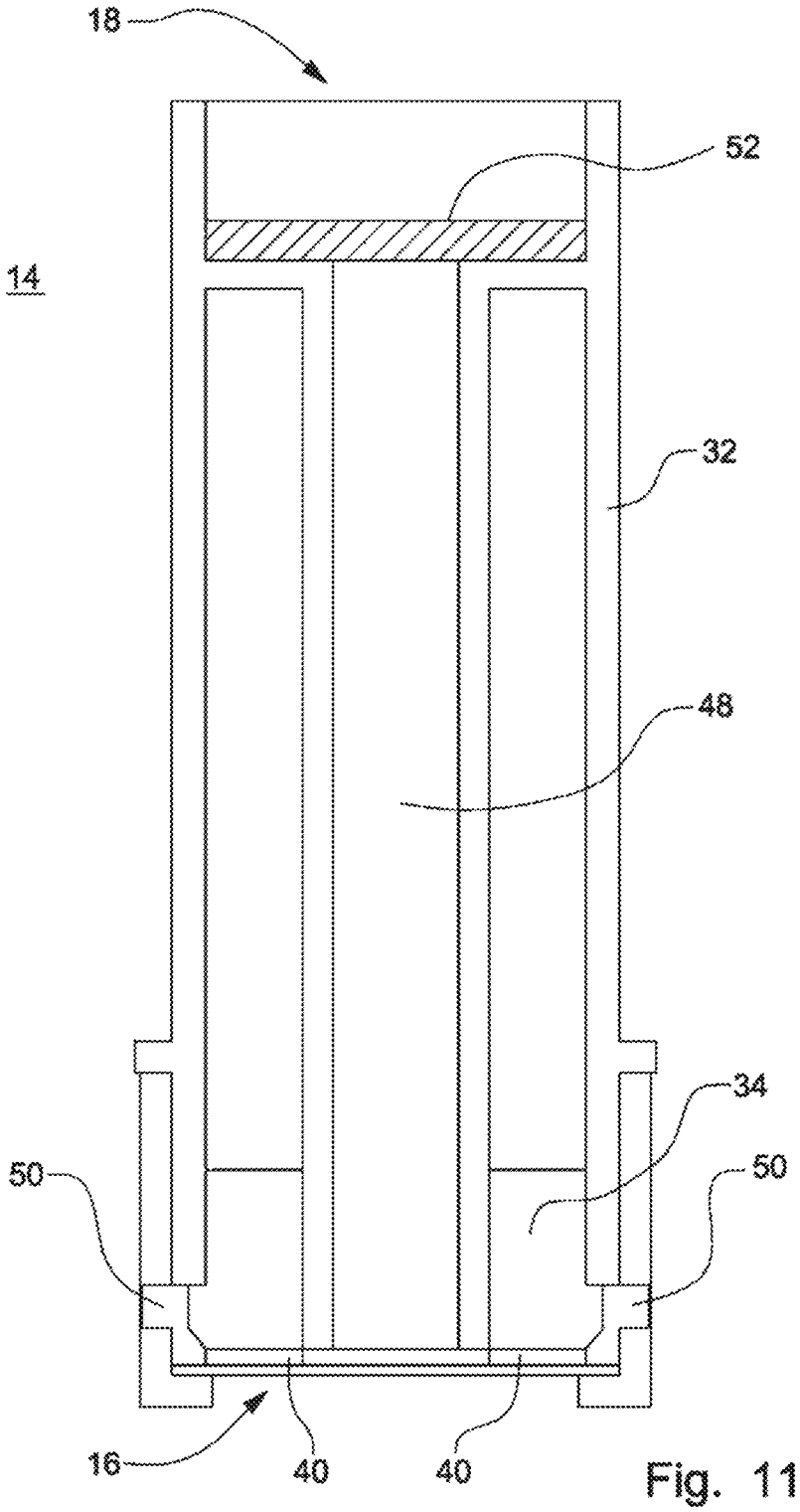
FIG. 11 is a cross-section side view of an aerosol carrier according to one or more embodiments of the first mode of the present disclosure.
Figure 12:
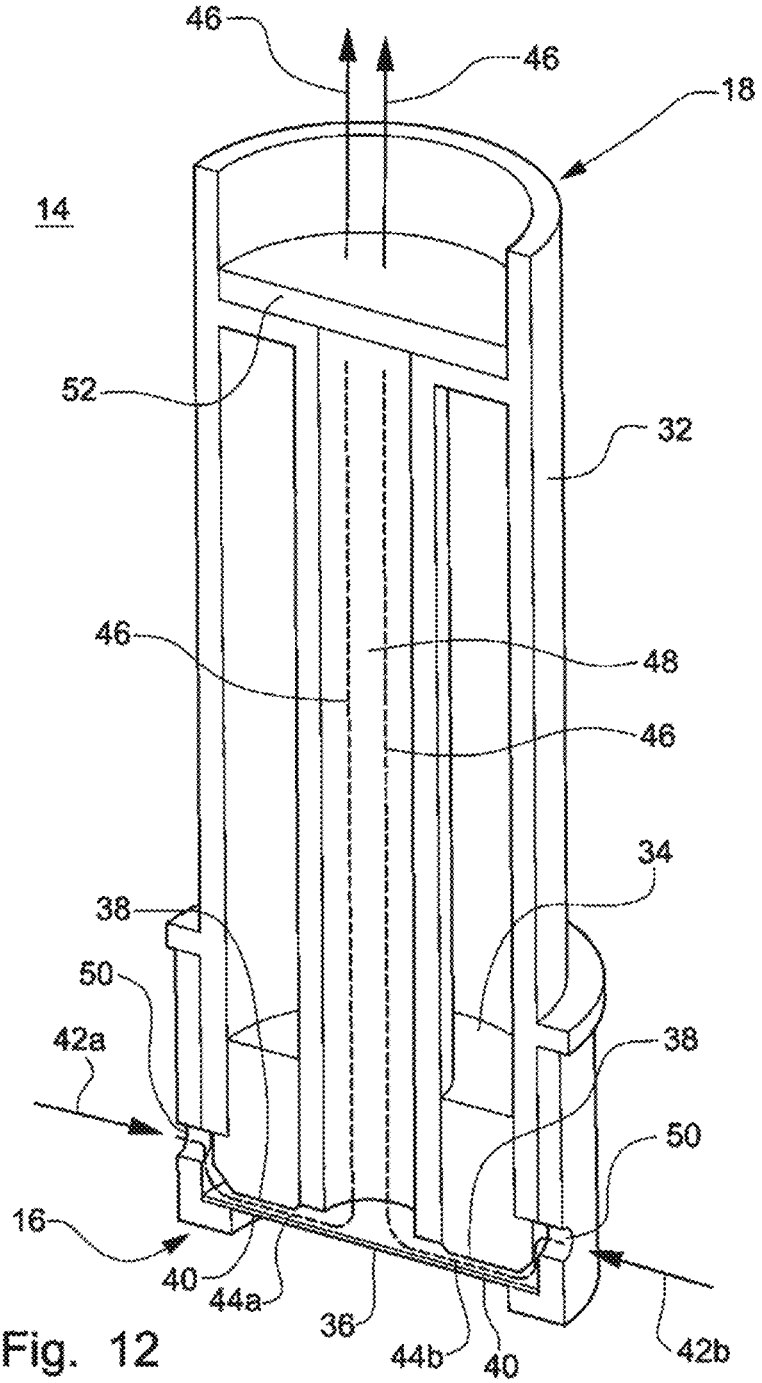
FIG. 12 is a perspective cross-section side view of the aerosol carrier of FIG. 11.

With the arrangement shown in FIGS. 9 and 10, the heating elements of the heater are therein not aligned with the valleys or grooves in the activation surface 38. Instead, they will be aligned with the projecting wall 45 of the activation surface 38, between which walls 45 the valleys or grooves are formed. FIGS. 11 and 12 illustrate an aerosol carrier 14 according to one or more possible arrangements in more detail. FIG. 11 is a cross-section side view illustration of the aerosol carrier 14 and FIG. 12 is a perspective cross-section side view illustration of the aerosol carrier 14 of FIG. 11. In FIGS. 11 and 12, the structure of the heater 24 is not illustrated in detail. However, it may correspond to, e.g., one of the arrangements of FIGS. 5 to 8, with a heater 24 having a substrate 35 on which heating elements 36 are formed which are not aligned with the channels 40, and instead are aligned with the parts of the activation surface between those channels 40.

As can be seen from FIGS. 11 and 12, the aerosol carrier 14 is generally tubular in form. The aerosol carrier 14 comprises housing 32, which defines the external walls of the aerosol carrier 14 and which defines therein a chamber in which are disposed the fluid-transfer article 34 (adjacent the first end 16 of the aerosol carrier 14) and internal walls defining the fluid communication pathway 48. Fluid communication pathway 48 defines a fluid pathway for an outgoing air stream from the channels 40 to the second end 18 of the aerosol carrier 14. In the examples illustrated in FIGS. 11 and 12, the fluid-transfer article 34 is an annular shaped element located around the fluid communication pathway 48, and the channels 40 are arranged so as to extend radially across its activation surface.

In walls of the housing 32, there are provided inlet apertures 50 to provide a fluid communication pathway for an incoming air stream to reach the fluid-transfer article 34, and particularly the one or more channels 40 defined between the activation surface of the fluid-transfer article 34 and the heater 24.

In the illustrated example of FIGS. 11 and 12, the aerosol carrier 14 further comprises a filter element 52. The filter element 52 is located across the fluid communication pathway 48 such that an outgoing air stream passing through the fluid communication pathway 48 passes through the filter element 52.

With reference to FIG. 12, when a user sucks on a mouthpiece of the apparatus (or on the second end 18 of the aerosol carrier 14, if configured as a mouthpiece), air is drawn into the carrier through inlet apertures 50 extending through walls in the housing 32 of the aerosol carrier 14. An incoming air stream 42*a* from a first side of the aerosol carrier 14 is directed to a first side of the activation surface 38 of the fluid-transfer article 34 (e.g., via a gas communication pathway within the housing of the carrier). An incoming air stream 42*b* from a second side of the aerosol carrier 14 is directed to a second side of the activation surface 38 of the fluid-transfer article 34 (e.g., via a gas communication pathway within the housing of the carrier). When the incoming air stream 42*a* from the first side of the aerosol carrier 14 reaches the first side of the activation surface 38, the incoming air stream 42*a* from the first side of the aerosol carrier 14 flows across the activation surface 38 via the one or more channels 40 formed between the activation surface 38 and the conduction element 36 (or between the activation surface 38 and heater 24). Likewise, when the incoming air stream 42*b* from the second side of the aerosol carrier 14 reaches the second side of the activation surface 38, the incoming air stream 42*b* from the second side of the aerosol carrier 14 flows across the activation surface 38 via the one or more channels 40 formed between the activation surface 38 and the conduction element 36 (or between the activation surface 38 and heater 24). The air streams from each side flowing through the one or more channels 40 are denoted by dashed lines 44*a* and 44*b* in FIG. 12. As air streams 44*a* and 44*b* flow through the one or more channels 40, aerosol precursor in the activation surface 38, across which the air streams 44*a* and 44*b* flow, is released from the activation surface 38 by heat conveyed to the activation surface from the heater 24. Aerosol precursor released from the activation surface 38 is entrained in air streams 44*a* and 44*b* flowing through the one or more channels 40.

In use, the heater 24 of the apparatus 12 conveys heat to the activation surface 38 of the fluid-transfer article 34 to raise a temperature of the activation surface 38 to a sufficient temperature to release, or liberate, captive substances (i.e., the aerosol precursor) held at the activation surface 38 of the fluid-transfer article 34 to form a vapor and/or aerosol, which is drawn downstream across the activation surface 38 of the fluid-transfer article 34. As the air streams 44*a* and 44*b* continue their passages in the one or more channels 40, more released aerosol precursor is entrained within the air streams 44*a* and 44*b*. When the air streams 44*a* and 44*b* entrained with aerosol precursor meet at a mouth of the outlet fluid communication pathway 48, they enter the outlet fluid communication pathway 48 and continue until they pass through filter element 52 and exit outlet fluid communication pathway 48, either as a single outgoing air stream, or as separate outgoing air streams 46 (as shown). The outgoing air streams 46 are directed to an outlet, from where it can be inhaled by the user directly (if the second end 18 of the aerosol capsule 14 is configured as a mouthpiece), or via a mouthpiece. The outgoing air streams 46 entrained with aerosol precursor are directed to the outlet (e.g., via a gas communication pathway within the housing of the carrier).

Figure 13:
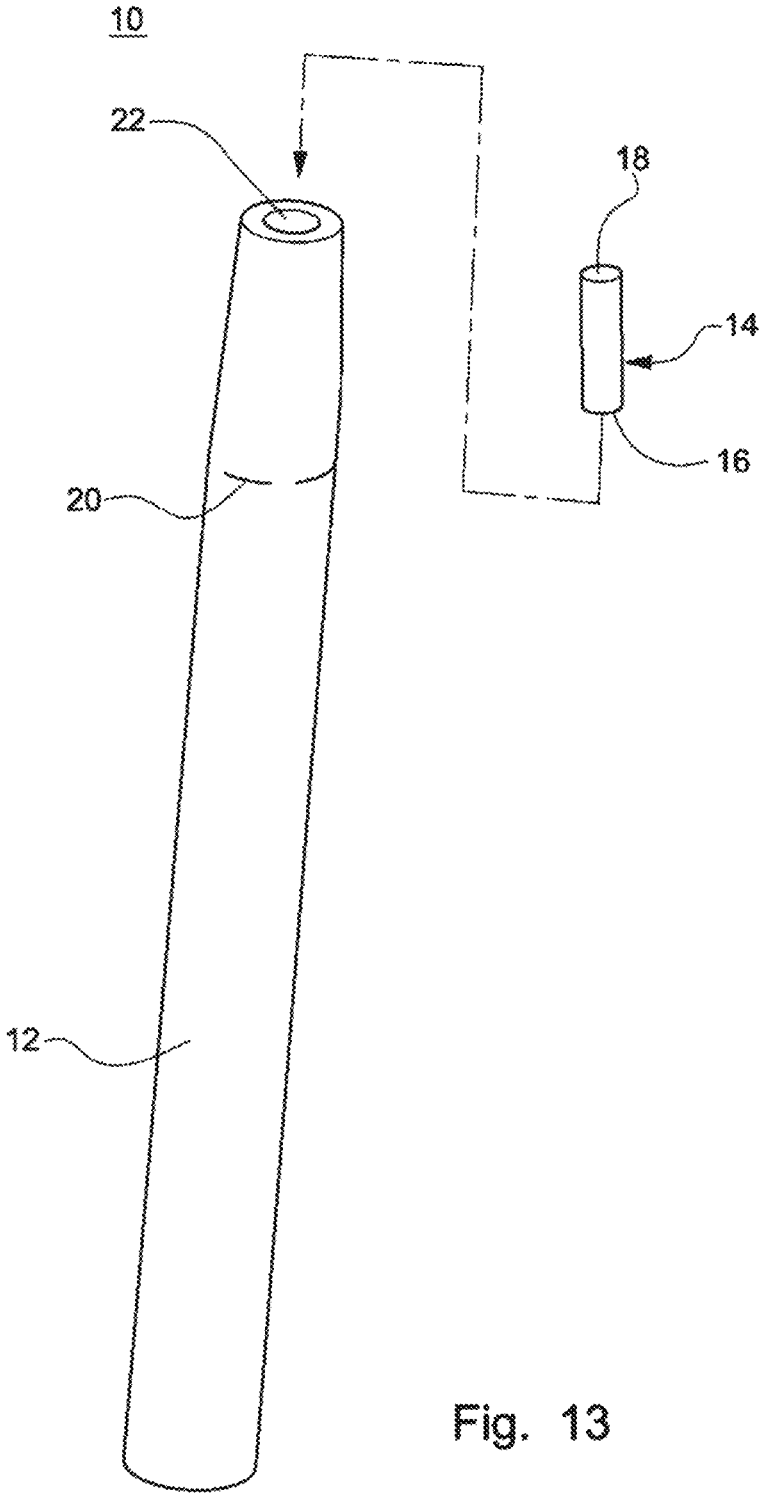
FIG. 13 is an exploded perspective view illustration of a kit-of-parts for assembling a system according to one or more embodiments of the first mode of the present disclosure.

When the user initially draws on a mouthpiece of the apparatus (or one the second end 18 of the aerosol carrier 14, if configured as a mouthpiece), this will cause an air column located in the fluid communication pathway 48 to move towards the outlet. In turn, this will draw air into the fluid communication pathway from the one or more channels 40. This will cause a pressure drop in the channels 40. To equalize the pressure in the channels 40, air will be drawn into the aerosol carrier 14, and thus into the channels 40 via the inlet apertures 50. During the period of lower pressure in the one or more channels 40 when the user begins to draw, aerosol precursor in the fluid-transfer medium will be released into the channels from the activation surface 38, because the aerosol precursor is drawn into the one or more channels by way of the lower pressure. This effect is in addition to the effect of releasing the aerosol precursor from the activation surface 38 by way of heat conveyed from the heater. The drawing of the aerosol precursor from the activation surface 38 by way of the user sucking on the mouthpiece of the apparatus (or one the second end 18 of the aerosol carrier 14, if configured as a mouthpiece) may produce a dragging effect on the volumetric rate of flow experienced by the user during a suction action, i.e., the user may have to suck harder to achieve a same volumetric rate of flow. This effect may manifest itself as a similar physical sensation experienced by the user as those experienced from a traditional smoking or tobacco product. FIG. 13 is an exploded perspective view illustration of a kit-of-parts for assembling an aerosol delivery system 10.

As will be appreciated, in the arrangements described above, the fluid-transfer article 34 is provided within a housing 32 of the aerosol carrier 14. In such arrangements, the housing of the carrier 14 serves to protect the aerosol precursor-containing fluid-transfer article 34, whilst also allowing the carrier 14 to be handled by a user without his/her fingers coming into contact with the aerosol precursor liquid retained therein. In such arrangements, it will be appreciated that the carrier 14 has a multi-part construction. In some cases, this might be considered somewhat disadvantageous because it requires a relatively complicated assembly procedure which can be both time-consuming and expensive. Turning now to consider FIG. 14, there is illustrated another possible aspect of the first mode of the fluid-transfer article 34, which may be employed in some arrangements, and which may permit the creation of a significantly simplified carrier 14.

Figure 14:
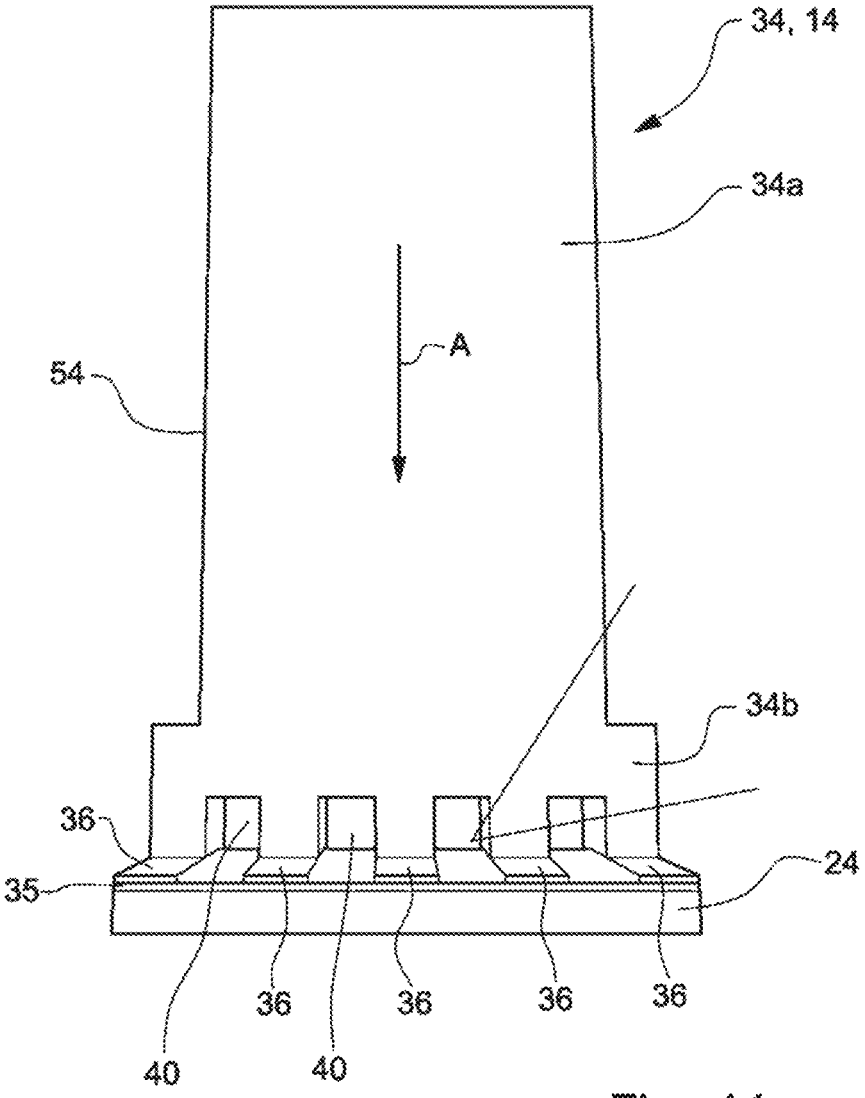
FIG. 14 is a cross-section side view of elements of an aerosol carrier and of part of an apparatus of the system for aerosol delivery according to one or more embodiments of the first mode of the present disclosure.

FIG. 14 illustrates an alternative fluid-transfer article 34 in position adjacent a planar heater 24, such that the air flow channels 40 are positioned between the activation surface 38 and the heater 24. In the arrangement of FIG. 14, the substrate forming the fluid-transfer article 34 again comprises a porous material where pores of the porous material hold, contain, carry, or bear the aerosol precursor material. Itis envisaged, for example, that the same types of substrate material may be used in the arrangement illustrated in FIG. 14 as in the previously-described arrangements. In particular, therefore, the porous material of the fluid-transfer article 34 may be a polymeric wicking material. However, in the arrangement illustrated in FIG. 14, the substrate material includes an integrally formed peripheral wall 54.

It is proposed that the peripheral wall 54 may be formed by treating the outermost surface of the porous substrate material of the fluid-transfer article 34 so as to render the surface substantially liquid-impermeable. For example, it is envisaged that in some arrangements the substrate material may be locally heated so as to fuse the material and close up its internal pores in the localized region of the surface. Alternatively, it is envisaged that the substrate material may be treated by a sintering process in order to create the liquid-impermeable peripheral wall 54.

The peripheral wall 54 may alternatively be created by a chemical treatment process to render the substrate material substantially liquid-impermeable in the region of its outermost surface. As will therefore be appreciated, the peripheral wall 54 may be considered to take the form of a skin formed from the material of the substrate itself. The peripheral wall may be created in this manner so as to substantially completely circumscribe the substrate material. It is to be appreciated, however, that the activation surface 38 of the fluid-transfer article 34 will not be treated in this manner, thereby ensuring that it will retain the function described above in detail in cooperation with the heater 24.

The thickness of the peripheral wall 54 formed from the substrate may vary depending on the desired physical properties of the fluid-transfer article 34. For example, a relatively thin wall 54 might be desirable in some circumstances, as this may retain some flexibility in the material, thereby providing a fluid-transfer article which will feel soft in the hands of a user. Alternatively, a relatively thick peripheral wall 54 might be desirable in arrangements where the wall 54 is required to provide some structural rigidity to the fluid-transfer article 34. The wall 54 may therefore have a thickness of less than 3 mm; or less than 2.5 mm; or less than 2 mm; or less than 1.5 mm; or less than 1 mm; or less than 0.9 mm; or less than 0.8 mm; or less than 0.7 mm; or less than 0.6 mm; or less than 0.5 mm; or less than 0.4 mm; or less than 0.3 mm; or less than 0.2 mm; or less than 0.1 mm in some embodiments of the first mode. As will be appreciated, the liquid-impermeable nature of the resulting peripheral wall or skin means that the fluid-transfer article 34 may be handled by a user without getting his or her fingers wet from the aerosol precursor liquid retained therein. This opens up the possibility of the fluid-transfer article 34 being used without an enclosing housing 32, as was necessary in the previously-described arrangements. It is therefore envisaged that in some arrangements, the fluid-transfer article 34 may itself define an entire aerosol carrier 14. Furthermore, it is envisaged that in some embodiments of the first mode, a fluid-transfer article 34 in accordance with this proposal may be provided in the form of a unitary monolithic element of substrate material and could, therefore, take the form of a single-piece consumable or carrier 14 for an aerosol-delivery system 10, which may be provided pre-filled with aerosol precursor liquid and which may be discarded when the initial volume of precursor has been used. A single-piece consumable of this type offers very significant advantages in terms of cost of manufacture, and from an environmental point of view.

Figure 15:
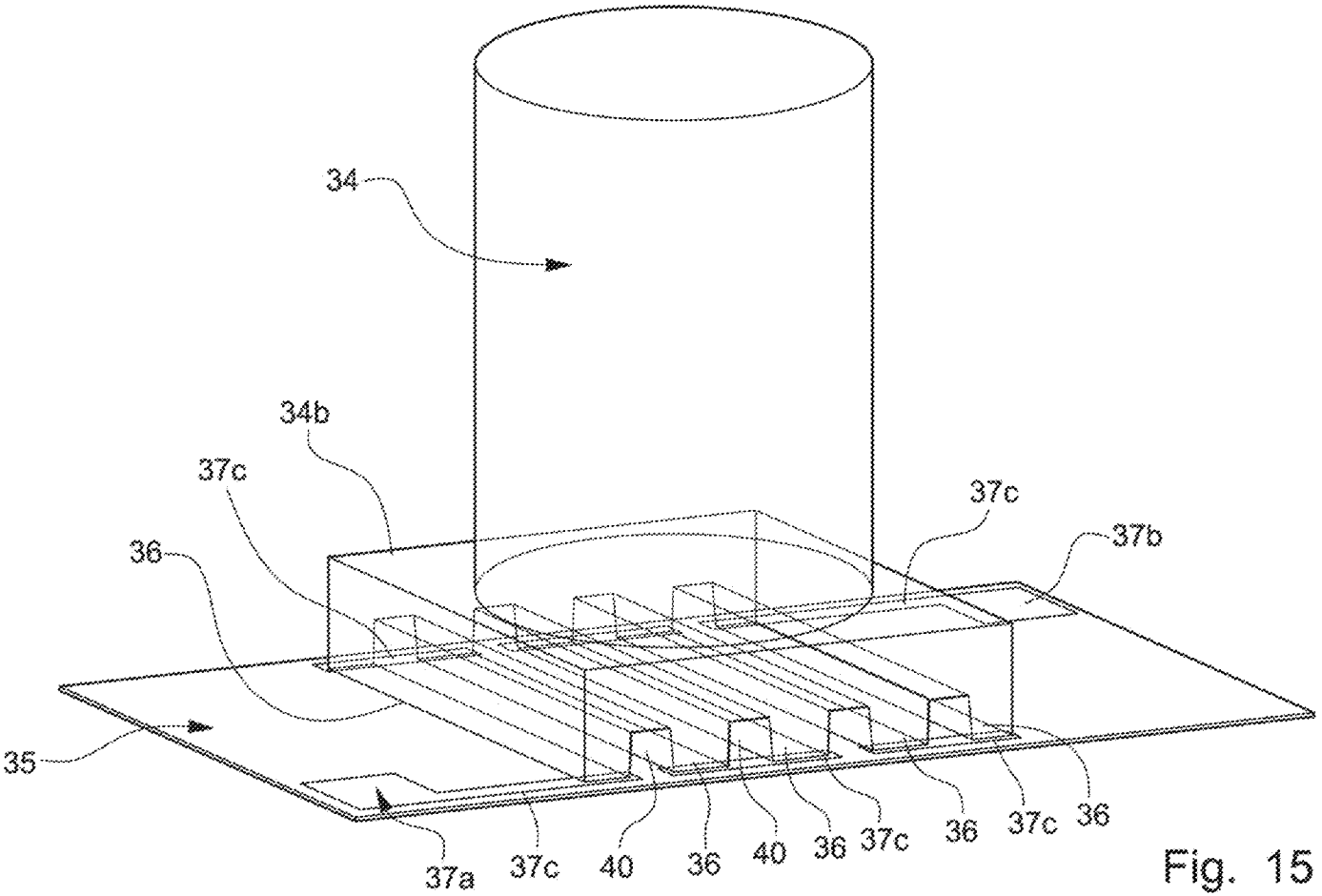
FIG. 15 is a perspective view of elements of an aerosol carrier and of part of an apparatus of the system for aerosol delivery according to one or more embodiments of the first mode of the present disclosure.

In order to illustrate the electrical connection of the heating elements 36, FIG. 15 shows an arrangement corresponds to FIG. 14, but in a perspective view, with part of the fluid-transfer article shown transparent (in reality, it will not be transparent). FIG. 15 thus illustrates the channels 40 and the heating elements 36 which are aligned with the walls of the second region 34*b* on either side of the channels 40. FIG. 15 also illustrates electrical contacts 37*a* and 37*b* on the substrate 35, which are connected to the heating elements 36 and which are connected to a source of electrical power for heating the heating elements 36. Conductive strips 37*c* then connect the terminals 37*a* and 37*b* with the heating elements 36, and connect the heating elements 36 to each other. The connection is such that the heating elements and conductive strips 37*c* form a zig-zag arrangement along the substrate 35. Other parts of the structure of FIG. 15 correspond to those shown in FIG. 14.

The porous layer may have a thickness of less than 5 mm. In other embodiments of the first mode it may have a thickness of: less than 3.5 mm, less than 3 mm, less than 2.5 mm, less than 2 mm, less than 1.9 mm, less than 1.8 mm, less than 1.7 mm, less than 1.6 mm, less than 1.5 mm, less than 1.4 mm, less than 1.3 mm, less than 1.2 mm, less than 1.1 mm, less than 1 mm, less than 0.9 mm, less than 0.8 mm, less than 0.7 mm, less than 0.6 mm, less than 0.5 mm, less than 0.4 mm, less than 0.3 mm, less than 0.2 mm, or less than 0.1 mm.

There has been described in the foregoing one or more proposals for an aerosol delivery system, and parts thereof, that avoids or at least ameliorates problems of the prior art.

In one or more optional arrangements of the first mode, a fluid-transfer article 34 containing nicotine and/or nicotine compounds may be substituted or supplemented with a fluid-transfer article configured to provide a flavored vapor and/or aerosol upon heating of the fluid-transfer article by the heater 24 of the apparatus 12. A precursor material for forming the flavored vapor and/or aerosol upon heating is held within pores, spaces, channels and/or conduits within the fluid-transfer article. The precursor material may be extracted from a tobacco plant starting material using a supercritical fluid extraction process. Optionally, the precursor material is nicotine-free and comprises tobacco-flavors extracted from the tobacco plant starting material. Further optionally, the extracted nicotine-free precursor material (e.g., flavors only) could have nicotine added thereto prior to loading of the precursor material into the substrate of the carrier unit. Further optionally, flavors and physiologically active material may be extracted from plants other than tobacco plants.

Second Mode: An Aerosol-Generation Apparatus has a Fluid-Transfer Article which Holds and Transfers Aerosol Precursor to an Activation Surface Aspects and embodiments of the second mode of the present disclosure will now be discussed with reference to the accompanying figures. Further aspects and embodiments of the second mode will be apparent to those skilled in the art. All documents mentioned in this text are incorporated herein by reference.

In general outline, one or more embodiments in accordance with the present disclosure may provide a system for aerosol delivery in which an aerosol carrier may be inserted into a receptacle (e.g., a "heating chamber") of an apparatus for initiating and maintaining release of an aerosol from the aerosol carrier. Another end, or another end portion, of the aerosol carrier may protrude from the apparatus and can be inserted into the mouth of a user for the inhalation of aerosol released from the aerosol carrier cartridge during operation of the apparatus.

Figure 16:
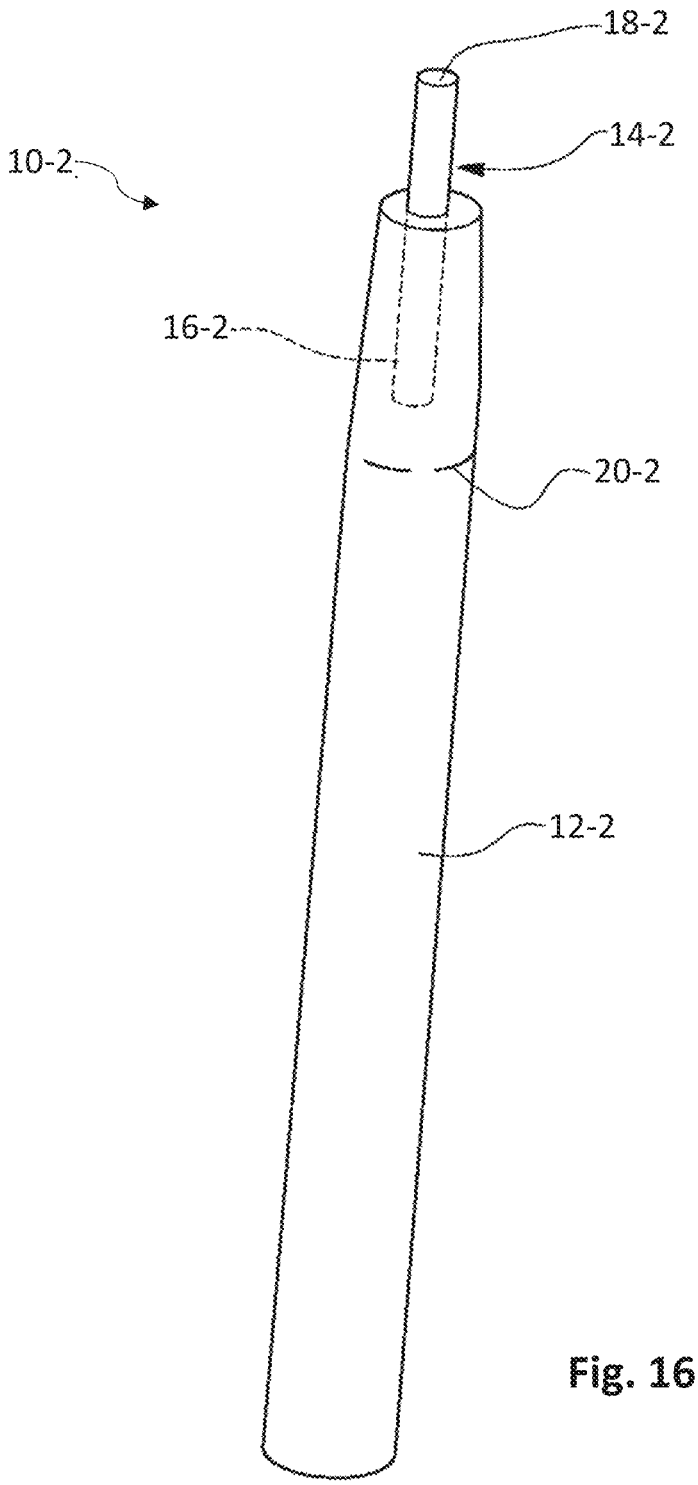
FIG. 16 is a perspective view illustration of a system for aerosol delivery according to one or more embodiment of the second mode of the present disclosure.

Hereinafter, and for convenience only, "system for aerosol delivery" shall be referred to as "aerosol delivery system". Referring now to FIG. 16, there is illustrated a perspective view of an aerosol delivery system 10-2 comprising an aerosol generation apparatus 12-2 operative to initiate and maintain release of aerosol from a fluid-transfer article in an aerosol carrier 14-2. In the arrangement of FIG. 16, the aerosol carrier 14-2 is shown with a first end 16-2 thereof and a portion of the length of the aerosol carrier 14-2 located within a receptacle of the apparatus 12-2. A remaining portion of the aerosol carrier 14-2 extends out of the receptacle. This remaining portion of the aerosol carrier 14-2, terminating at a second end 18-2 of the aerosol carrier, is configured for insertion into a user's mouth. A vapor and/or aerosol is produced when a heater (not shown in FIG. 16) of the apparatus 12-2 heats a fluid-transfer article in the aerosol carrier 14-2 to release a vapor and/or an aerosol, and this can be delivered to the user, when the user sucks or inhales, via a fluid passage in communication with an outlet of the aerosol carrier 14-2 from the fluid-transfer article to the second end 18-2.

The device 12-2 also comprises air-intake apertures 20-2 in the housing of the apparatus 12-2 to provide a passage for air to be drawn into the interior of the apparatus 12-2 (when the user sucks or inhales) for delivery to the first end 16-2 of the aerosol carrier 14-2, so that the air can be drawn across an activation surface of a fluid-transfer article located within a housing of the aerosol carrier cartridge 14-2 during use. Optionally, these apertures may be perforations in the housing of the apparatus 12-2.

A fluid-transfer article (not shown in FIG. 16, but described hereinafter with reference to FIGS. 20 to 23) is located within a housing of the aerosol carrier 14-2. The fluid-transfer article contains an aerosol precursor material, which may include at least one of: nicotine; a nicotine precursor material; a nicotine compound; and one or more flavorings. The fluid-transfer article is located within the housing of the aerosol carrier 14-2 to allow air drawn into the aerosol carrier 14-2 at, or proximal, the first end 16-2 to flow across an activation surface of the fluid-transfer article. As air passes across the activation surface of the fluid-transfer article, an aerosol may be entrained in the air stream from a substrate forming the fluid-transfer article, e.g., via diffusion from the substrate to the air stream and/or via vaporization of the aerosol precursor material and release from the fluid-transfer article under heating. The substrate forming the fluid-transfer article 34-2 comprises a porous material where pores of the porous material hold, contain, carry, or bear the aerosol precursor material. In particular, the porous material of the fluid-transfer article is a porous polymer material such as, for example, a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET). All such materials may be described as heat resistant polymeric wicking material in the context of the present disclosure.

The aerosol carrier 14-2 is removable from the apparatus 12-2 so that it may be disposed of when expired. After removal of a used aerosol carrier 14-2, a replacement aerosol carrier 14-2 can be inserted into the apparatus 12-2 to replace the used aerosol carrier 14-2.

Figure 17:
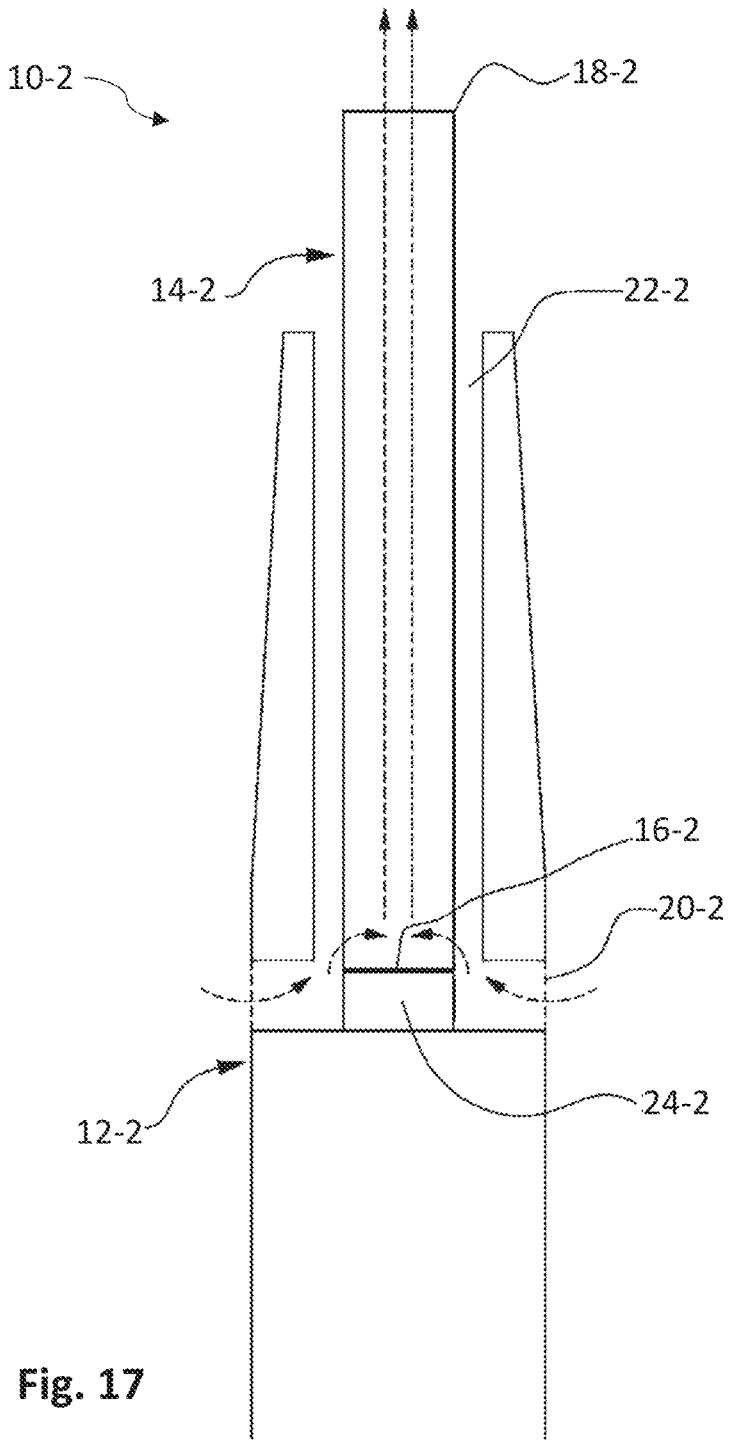
FIG. 17 is a cross-section side view illustration of part of an apparatus of the system for aerosol delivery of FIG. 16.

FIG. 17 is a cross-sectional side view illustration of a part of apparatus 12-2 of the aerosol delivery system 10. The apparatus 12-2 comprises a receptacle 22-2 in which is located a portion of the aerosol carrier 14-2. In one or more optional arrangements, the receptacle 22-2 may enclose the aerosol carrier 14-2. The apparatus 12-2 also comprise a heater 24-2, which opposes an activation surface of the fluid-transfer article (not shown in FIG. 17) of the aerosol carrier 14-2 when an aerosol carrier 14-2 is located within the receptacle 22-2.

Air flows into the apparatus 12-2 (in particular, into a closed end of the receptacle 22-2) via air-intake apertures

20-2. From the closed end of the receptacle 22-2, the air is drawn into the aerosol carrier 14-2 (under the action of the user inhaling or sucking on the second end 18-2) and expelled at the second end 18-2. As the air flows into the aerosol carrier 14-2, it passes across the activation surface of the fluid-transfer article. Heat from the heater 24-2, which opposes the activation surface of the fluid-transfer article, causes vaporization of aerosol precursor material at the activation surface of the fluid-transfer article and an aerosol is created in the air flowing over the activation surface. Thus, through the application of heat in the region of the activation surface of the fluid-transfer article, an aerosol is released, or liberated, from the fluid-transfer article, and is drawn from the material of the aerosol carrier unit by the air flowing across the activation surface and is transported in the air flow to via outlet conduits (not shown in FIG. 17) in the housing of the aerosol carrier 14-2 to the second end 18-2. The direction of air flow is illustrated by arrows in FIG. 17.

To achieve release of the captive aerosol from the fluid-transfer article, the fluid-transfer article of the aerosol carrier 14-2 is heated by the heater 24-2. As a user sucks or inhales on second end 18-2 of the aerosol carrier 14-2, the aerosol released from the fluid-transfer article and entrained in the air flowing across the activation surface of the fluid-transfer article is drawn through the outlet conduits (not shown) in the housing of the aerosol carrier 14-2 towards the second end 18-2 and onwards into the user's mouth.

Figure 18:
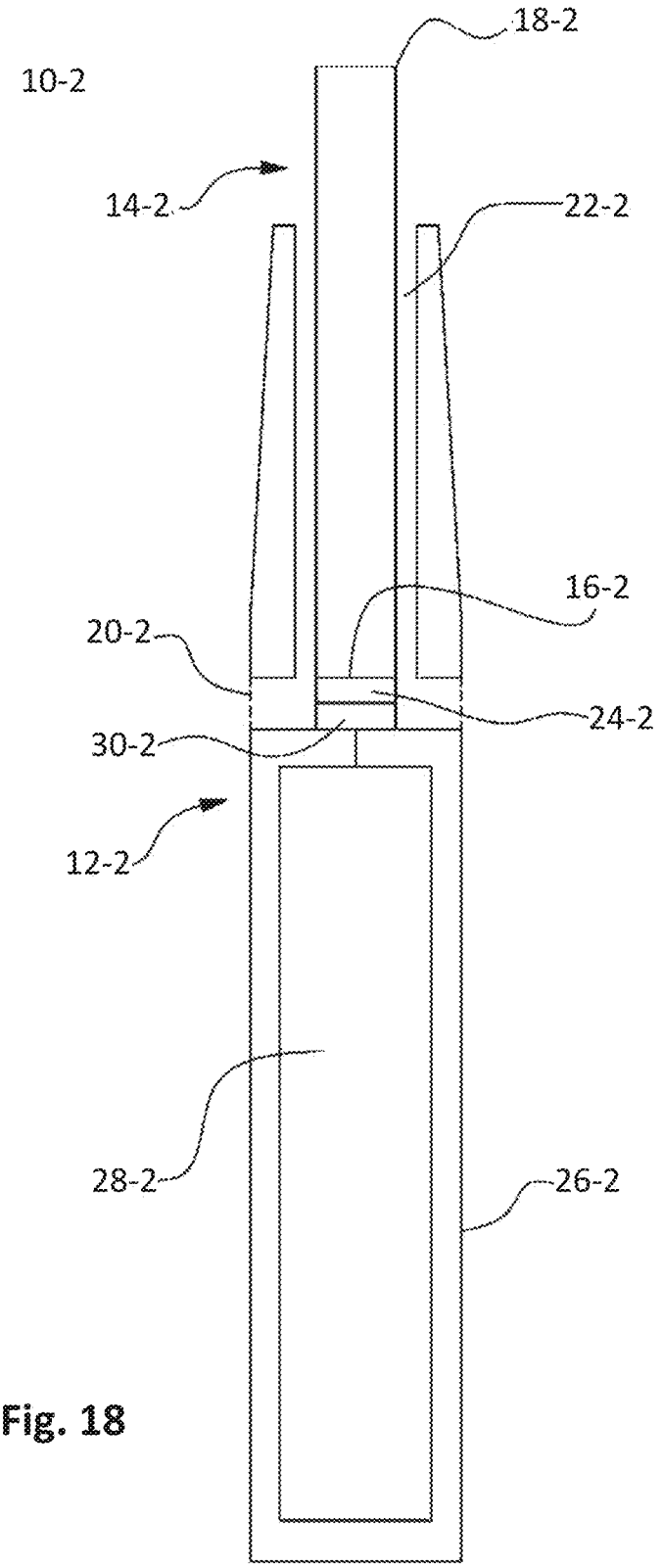
FIG. 18 is a cross-section side view illustration of the system and apparatus for aerosol delivery of FIG. 16.

Turning now to FIG. 18, a cross-sectional side view of the aerosol delivery system 10-2 is schematically illustrated showing the features described above in relation to FIG. 16 and FIG. 17 in more detail. As can be seen, apparatus 12-2 comprises a housing 26-2, in which are located the receptacle 22-2 and heater 24-2. The housing 26-2 also contains control circuitry (not shown) operative by a user, or upon detection of air and/or vapor being drawn into the device 12-2 through air-intake apertures 20-2, i.e., when the user sucks or inhales. Additionally, the housing 26-2 comprises an electrical energy supply 28-2, for example a battery. Optionally, the battery comprises a rechargeable lithium-ion battery. The housing 26-2 also comprises a coupling 30-2 for electrically (and optionally mechanically) coupling the electrical energy supply 28-2 to control circuitry (not shown) for powering and controlling operation of the heater 24-2.

Responsive to activation of the control circuitry of apparatus 12-2, the heater 24-2 heats the fluid-transfer article (not shown in FIG. 18) of aerosol carrier 14-2. This heating process initiates (and, through continued operation, maintains) release of vapor and/or an aerosol from the activation surface of the fluid-transfer article. The vapor and/or aerosol formed as a result of the heating process is entrained into a stream of air being drawn across the activation surface of the fluid-transfer article (as the user sucks or inhales). The stream of air with the entrained vapor and/or aerosol passes through the aerosol carrier 14-2 via outlet conduits (not shown) and exits the aerosol carrier 14-2 at second end 18-2 for delivery to the user. This process is briefly described above in relation to FIG. 17, where arrows schematically denote the flow of the air stream into the device 12-2 and through the aerosol carrier 14-2, and the flow of the air stream with the entrained vapor and/or aerosol through the aerosol carrier cartridge 14-2.

Figure 19:
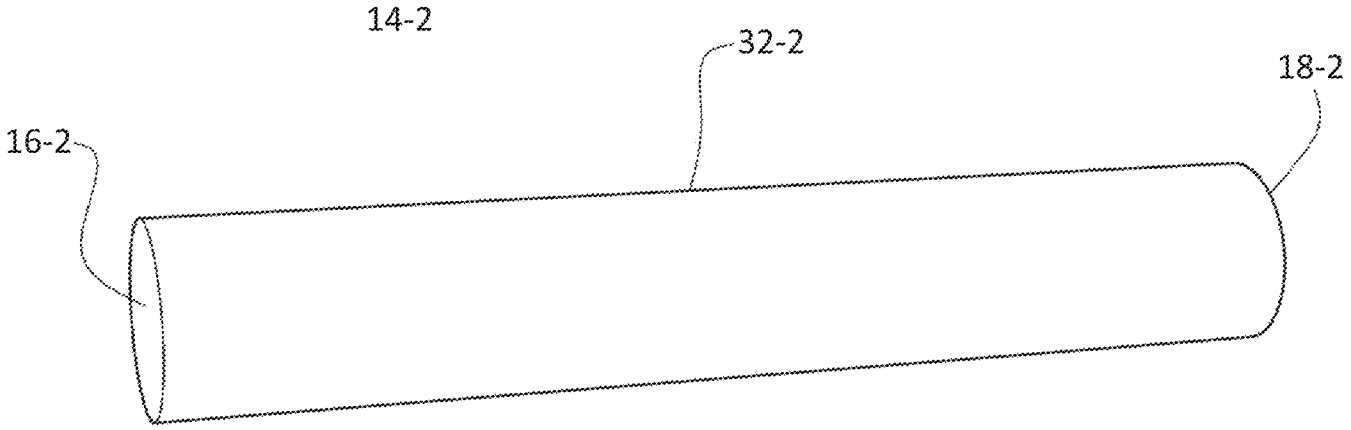
FIG. 19 is a perspective view illustration of an aerosol carrier for use in the system for aerosol delivery according to one or more embodiment of the second mode of the present disclosure.
Figure 20:
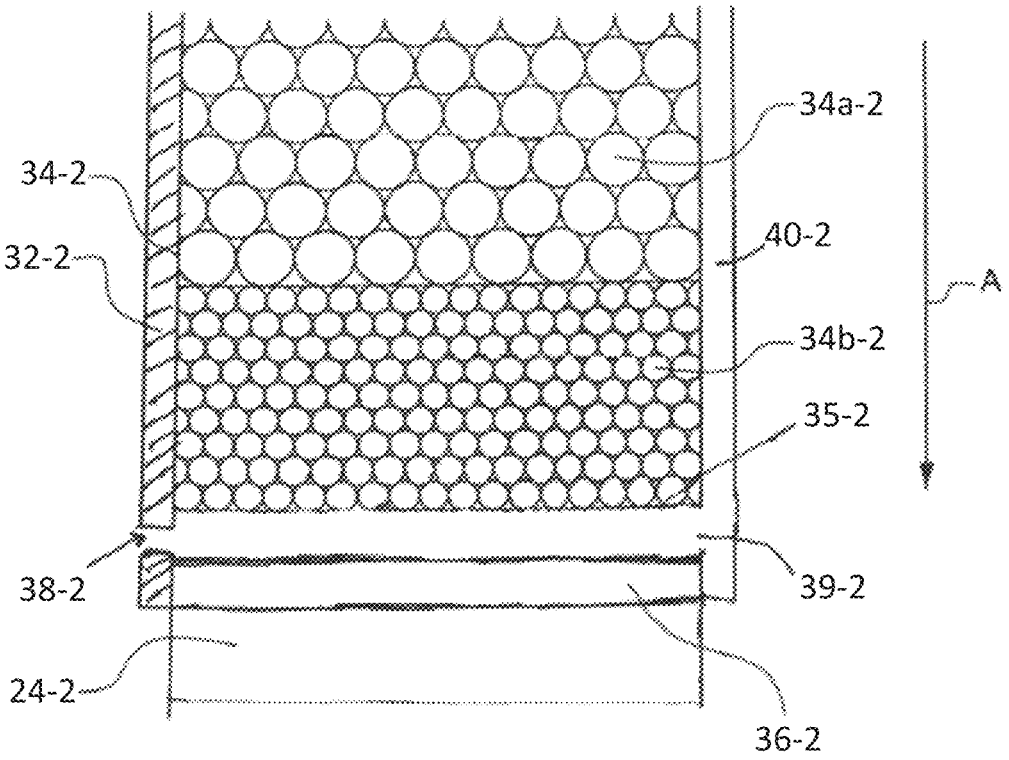
FIG. 20 is a cross-section side view of elements of an aerosol carrier and a part of an apparatus of the system for aerosol delivery according to one or more embodiment of the second mode of the present disclosure.
Figure 21:
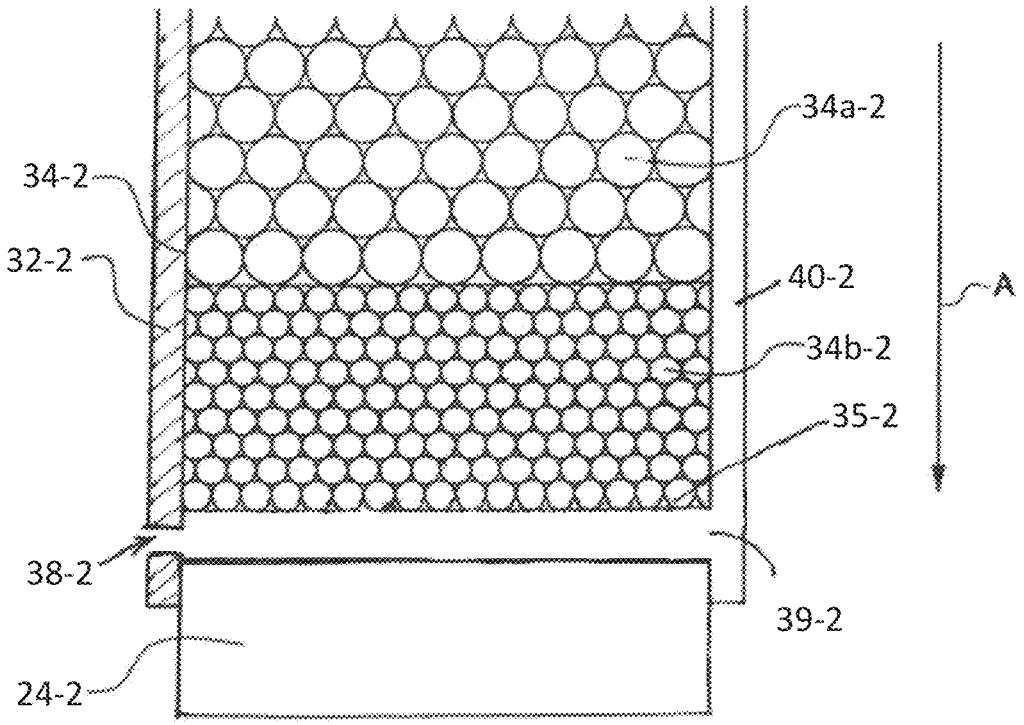
FIG. 21 is a cross-section side view of elements of an aerosol carrier and a part of an apparatus of the system for aerosol delivery according to one or more embodiment of the second mode of the present disclosure, in an alternative configuration from that of FIG. 20.

FIGS. 19 to 21 schematically illustrate the aerosol carrier 14-2 in more detail (and, in FIGS. 20 and 21, features within the receptacle in more detail). FIG. 19 illustrates an exterior of the aerosol carrier 14-2, FIG. 20 illustrates internal components of the aerosol carrier 14-2 in one optional configuration, and FIG. 21 illustrates internal components of the aerosol carrier 14-2 in another optional configuration. FIG. 4 illustrates the exterior of the aerosol carrier 14-2, which comprises housing 32-2 for housing said fluid-transfer article (not shown) and at least one other internal component. The particular housing 32-2 illustrated in FIG. 19 comprises a tubular member, which may be generally cylindrical in form, and which is configured to be received within the receptacle of the apparatus. First end 16-2 of the aerosol carrier 14-2 is for location to oppose the heater of the apparatus, and second end 18-2 (and the region adjacent the second end 18-2) is configured for insertion into a user's mouth.

FIG. 20 illustrates some internal components of the aerosol carrier 14-2 and of the heater 24-2 of apparatus 12-2, in in one embodiment of the disclosure.

As described above, the aerosol carrier 14-2 comprises a fluid-transfer article 34-2. Optionally, there may be a conduction element 36-2 (as shown in FIG. 20), being part of the heater 24-2. In one or more arrangements, the aerosol carrier 14-2 is located within the receptacle of the apparatus such that the activation surface of the fluid-transfer article opposes the heater 24-2 of the apparatus and receives heat directly from the heater 24-2 of the apparatus. When aerosol carrier 14-2 is located within the receptacle of the apparatus such that the activation surface of the fluid-transfer article is located to oppose the heater of the apparatus, the conduction element 36-2 is disposed between the rest of the heater 24-2 and the activation surface 35-2 of the fluid-transfer article. Heat may be transferred to the activation surface 35-2 via conduction through conduction element 36-2 (i.e., application of heat to the activation surface is indirect).

Further components not shown in FIG. 20 comprise: an inlet conduit, via which air can be drawn into the aerosol carrier 14-2; an outlet conduit, via which an air stream entrained with aerosol can be drawn from the aerosol carrier 14-2; a filter element; and a reservoir for storing aerosol precursor material and for providing the aerosol precursor material to the fluid-transfer article 34-2.

In FIG. 20, the aerosol carrier is shown as comprising the fluid-transfer article 34-2 located within housing 32. The fluid transfer article 34-2 comprises a first region **34*a*-2 holding an aerosol precursor. In one or more arrangements, the first region of 34*a* of the fluid transfer article 34-2 comprises a reservoir for holding the aerosol precursor. The first region 34*a*-2 can be the sole reservoir of the aerosol carrier 14-2, or it can be arranged in fluid communication with a separate reservoir, where aerosol precursor is stored for supply to the first region 34*a*-2. As shown in FIG. 20, the material forming the first region of 34*a* comprises a porous structure, whose pore diameter size varies between one end of the first region 34*a*-2 and another end of the first region 34*a*-2. In the illustrated example of FIG. 20, the pore diameter size decreases from a first end remote from heater 24-2 (the upper end is as shown in the figure) to a second end. Although the figure illustrates the pore diameter size changing in a step-wise manner (i.e., a first part with pores having a diameter of first size, and a second part with pores having a diameter of second, smaller size), the change in pore size in the first region 34*a*-2 may be gradual rather than step-wise. This configuration of pores having a decreasing diameter size can provide a wicking effect, which can serve to draw fluid through the first region 34*a*-2, towards heater 24-2**.

The fluid transfer article 34-2 also comprises a second region **34*b*-2. Aerosol precursor is drawn from the first region of 34*a* to the second region 34*b*-2 by the wicking effect of the material forming the first region of 34*a*. Thus, the first region 34***a*-2 is configured to transfer the aerosol precursor to the second region 34*b*-2 of the article 34-2.

The second region 34*b*-2 itself comprises a porous structure formed by a porous polymer material. It is then preferable that the pore diameter size of the porous structure of the second region 34*b*-2 is smaller than the pore diameter size of the immediately adjacent part of the first region 34*a*-2. As mentioned above, the porous polymer material may be a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET).

In FIG. 20, the second region 34*b*-2 terminates in an activation surface 35-2 which is spaced from the adjacent surface of the conduction element 36-2 such that there is no contact between the activation surface and the conduction element of the heater anywhere along their facing extent. The conduction element 36-2 transfers heat to the activation surface 35-2, thereby releasing aerosol precursor which has reached that activation surface 35-2 through the porous polymer material of the second region 34*b*-2. That vapor and/or a mixture of vapor and aerosol, may then pass in to the air between the activation surface 35-2 and the conduction element 36-2.

In the particular embodiment illustrated in FIG. 20, both the activation surface 35-2 and the adjacent surface of conduction element 36-2 which it faces are generally planar, such that both surfaces are arranged substantially parallel to one another. However, in other embodiments it is envisaged that either the activation surface 35-2, or the facing surface of the conduction element 36-2, or indeed both, may be non-planar. In arrangements in which the activation surface 35-2 and the facing surface of the conduction element 36-2 are both non-planar, the two surfaces may have complimentary profiles such that they are substantially equi-spaced apart across their entire extent.

FIG. 20 also illustrates an opening 38-2 in the housing 32-2, which opening 38-2 is in communication with the air-intake apertures 20-2. A further opening 39-2 communicates with a duct 40-2 within the housing 32-2, which duct 40-2 communicates with the second end 18-2.

There is thus a fluid-flow path for air (hereinafter referred to as an air-flow pathway) between openings 38-2 and 39-2, linking the apertures 20-2 and the second end 18-2 of the aerosol carrier. When the user sucks or inhales, air is drawn along the air-flow pathway, along the surface of the conduction element 36-2 facing the activation surface 35-2, between the conduction element 36-2 and the activation surface of the second region 34*b*-2.

One or more droplets of the aerosol precursor will be released from the second region 34*b*-2 and heated, to release vapor or a mixture of aerosol and vapor from the conduction element 36-2 into the air flowing in the air-flow pathway between the openings 38-2, 39-2. The vapor or mixture passes, as the user sucks and inhales, to the second end 18-2. As noted above, the conduction element 36-2 may be absent in some arrangements. In such arrangements there will nevertheless still be no contact between the activation surface and the heater anywhere along their facing extent.

The conduction element 36-2, if present, may comprise a thin film of thermally conductive material, such as, for example, a metal foil (for example, aluminum, brass, copper, gold, steel, silver, or an alloy comprising anyone of the foregoing together with thermally conductive plastics and/or ceramics).

In the illustrative examples of FIG. 20, the first region 34*a*-2 of the fluid-transfer article 34-2 is located at an "upstream" end of the fluid-transfer article 34-2 and the second region 34*b*-2 is located at a downstream" end of the fluid-transfer article 34-2. That is, aerosol precursor is wicked, or is drawn, from the "upstream" end of the fluid-transfer article 34-2 to the "downstream" end of the fluid-transfer article 34-2 (as denoted by arrow A in FIG. 20).

As mentioned above, the conduction element 36-2 need not be present. FIG. 21 illustrates an embodiment corresponding to that of FIG. 20, but without such a conduction element 36-2. The arrangement of FIG. 21 is otherwise similar to that of FIG. 20, and corresponding parts are indicated by the same reference numerals. In the arrangement of FIG. 21, therefore, the activation surface 35-2 of the fluid-transfer article 34-2 is arranged to as to be facing, and spaced from adjacent surface of the heater 24-2 itself. Such an arrangement means that there is no contact between the activation surface and the heater anywhere along their facing extent. Thus, although proximate, the activation surface and the heater do not touch one another anywhere along their interface. The heater 24-2 transfers heat to the activation surface 35-2, thereby releasing aerosol precursor which has reached that activation surface 35-2 through the porous polymer material of the second region 34*b*-2 in the same manner as discussed above in connection with the arrangement of FIG. 20 That vapor and/or a mixture of vapor and aerosol, may then pass in to the air between the activation surface 35-2 and the conduction element 36-2.

In the particular embodiment illustrated in FIG. 21, both the activation surface 35-2 and the adjacent surface of heater 24-2 which it faces are generally planar, such that both surfaces are arranged substantially parallel to one another. However, in other embodiments it is envisaged that either the activation surface 35-2, or the facing surface of the heater 24-2, or indeed both, may be non-planar. In arrangements in which the activation surface 35-2 and the facing surface of the heater 24-2 are both non-planar, the two surfaces may have complimentary profiles such that they are substantially equi-spaced apart across their entire extent.

Figure 22:
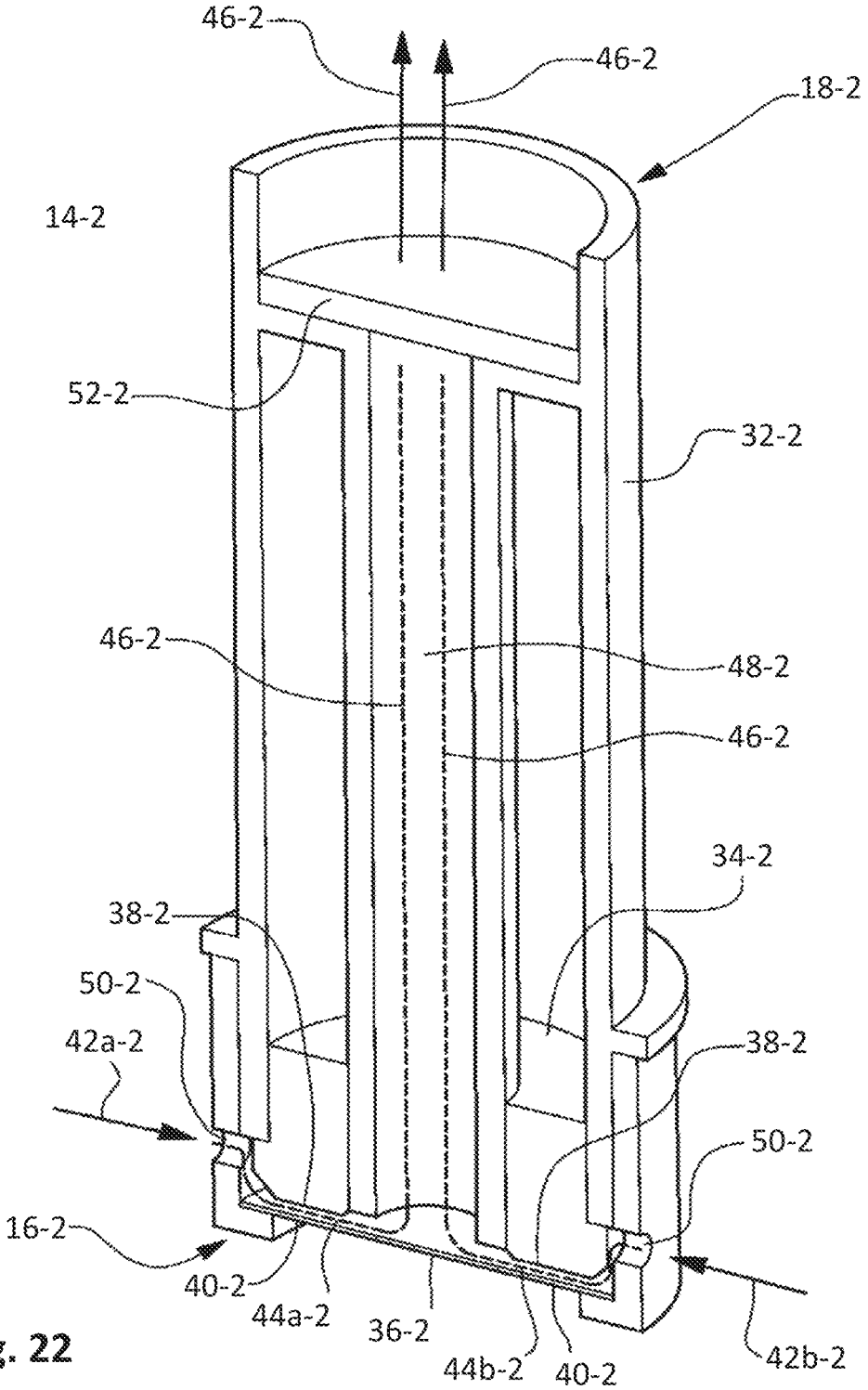
FIG. 22 is a cross-section side view of aerosol carrier according to one or more embodiment of the second mode of the present disclosure.
Figure 23:
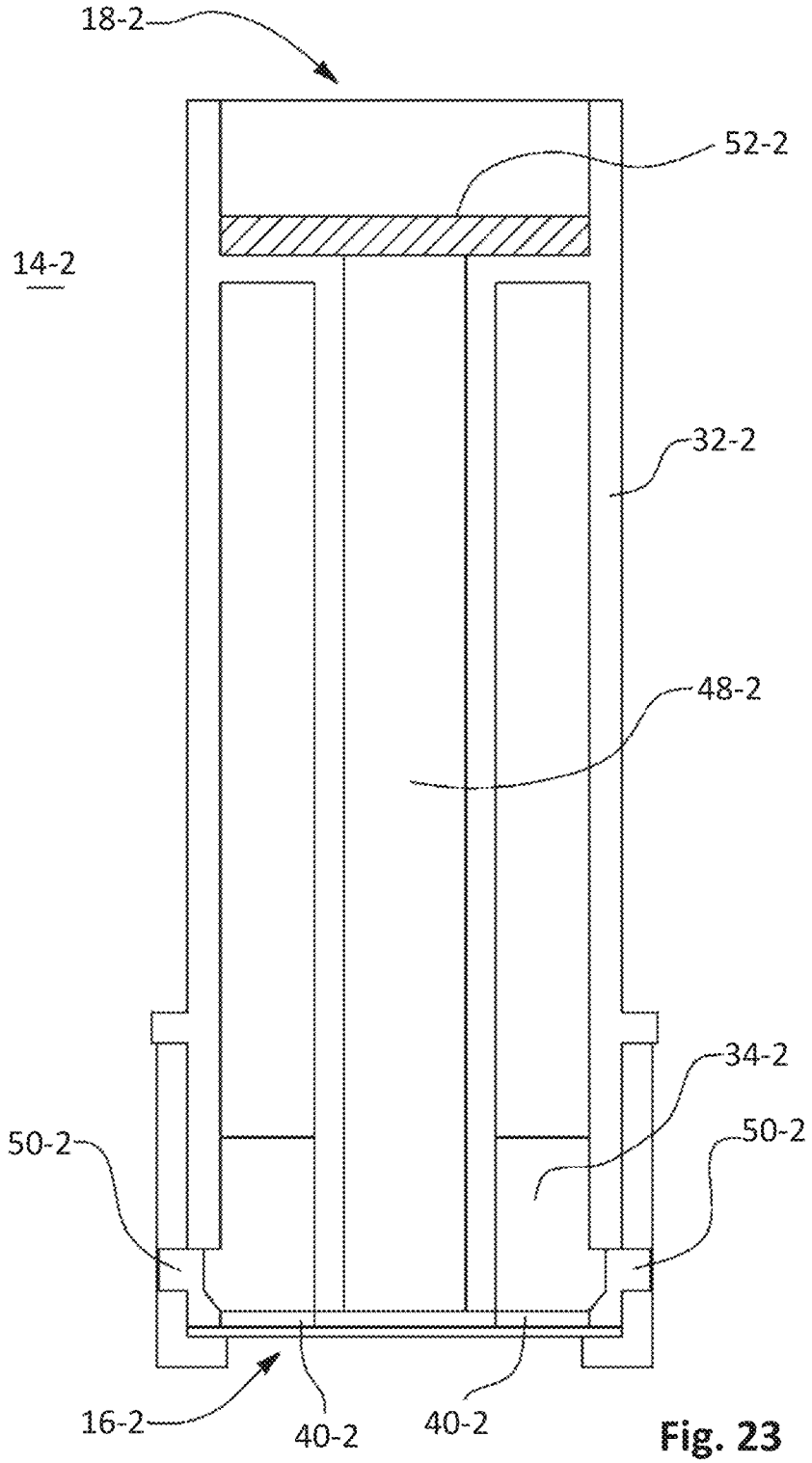
FIG. 23 is a perspective cross-section side view of the aerosol carrier of FIG. 22.

In the arrangements shown in FIGS. 20 and 21, the apertures 38-2, 39-2 are on opposite sides of the housing 32-2. FIGS. 22 and 23 show an alternative configuration, in which the fluid-transfer article is annular, and the second part 34*b*-2 is then in the form of annular diaphragm. In FIGS. 22 and 23, the second part 34*b*-2 is illustrated in a position corresponding to that shown in FIGS. 20 and 21, where it is spaced from the conduction element 36-2 such that it makes no contact with the conduction element 36-2. This enables the air flow in the apparatus to be illustrated. Thus, FIGS. 22 and 23 illustrate an aerosol carrier 14-2 according to one or more possible arrangements in more detail. FIG. 22 is a cross-section side view illustration of the aerosol carrier 14-2 and FIG. 23 is a perspective cross-section side view illustration of the aerosol carrier 14-2.

As can be seen from FIGS. 22 and 23, the aerosol carrier 14-2 is generally tubular in form. The aerosol carrier 14-2 comprises housing 32-2, which defines the external walls of the aerosol carrier 14-2 and which defines therein a chamber in which are disposed the fluid-transfer article 34-2 (adjacent the first end 16-2 of the aerosol carrier 14-2) and internal walls defining the fluid communication pathway 48-2. Fluid communication pathway 48-2 defines a fluid pathway for an outgoing air stream from the channels 40-2 to the second end 18-2 of the aerosol carrier 14-2. In the examples illustrated in FIGS. 22 and 23, the fluid-transfer article 34-2 is an annular shaped element located around the fluid communication pathway 48-2.

In walls of the housing 32-2, there are provided inlet apertures 50-2 to provide a fluid communication pathway for an incoming air stream to reach the fluid-transfer article 34-2, and particularly the air-flow pathway defined between the activation surface of the fluid-transfer article 34-2 and the conduction element 36-2 (or between the activation surface and the 15 heater).

In the illustrated example of FIGS. 22 and 23, the aerosol carrier 14-2 further comprises a filter element 52-2. The filter element 52-2 is located across the fluid communication pathway 48-2 such that an outgoing air stream passing through the fluid communication pathway 48-2 passes through the filter element 52-2.

With reference to FIG. 23, when a user sucks on a mouthpiece of the apparatus (or on the second end 18-2 of the aerosol carrier 14-2, if configured as a mouthpiece), air is drawn into the carrier through inlet apertures 50-2 extending through walls in the housing 32-2 of the aerosol carrier 14-2.

An incoming airstream **42*a*-2 from a first side of the aerosol carrier 14-2 is directed to a first side of the second part 34*b*-2 of the fluid-transfer article 34-2 (e.g., via a gas communication pathway within the housing of the carrier). An incoming air stream 42*b*-2 from a second side of the aerosol carrier 14-2 is directed to a second side of the second part 34*a*-2 of the fluid-transfer article 34-2 (e.g., via a gas communication pathway within the housing of the carrier). When the incoming air stream 42*a*-2 from the first side of the aerosol carrier 14-2 reaches the first side of the second part 34*b*-2, the incoming air stream 42*a*-2 from the first side of the aerosol carrier 14-2 flows between the second part 34*b*-2 and the conduction element 36-2 (or between the second part 34*b*-2 and heater 24-2 if the conduction element is omitted). Likewise, when the incoming air stream 42*b*-2 from the second side of the aerosol carrier 14-2 reaches the second side of the second part 34*a*-2, the incoming air stream 42*b*-2 from the second side of the aerosol carrier 14-2 flows between the second part 34*a*-2 and the conduction element 36-2 (or between the second part 34*b*-2 and heater 24-2). The air streams from each side are denoted by dashed lines 44*a*-2 and 44*b*-2 in FIG. 23 As these air streams 44*a*-2 and 44*b*-2 flow, aerosol precursor on the activation surface 35-2 or on the conduction element 36-2 (or on the heater 24-2) is entrained in air streams 44*a*-2 and 44*b*-2**.

In use, the heater 24-2 of the apparatus 12-2 serves to raise a temperature of the conduction element 36-2 to a sufficient temperature to release, or liberate, captive substances (i.e., the aerosol precursor) to form a vapor and/or aerosol, which is drawn downstream. As the air streams **44*a*-2 and 44*b*-2 continue their passages, more released aerosol precursor is entrained within the air streams 44*a*-2 and 44*b*-2. When the air streams 44*a*-2 and 44*b*-2 entrained with aerosol precursor meet at a mouth of the outlet fluid communication pathway 48-2, they enter the outlet fluid communication pathway 48-2 and continue until they pass through filter element 52-2 and exit outlet fluid communication pathway 48-2, either as a single outgoing air stream, or as separate outgoing air streams 46-2 (as shown). The outgoing air streams 46-2 are directed to an outlet, from where it can be inhaled by the user directly (if the second end 18-2 of the aerosol capsule 14-2 is configured as a mouthpiece), or via a mouthpiece. The outgoing air streams 46-2** entrained with aerosol precursor are directed to the outlet (e.g., via a gas communication pathway within the housing of the carrier).

Figure 24:
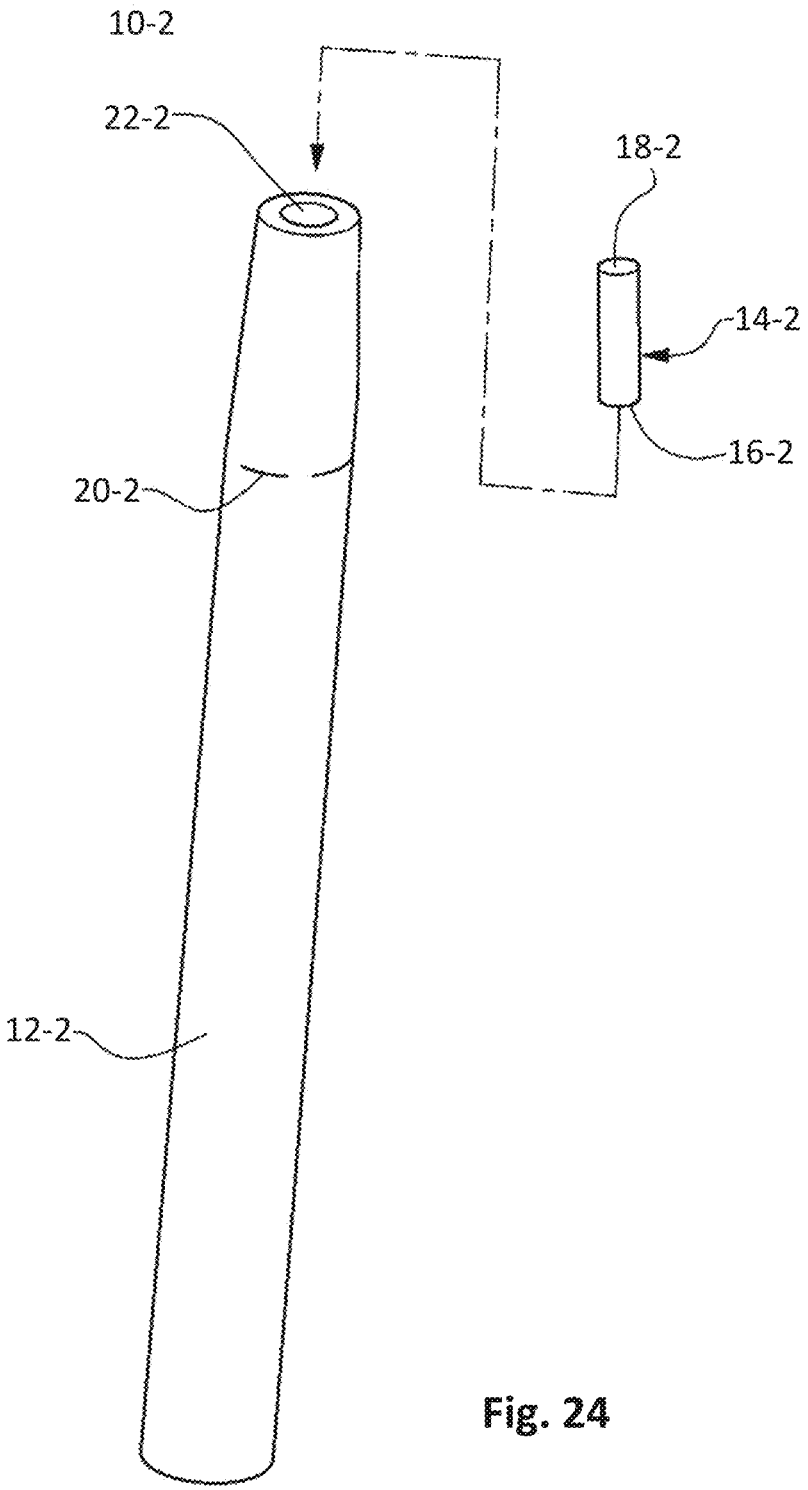
FIG. 24 is an exploded perspective view illustration of a kit-of-parts for assembling the system according to one or more embodiment of the second mode of the present disclosure.

FIG. 24 is an exploded perspective view illustration of a kit-of-parts for assembling an aerosol delivery system 10-2. In any of the embodiments described above the second part **34*b*-2** may have a thickness of less than 5 mm. In other embodiments it may have a thickness of: less than 3.5 mm, less than 3 mm, less than 2.5 mm, less than 2 mm, less than 1.9 mm, less than 1.8 mm, less than 1.7 mm, less than 1.6 mm, less than 1.5 mm, less than 1.4 mm, less than 1.3 mm, less than 1.2 mm, less than 1.1 mm, less than 1 mm, less than 0.9 mm, less than 0.8 mm, less than 0.7 mm, less than 0.6 mm, less than 0.5 mm, less than 0.4 mm, less than 0.3 mm, less than 0.2 mm, or less than 0.1 mm.

As will be appreciated, in the arrangements described above, the fluid-transfer article 34-2 is provided within a housing 32-2 of the aerosol carrier 14-2. In such arrangements, the housing of the carrier 14-2 serves to protect the aerosol precursor-containing fluid-transfer article 34-2, whilst also allowing the carrier 14-2 to be handled by a user without his/her fingers coming into contact with the aerosol precursor liquid retained therein.

Third Mode: An Aerosol Generation Apparatus has a Fluid-Transfer Article with a First Region which Holds an Aerosol Precursor Aspects and embodiments of the third mode of the present disclosure will now be discussed with reference to the accompanying figures. Further aspects and embodiments of the third mode will be apparent to those skilled in the art. All documents mentioned in this text are incorporated herein by reference.

In general outline, one or more embodiments of the third mode in accordance with the present disclosure may provide a system for aerosol delivery in which an aerosol carrier may be inserted into a receptacle (e.g., a "heating chamber") of an apparatus for initiating and maintaining release of an aerosol from the aerosol carrier. Another end, or another end portion, of the aerosol carrier may protrude from the apparatus and can be inserted into the mouth of a user for the inhalation of aerosol released from the aerosol carrier cartridge during operation of the apparatus.

Hereinafter, and for convenience only, "system for aerosol delivery" shall be referred to as "aerosol delivery system".

Figure 25:
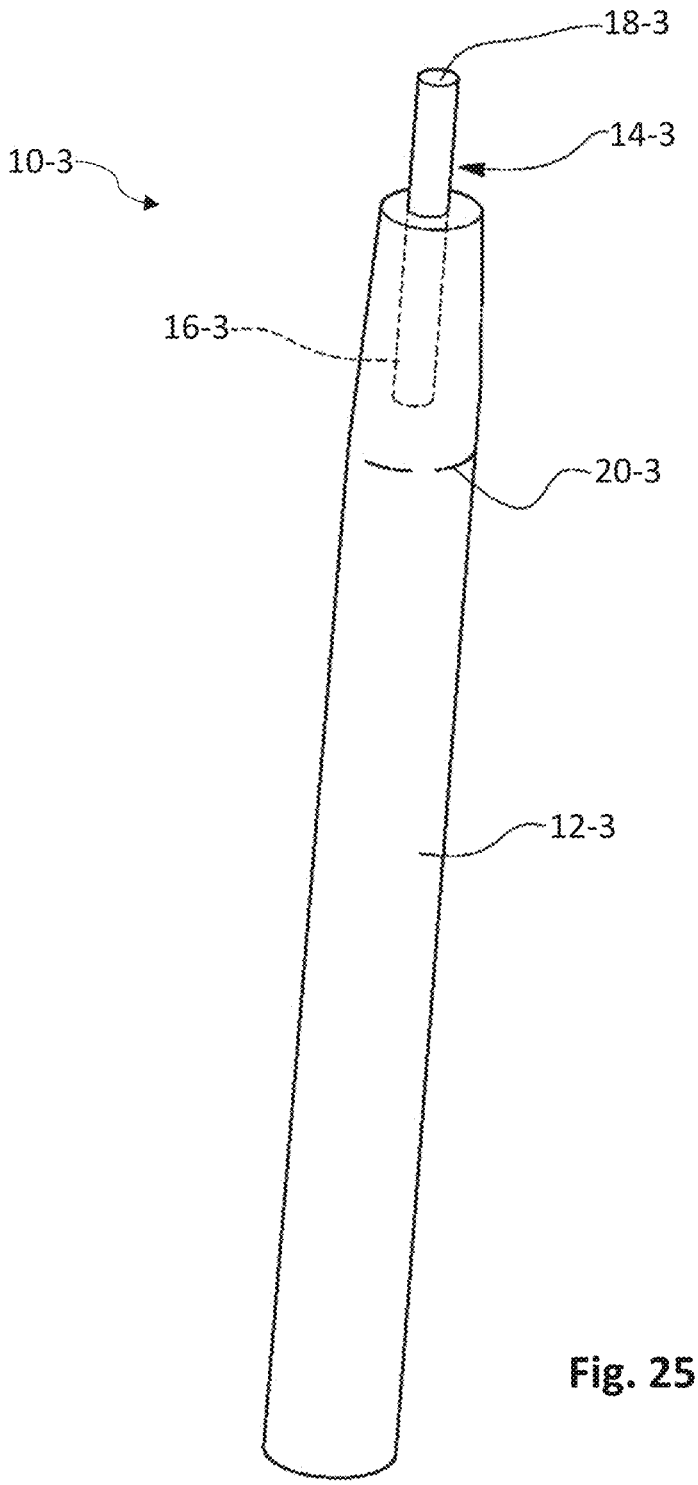
FIG. 25 is a perspective view illustration of a system for aerosol delivery according to one or more embodiments of the third mode of the present disclosure.

Referring now to FIG. 25, there is illustrated a perspective view of an aerosol delivery system 10-3 comprising an aerosol generation apparatus 12-3 operative to initiate and maintain release of aerosol from a fluid-transfer article in an aerosol carrier 14-3. In the arrangement of FIG. 25, the aerosol carrier 14-3 is shown with a first end 16-3 thereof and a portion of the length of the aerosol carrier 14-3 located within a receptacle of the apparatus 12-3. A remaining portion of the aerosol carrier 14-3 extends out of the receptacle. This remaining portion of the aerosol carrier 14-3, terminating at a second end 18-3 of the aerosol carrier, is configured for insertion into a user's mouth. A vapor and/or aerosol is produced when a heater (not shown in FIG. 25) of the apparatus 12-3 heats a fluid-transfer article in the aerosol carrier 14-3 to release a vapor and/or an aerosol, and this can be delivered to the user, when the user sucks or inhales, via a fluid passage in communication with an outlet of the aerosol carrier 14-3 from the fluid-transfer article to the second end 18-3.

The device 12-3 also comprises air-intake apertures 20-3 in the housing of the apparatus 12-3 to provide a passage for air to be drawn into the interior of the apparatus 12-3 (when the user sucks or inhales) for delivery to the first end 16-3 of the aerosol carrier 14-3, so that the air can be drawn across an activation surface of a fluid-transfer article located within a housing of the aerosol carrier cartridge 14-3 during use. Optionally, these apertures may be perforations in the housing of the apparatus 12-3.

A fluid-transfer article 34-3 (not shown in FIG. 25, but described hereinafter with reference to FIGS. 29 to 32 is located within a housing of the aerosol carrier 14-3. The fluid-transfer article 34-3 contains an aerosol precursor material, which may include at least one of: nicotine; a nicotine precursor material; a nicotine compound; and one or more flavorings. The fluid-transfer article 34-3 is located within the housing of the aerosol carrier 14-3 to allow air drawn into the aerosol carrier 14-3 at, or proximal, the first end 16-3, and has first and second regions, as will be described.

The first region of the fluid-transfer article 34-3 may comprise a substrate of porous material where pores of the porous material hold, contain, carry, or bear the aerosol precursor material. In particular, the porous material of the fluid-transfer article may be a porous polymer material such as, for example, a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET). All such materials may be described as heat resistant polymeric wicking material in the context of the present disclosure.

Alternatively, in some embodiments it is envisaged that the first region of the fluid-transfer article 34-3 may take the form of a simple tank having a cavity defining a hollow reservoir to hold the aerosol precursor.

The aerosol carrier 14-3 is removable from the apparatus 12-3 so that it may be disposed of when expired. After removal of a used aerosol carrier 14-3, a replacement aerosol carrier 14-3 can be inserted into the apparatus 12-3 to replace the used aerosol carrier 14-3.

Figure 26:
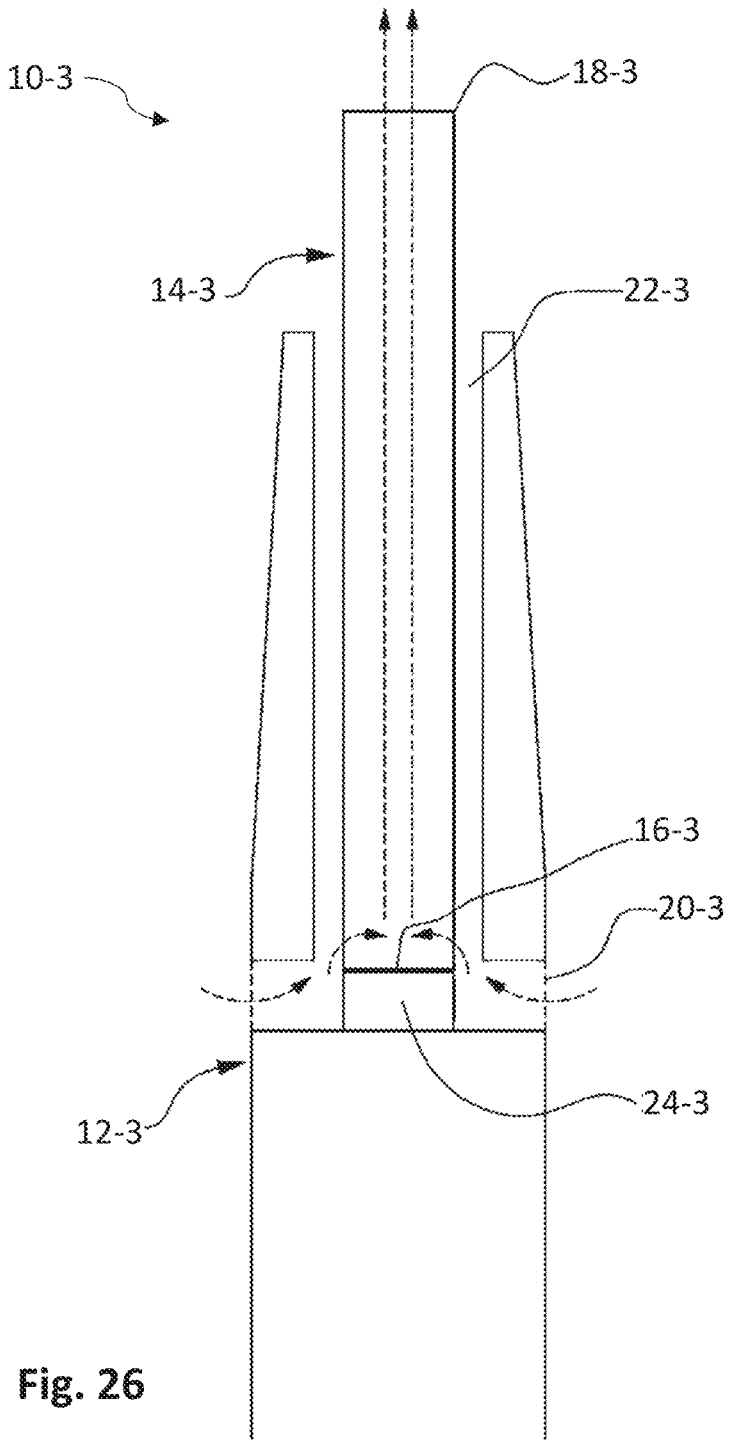
FIG. 26 is a cross-section side view illustration of part of an apparatus of the system for aerosol delivery of FIG. 25.

FIG. 26 is a cross-sectional side view illustration of a part of apparatus 12-3 of the aerosol delivery system 10. The apparatus 12-3 comprises a receptacle 22-3 in which is located a portion of the aerosol carrier 14-3. In one or more optional arrangements, the receptacle 22-3 may enclose the aerosol carrier 14-3. The apparatus 12-3 also comprises a heater 24-3, which is proximate but spaced from an activation surface of the fluid-transfer article 34-3 when an aerosol carrier 14-3 is located within the receptacle 22-3. Optional configurations of the heater 24-3 will be discussed later.

Air flows into the apparatus 12-3 (in particular, into a closed end of the receptacle 22-3) via air-intake apertures 20-3. From the closed end of the receptacle 22-3, the air is drawn into the aerosol carrier 14-3 (under the action of the user inhaling or sucking on the second end 18-3) and expelled at the second end 18-3. As the air flows into the aerosol carrier 14-3, it passes across the activation surface. Heat from the heater 24-3 heats the activation surface of the fluid-transfer article 34-3, causing vaporization of aerosol precursor material at the activation surface of the fluid-transfer article 34-3 and an aerosol is created in the air flowing over the activation surface. Thus, through the application of heat to the activation surface, an aerosol is released, or liberated, from the fluid-transfer article, and is drawn from the material of the aerosol carrier unit by the air flowing across the activation surface and is transported in the air flow to via outlet conduits (not shown in FIG. 26) in the housing of the aerosol carrier 14-3 to the second end 18-3. The direction of air flow is illustrated by arrows in FIG. 26.

To achieve release of the captive aerosol from the fluid-transfer article, the activation surface of the fluid-transfer article 34-3 is heated by the heater 24-3. As a user sucks or inhales on second end 18-3 of the aerosol carrier 14-3, the aerosol released from the fluid-transfer article and entrained in the air flowing across the activation surface is drawn through the outlet conduits (not shown) in the housing of the aerosol carrier 14-3 towards the second end 18-3 and onwards into the user's mouth.

Figure 27:
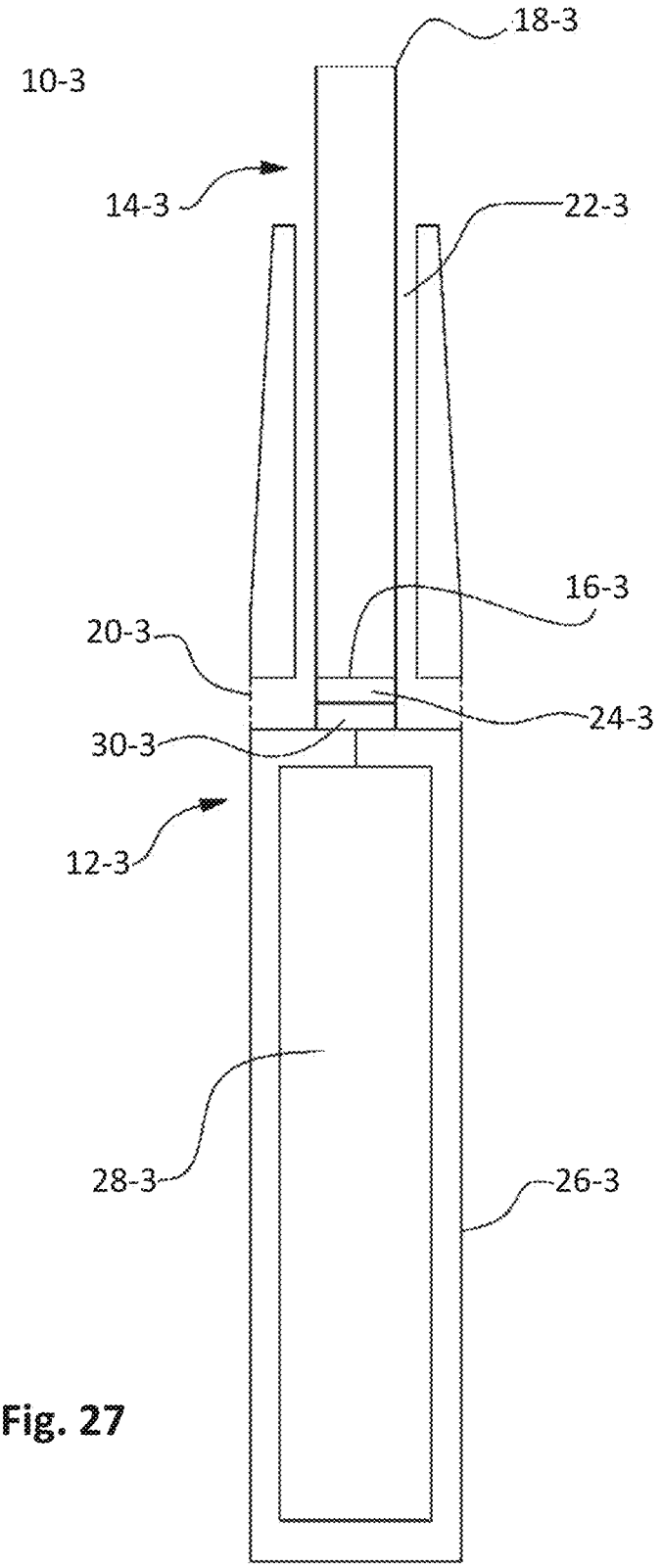
FIG. 27 is a cross-section side view illustration of the system and apparatus for aerosol delivery of FIG. 25.

Turning now to FIG. 27, a cross-sectional side view of the aerosol delivery system 10-3 is schematically illustrated showing the features described above in relation to FIGS. 25 and 26 in more detail. As can be seen, apparatus 12-3 comprises a housing 26-3, in which is located the receptacle 22-3. The housing 26-3 also contains control circuitry (not shown) operative by a user, or upon detection of air and/or vapor being drawn into the device 12-3 through air-intake apertures 20-3, i.e., when the user sucks or inhales. Additionally, the housing 26-3 comprises an electrical energy supply 28-3, for example a battery. Optionally, the battery comprises a rechargeable lithium-ion battery. The housing 26-3 also comprises a coupling 30-3 for electrically (and optionally mechanically) coupling the electrical energy supply 28-3 to control circuitry (not shown) for powering and controlling operation of the heater 24-3.

Responsive to activation of the control circuitry of apparatus 12-3, the heater 24-3 heats the activation surface of the fluid-transfer article 34-3 (not shown in FIG. 27). This heating process initiates (and, through continued operation, maintains) release of vapor and/or an aerosol from the activation surface of the fluid-transfer article 34-3. The vapor and/or aerosol formed as a result of the heating process is entrained into a stream of air being drawn across the activation surface of the fluid-transfer article 34-3 (as the user sucks or inhales). The stream of air with the entrained vapor and/or aerosol passes through the aerosol carrier 14-3 via outlet conduits (not shown) and exits the aerosol carrier 14-3 at second end 18-3 for delivery to the user. This process is briefly described above in relation to FIG. 26, where arrows schematically denote the flow of the air stream into the device 12-3 and through the aerosol carrier 14-3, and the flow of the air stream with the entrained vapor and/or aerosol through the aerosol carrier cartridge 14-3.

Figure 28:
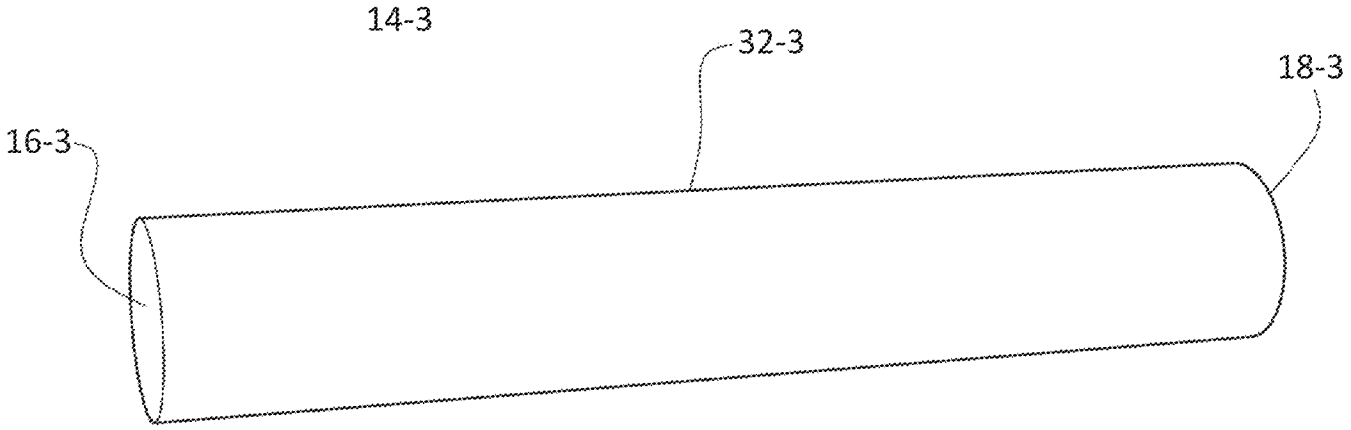
FIG. 28 is a perspective view illustration of an aerosol carrier for use in the system for aerosol delivery according to one or more embodiments of the third mode of the present disclosure.
Figure 29:
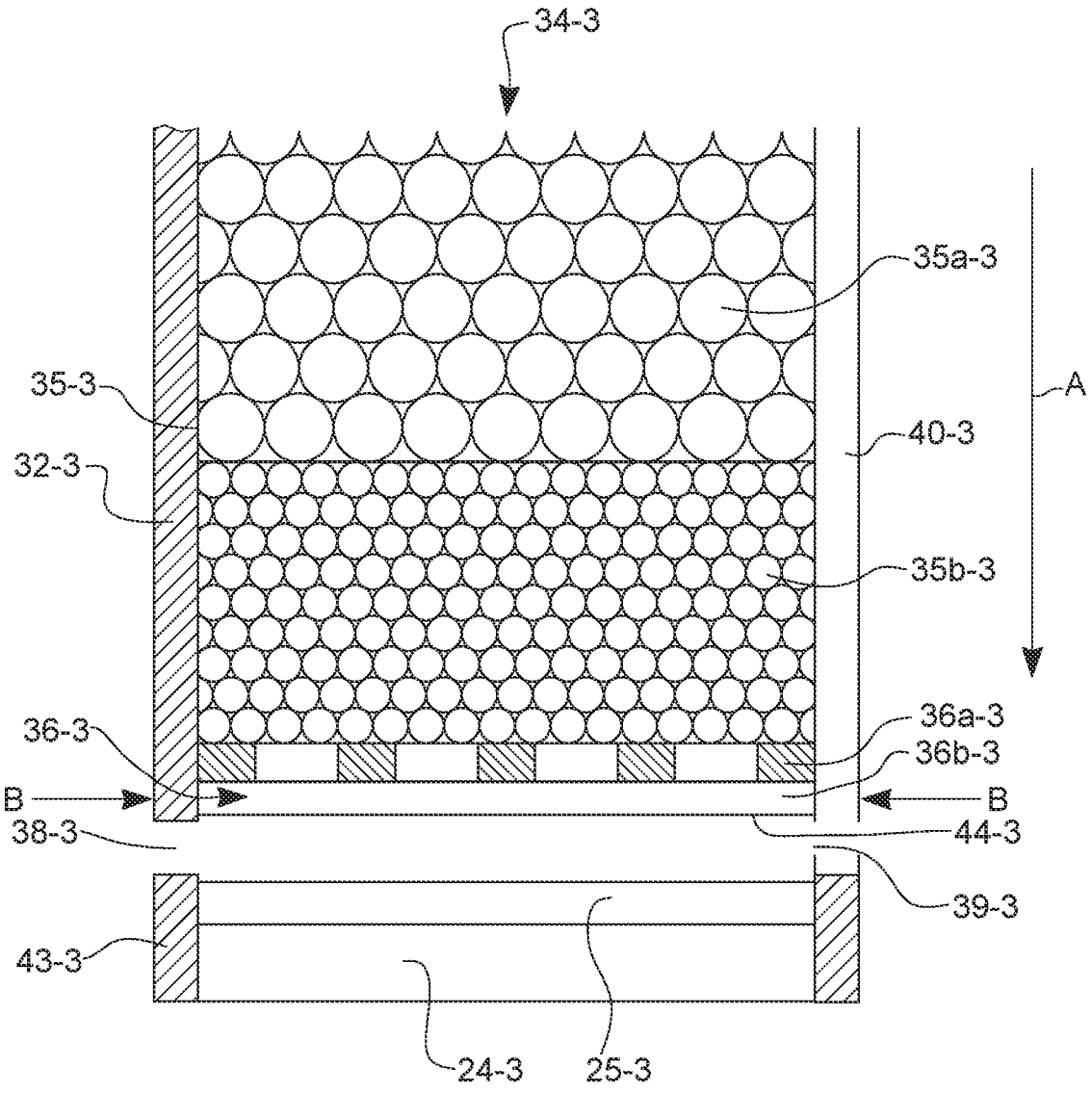
FIG. 29 is a cross-section side view of elements of an aerosol carrier and a part of an apparatus of the system for aerosol delivery according to one or more embodiments of the third mode of the present disclosure.
Figure 30:
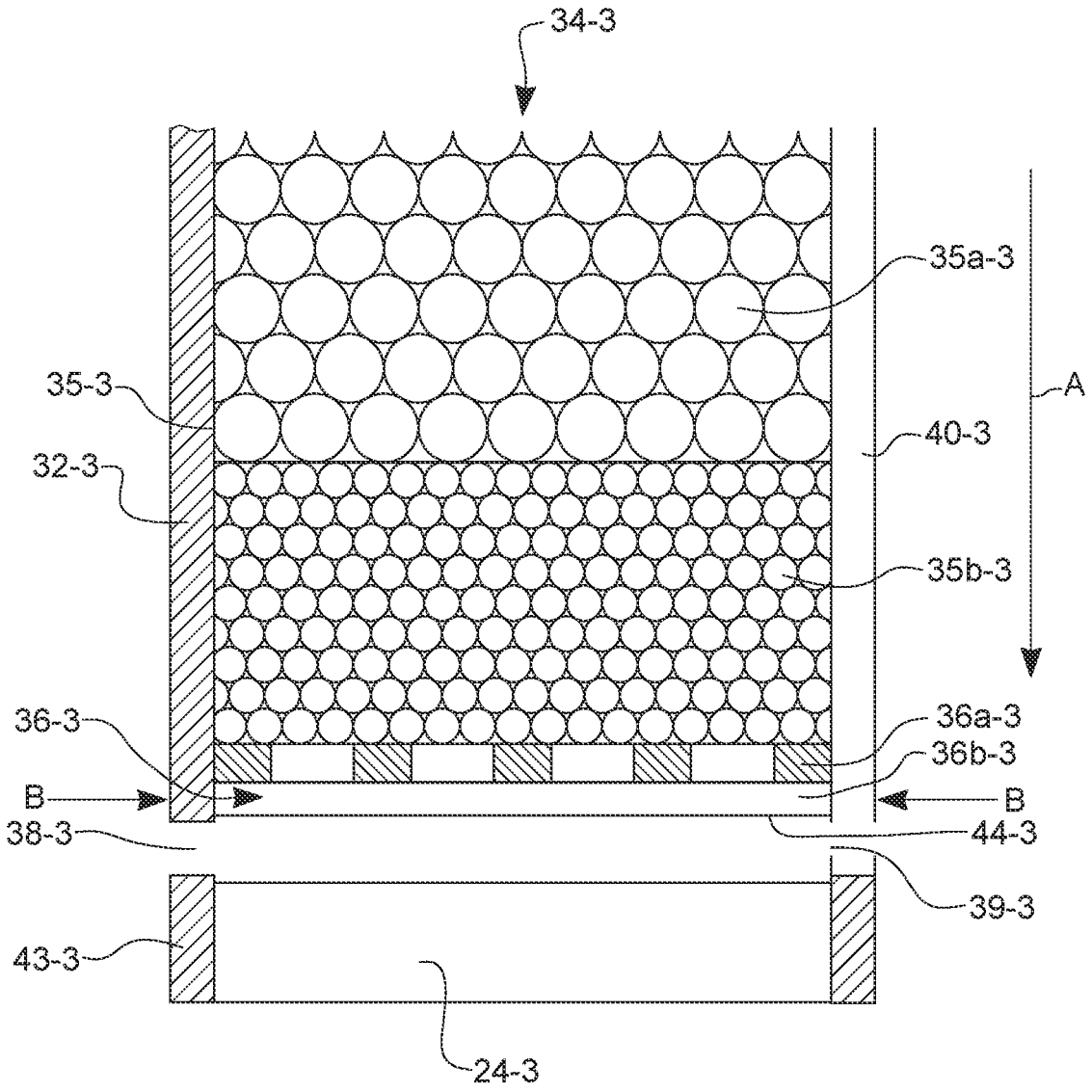
FIG. 30 is a cross-section side view of elements of an aerosol carrier and a part of an apparatus of the system for aerosol delivery according to one or more embodiments of the third mode of the present disclosure, in an alternative configuration from that of FIG. 29.

FIGS. 28 to 30 schematically illustrate the aerosol carrier 14-3 in more detail (and, in FIGS. 29 and 30, features within the receptacle in more detail). FIG. 28 illustrates an exterior of the aerosol carrier 14-3, FIG. 29 illustrates internal components of the aerosol carrier 14-3 in one optional configuration, and FIG. 30 illustrates internal components of the aerosol carrier 14-3 in another optional configuration.

FIG. 28 illustrates the exterior of the aerosol carrier 14-3, which comprises housing 32-3 for housing said fluid-transfer article (not shown). The particular housing 32-3 illustrated in FIG. 28 comprises a tubular member, which may be generally cylindrical in form, and which is configured to be received within the receptacle of the apparatus. First end 16-3 of the aerosol carrier 14-3 is for location to oppose the heater of the apparatus, and second end 18-3 (and the region adjacent the second end 18-3) is configured for insertion into a user's mouth.

FIG. 29 illustrates some internal components of the aerosol carrier 14-3 and of the heater 24-3 of apparatus 12-3, in one embodiment of the disclosure.

As described above, the aerosol carrier 14-3 comprises a fluid-transfer element 34-3. At least part of the fluid-transfer article 34-3 may be removable from the housing 32-3, to enable it to be replaced. The fluid-transfer article 34-3 acts as a reservoir for aerosol precursor and that aerosol precursor will be consumed as the apparatus is used. Once sufficient aerosol precursor has been consumed, the aerosol precursor will need to be replaced. It may then be easiest to replace it by replacing the fluid-transfer article 34-3, rather than trying to re-fill the fluid-transfer article 34-3 with aerosol precursor while it is in the housing 32-3.

In the illustrated embodiments, the fluid-transfer article 34-3 has a first region 35-3 formed by layers 35*a*-3 and 35*b*-3, and a second region 36-3. That second region 36-3 has a first part being an upper layer 36*a*-3 which is formed by a plate with a plurality of holes 37-3 therein, and a second part being a lower layer formed by a second plate 36*b*-3 made of a porous material which allows aerosol precursor to pass therethrough. In the arrangement of FIG. 29, the plate 36*a*-3 with holes 37-3 therein is in contact with the first region 35-3 of the fluid-transfer article 34-3, so that aerosol precursor may pass from that first region 35-3 directly into the holes 37-3, and through those holes to the second plate 36*b*-3.

Since the second plate 36*b*-3 is porous, the aerosol precursor will pass to the surface of the plate 36*b*-3 remote from the first region 35-3 of the fluid-transfer article 34-3, which surface acts as an activation surface 41-3 of the fluid-transfer article 34-3. A heater 24-3 is mounted so as to be proximate but spaced from the activation surface 41-3. When the heater 24-3 is activated, the heat which it generates will be transferred to the activation surface 41-3. The spacing between the activation surface 41-3 and the heater 24-3 is preferably between 0.05 mm and 0.5 mm. The spacing is chosen so as to ensure efficient heating of the activation surface 41-3 by the heater 24-3, but allow satisfactory air flow between the activation surface 41-3 and the heater 24-3.

Further components not shown in FIG. 29 comprise: an inlet conduit, via which air can be drawn into the aerosol carrier 14-3; an outlet conduit, via which an air stream entrained with aerosol can be drawn from the aerosol carrier 14-3; a filter element; and a reservoir for storing aerosol precursor material and for providing the aerosol precursor material to the fluid-transfer article 34-3.

In FIG. 29, the aerosol carrier is shown as comprising the fluid-transfer article 34-3 located within housing 32-3. The fluid transfer article 34-3 comprises a first region 35-3 holding an aerosol precursor. In one or more arrangements, the fluid transfer article 34-3 comprises a reservoir for holding the aerosol precursor. The first region 35-3 can be the sole reservoir of the aerosol carrier 14-3, or it can be arranged in fluid communication with a separate reservoir, where aerosol precursor is stored for supply to the first region 35-3. As shown in FIG. 29, the first region 35-3 has a first layer 35*a*-3 and a second layer 35*b*-3. The material forming the first layer 35*a*-3 of the first region 35-3 comprises a porous structure, whose pore diameter size varies between one end of the first layer 35*a*-3 and another end of the first layer 35*a*-3. The pore diameter size may increase from a first end remote from heater 24-3 (the upper end is as shown in the figure) to a second end. The pore diameter size may change in a step-wise manner (i.e., a first part with pores having a diameter of first size, and a second part with pores having a diameter of second, smaller size), or the change in pore size in the first layer 35*a*-3 may be gradual rather than step-wise. This configuration of pores having a decreasing diameter size can provide a wicking effect, which can serve to draw fluid through the first layer 35*a*-3, towards heater 24-3.

The first region 35-3 of the fluid transfer article 34-3 may also comprise a second layer 35*b*-3. Aerosol precursor is drawn from the first layer 35*a*-3 to the second layer 35*b*-3 by the wicking effect of the material forming the first layer 35*a*-3. Thus, the first layer 35*a*-3 is configured to transfer the aerosol precursor to the second layer 35*b*-3 of the first region 35-3 of the fluid-transfer article 34-3.

The second layer 35*b*-3 itself may comprise a porous structure formed by a porous polymer material. It is then preferable that the pore diameter size of the porous structure of the second layer 35*b*-3 is smaller than the pore diameter size of the immediately adjacent part of the first layer 35*a*-3. As mentioned above, the porous polymer material may be a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET).

However, as mentioned previously, in some embodiments it is envisaged that the first region 35-3 of the fluid-transfer article need not be of porous polymer material as described above. Instead, the first region 35-3 of the fluid-transfer article 34-3 may take the form of a simple tank having a cavity defining a hollow reservoir to hold the aerosol precursor. In such embodiments it is proposed that the plate 36*a*-3 with holes 37-3 therein will extend across the bottom of the tank so that aerosol precursor held in the tank will impinge directly on the plate 36*a*-3 and pass directly from the tank defining the first region 35-3 of the fluid-transfer article 34-3 into the holes 37-3 of the second region 36-3 of the fluid-transfer article.

As discussed above, the heater 24-3 transfers heat to the activation surface 41-3, thereby releasing aerosol precursor which has reached that activation surface 41-3 from the porous polymer material (or hollow reservoir) of the first region 35-3, through the second region 36-3. That vapor and/or a mixture of vapor and aerosol, may then pass into the air adjacent the activation surface 41-3, between the heater 24-3 and the activation surface.

FIG. 29 also illustrates an opening 38-3, which opening 38-3 is in communication with the air-intake apertures 20-3. A further opening 39-3 communicates with a duct 40-3 within the housing 32-3, which duct 40-3 communicates with the second end 18-3.

There is thus a fluid-flow path for air (referred to as an air-flow pathway) between openings 38-3 and 39, linking the apertures 20-3 and the second end 18-3 of the aerosol carrier. When the user sucks or inhales, air is drawn along the air-flow pathway, along the activation surface 41-3. The heater 24-3 forms a lower surface of the air-flow pathway. As mentioned above, the spacing between the activation surface 41-3 and the heater 24-3 needs to be small enough to allow good heat transfer from the heater 24-3 to the activation surface 41-3, but large enough to allow sufficient air flow along the air-flow pathway. Thus, the spacing between the activation surface and the heater is preferably 0.5 mm to 0.05 mm.

One or more droplets of the aerosol precursor will be released from the second plate 36*b*-3 and heated, to release vapor or a mixture of aerosol and vapor into the air flowing in the air-flow pathway between the openings 38-3, 39-3. The vapor or mixture passes, as the user sucks and inhales, to the second end 18-3.

As mentioned above, the second region 36-3 of the fluid-transfer article 34-3 comprises a first plate **36*a*-3 and a second plate 36*b*-3. The first plate 36*a*-3 may be a molded polymer disc so that is then easy to form the holes 37-3 therein by molding the holes 37-3 when the plate 36*a*-3 is itself molded. The holes 37-3 are sufficiently large that they do not act as a capillary, but instead define non-capillary spaces in the second region 36-3. Hence, aerosol precursor is able to pass from the first region 35-3 of the fluid-transfer article to the second region 36-3 in a non-capillary manner, into the holes 37-3, and then pass through the second plate 36*b*-3 to the heater or heaters 24-3. The holes 37-3** may be relatively large, so that they fill with aerosol precursor when the apparatus is in use.

The second plate **36*b*-3 is made of a porous material which is more heat-resistant than the material of the plate 36*a*-3, as it is acted on by the heater 24-3. It may be fibrous, made from e.g., ceramic fiber, glass fiber or carbon fiber. Alternatively, it may be formed from a high-temperature porous material such as porous glass or porous ceramic. Another possibility is that the second plate 36*b*-3 may be of a porous polymer material, such as the materials described previously with reference to the layers 35*a*-3 and 35*b*-3 of the first region 35-3, provided that the polymer material is sufficiently resistant to the high temperatures to which it will be subject due to the heater 24-3**.

It is thought that the flow of air between openings 38-3 and 39-3 along the activation surface 41-3 and past the heater 24-3 will have the effect of creating the lower air pressure adjacent the activation surface 41-3 which will tend to draw liquid through the porous second plate **36*b*-3 to the activation surface 41-3. Thus, the transfer of aerosol precursor from the fluid-transfer article 34-3** is facilitated.

As mentioned above, the fluid-transfer article 34-3, formed by the first and second regions 35-3 and 36-3 and any further reservoir of aerosol precursor, forms the consumable part of the apparatus, in the sense that it can readily be replaced to enable the aerosol precursor to be replaced once it is consumed. The heater 24-3 is not part of the consumable elements. Thus, the housing 32-3 containing the fluid-transfer article 34-3 may be separable from a housing 43-3 supporting the heater 24-3 e.g., along the line B-B in FIG. 29 The openings 38-3 and 39-3 are formed in the further housing 43-3. The further housing 43-3 may be integral with the housing 26-3 containing the electrical energy supply 28-3. The heater 24-3 must be separable from the fluid-transfer article 34-3 to allow removal of the housing 32-3 from the further housing 43-3 when the fluid-transfer article 34-3 has become depleted. The line of separation of the housing 32-3 and further housing 43-3 may therefore correspond to the plane of the activation surface 41-3 (along the line B-B), or any other line running between the activation surface 41-3 and the heater 24-3.

In the arrangement of FIG. 29, there is an optional conduction element 25-3, being part of the heater 24-3, facing the activation surface 41-3. Heat will be transferred to the activation surface 41-3 via conduction through the conduction element 25-3, so that the application of heat to the activation surface is indirect. The air-flow pathway is thus between the conduction element 25-3 of the heater 24-3 and the activation surface 41-3.

The conduction element 25-3, if present, may comprise a thin film of thermally conductive material, such as, for example, a metal foil (for example, aluminum, brass, copper, gold, steel, silver, or an alloy comprising anyone of the foregoing together with thermally conductive plastics and/or ceramics).

In the illustrative examples of FIG. 29, the first layer **35*a*-3 of the first region 35-3 of the fluid-transfer article 34-3 is located at an "upstream" end of the fluid-transfer article 34-3 and the second plate 35*b*-3 of the second region 35*b*-3 is located at a downstream" end of the fluid-transfer article 34-3. That is, aerosol precursor is wicked, or is drawn, from the "upstream" end of the fluid-transfer article 34-3 to the "downstream" end of the fluid-transfer article 34-3 (as denoted by arrow A in FIG. 29**).

As mentioned above, the conduction element 25-3 is optional. FIG. 30 illustrates an arrangement in which that conduction element 36-3 is omitted, from the body of the heater adjacent to the activation surface 41-3. Other components of FIG. 30 which are the same as components of FIG. 29 are indicated by the same reference numerals.

Figure 31:
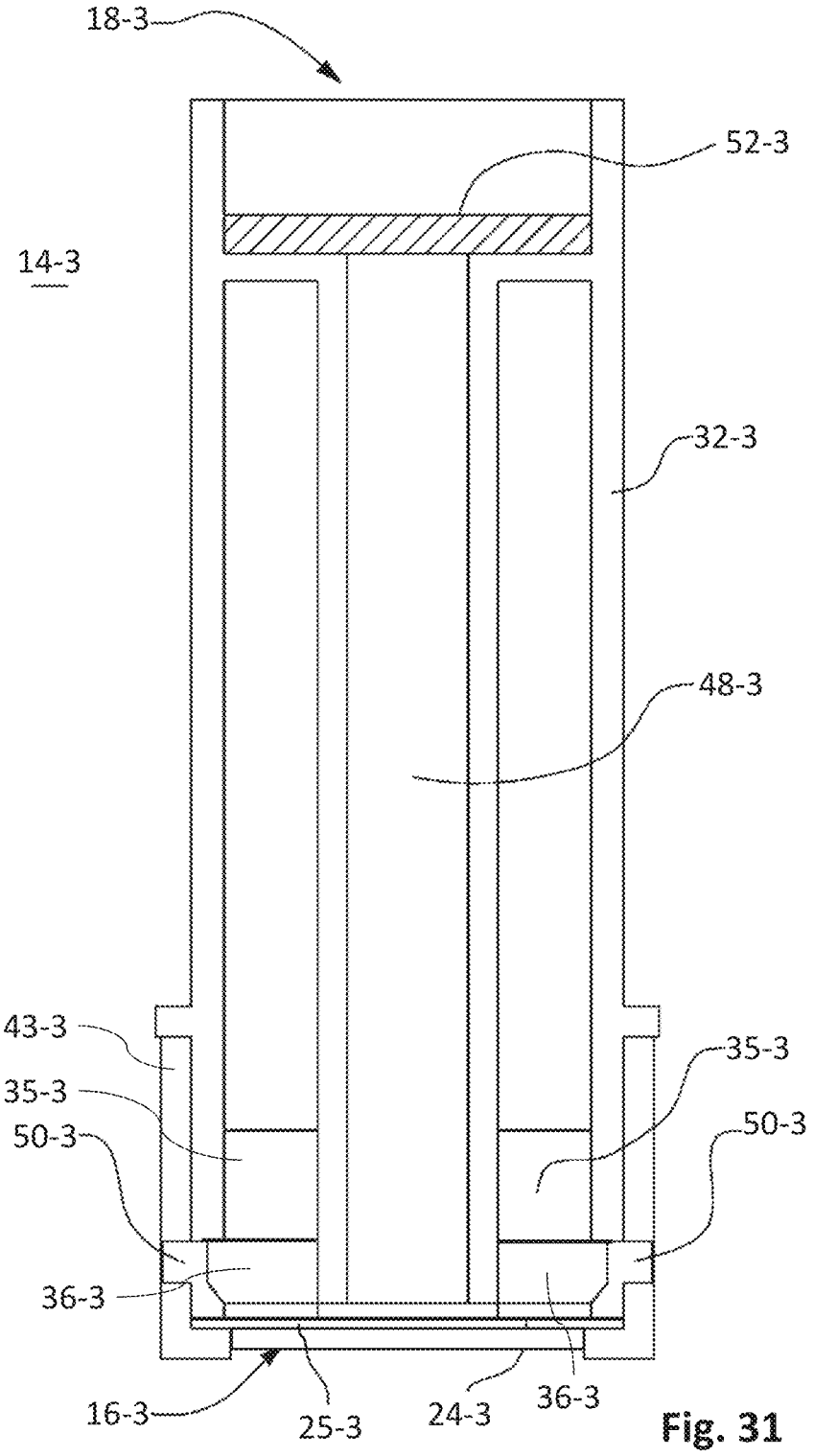
FIG. 31 is a cross-section side view of aerosol carrier according to one or more embodiments of the third mode of the present disclosure.
Figure 32:
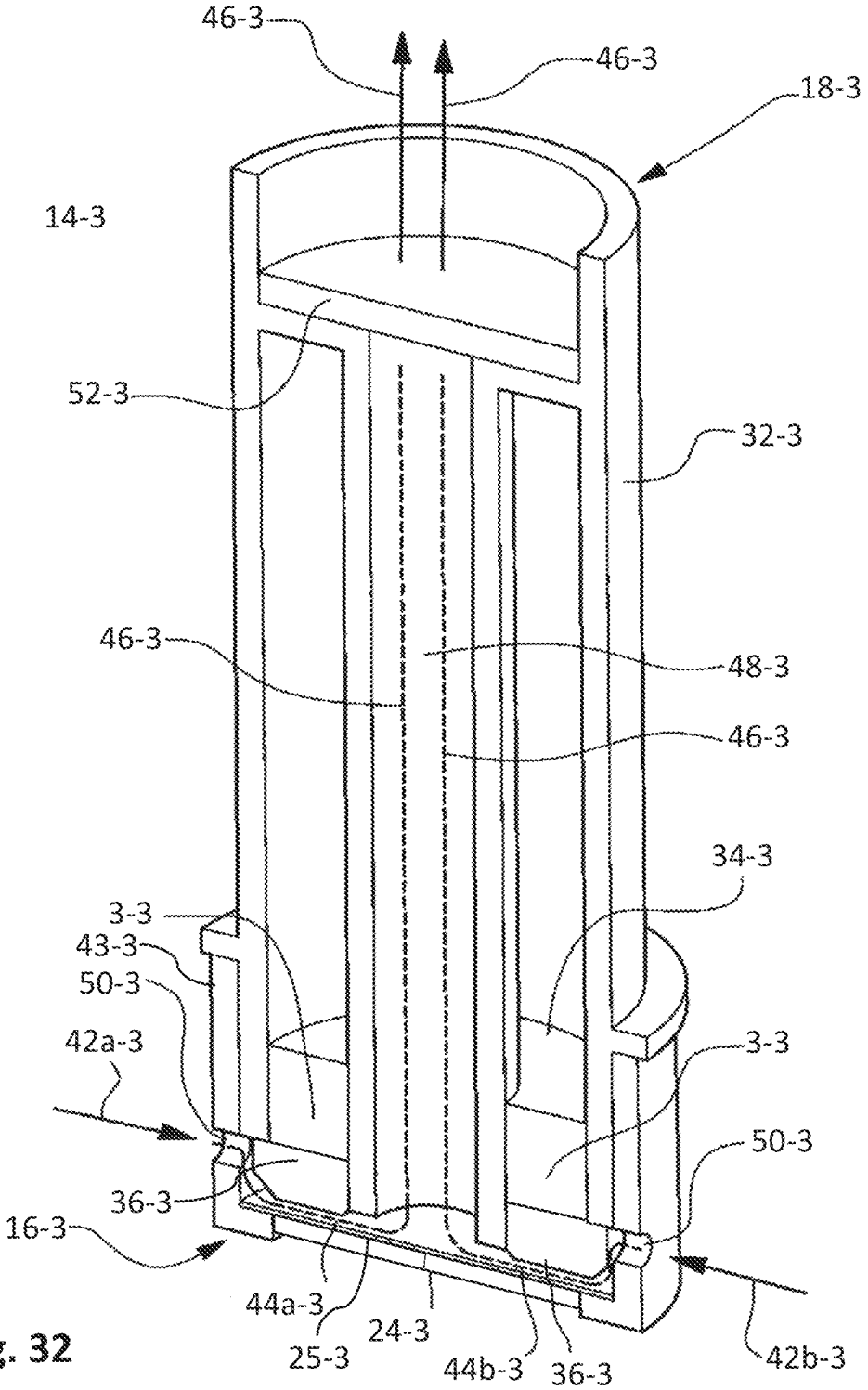
FIG. 32 is a perspective cross-section side view of the aerosol carrier of FIG. 31.
Figure 33:
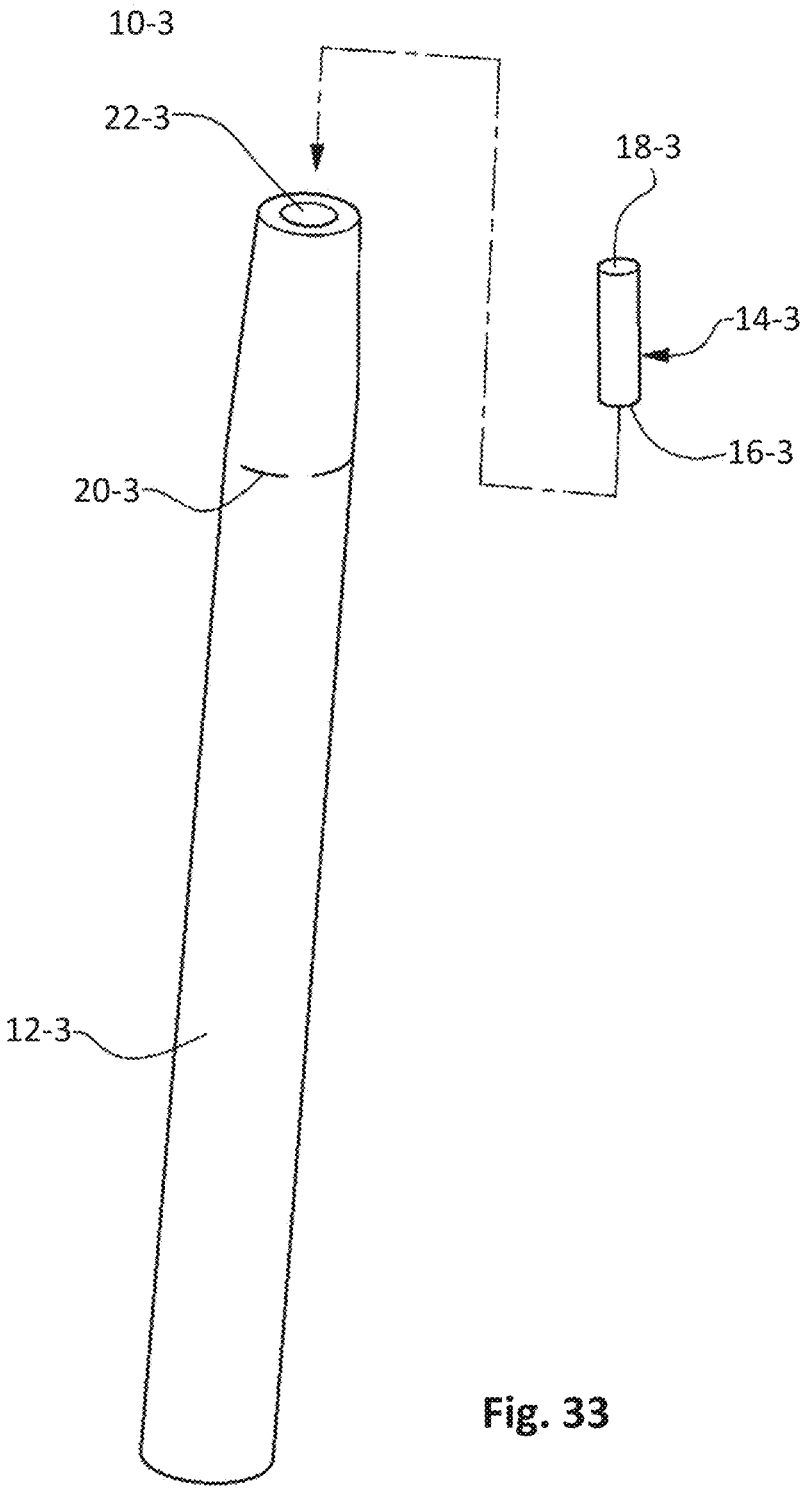
FIG. 33 is an exploded perspective view illustration of a kit-of-parts for assembling the system according to one or more embodiments of the third mode of the present disclosure.

In the arrangements shown in FIGS. 29 and 30, the apertures 38-3, 39 are on opposite sides of the housing 32-3. FIGS. 31 and 32 shows an alternative configuration, in which the fluid-transfer article is annular, and both the first region 35-3 and the second region 36-3 are then in the form of annuli. In FIGS. 32 and 33, the structure of the fluid-transfer article 34-3, including the first region 35-3 and the second region 36-3 may correspond generally to that shown in FIG. 29 The internal structure of the first and second regions 35-3 and 36-3 may be the same as in FIG. 29, but are not illustrated in detail in FIGS. 31 and 32 for simplicity.

The heater 24-3 also may be formed as in the arrangement of FIG. 29 or FIG. 30 The air flow in the apparatus is discussed in more detail below. Thus, FIGS. 31 and 32 illustrate an aerosol carrier 14-3 according to one or more possible arrangements in more detail. FIG. 31 is a cross-section side view illustration of the aerosol carrier 14-3 and FIG. 32 is a perspective cross-section side view illustration of the aerosol carrier 14-3.

As can be seen from FIGS. 31 and 32, the aerosol carrier 14-3 is generally tubular in form. The aerosol carrier 14-3 comprises housing 32-3, which defines the external walls of the aerosol carrier 14-3 and which defines therein a chamber in which are disposed the fluid-transfer article 34-3 (adjacent the first end 16-3 of the aerosol carrier 14-3) and internal walls defining the fluid communication pathway 48-3. Fluid communication pathway 48-3 defines a fluid pathway for an outgoing air stream from the channels 40-3 to the second end 18-3 of the aerosol carrier 14-3. In the examples illustrated in FIGS. 31 and 32, the fluid-transfer article 34-3 is an annular shaped element located around the fluid communication pathway 48-3. The housing 32-3 containing the fluid-transfer article 34-3 is separable from the housing 43-3 supporting the heater 24-3.

In walls of the housing 43-3, there are provided inlet apertures 50-3 to provide a fluid communication pathway for an incoming air stream to reach the activation surface 41-3 of the second region 36-3 of the fluid-transfer article 34-3.

In the illustrated example of FIGS. 31 and 32, the aerosol carrier 14-3 further comprises a filter element 52-3. The filter element 52-3 is located across the fluid communication pathway 48-3 such that an outgoing air stream passing through the fluid communication pathway 48-3 passes through the filter element 52-3.

With reference to FIG. 32, when a user sucks on a mouthpiece of the apparatus (or on the second end 18-3 of the aerosol carrier 14-3, if configured as a mouthpiece), air is drawn into the carrier through inlet apertures 50-3 extending through walls in the housing 32-3 of the aerosol carrier 14-3.

An incoming airstream **42*a*-3 from a first side of the aerosol carrier 14-3 is directed to a first side of the second region 36-3 (e.g., via a gas communication pathway within the housing of the carrier). An incoming air stream 42*b*-3 from a second side of the aerosol carrier 14-3 is directed to a second side of the second region 36-3 (e.g., via a gas communication pathway within the housing of the carrier). When the incoming air stream 42*a*-3 from the first side of the aerosol carrier 14-3 reaches the first side of the second region 36-3, the incoming air stream 42*a*-3 from the first side of the aerosol carrier 14-3 flows along the activation surface 41-3 of the second region 36-3. Likewise, when the incoming air stream 42*b*-3 from the second side of the aerosol carrier 14-3 reaches the second side of the second region 36-3, the incoming air stream 42*b*-3 from the second side of the aerosol carrier 14-3 flows along the activation surface 41-3 of the second region 36-3. The air streams from each side are denoted by dashed lines 44*a*-3 and 44*b*-3 in FIG. 32 As these air streams 44*a*-3 and 44*b*-3 flow, aerosol precursor on the activation surface 41-3 of the second region 36-3 is entrained in air streams 44*a*-3 and 44*b*-3**.

In use, the heater or heaters 24-3 of the apparatus 12-3 raise a temperature of the second plate **36*b*-3 of the second region 36-3 to a sufficient temperature to release, or liberate, captive substances (i.e., the aerosol precursor) to form a vapor and/or aerosol, which is drawn downstream. As the air streams 44*a*-3 and 44*b*-3 continue their passages, more released aerosol precursor is entrained within the air streams 44*a*-3 and 44*b*-3. When the air streams 44*a*-3 and 44*b*-3 entrained with aerosol precursor meet at a mouth of the outlet fluid communication pathway 48-3, they enter the outlet fluid communication pathway 48-3 and continue until they pass through filter element 52-3 and exit outlet fluid communication pathway 48-3, either as a single outgoing air stream, or as separate outgoing air streams 46-3 (as shown). The outgoing air streams 46-3 are directed to an outlet, from where it can be inhaled by the user directly (if the second end 18-3 of the aerosol capsule 14-3 is configured as a mouthpiece), or via a mouthpiece. The outgoing air streams 46-3** entrained with aerosol precursor are directed to the outlet (e.g., via a gas communication pathway within the housing of the carrier).

FIG. 33 is an exploded perspective view illustration of a kit-of-parts for assembling an aerosol delivery system 10-3.

As will be appreciated, in the arrangements described above, the fluid-transfer article 34-3 is provided within a housing 32-3 of the aerosol carrier 14-3. In such arrangements, the housing of the carrier 14-3 serves to protect the aerosol precursor-containing fluid-transfer article 34-3, whilst also allowing the carrier 14-3 to be handled by a user without his/her fingers coming into contact with the aerosol precursor liquid retained therein.

In any of the embodiments described above the second plate **36*b*-3 of the second region 36-3** may have a thickness of less than 5 mm. In other embodiments it may have a thickness of: less than 3.5 mm, less than 3 mm, less than 2.5 mm, less than 2 mm, less than 1.9 mm, less than 1.8 mm, less than 1.7 mm, less than 1.6 mm, less than 1.5 mm, less than 1.4 mm, less than 1.3 mm, less than 1.2 mm, less than 1.1 mm, less than 1 mm, less than 0.9 mm, less than 0.8 mm, less than 0.7 mm, less than 0.6 mm, less than 0.5 mm, less than 0.4 mm, less than 0.3 mm, less than 0.2 mm, or less than 0.1 mm.

Fourth Mode: An Aerosol Generation Apparatus has a Fluid-Transfer Article which Holds Aerosol Precursor and which Transfers that Aerosol Precursor to a Transfer Surface Aspects and embodiments of the fourth mode of the present disclosure will now be discussed with reference to the accompanying figures. Further aspects and embodiments of the fourth mode will be apparent to those skilled in the art. All documents mentioned in this text are incorporated herein by reference.

In general outline, one or more embodiments of the fourth mode in accordance with the present disclosure may provide a system for aerosol delivery in which an aerosol carrier may be inserted into a receptacle (e.g., a "heating chamber") of an apparatus for initiating and maintaining release of an aerosol from the aerosol carrier. Another end, or another end portion, of the aerosol carrier may protrude from the apparatus and can be inserted into the mouth of a user for the inhalation of aerosol released from the aerosol carrier cartridge during operation of the apparatus.

Hereinafter, and for convenience only, "system for aerosol delivery" shall be referred to as "aerosol delivery system".

Figure 34:
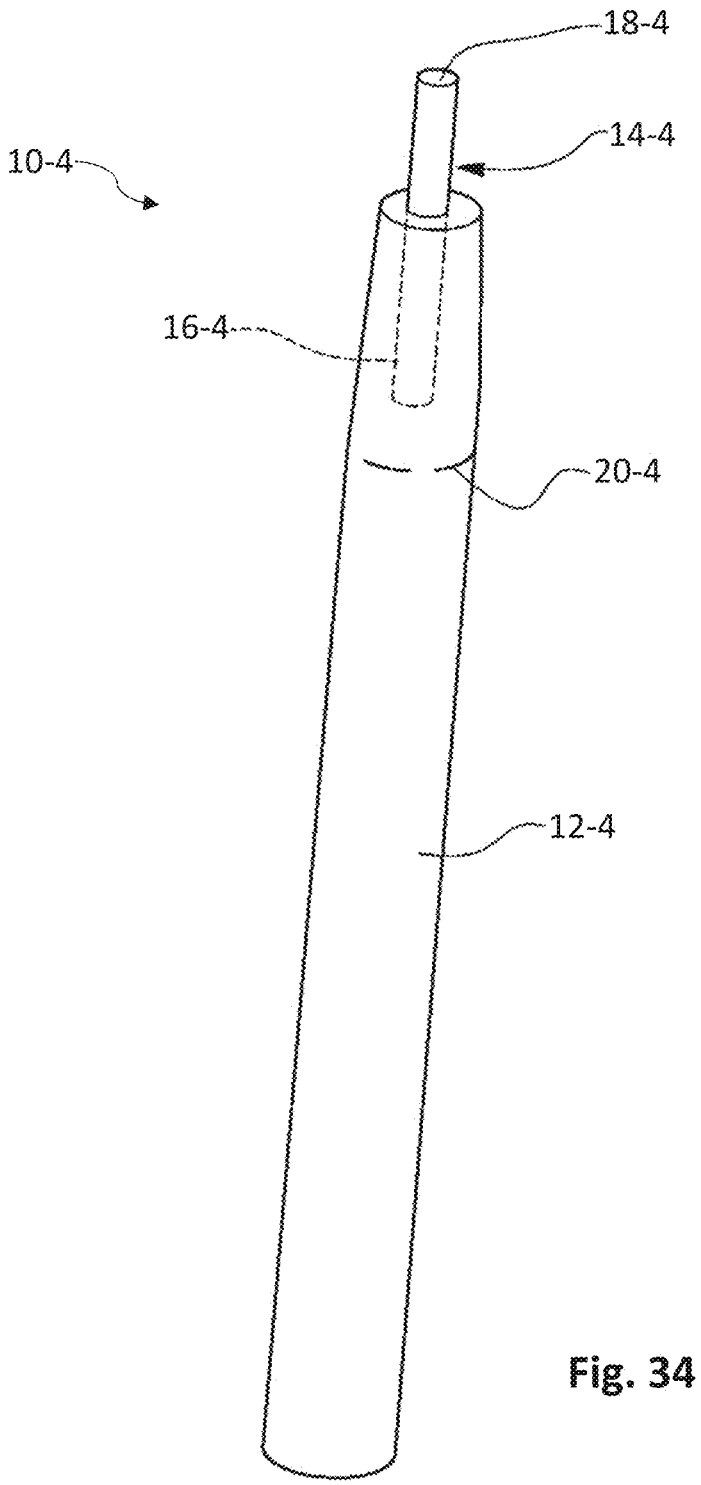
FIG. 34 is a perspective view illustration of a system for aerosol delivery according to one or more embodiments of the fourth mode of the present disclosure.

Referring now to FIG. 34, there is illustrated a perspective view of an aerosol delivery system 10-4 comprising an aerosol generation apparatus 12-4 operative to initiate and maintain release of aerosol from a fluid-transfer article in an aerosol carrier 14-4. In the arrangement of FIG. 34, the aerosol carrier 14-4 is shown with a first end 16-4 thereof and a portion of the length of the aerosol carrier 14-4 located within a receptacle of the apparatus 12-4. A remaining portion of the aerosol carrier 14-4 extends out of the receptacle. This remaining portion of the aerosol carrier 14-4, terminating at a second end 18-4 of the aerosol carrier, is configured for insertion into a user's mouth. A vapor and/or aerosol is produced when a heater (not shown in FIG. 34) of the apparatus 12-4 heats a fluid-transfer article in the aerosol carrier 14-4 to release a vapor and/or an aerosol, and this can be delivered to the user, when the user sucks or inhales, via a fluid passage in communication with an outlet of the aerosol carrier 14-4 from the fluid-transfer article to the second end 18-4.

The device 12-4 also comprises air-intake apertures 20-4 in the housing of the apparatus 12-4 to provide a passage for air to be drawn into the interior of the apparatus 12-4 (when the user sucks or inhales) for delivery to a heater associated with the first end 16-4 of the aerosol carrier 14-4, so that the air can be drawn across an activation surface of the heater during use. Optionally, these apertures may be perforations in the housing of the apparatus 12-4.

A fluid-transfer article (not shown in FIG. 34, but described hereinafter with reference to FIGS. 38 to 42 is located within a housing of the aerosol carrier 14-4. The fluid-transfer article contains an aerosol precursor material, which may include at least one of: nicotine; a nicotine precursor material; a nicotine compound; and one or more flavorings. As air passes across the activation surface of the heater, an aerosol may be entrained in the air stream, e.g., via diffusion to the air stream and/or via vaporization of the aerosol precursor material and release from the heater under heating.

The substrate forming the fluid-transfer article 34-4 comprises a porous material where pores of the porous material hold, contain, carry, or bear the aerosol precursor material. In particular, the porous material of the fluid-transfer article is a porous polymer material such as, for example, a sintered material. Particular examples of material suitable for the fluid-transfer article include: Polyetherimide (PEI); Polytetrafluoroethylene (PTFE); Polyether ether ketone (PEEK);

Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET). All such materials may be described as heat resistant polymeric wicking material in the context of the present disclosure.

The aerosol carrier 14-4 is removable from the apparatus 12-4 so that it may be disposed of when expired. After removal of a used aerosol carrier 14-4, a replacement aerosol carrier 14-4 can be inserted into the apparatus 12-4 to replace the used aerosol carrier 14-4.

Figure 35:
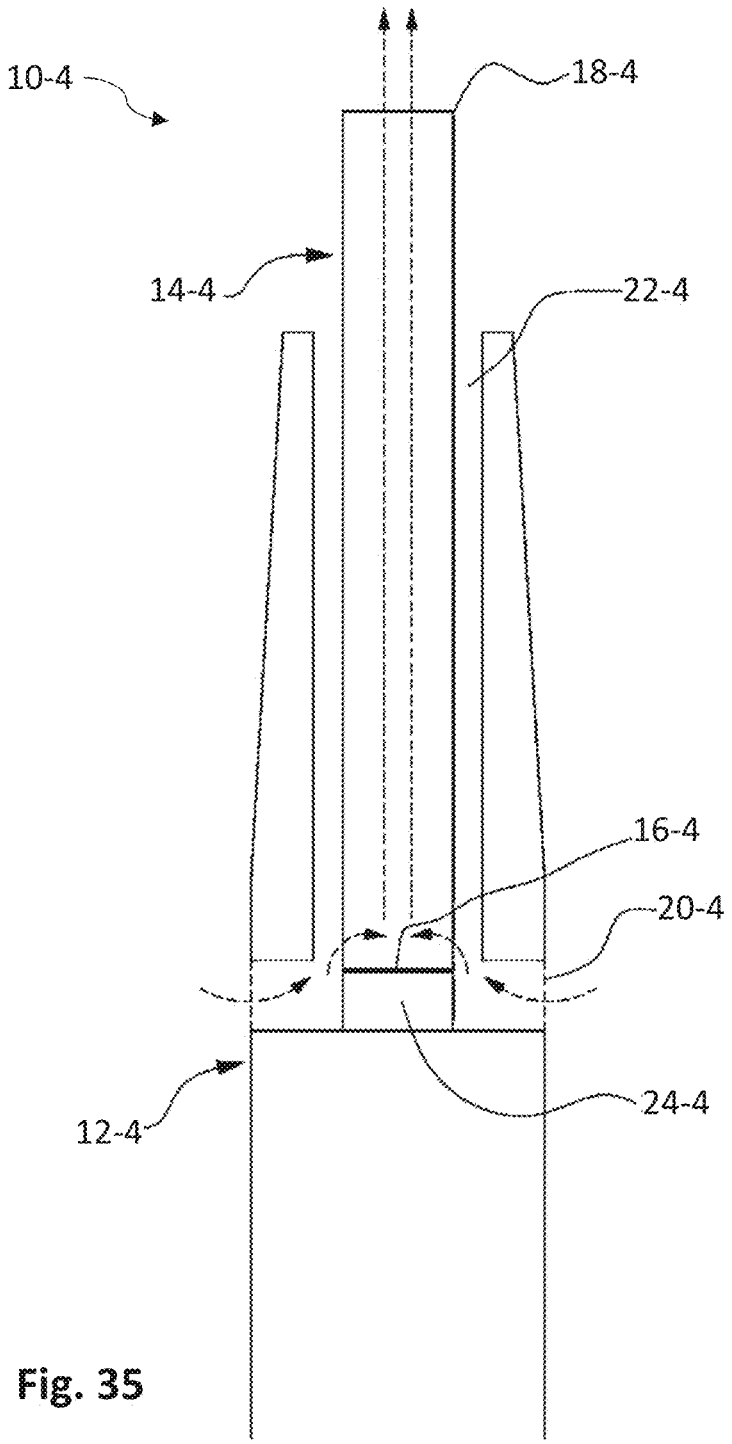
FIG. 35 is a cross-section side view illustration of part of an apparatus of the system for aerosol delivery of FIG. 33.

FIG. 35 is a cross-sectional side view illustration of a part of apparatus 12-4 of the aerosol delivery system 10. The apparatus 12-4 comprises a receptacle 22-4 in which is located a portion of the aerosol carrier 14-4. In one or more optional arrangements, the receptacle 22-4 may enclose the aerosol carrier 14-4. The apparatus 12-4 also comprises a heater 24-4, which may contact a transfer surface of the fluid-transfer article (not shown in FIG. 35) of the aerosol carrier 14-4 when an aerosol carrier 14-4 is located within the receptacle 22-4. Optional configurations of the heater 24-4 will be discussed later.

Air flows into the apparatus 12-4 (in particular, into a closed end of the receptacle 22-4) via air-intake apertures 20-4. From the closed end of the receptacle 22-4, the air is drawn into the aerosol carrier 14-4 (under the action of the user inhaling or sucking on the second end 18-4) and expelled at the second end 18-4. As the air flows towards the aerosol carrier 14-4, it passes across the activation surface of the heater. Heat from the heating elements of the heater 24-4 causes vaporization of aerosol precursor material at the activation surface of the heater and an aerosol is created in the air flowing over the activation surface. Thus, through the application of heat in the region of the activation surface an aerosol is released, or liberated and is drawn from the material of the aerosol carrier unit by the air flowing across the activation surface and is transported in the air flow to via outlet conduits (not shown in FIG. 35) in the housing of the aerosol carrier 14-4 to the second end 18-4. The direction of air flow is illustrated by arrows in FIG. 35.

As a user sucks or inhales on second end 18-4 of the aerosol carrier 14-4, the is aerosol released from the heater and entrained in the air flowing across the activation surface of the heater is drawn through the outlet conduits (not shown) in the housing of the aerosol carrier 14-4 towards the second end 18-4 and onwards into the user's mouth.

Figure 36:
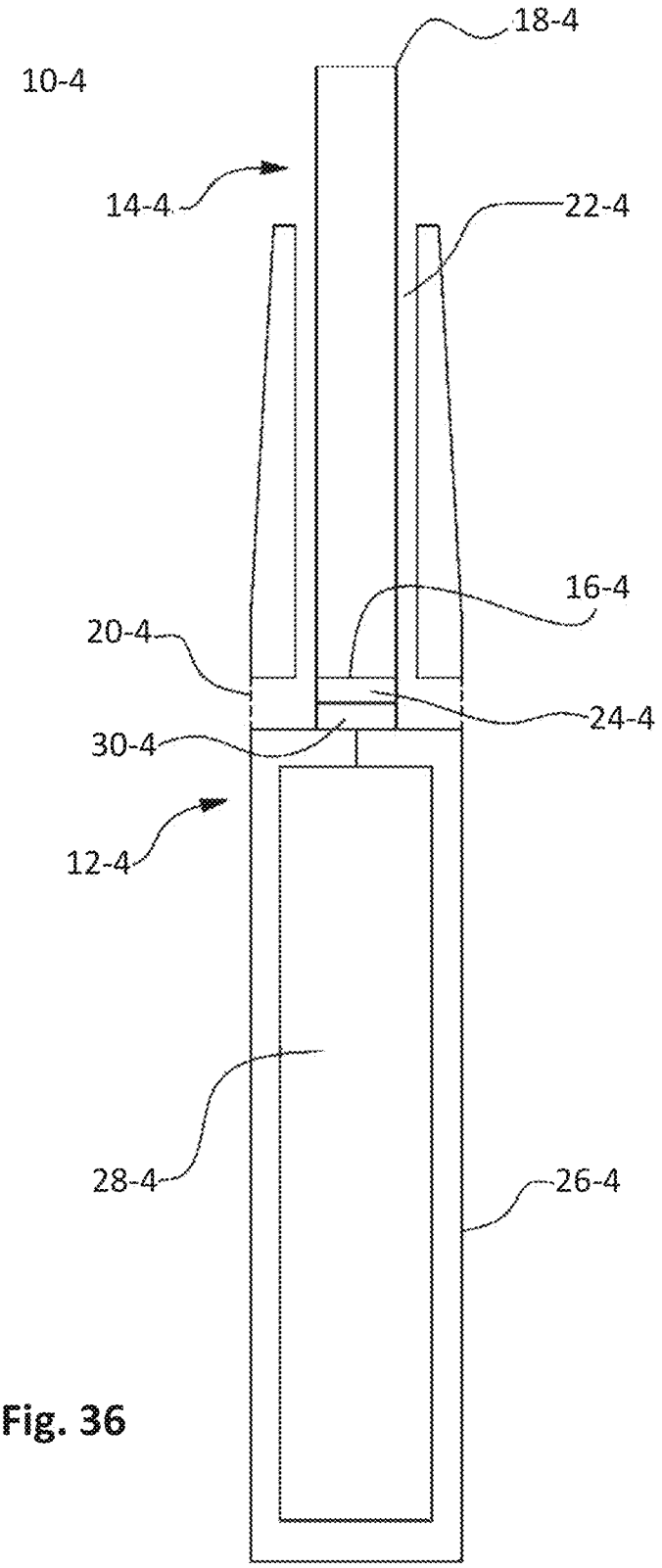
FIG. 36 is a cross-section side view illustration of the system and apparatus for aerosol delivery of FIG. 34.

Turning now to FIG. 36, a cross-sectional side view of the aerosol delivery system 10-4 is schematically illustrated showing the features described above in relation to FIGS. 34 and 35 in more detail. As can be seen, apparatus 12-4 comprises a housing 26-4, in which are located the receptacle 22-4 and heater 24-4. The housing 26-4 also contains control circuitry (not shown) operative by a user, or upon detection of air and/or vapor being drawn into the device 12-4 through air-intake apertures 20-4, i.e., when the user sucks or inhales. Additionally, the housing 26-4 comprises an electrical energy supply 28-4, for example a battery. Optionally, the battery comprises a rechargeable lithium-ion battery. The housing 26-4 also comprises a coupling 30-4 for electrically (and optionally mechanically) coupling the electrical energy supply 28-4 to control circuitry (not shown) for powering and controlling operation of the heater 24-4.

Responsive to activation of the control circuitry of apparatus 12-4, the heating elements of the heater 24-4 cause a heating process to be initiated which causes (and, through continued operation, maintains) release of vapor and/or an aerosol from the activation surface of the heater. The vapor and/or aerosol formed as a result of the heating process is entrained into a stream of air being drawn across the activation surface of the heater (as the user sucks or inhales). The stream of air with the entrained vapor and/or aerosol passes through the aerosol carrier 14-4 via outlet conduits (not shown) and exits the aerosol carrier 14-4 at second end 18-4 for delivery to the user. This process is briefly described above in relation to FIG. 35, where arrows schematically denote the flow of the air stream into the device 12-4 and through the aerosol carrier 14-4, and the flow of the air stream with the entrained vapor and/or aerosol through the aerosol carrier cartridge 14-4.

Figure 37:
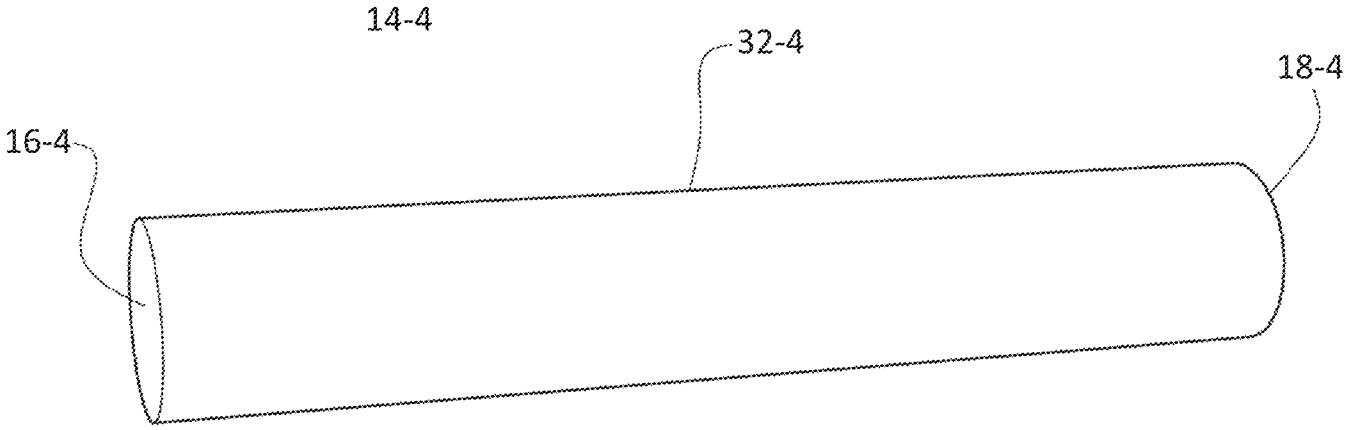
FIG. 37 is a perspective view illustration of an aerosol carrier for use in the system for aerosol delivery according to one or more embodiments of the fourth mode of the present disclosure.
Figure 38:
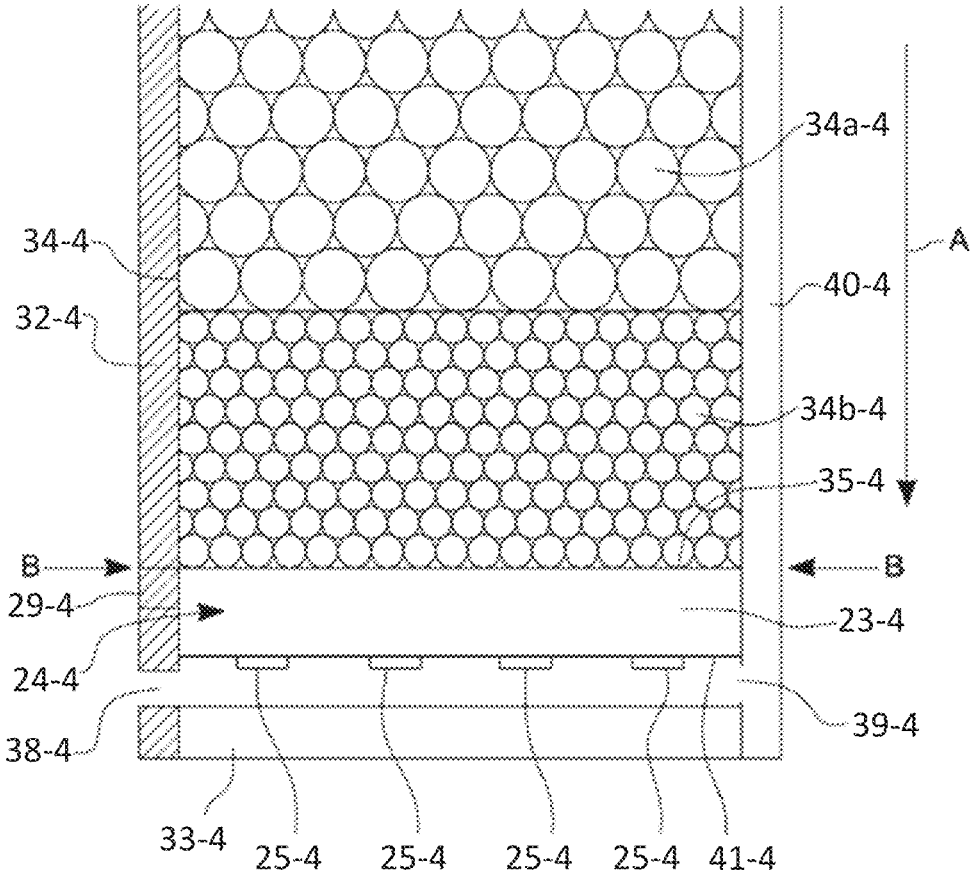
FIG. 38 is a cross-section side view of elements of an aerosol carrier and a part of an apparatus of the system for aerosol delivery according to one or more embodiments of the fourth mode of the present disclosure.
Figure 39:
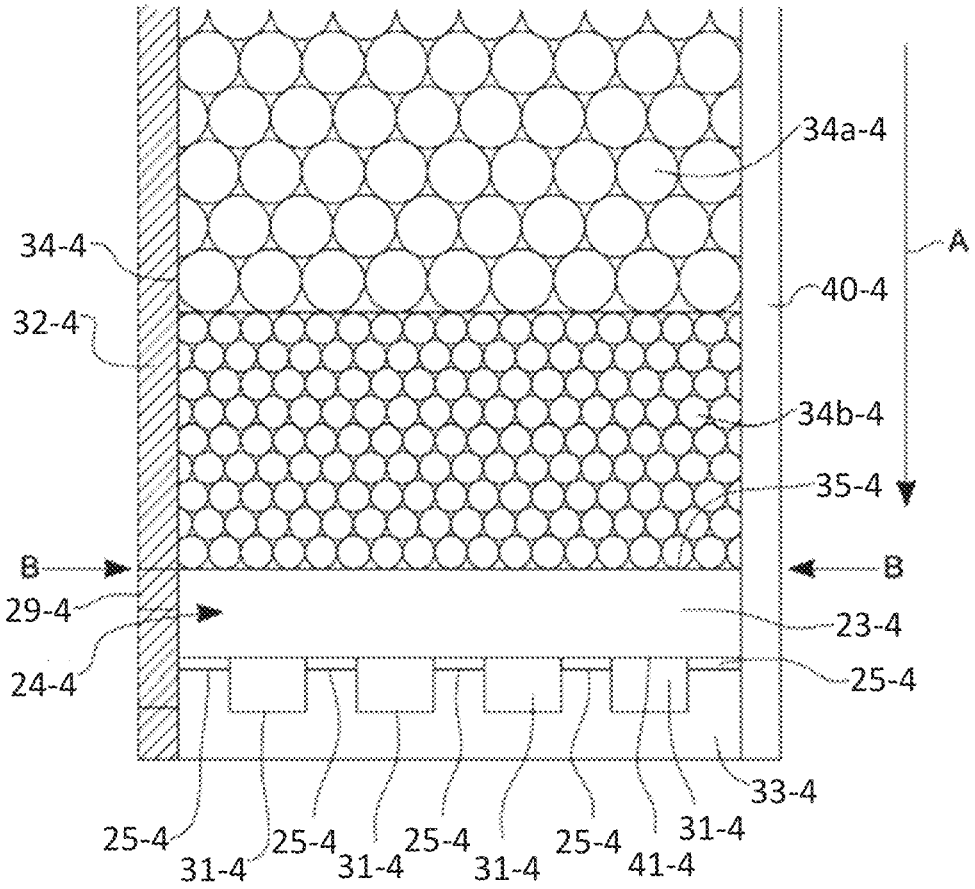
FIG. 39 is a cross-section side view of elements of an aerosol carrier and a part of an apparatus of the system for aerosol delivery according to one or more embodiments of the fourth mode of the present disclosure, in an alternative configuration from that of FIG. 38.
Figure 40:
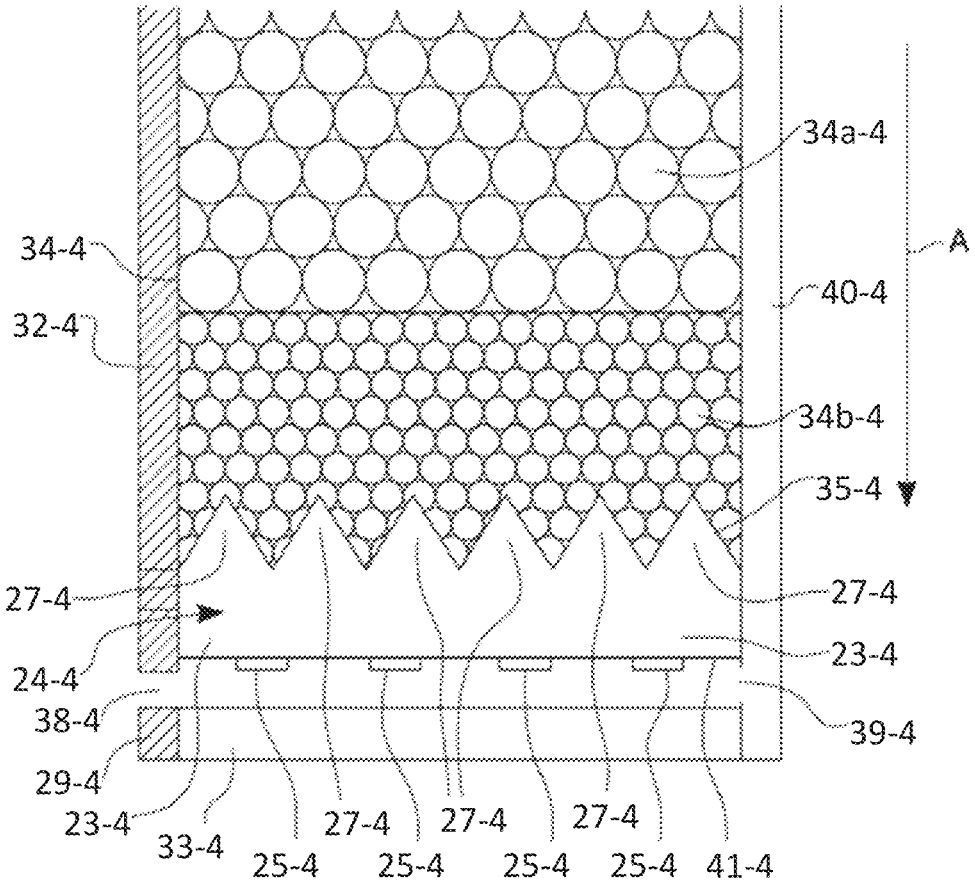
FIG. 40 is a cross-section side view of elements of an aerosol carrier and a part of an apparatus of the system for aerosol delivery according to one or more embodiments of the fourth mode of the present disclosure, in an alternative configuration from those of FIGS. 38 and 39.

FIGS. 37 to 39 schematically illustrate the aerosol carrier 14-4 in more detail (and, in FIGS. 38, 39 and 40, features within the receptacle in more detail). FIG. 37 illustrates an exterior of the aerosol carrier 14-4, FIG. 38 illustrates internal components of the aerosol carrier 14-4 in one optional configuration, and FIGS. 39 and 40 illustrate internal components of the aerosol carrier 14-4 in other optional configurations.

FIG. 37 illustrates the exterior of the aerosol carrier 14-4, which comprises housing 32-4 for housing said fluid-transfer article (not shown). The particular housing 32-4 illustrated in FIG. 37 comprises a tubular member, which may be generally cylindrical in form, and which is configured to be received within the receptacle of the apparatus. First end 16-4 of the aerosol carrier 14-4 is for location to oppose the heater of the apparatus, and second end 18-4 (and the region adjacent the second end 18-4) is configured for insertion into a user's mouth.

FIG. 38 illustrates some internal components of the aerosol carrier 14-4 and of the heater 24-4 of apparatus 12-4, in one embodiment of the disclosure.

As described above, the aerosol carrier 14-4 comprises a fluid-transfer element 34-4. The fluid-transfer article 34-4 may be removable from the housing 32-4, to enable it to be replaced. The fluid-transfer article 34-4 acts as a reservoir for aerosol precursor and that aerosol precursor will be consumed as the apparatus is used. Once sufficient aerosol precursor has been consumed, the aerosol precursor will need to be replaced. It may then be easiest to replace it by replacing the fluid-transfer article 34-4, rather than trying to re-fill the fluid-transfer article 34-4 with aerosol precursor while it is in the housing 32-4.

Adjacent to, but separable from, the fluid-transfer article 34-4 is the heater 24-4, which has an element 23-4 of a porous material which allows aerosol precursor to pass therethrough. In the arrangement of FIG. 38 the porous element 23-4 of the heater 24-4 is in contact with transfer surface 35-4 of the fluid-transfer article 34-4, so that aerosol precursor may pass from that transfer surface 35-4 directly into the porous element 23-4 of the heater 24-4.

Since the element 23-4 is porous, the aerosol precursor will pass to the surface of the element 23-4 remote from the fluid-transfer article 34-4, which surface will be referred to as an activation surface 41-4. Heating elements 25-4 of the heater 24-4 are mounted on the activation surface 41-4. When the heating elements 25-4 are activated, the heat which they generate will be transferred to the activation surface 41-4.

Further components not shown in FIG. 38 comprise: an inlet conduit, via which air can be drawn into the aerosol carrier 14-4; an outlet conduit, via which an air stream entrained with aerosol can be drawn from the aerosol carrier 14-4; a filter element; and a reservoir for storing aerosol precursor material and for providing the aerosol precursor material to the fluid-transfer article 34-4.

In FIG. 38, the aerosol carrier is shown as comprising the fluid-transfer article 34-4 located within housing 32-4. The fluid transfer article 34-4 comprises a first region 34*a*-4 holding an aerosol precursor. In one or more arrangements, the first region of 34*a* of the fluid transfer article 34-4 comprises a reservoir for holding the aerosol precursor. The first region 34*a*-4 can be the sole reservoir of the aerosol carrier 14-4, or it can be arranged in fluid communication with a separate reservoir, where aerosol precursor is stored for supply to the first region 34*a*-4. The material forming the first region of 34*a* comprises a porous structure, whose pore diameter size may vary between one end of the first region 34*a*-4 and another end of the first region 34*a*-4. For example, the pore diameter size may increase from a first end remote from heater 24-4 (the upper end is as shown in the figure) to a second end. The pore diameter size may change in a step-wise manner (i.e., a first part with pores having a diameter of first size, and a second part with pores having a diameter of second, smaller size), or the change in pore size in the first region 34*a*-4 may be gradual rather than step-wise. This configuration of pores having a decreasing diameter size can provide a wicking effect, which can serve to draw fluid through the first region 34*a*-4, towards heater 24-4.

The fluid transfer article 34-4 also comprises a second region 34*b*-4. Aerosol precursor is drawn from the first region of 34*a* to the second region 34*b*-4 by the wicking effect of the material forming the first region of 34*a*. Thus, the first region 34*a*-4 is configured to transfer the aerosol precursor to the second region 34*b*-4 of the article 34-4.

The second region 34*b*-4 itself comprises a porous structure formed by a porous polymer material. It is then preferable that the pore diameter size of the porous structure of the second region 34*b*-4 is smaller than the pore diameter size of the immediately adjacent part of the first region 34*a*-4. As mentioned above, the porous polymer material may be a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET).

As discussed above, the heating elements 25-4 transfer heat to the activation surface 41-4 of the heater, thereby releasing aerosol precursor which has reached that activation surface 41-4 through the porous polymer material of the second region 34*b*-4 and the porous element 23-4 of the heater 24-4, in the form of vapor or a mixture of vapor and aerosol. That vapor and/or mixture of vapor and aerosol, may then pass into the air adjacent the activation surface 41-4 and the heating elements 25-4.

FIG. 38 also illustrates an opening 38-4 in a further housing 29-4, which opening 38-4 is in communication with the air-intake apertures 20-4. A further opening 39-4 communicates with a duct 40-4, which duct 40-4 communicates with the second end 18-4. The housing 32-4 and the further housing 29-4 are separable, e.g., along the line B-B in FIG. 38 This allows the housing 32-4 to be removed from the rest of the apparatus, when the aerosol precursor in the fluid-transfer article 34-4 has been consumed. The fluid-transfer article 34-4 can then be re-filled with aerosol precursor, on the fluid-transfer article 34-4 replaced by one filled with aerosol precursor. The further housing 29-4 may be integral with the housing 26-4 containing the electrical energy supply 28-4.

There is thus a fluid-flow path for air (hereinafter referred to as an air-flow pathway) between openings 38-4 and 39-4, linking the apertures 20-4 and the second end 18-4 of the aerosol carrier. When the user sucks or inhales, air is drawn along the air-flow pathway, along the activation surface 41-4. The housing 29-4 may include a plate 33-4 spaced from the activation surface 41-4, so that the air-flow pathway is defined between the activation surface 41-4 and the plate 33-4.

One or more droplets of the aerosol precursor will be released from the porous element 23-4 of the heater 24-4 and heated, to release vapor or a mixture of aerosol and vapor into the air flowing in the air-flow pathway between the openings 38-4, 39-4. The vapor or mixture passes, as the user sucks and inhales, to the second end 18-4.

The porous element 33-4 of the heater 24-4 may be fibrous, made from e.g., ceramic fiber, glass fiber or carbon fiber. Alternatively, it may be formed from a high-temperature porous material such as porous glass or porous ceramic.

It is thought that the flow of air between openings 38-4 and 39-4 along the activation surface 41-4 and past the heating elements 25-4 will have the effect of creating a lower air pressure adjacent the activation surface 41-4 which will tend to draw liquid through the porous element 23-4 to the activation surface 41-4. Thus, the transfer of aerosol precursor from the fluid-transfer article 34-4 is facilitated.

As mentioned above, the heater 24-4 is separable from the fluid-transfer article 34-4. The fluid-transfer article 34-4, formed by the first and second regions 34*a*-4 and 34*b*-4 and any further reservoir of aerosol precursor, may thus form a consumable part of the apparatus, in the sense that it can readily be replaced to enable the aerosol precursor to be replaced once it is consumed. The heater 24-4 formed by the porous element 23-4 and the heating elements 25-4 together with the surrounding housing 29-4 is not part of the consumable elements.

In FIG. 38, the heating elements 25-4 may be separate or may be interconnected to form a single heating structure. For example, the heating elements 25-4 may be a coil, mesh or foil heater in which the heating elements 25-4 illustrated in FIG. 38 are parts of a common structure. Such a coil, mesh or foil heater is preferred so that any restriction caused by the heating elements 25-4 on release of aerosol or vapor from the activation surface is minimized, as vapor and/or aerosol may pass through the heating elements 25-4. However, it is also possible for the heating elements 25-4 to be a solid unbroken strip or strips, provided that there is then enough of the activation surface 41-4 not covered by the heating elements 25-4 to allow sufficient release of vapor and/or aerosol from the activation surface 41-4.

In the illustrative examples of FIG. 38, the first region 34*a*-4 of the fluid-transfer article 34-4 is located at an "upstream" end of the fluid-transfer article 34-4 and the second region 34*b*-4 is located at a downstream" end of the fluid-transfer article 34-4. That is, aerosol precursor is wicked, or is drawn, from the "upstream" end of the fluid-transfer article 34-4 to the "downstream" end of the fluid-transfer article 34-4 (as denoted by arrow A in FIG. 38).

In the arrangement of FIG. 38, the plate 33-4 has a planar surface facing the activation surface 41-4. FIG. 39 illustrates an alternative arrangement in which the plate 33-4 has projections and recesses in its surface facing the activation surface 41-4, with the recesses forming channels 31-4 for air to flow therethrough. Thus, the channels 31-4 form the air-flow pathway along the activation surface 41-4. In FIG. 39, the projections and recesses have a square-wave or "castellated" structure. Other shapes are possible, however, such as alternating peaks and troughs or recesses with curved or sinusoidal walls. All such arrangements permit channels 31-4 to be formed and allow air to flow along the activation surface 41-4. This control of air flow improves the mixing of the vaporized aerosol precursor into the air flow.

In the embodiment of FIG. 39, the peaks in the upper surface of the plate 33-4 extend to the heating elements 25-4. Other alignments are possible, and the projections need not reach all the way to the heating elements 25-4. In general, however, the heating elements 25-4 may restrict release of the vaporized aerosol precursor from parts of the activation surface 41-4 on which those heating elements 25-4 are formed, so it will normally be desirable that the channels 31-4 are aligned with the part or parts of the activation surface 41-4 other than the part of parts on which the heating elements 25-4 are formed.

Note also that, in FIG. 39, the openings 38-4 and 39-4 are not visible since they will be at the ends of the channels 31-4 to allow air to pass from the opening 38-4 in to the channels 31-4, and from those channels 31-4 out of the opening 39-4.

In the arrangements of FIGS. 38 and 39, the upper surface of the porous element 23-4 of the heater 24-4 which is adjacent the fluid-transfer article 34-4 is planar. Similarly, the lower surface of the fluid-transfer article 34-4, which forms the transfer surface 35-4, is also planar. Thus, the transfer surface 35-4 and the adjacent surface of the porous element 23-4 are in intimate contact, enabling good fluid transfer from the transfer surface to the pores of the porous element 23-4 of the heater 24-4. Such an arrangement is also simple to manufacture.

FIG. 40 illustrates an embodiment corresponding to that illustrated in FIG. 38, but in which the upper surface of the porous element 23-4 of the heater 24-4 comprises a plurality of V-shaped or triangular projections 27-4. Then, the transfer surface has matching V-shaped recesses in it, so that the transfer surface 35-4 follows the profiles of the projections 27-4. Thus, intimate contact between the transfer surface 35-4 and the heater is maintained, but the surface area of contact is increased, thereby promoting transfer of aerosol precursor from the fluid-transfer article 32-4 to the porous element 23-4 of the heater 24-4. Other possible configurations for the interface between the fluid-transfer article 32-4 and the heater 24-4 can be used, such as "castellated" or "sinusoidal" arrangements. It is then a balance between the increased complexity of manufacture to provide such convoluted surfaces, and the increased fluid transfer which results.

Figure 41:
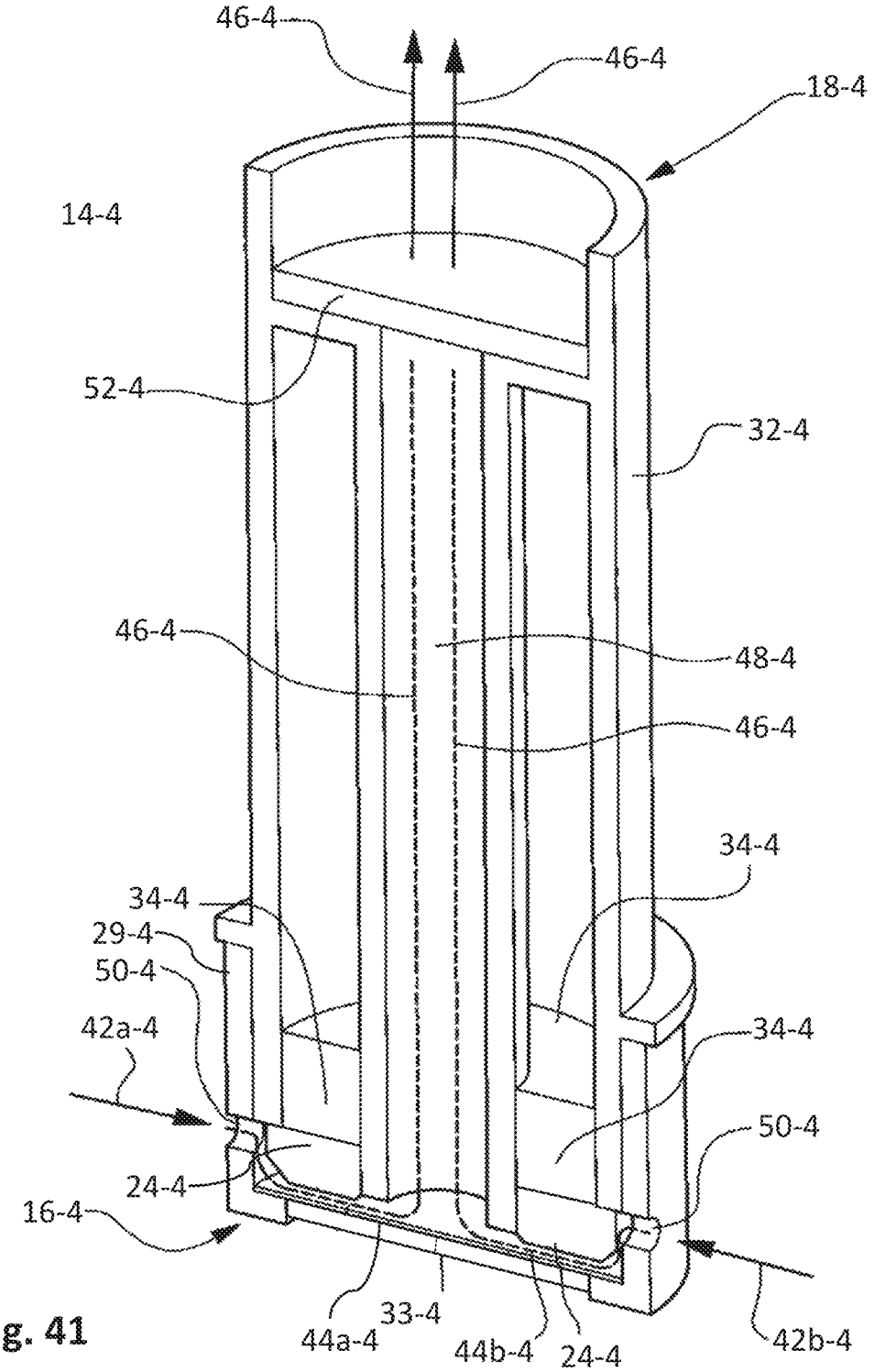
FIG. 41 is a cross-section side view of aerosol carrier according to one or more embodiments of the fourth mode of the present disclosure.
Figure 42:
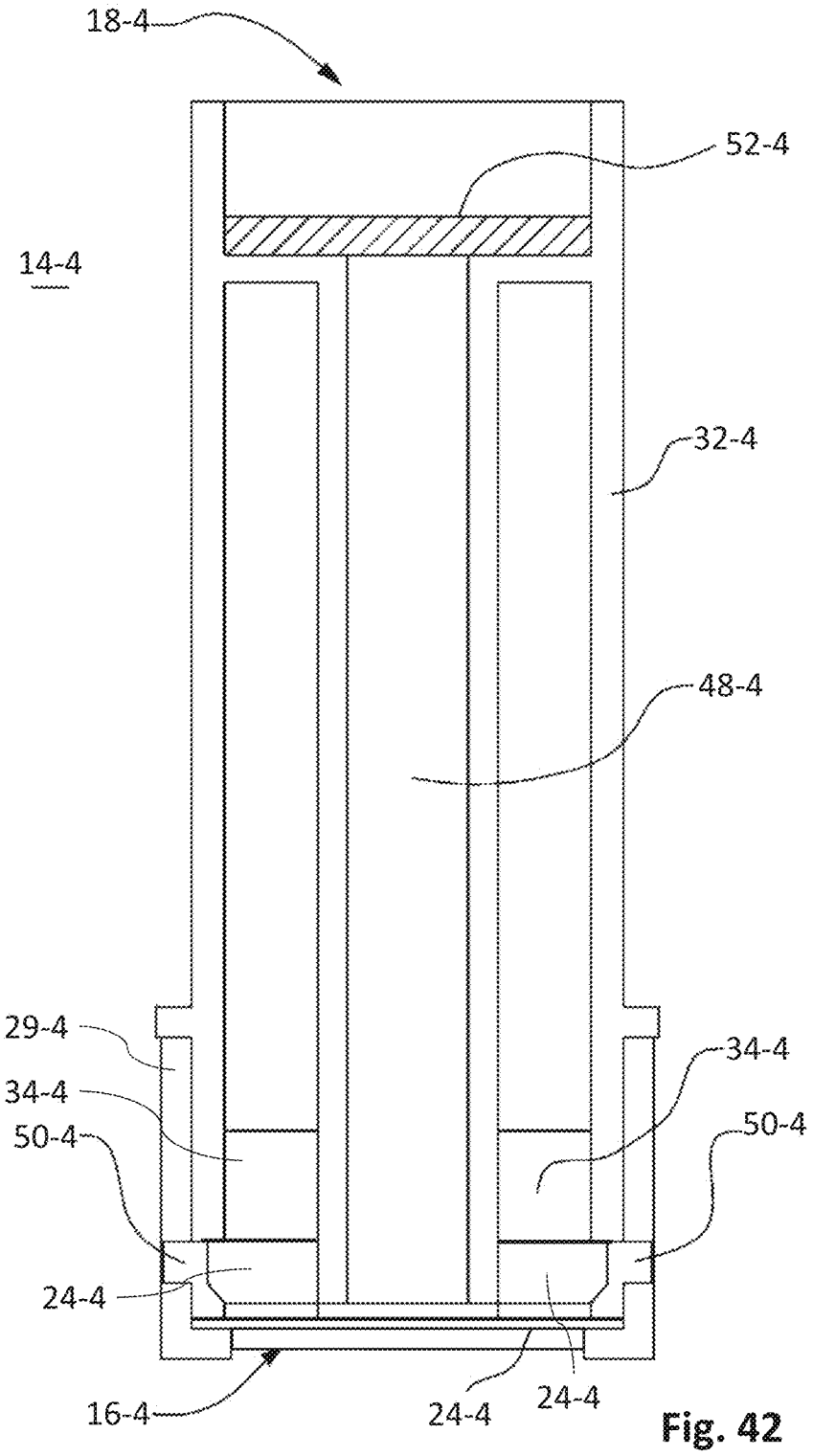
FIG. 42 is a perspective cross-section side view of the aerosol carrier of FIG. 41.
Figure 43:
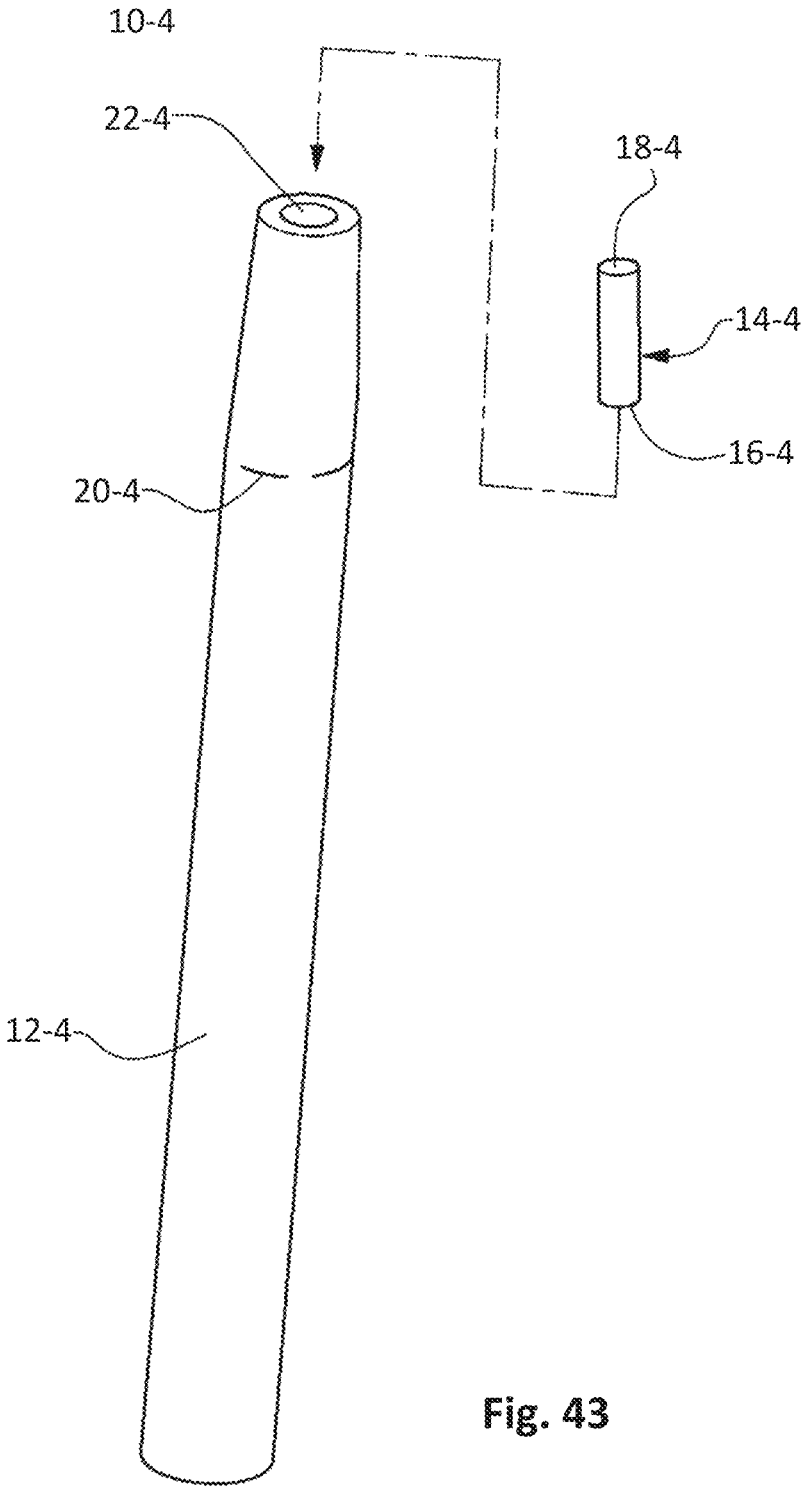
FIG. 43 is an exploded perspective view illustration of a kit-of-parts for assembling the system according to one or more embodiments of the fourth mode of the present disclosure.

In the arrangements shown in FIGS. 38 to 40, the apertures 38-4, 39-4 are on opposite sides of the housing 32-4. FIGS. 41 and 42 show an alternative configuration, in which the fluid-transfer article is annular, and both the fluid-transfer article 34-4 and the intermediate structure 36-4 is then in the form of annulus. In FIGS. 41 and 42, the structure of the fluid-transfer article 34-4 and the intermediate structure correspond to that shown in FIG. 38 The internal structure of fluid-transfer article 34-4 and heater 24-4 may be the same as in FIGS. 38 to 40, but is not illustrated in detail in FIGS. 8 and 9 for simplicity. The heating elements 25-4 also cannot be seen in FIGS. 8 and 9, but may be formed as in the arrangement of FIG. 38 or FIG. 39 However, the air flow in the apparatus is discussed in more detail below. Thus, FIGS. 41 and 42 illustrate an aerosol carrier 14-4 according to one or more possible arrangements in more detail. FIG. 40 is a cross-section side view illustration of the aerosol carrier 14-4 and FIG. 41 is a perspective cross-section side view illustration of the aerosol carrier 14-4.

As can be seen from FIGS. 41 and 42, the aerosol carrier 14-4 is generally tubular in form. The aerosol carrier 14-4 comprises housing 32-4, which defines the external walls of the aerosol carrier 14-4 and which defines therein a chamber in which are disposed the fluid-transfer article 34-4 (adjacent the first end 16-4 of the aerosol carrier 14-4) and internal walls defining the fluid communication pathway 48-4. Fluid communication pathway 48-4 defines a fluid pathway for an outgoing air stream from the channels 40-4 to the second end 18-4 of the aerosol carrier 14-4. In the examples illustrated in FIGS. 41 and 42, the fluid-transfer article 34-4 is an annular shaped element located around the fluid communication pathway 48-4.

In walls of the housing 29-4, there are provided inlet apertures 50-4 to provide a fluid communication pathway for an incoming air stream to reach the activation surface 41-4 of the heater 24-4. As is in the arrangements of FIGS. 38 to 40, the housings 29-4 and 32-4 are separable in FIGS. 41 and 42.

In the illustrated example of FIGS. 41 and 42, the aerosol carrier 14-4 further comprises a filter element 52-4. The filter element 52-4 is located across the fluid communication pathway 48-4 such that an outgoing air stream passing through the fluid communication pathway 48-4 passes through the filter element 52-4.

With reference to FIG. 41, when a user sucks on a mouthpiece of the apparatus (or on the second end 18-4 of the aerosol carrier 14-4, if configured as a mouthpiece), air is drawn into the carrier through inlet apertures 50-4 extending through walls in the housing 29-4 of the aerosol carrier 14-4.

An incoming airstream **42*a*-4 from a first side of the aerosol carrier 14-4 is directed to a first side of the heater 24-4 (e.g., via a gas communication pathway within the housing of the carrier). An incoming air stream 42*b*-4 from a second side of the aerosol carrier 14-4 is directed to a second side of the heater 24-4 (e.g., via a gas communication pathway within the housing of the carrier). When the incoming air stream 42*a*-4 from the first side of the aerosol carrier 14-4 reaches the first side of the heater 24-4, the incoming air stream 42*a*-4 from the first side of the aerosol carrier 14-4 flows along the activation surface of the heater 24-4. Likewise, when the incoming air stream 42*b*-4 from the second side of the aerosol carrier 14-4 reaches the second side of the heater 24-4, the incoming air stream 42*b*-4 from the second side of the aerosol carrier 14-4 flows along the activation surface of the heater 24-4. The air streams from each side are denoted by dashed lines 44*a*-4 and 44*b*-4 in FIG. 41 As these air streams 44*a*-4 and 44*b*-4 flow, aerosol precursor on the activation surface 41-4 of the heater 24-4 is entrained in air streams 44*a*-4 and 44*b*-4**.

In use, the heating elements 25-4 of the apparatus 12-4 raise the temperature of the porous element 23-4 of the heater 24-4 to a sufficient temperature to release, or liberate, captive substances (i.e., the aerosol precursor) to form a vapor and/or aerosol, which is drawn downstream. As the air streams **44*a*-4 and 44*b*-4 continue their passages, more released aerosol precursor is entrained within the air streams 44*a*-4 and 44*b*-4. When the air streams 44*a*-4 and 44*b*-4 entrained with aerosol precursor meet at a mouth of the outlet fluid communication pathway 48-4, they enter the outlet fluid communication pathway 48-4 and continue until they pass through filter element 52-4 and exit outlet fluid communication pathway 48-4, either as a single outgoing air stream, or as separate outgoing air streams 46-4 (as shown). The outgoing air streams 46-4 are directed to an outlet, from where it can be inhaled by the user directly (if the second end 18-4 of the aerosol capsule 14-4 is configured as a mouthpiece), or via a mouthpiece. The outgoing air streams 46-4** entrained with aerosol precursor are directed to the outlet (e.g., via a gas communication pathway within the housing of the carrier).

FIG. 33 is an exploded perspective view illustration of a kit-of-parts for assembling an aerosol delivery system 10-4.

As will be appreciated, in the arrangements described above, the fluid-transfer article 34-4 is provided within a housing 32-4 of the aerosol carrier 14-4. In such arrangements, the housing of the carrier 14-4 serves to protect the aerosol precursor-containing fluid-transfer article 34-4, whilst also allowing the carrier 14-4 to be handled by a user without his/her fingers coming into contact with the aerosol precursor liquid retained therein.

In any of the embodiments described above the second region **34*b*-4** may have a thickness of less than 5 mm. In other embodiments it may have a thickness of: less than 3.5 mm, less than 3 mm, less than 2.5 mm, less than 2 mm, less than 1.9 mm, less than 1.8 mm, less than 1.7 mm, less than 1.6 mm, less than 1.5 mm, less than 1.4 mm, less than 1.3 mm, less than 1.2 mm, less than 1.1 mm, less than 1 mm, less than 0.9 mm, less than 0.8 mm, less than 0.7 mm, less than 0.6 mm, less than 0.5 mm, less than 0.4 mm, less than 0.3 mm, less than 0.2 mm, or less than 0.1 mm.

Fifth Mode: A Fluid Transfer Article Comprising a First Region Having an Aerosol Precursor and for Transferring Said Aerosol Precursor to an Activation Surface of a Second Region of Said Article Aspects and embodiments of the fifth mode of the present disclosure will now be discussed with reference to the accompanying figures. Further aspects and embodiments of the fifth mode will be apparent to those skilled in the art. All documents mentioned in this text are incorporated herein by reference.

In general outline, one or more embodiments of the fifth mode in accordance with the present disclosure may provide a system for aerosol delivery in which an aerosol carrier may be inserted into a receptacle (e.g., a "heating chamber") of an apparatus for initiating and maintaining release of an aerosol from the aerosol carrier. Another end, or another end portion, of the aerosol carrier may protrude from the apparatus and can be inserted into the mouth of a user for the inhalation of aerosol released from the aerosol carrier cartridge during operation of the apparatus.

Hereinafter, and for convenience only, "system for aerosol delivery" shall be referred to as "aerosol delivery system".

Figure 44:
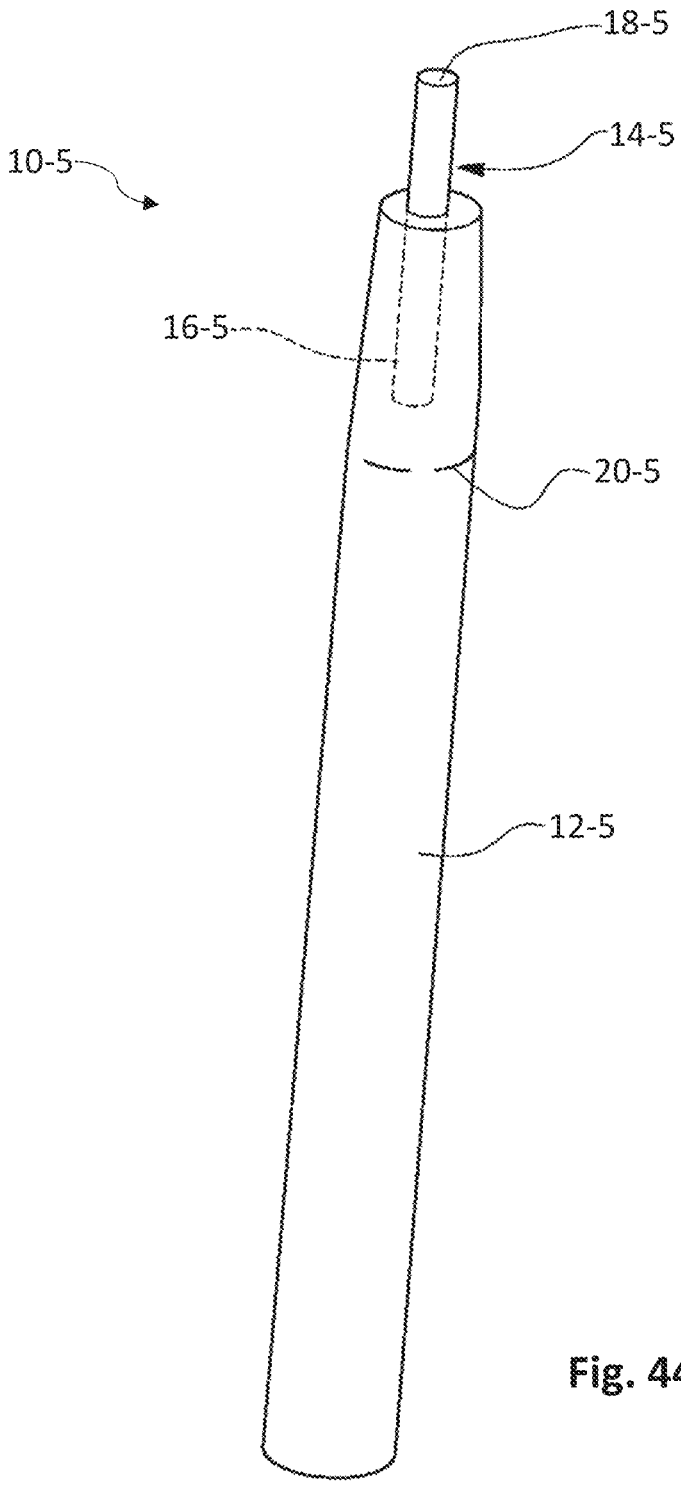
FIG. 44 is a perspective view illustration of a system for aerosol delivery according to one or more embodiments of the fifth mode of the present disclosure.

Referring now to FIG. 44, there is illustrated a perspective view of an aerosol delivery system 10-5 comprising an aerosol generation apparatus 12-5 operative to initiate and maintain release of aerosol from a fluid-transfer article in an aerosol carrier 14-5. In the arrangement of FIG. 44, the aerosol carrier 14-5 is shown with a first end 16-5 thereof and a portion of the length of the aerosol carrier 14-5 located within a receptacle of the apparatus 12-5. A remaining portion of the aerosol carrier 14-5 extends out of the receptacle. This remaining portion of the aerosol carrier 14-5, terminating at a second end 18-5 of the aerosol carrier, is configured for insertion into a user's mouth. A vapor and/or aerosol is produced when a heater (not shown in FIG. 44) of the apparatus 12-5 heats a fluid-transfer article in the aerosol carrier 14-5 to release a vapor and/or an aerosol, and this can be delivered to the user, when the user sucks or inhales, via a fluid passage in communication with an outlet of the aerosol carrier 14-5 from the fluid-transfer article to the second end 18-5.

The device 12-5 also comprises air-intake apertures 20-5 in the housing of the apparatus 12-5 to provide a passage for air to be drawn into the interior of the apparatus 12-5 (when the user sucks or inhales) for delivery to the first end 16-5 of the aerosol carrier 14-5, so that the air can be drawn across an activation surface of a fluid-transfer article located within a housing of the aerosol carrier cartridge 14-5 during use. Optionally, these apertures may be perforations in the housing of the apparatus 12-5.

A fluid-transfer article 34-5 (not shown in FIG. 44, but described hereinafter with reference to FIGS. 48 to 51 is located within a housing of the aerosol carrier 14-5. The fluid-transfer article 34-5 contains an aerosol precursor material, which may include at least one of: nicotine; a nicotine precursor material; a nicotine compound; and one or more flavorings. The aerosol precursor of the fluid-transfer article 34-5 is in the unheated state where the heater (not shown in FIG. 44) is not active and the aerosol near the activation surface is at ambient temperature and pressure. The aerosol precursor near the activation surface has a dynamic viscosity such that the aerosol precursor is substantially retained in the fluid-transfer article and does not leave the activation surface. On application of a pressure below atmospheric pressure the aerosol precursor in the unheated state is also substantially retained in the fluid-transfer article and is not drawn from the activation surface. The fluid-transfer article 34-5 is located within the housing of the aerosol carrier 14-5 to allow air drawn into the aerosol carrier 14-5 at, or proximal, the first end 16-5, and has first and second regions, as will be described.

The first region of the fluid-transfer article 34-5 may comprise a substrate of porous material where pores of the porous material hold, contain, carry, or bear the aerosol precursor material. In particular, the porous material of the fluid-transfer article may be a porous polymer material such as, for example, a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET). All such materials may be described as heat resistant polymeric wicking material in the context of the present disclosure.

Alternatively, in some embodiments it is envisaged that the first region of the fluid-transfer article 34-5 may take the form of a simple tank having a cavity defining a hollow reservoir to hold the aerosol precursor.

The aerosol carrier 14-5 is removable from the apparatus 12-5 so that it may be disposed of when expired. After removal of a used aerosol carrier 14-5, a replacement aerosol carrier 14-5 can be inserted into the apparatus 12-5 to replace the used aerosol carrier 14-5.

Figure 45:
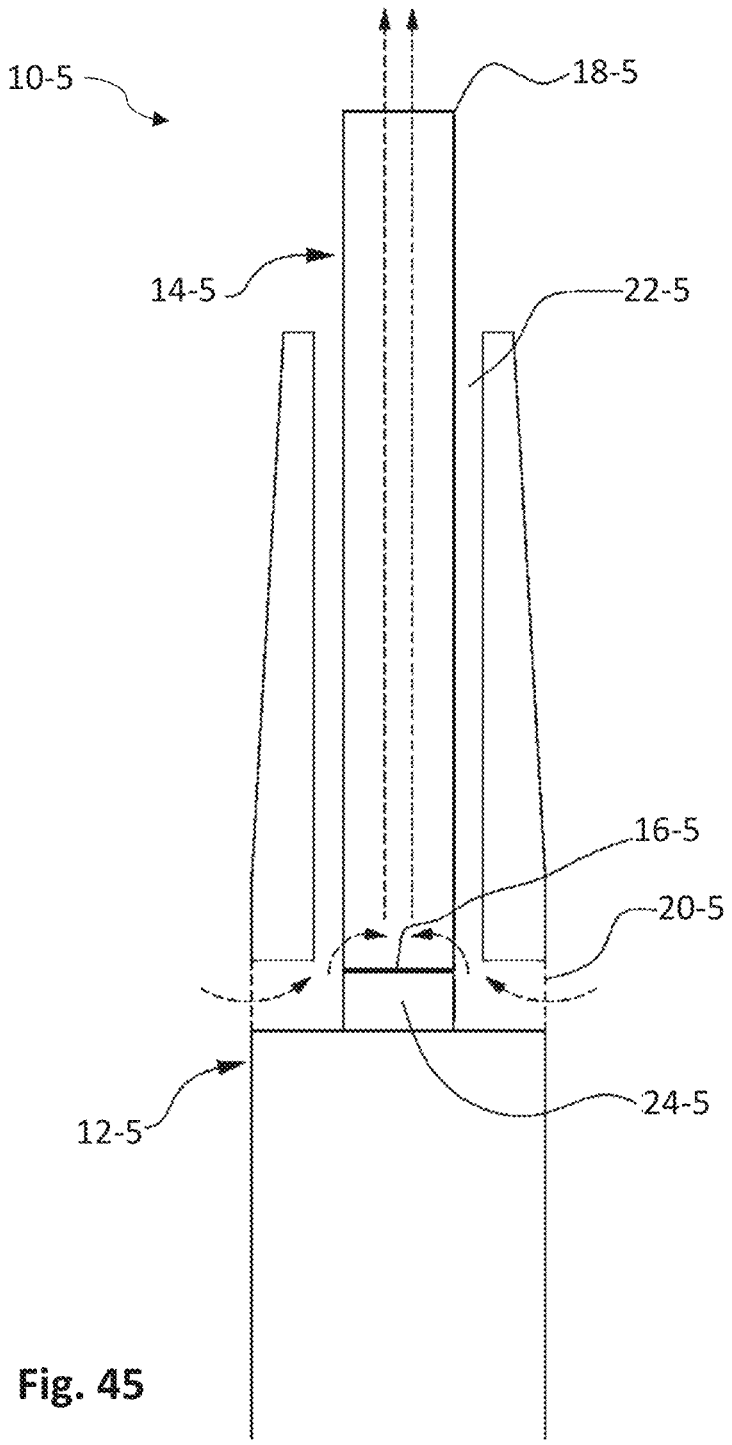
FIG. 45 is a cross-section side view illustration of part of an apparatus of the system for aerosol delivery of FIG. 44.

FIG. 45 is a cross-sectional side view illustration of a part of apparatus 12-5 of the aerosol delivery system 10-5. The apparatus 12-5 comprises a receptacle 22-5 in which is located a portion of the aerosol carrier 14-5. In one or more optional arrangements, the receptacle 22-5 may enclose the aerosol carrier 14-5. The apparatus 12-5 also comprises a heater 24-5, which is in contact with an activation surface of the fluid-transfer article 34-5 when an aerosol carrier 14-5 is located within the receptacle 22-5. Optional configurations of the heater 24-5 will be discussed later.

Air flows into the apparatus 12-5 (in particular, into a closed end of the receptacle 22-5) via air-intake apertures 20-5. From the closed end of the receptacle 22-5, the air is drawn into the aerosol carrier 14-5 (under the action of the user inhaling or sucking on the second end 18-5) and expelled at the second end 18-5. As the airflows into the aerosol carrier 14-5, it passes across the activation surface. Heat from the heater 24-5, which is in contact with the activation surface of the fluid-transfer article 34-5, causes vaporization of aerosol precursor material at the activation surface of the fluid-transfer article 34-5 and an aerosol is created in the air flowing over the activation surface. Thus, through the application of heat to the activation surface, an aerosol is released, or liberated, from the fluid-transfer article, and is drawn from the material of the aerosol carrier unit by the air flowing across the activation surface and is transported in the air flow to via outlet conduits (not shown in FIG. 45) in the housing of the aerosol carrier 14-5 to the second end 18-5. The direction of airflow is illustrated by arrows in FIG. 45.

To achieve release of the captive aerosol from the fluid-transfer article, the activation surface of the fluid-transfer article 34-5 is heated by the heater 24-5. As a user sucks or inhales on second end 18-5 of the aerosol carrier 14-5, the aerosol released from the fluid-transfer article and entrained in the air flowing across the activation surface is drawn through the outlet conduits (not shown) in the housing of the aerosol carrier 14-5 towards the second end 18-5 and onwards into the user's mouth.

Figure 46:
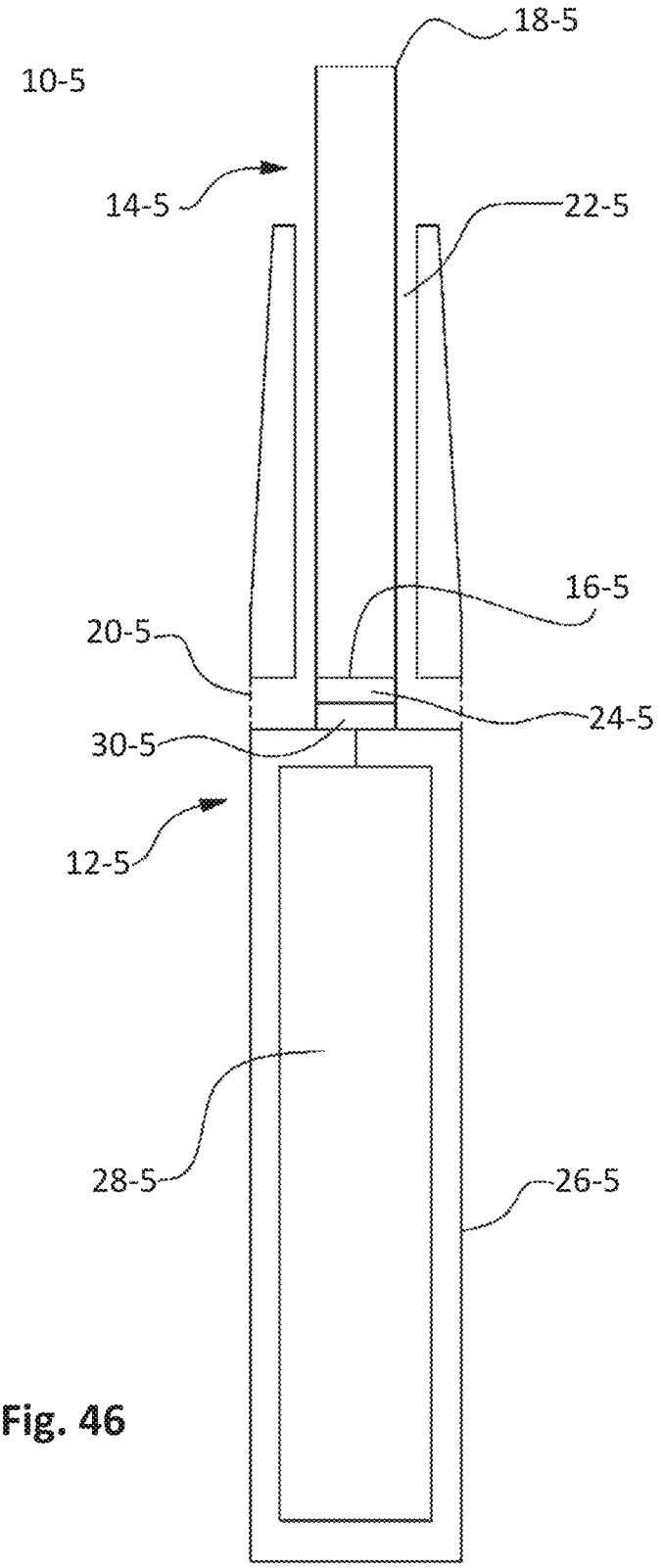
FIG. 46 is a cross-section side view illustration of the system and apparatus for aerosol delivery of FIG. 44.

Turning now to FIG. 46, a cross-sectional side view of the aerosol delivery system 10-5 is schematically illustrated showing the features described above in relation to FIGS. 44 and 45 in more detail. As can be seen, apparatus 12-5 comprises a housing 26-5, in which is located the receptacle 22-5. The housing 26-5 also contains control circuitry (not shown) operative by a user, or upon detection of air and/or vapor being drawn into the device 12-5 through air-intake apertures 20-5, i.e., when the user sucks or inhales. Additionally, the housing 26-5 comprises an electrical energy supply 28-5, for example a battery. Optionally, the battery comprises a rechargeable lithium-ion battery. The housing 26-5 also comprises a coupling 30-5 for electrically (and optionally mechanically) coupling the electrical energy supply 28-5 to control circuitry (not shown) for powering and controlling operation of the heater 24-5.

Responsive to activation of the control circuitry of apparatus 12-5, the heater 24-5 heats the activation surface of the fluid-transfer article 34-5 (not shown in FIG. 46). This heating process initiates (and, through continued operation, maintains) release of vapor and/or an aerosol from the activation surface of the fluid-transfer article 34-5. The vapor and/or aerosol formed as a result of the heating process is entrained into a stream of air being drawn across the activation surface of the fluid-transfer article 34-5 (as the user sucks or inhales). The stream of air with the entrained vapor and/or aerosol passes through the aerosol carrier 14-5 via outlet conduits (not shown) and exits the aerosol carrier 14-5 at second end 18-5 for delivery to the user. This process is briefly described above in relation to FIG. 45, where arrows schematically denote the flow of the air stream into the device 12-5 and through the aerosol carrier 14-5, and the flow of the air stream with the entrained vapor and/or aerosol through the aerosol carrier cartridge 14-5.

Figure 47:
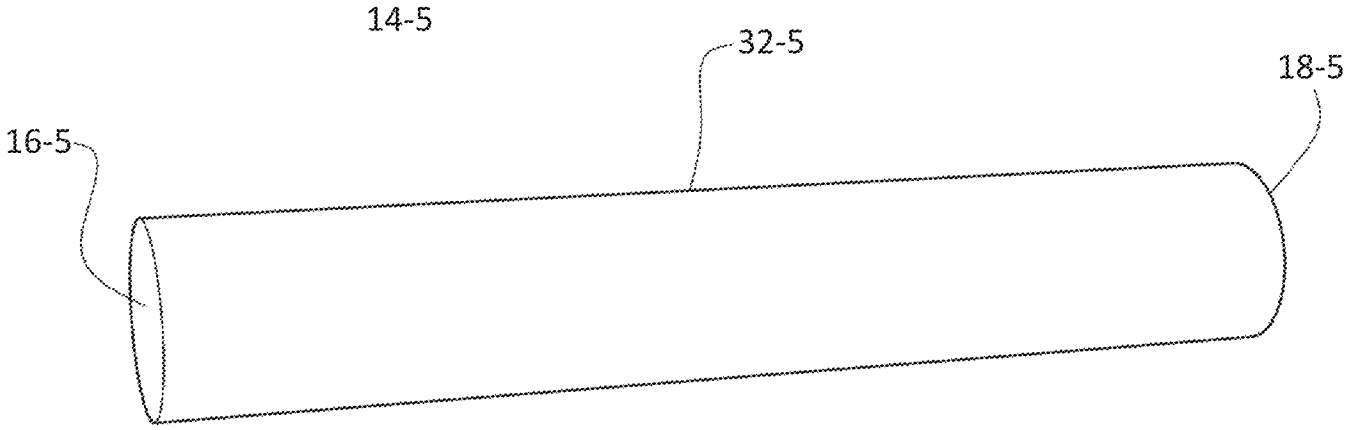
FIG. 47 is a perspective view illustration of an aerosol carrier for use in the system for aerosol delivery according to one or more embodiments of the fifth mode of the present disclosure.
Figure 48:
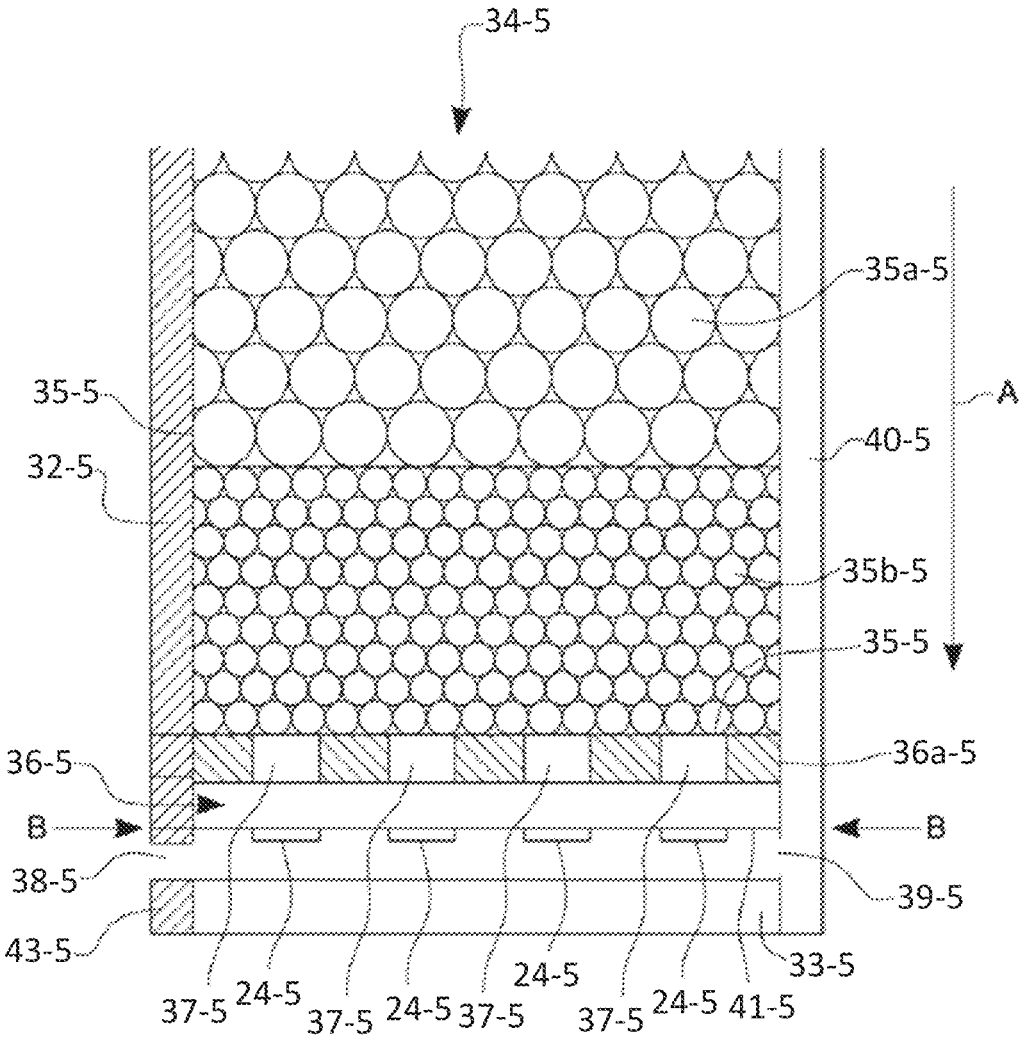
FIG. 48 is a cross-section side view of elements of an aerosol carrier and a part of an apparatus of the system for aerosol delivery according to one or more embodiments of the fifth mode of the present disclosure.
Figure 49:
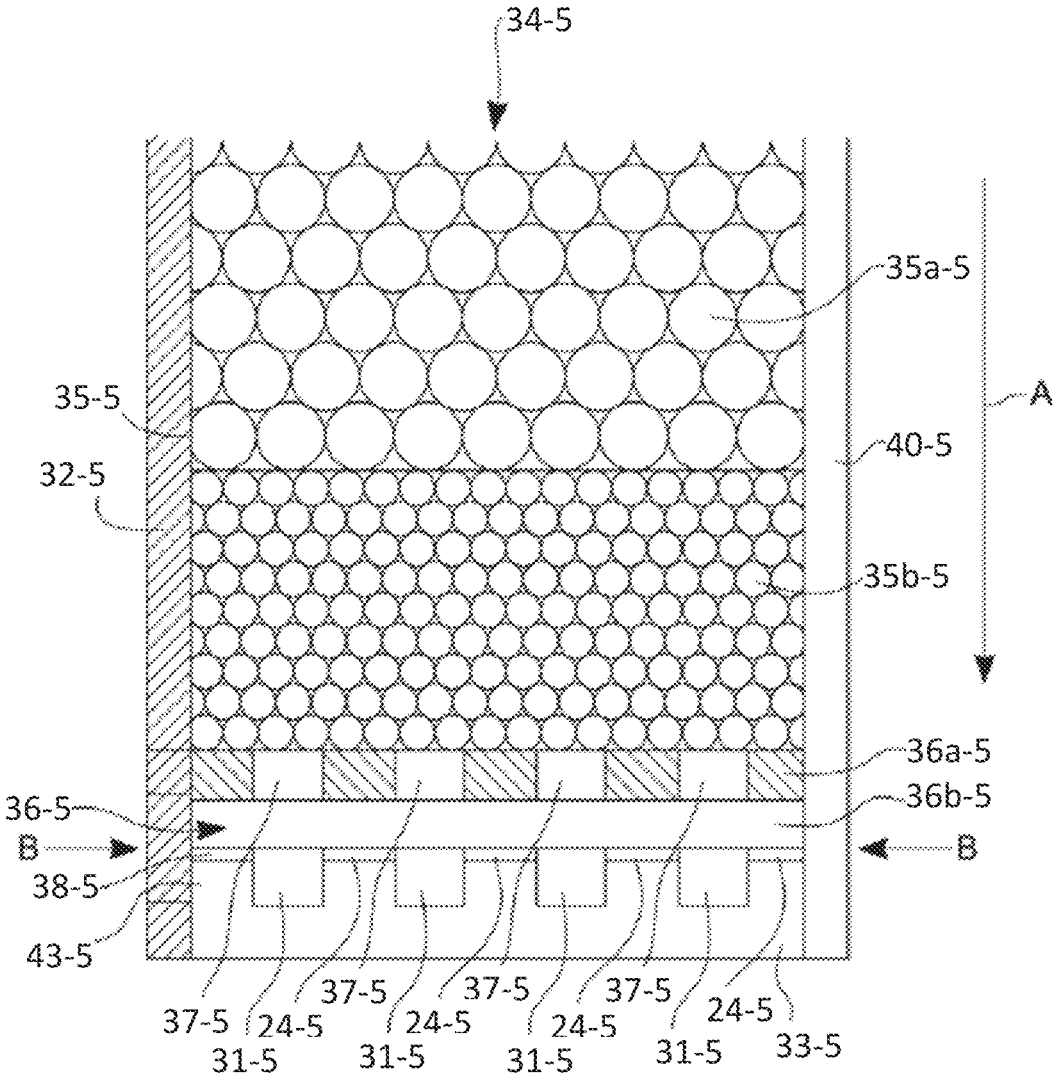
FIG. 49 is a cross-section side view of elements of an aerosol carrier and a part of an apparatus of the system for aerosol delivery according to one or more embodiments of the fifth mode of the present disclosure, in an alternative configuration from that of FIG. 48.

FIGS. 47 to 49 schematically illustrate the aerosol carrier 14-5 in more detail (and, in FIGS. 48 and 49, features within the receptacle in more detail). FIG. 47 illustrates an exterior of the aerosol carrier 14-5, FIG. 48 illustrates internal components of the aerosol carrier 14-5 in one optional configuration, and FIG. 49 illustrates internal components of the aerosol carrier 14-5 in another optional configuration.

FIG. 47 illustrates the exterior of the aerosol carrier 14-5, which comprises housing 32-5 for housing said fluid-transfer article (not shown). The particular housing 32-5 illustrated in FIG. 47 comprises a tubular member, which may be generally cylindrical in form, and which is configured to be received within the receptacle of the apparatus. First end 16-5 of the aerosol carrier 14-5 is for location to oppose the heater of the apparatus, and second end 18-5 (and the region adjacent the second end 18-5) is configured for insertion into a user's mouth.

FIG. 48 illustrates some internal components of the aerosol carrier 14-5 and of the heater 24-5 of apparatus 12-5, in one embodiment of the disclosure.

As described above, the aerosol carrier 14-5 comprises a fluid-transfer element 34-5. At least part of the fluid-transfer article 34-5 may be removable from the housing 32-5, to enable it to be replaced. The fluid-transfer article 34-5 acts as a reservoir for aerosol precursor and that aerosol precursor will be consumed as the apparatus is used. Once sufficient aerosol precursor has been consumed, the aerosol precursor will need to be replaced. It may then be easiest to replace it by replacing the fluid-transfer article 34-5, rather than trying to re-fill the fluid-transfer article 34-5 with aerosol precursor while it is in the housing 32-5.

In the illustrated embodiments, the fluid-transfer article 34-5 has a first region 35-5 formed by layers **35*a*-5 and 35*b*-5, and a second region 36-5. That second region 36-5 has a first part being an upper layer 36*a*-5 which is formed by a plate with a plurality of holes 37-5 therein, and a second part being a lower layer formed by a second plate 36*b*-5 made of a porous material which allows aerosol precursor to pass therethrough. In the arrangement of FIG. 48, the plate 36*a*-5 with holes 37-5 therein is in contact with the first region 35-5 of the fluid-transfer article 34-5, so that aerosol precursor may pass from that first region 35-5 directly into the holes 37-5, and through those holes to the second plate 36*b*-5**.

Since the second plate **36*b*-5 is porous, the aerosol precursor will pass to the surface of the plate 36*b*-5 remote from the first region 35-5 of the fluid-transfer article 34-5, which surface acts as an activation surface 41-5 of the fluid-transfer article 34-5. One or more heaters 24-5 are mounted on the activation surface 41-5. When the heater or heaters 24-5 are activated, the heat which they generate will be transferred to the activation surface 41-5**.

Further components not shown in FIG. 48 comprise: an inlet conduit, via which air can be drawn into the aerosol carrier 14-5; an outlet conduit, via which an air stream entrained with aerosol can be drawn from the aerosol carrier 14-5; a filter element; and a reservoir for storing aerosol precursor material and for providing the aerosol precursor material to the fluid-transfer article 34-5.

In FIG. 48, the aerosol carrier is shown as comprising the fluid-transfer article 34-5 located within housing 32. The fluid transfer article 34-5 comprises a first region 35-5 holding an aerosol precursor. In one or more arrangements, the first region of 35 of the fluid transfer article 34-5 comprises a reservoir holding the aerosol precursor. The first region 35-5 can be the sole reservoir of the aerosol carrier 14-5, or it can be arranged in fluid communication with a separate reservoir, where aerosol precursor is stored for supply to the first region 35-5. As shown in FIG. 48, the first region 35-5 has a first layer 35*a*-5 and a second layer 35*b*-5. The material forming the first layer 35*a*-5 of the first region 35-5 comprises a porous structure, whose pore diameter size varies between one end of the first layer 35*a*-5 and another end of the first layer 35*a*-5. The pore diameter size may increase from a first end remote from heater or heaters 24-5 (the upper end is as shown in the figure) to a second end. The pore diameter size may change in a step-wise manner (i.e., a first part with pores having a diameter of first size, and a second part with pores having a diameter of second, smaller size), or the change in pore size in the first layer 35*a*-5 may be gradual rather than step-wise. This configuration of pores having a decreasing diameter size can provide a wicking effect, which can serve to draw fluid through the first layer 35*a*-5, towards heater or heaters 24-5.

The first region 35-5 of the fluid transfer article 34-5 may also comprise a second layer 35*b*-5. Aerosol precursor is drawn from the first layer 35*a*-5 to the second layer 35*b*-5 by the wicking effect of the material forming the first layer 35*a*-5. Thus, the first layer 35*a*-5 is configured to transfer the aerosol precursor to the second layer 35*b*-5 of the first region 35-5 of the fluid-transfer article 34-5.

The second layer 35*b*-5 itself may comprise a porous structure formed by a porous polymer material. It is then preferable that the pore diameter size of the porous structure of the second layer 35*b*-5 is smaller than the pore diameter size of the immediately adjacent part of the first layer 35*a*-5. As mentioned above, the porous polymer material may be a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET).

However, as mentioned previously, in some embodiments it is envisaged that the first region 35-5 of the fluid-transfer article need not be of porous polymer material as described above. Instead, the first region 35-5 of the fluid-transfer article 34-5 may take the form of a simple tank having a cavity defining a hollow reservoir to hold the aerosol precursor. In such embodiments it is proposed that the plate 36*a*-5 with holes 37-5 therein will extend across the bottom of the tank so that aerosol precursor held in the tank will impinge directly on the plate 36*a*-5 and pass directly from the tank defining the first region 35-5 of the fluid-transfer article 34-5 into the holes 37-5 of the second region 36-5 of the fluid-transfer article.

As discussed above, the heater or heaters 24-5 transfer heat to the activation surface 41-5, thereby releasing aerosol precursor which has reached that activation surface 41-5 from the porous polymer material (or hollow reservoir) of the first region 35-5, through the second region 36-5. That vapor and/or a mixture of vapor and aerosol, may then pass into the air adjacent the activation surface 41-5 and the heater or heaters 24-5.

FIG. 48 also illustrates an opening 38-5, which opening 38-5 is in communication with the air-intake apertures 20-5. A further opening 39-5 communicates with a duct 40-5 within the housing 32-5, which duct 40-5 communicates with the second end 18-5.

There is thus a fluid-flow path for air (referred to as an air-flow pathway) between openings 38-5 and 39-5, linking the apertures 20-5 and the second end 18-5 of the aerosol carrier. When the user sucks or inhales, air is drawn along the air-flow pathway, along the activation surface 41-5. A plate 33-5 forms a lower surface of the air-flow pathway, the plate 33-5 being spaced from the activation surface 41-5. It can be seen that the air-flow pathway is in direct contact with parts of the activation surface 41-5, as the heater or heaters 24-5 may partially block that path from the activation surface to the fluid flow pathway. The fluid flow pathway is on the opposite side of the heater or heaters 24-5 from the activation surface 41-5, so vapor must pass around the heater or heaters 24-5 if it cannot pass therethrough.

One or more droplets of the aerosol precursor will be released from the second plate 36*b*-5 and heated, to release vapor or a mixture of aerosol and vapor into the air flowing in the air-flow pathway between the openings 38-5, 39-5. The vapor or mixture passes, as the user sucks and inhales, to the second end 18-5.

As mentioned above, the second region 36-5 of the fluid-transfer article 34-5 comprises a first plate 36*a*-5 and a second plate 36*b*-5. The first plate 36*a*-5 may be a molded polymer disc so that is then easy to form the holes 37-5 therein by molding the holes 37-5 when the plate 36*a*-5 is itself molded. The holes 37-5 are sufficiently large that they do not act as a capillary, but instead define non-capillary spaces in the second region 36-5. Hence, aerosol precursor is able to pass from the first region 35-5 of the fluid-transfer article to the second region 36-5 in a non-capillary manner, into the holes 37-5, and then pass through the second plate 36*b*-5 to the heater or heaters 24-5. The holes 37-5 may be relatively large, so that they fill with aerosol precursor when the apparatus is in use.

The second plate 36*b*-5 is made of a porous material which is more heat-resistant than the material of the plate 36*a*-5, as it is acted on directly by the heater or heaters 24-5. It may be fibrous, made from e.g., ceramic fiber, glass fiber or carbon fiber. Alternatively, it may be formed from a high-temperature porous material such as porous glass or porous ceramic. Another possibility is that the second plate 36*b*-5 may be of a porous polymer material, such as the materials described previously with reference to the layers 35*a*-5 and 35*b*-5 of the first region 35-5, provided that the polymer material is sufficiently resistant to the high temperatures to which it will be subject due to the heater or heaters 24-5.

It is thought that the flow of air between openings 38-5 and 39-5 along the activation surface 41-5 and past the heater or heaters 24-5 will have the effect of creating the lower air pressure adjacent the activation surface 41-5 which will tend to draw liquid through the porous second plate 36*b*-5 to the activation surface 41-5. Thus, the transfer of aerosol precursor from the fluid-transfer article 34-5 is facilitated.

As mentioned above, the fluid-transfer article 34-5, formed by the first and second regions 35-5 and 36-5 and any further reservoir of aerosol precursor, forms the consumable part of the apparatus, in the sense that it can readily be replaced to enable the aerosol precursor to be replaced once it is consumed. The heater or heaters 24-5 are not part of the consumable elements. Thus, the housing 32-5 containing the fluid-transfer article 34-5 may be separable from a housing 43-5 supporting the heater or heaters 24-5 along the line B-B in FIG. 48 The plate 33-5 may be integral with the further housing 43-5, and the openings 38-5 and 39-5 are formed in the further housing 43-5. The further housing 43-5 may be integral with the housing 26-5 containing the electrical energy supply 28-5. It is for this reason that the heater or heaters 24-5 make contact with, but are not bonded to, the activation surface 41-5. The contact ensures the most efficient heat transfer from the heater or heaters 24-5 to the second plate **36*b*-5 to heat the activation surface 41-5 but the heater or heaters 24-5 must be separable from that activation surface 41-5 to allow removal of the housing 32-5 from the further housing 43-5 when the fluid-transfer article 34-5 has become depleted. The line B to B may therefore correspond to the plane of the activation surface 41-5**.

In FIG. 48, the heater or heaters 24-5 may be separate or be interconnected to form a single heater. For example, the heater may be a coil, mesh or foil heater in which the parts of the heater 24-5 illustrated in FIG. 48 may be parts of a common structure. Such a coil, mesh or foil heater is preferred so that any restriction caused by the heater or heaters 24-5 on release of aerosol or vapor from the activation surface is minimized, as vapor and/or aerosol may pass through the heater or heaters 24-5. However, it is also possible for the heater or heaters 24-5 to be a solid unbroken strip or strips, provided that there is then enough of the activation surface 41-5 not covered by the heater or heaters 24-5 to allow sufficient release of vapor and/or aerosol from the activation surface 41-5.

In the illustrative examples of FIG. 48, the first layer **35*a*-5 of the first region 35-5 of the fluid-transfer article 34-5 is located at an "upstream" end of the fluid-transfer article 34-5 and the second plate 35*b*-5 of the second region 35*b*-5 is located at a downstream" end of the fluid-transfer article 34-5. That is, aerosol precursor is wicked, or is drawn, from the "upstream" end of the fluid-transfer article 34-5 to the "downstream" end of the fluid-transfer article 34-5 (as denoted by arrow A in FIG. 48**).

In the arrangement of FIG. 48, the plate 33-5 has a planar surface facing the activation surface 41-5. FIG. 49 illustrates an arrangement in which the plate 33-5 has projections and recesses in its upper surface, so that the recesses can form channels 31-5 for air to flow therethrough. Other features which are the same as those of FIG. 48 are indicated by the same reference numerals. Thus, the channels 31-5 form the air-flow pathway along the activation surface 41-5. In FIG. 49, the projections and recesses form a square-wave or "castellated" structure. Further shapes are possible, however, such as alternating peaks and troughs or recesses with curved walls. All such arrangements permit channels 31-5 to be formed and allow air to flow along the activation surface 41-5. This control of air flow improves the mixing of the vaporized aerosol precursor into the air flow.

In the embodiment of FIG. 49, the peaks in the upper surface of the plate 33-5 extend to the heater or heaters 24-5, with the recesses between those peaks which form the channels 31-5 then being aligned with the holes 37-5 formed in the second plate **35*b*-5 of the fluid-transfer article 34-5. Other alignments are possible, and the projections need not reach all the way to the heater or heaters 24-5. In general, however, the heater or heaters 24-5 may restrict release of the vaporized aerosol precursor from parts of the activation surface 41-5 on which those heater or heaters 24-5 are formed, so it will normally be desirable that the channels 31-5 are aligned with the part or parts of the activation surface 41-5 other than the part or parts on which the heater or heaters 24-5** are formed.

Note also that, in FIG. 49, the openings 38-5 and 39-5 are not visible since they will be at the ends of the channels 31-5 to allow air to pass from the opening 38-5 in to the channels 31-5, and from those channels 31-5 out of the opening 39-5.

Also, as in FIG. 48, the housing 32-5 containing the fluid-transfer article 34-5 may be separable from the housing 43-5 containing the intermediate structure 36-5 and the heater or heaters 24-5 along the line B-B in FIG. 49.

Figure 50:
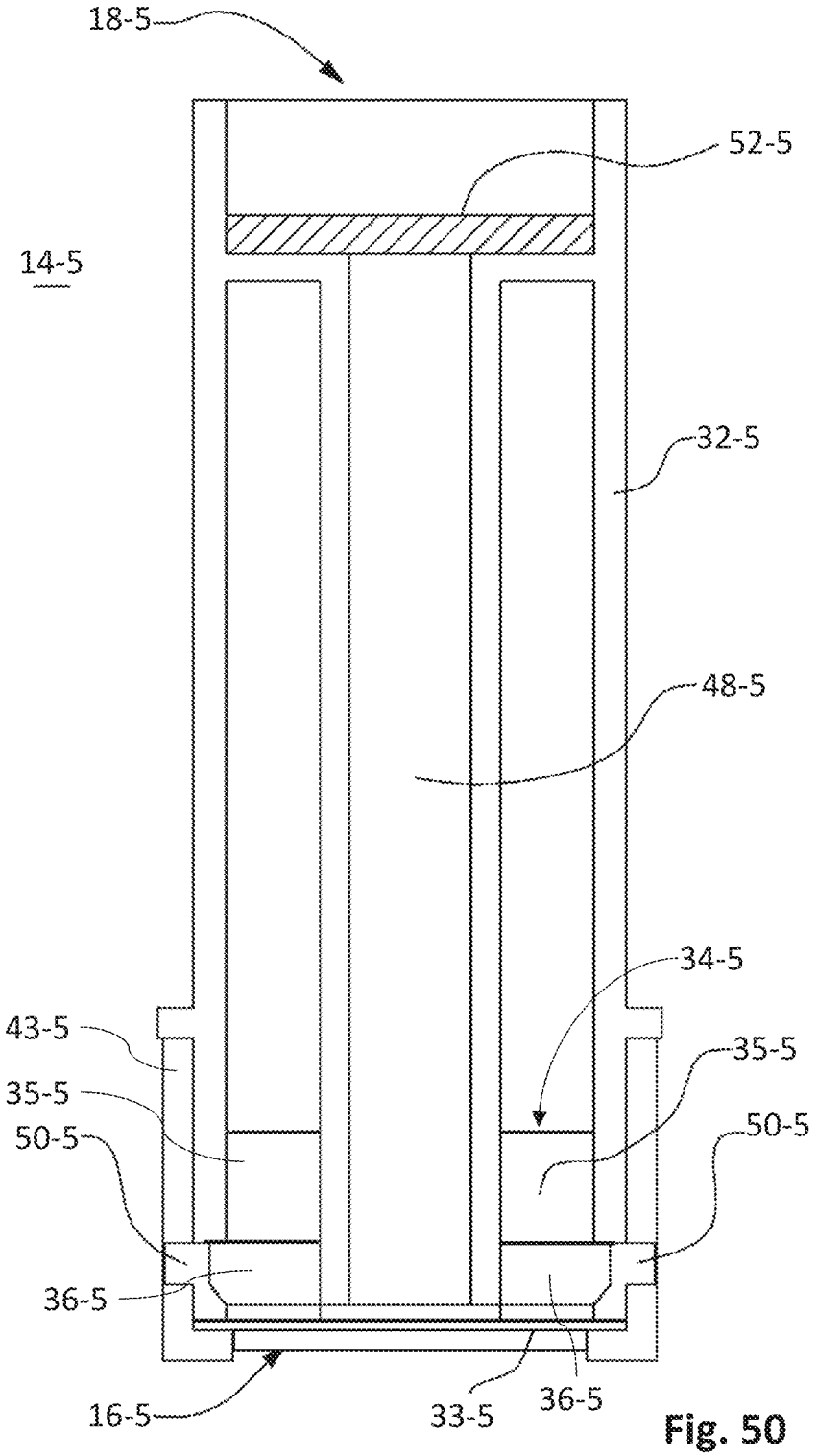
FIG. 50 is a cross-section side view of aerosol carrier according to one or more embodiments of the fifth mode of the present disclosure.
Figure 51:
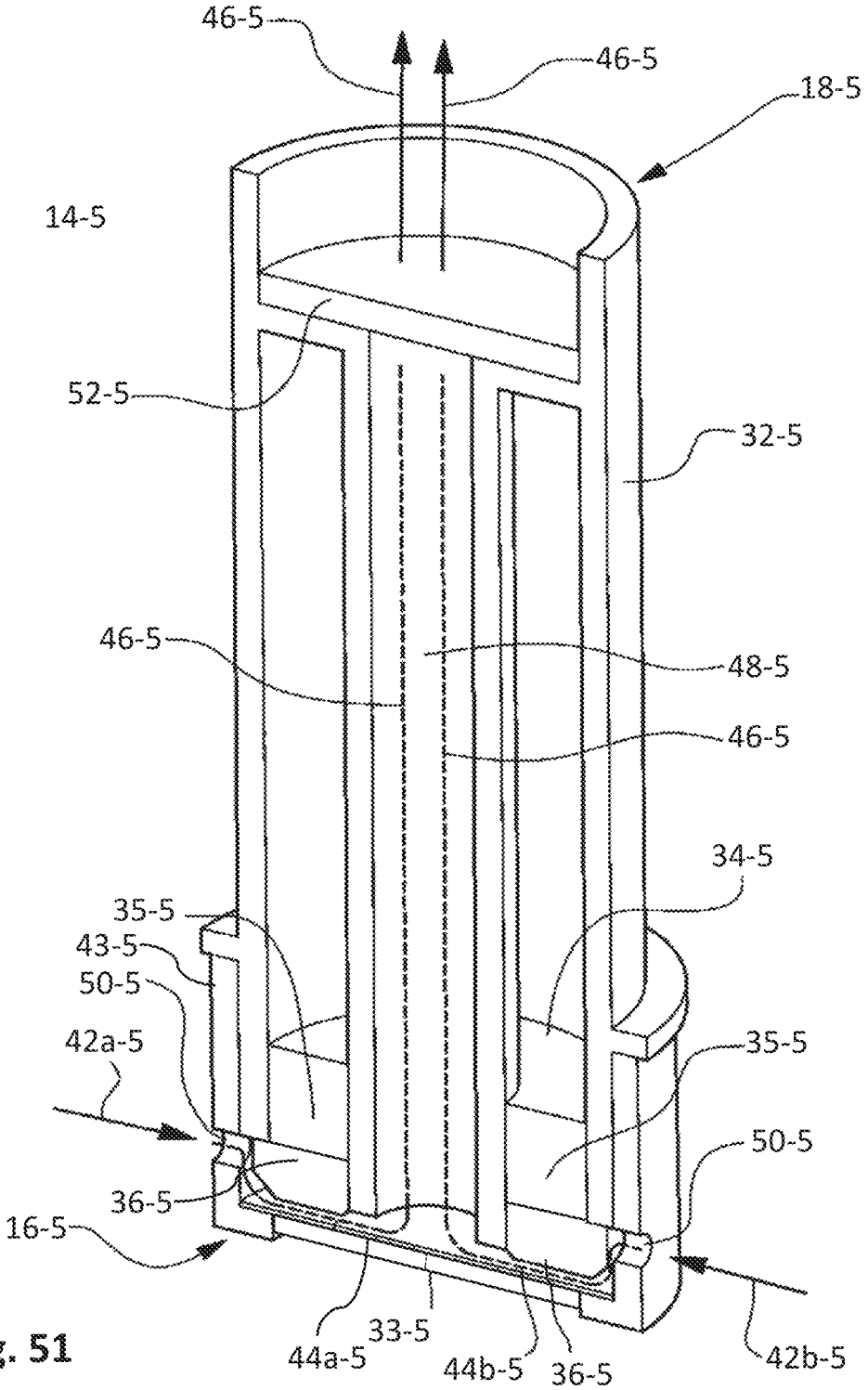
FIG. 51 is a perspective cross-section side view of the aerosol carrier of FIG. 50.
Figure 52:
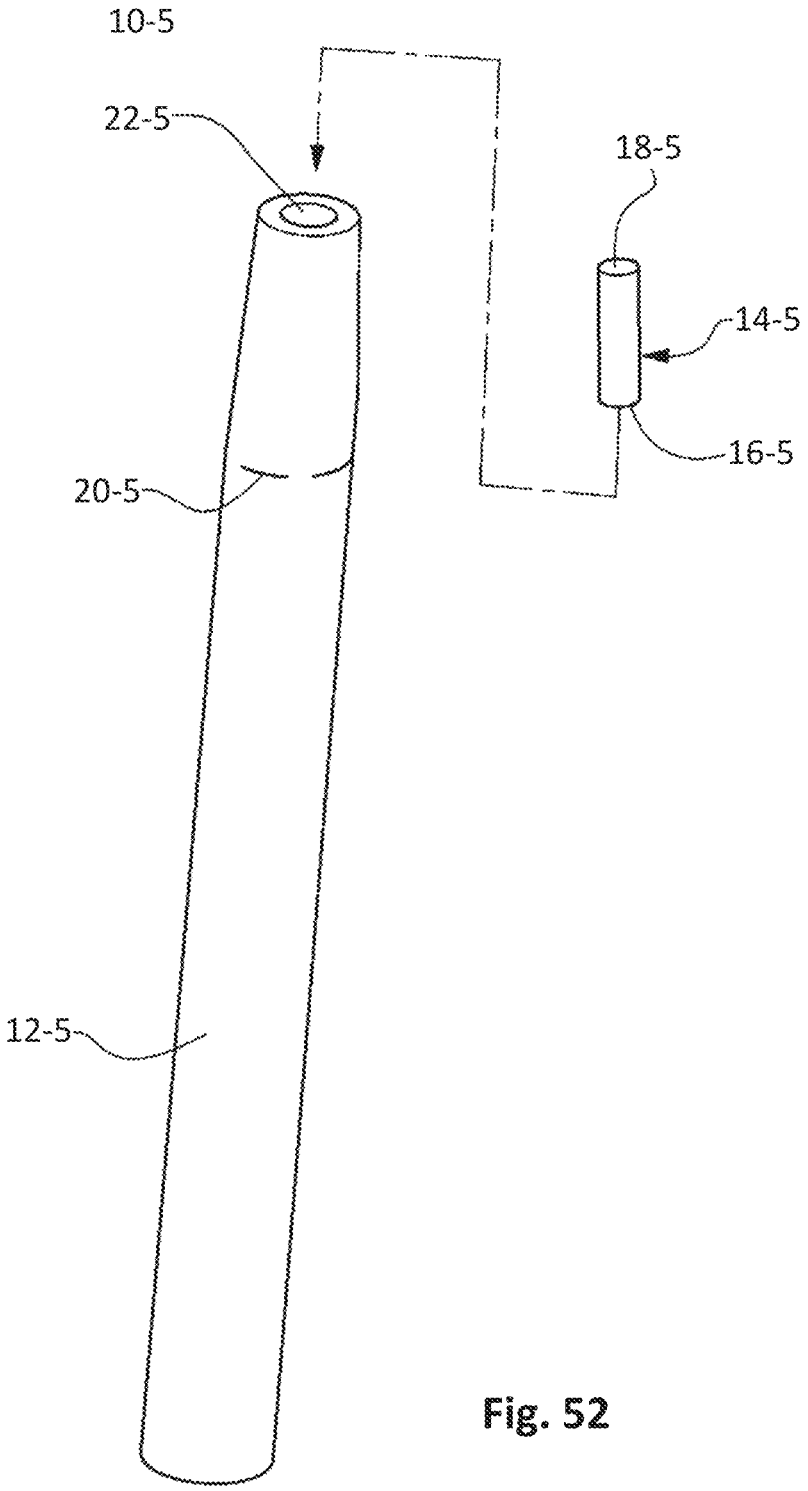
FIG. 52 is an exploded perspective view illustration of a kit-of-parts for assembling the system according to one or more embodiments of the fifth mode of the present disclosure.

In the arrangements shown in FIGS. 48 and 49, the apertures 38-5, 39-5 are on opposite sides of the housing 32-5. FIGS. 50 and 51 shows an alternative configuration, in which the fluid-transfer article is annular, and both the first region 35-5 and the second region 36-5 are then in the form of annuli. In FIGS. 51 and 52, the structure of the fluid-transfer article 34-5, including the first region 35-5 and the second region 36-5 may correspond generally to that shown in FIG. 48 The internal structure of the first and second regions 35-5 and 36-5 may be the same as in FIG. 48, but are not illustrated in detail in FIGS. 50 and 51 for simplicity. The heater or heaters 24-5 also cannot be seen in FIGS. 50 and 51, but may be formed as in the arrangement of FIG. 48 or FIG. 49 However, the air flow in the apparatus is discussed in more detail below. Thus, FIGS. 50 and 51 illustrate an aerosol carrier 14-5 according to one or more possible arrangements in more detail. FIG. 50 is a cross-section side view illustration of the aerosol carrier 14-5 and FIG. 51 is a perspective cross-section side view illustration of the aerosol carrier 14-5.

As can be seen from FIGS. 50 and 51, the aerosol carrier 14-5 is generally tubular in form. The aerosol carrier 14-5 comprises housing 32-5, which defines the external walls of the aerosol carrier 14-5 and which defines therein a chamber in which are disposed the fluid-transfer article 34-5 (adjacent the first end 16-5 of the aerosol carrier 14-5) and internal walls defining the fluid communication pathway 48-5. Fluid communication pathway 48-5 defines a fluid pathway for an outgoing air stream from the channels 40-5 to the second end 18-5 of the aerosol carrier 14-5. In the examples illustrated in FIGS. 50 and 51, the fluid-transfer article 34-5 is an annular shaped element located around the fluid communication pathway 48-5. The housing 32-5 containing the fluid-transfer article 34-5 is separable from the housing 43-5 supporting heater or heaters 24-5.

In walls of the housing 43-5, there are provided inlet apertures 50-5 to provide a fluid communication pathway for an incoming air stream to reach the activation surface 41-5 of the second region 36-5 of the fluid-transfer article 34-5.

In the illustrated example of FIGS. 50 and 51, the aerosol carrier 14-5 further comprises a filter element 52-5. The filter element 52-5 is located across the fluid communication pathway 48-5 such that an outgoing air stream passing through the fluid communication pathway 48-5 passes through the filter element 52-5.

With reference to FIG. 51, when a user sucks on a mouthpiece of the apparatus (or on the second end 18-5 of the aerosol carrier 14-5, if configured as a mouthpiece), air is drawn into the carrier through inlet apertures 50-5 extending through walls in the housing 32-5 of the aerosol carrier 14-5.

An incoming airstream **42*a*-5 from a first side of the aerosol carrier 14-5 is directed to a first side of the second region 36-5 (e.g., via a gas communication pathway within the housing of the carrier). An incoming air stream 42*b*-5 from a second side of the aerosol carrier 14-5 is directed to a second side of the second region 36-5 (e.g., via a gas communication pathway within the housing of the carrier). When the incoming air stream 42*a*-5 from the first side of the aerosol carrier 14-5 reaches the first side of the second region 36-5, the incoming air stream 42*a*-5 from the first side of the aerosol carrier 14-5 flows along the activation surface 41-5 of the second region 36-5. Likewise, when the incoming air stream 42*b*-5 from the second side of the aerosol carrier 14-5 reaches the second side of the second region 36-5, the incoming air stream 42*b*-5 from the second side of the aerosol carrier 14-5 flows along the activation surface 41-5 of the second region 36-5. The air streams from each side are denoted by dashed lines 44*a*-5 and 44*b*-5 in FIG. 51 As these air streams 44*a*-5 and 44*b*-5 flow, aerosol precursor on the activation surface 41-5 of the second region 36-5 is entrained in air streams 44*a*-5 and 44*b*-5**.

In use, the heater or heaters 24-5 of the apparatus 12-5 raise a temperature of the second plate **36*b*-5 of the second region 36-5 to a sufficient temperature to release, or liberate, captive substances (i.e., the aerosol precursor) to form a vapor and/or aerosol, which is drawn downstream. The heater or heaters 24-5 modify the captive substances (i.e., the aerosol precursor) from an unheated state to a heated state. As the air streams 44*a*-5 and 44*b*-5 continue their passages, more released aerosol precursor is entrained within the air streams 44*a*-5 and 44*b*-5. When the air streams 44*a*-5 and 44*b*-5 entrained with aerosol precursor meet at a mouth of the outlet fluid communication pathway 48-5, they enter the outlet fluid communication pathway 48-5 and continue until they pass through filter element 52-5 and exit outlet fluid communication pathway 48-5, either as a single outgoing air stream, or as separate outgoing air streams 46-5 (as shown). The outgoing air streams 46-5 are directed to an outlet, from where it can be inhaled by the user directly (if the second end 18-5 of the aerosol capsule 14-5 is configured as a mouthpiece), or via a mouthpiece. The outgoing air streams 46-5** entrained with aerosol precursor are directed to the outlet (e.g., via a gas communication pathway within the housing of the carrier).

FIG. 52 is an exploded perspective view illustration of a kit-of-parts for assembling an aerosol delivery system 10-5.

As will be appreciated, in the arrangements described above, the fluid-transfer article 34-5 is provided within a housing 32-5 of the aerosol carrier 14-5. In such arrangements, the housing of the carrier 14-5 serves to protect the aerosol precursor-containing fluid-transfer article 34-5, whilst also allowing the carrier 14-5 to be handled by a user without his/her fingers coming into contact with the aerosol precursor liquid retained therein.

In any of the embodiments described above the second plate **36*b*-5 of the second region 36-5** may have a thickness of less than 5 mm. In other embodiments it may have a thickness of: less than 3.5 mm, less than 3 mm, less than 2.5 mm, less than 2 mm, less than 1.9 mm, less than 1.8 mm, less than 1.7 mm, less than 1.6 mm, less than 1.5 mm, less than 1.4 mm, less than 1.3 mm, less than 1.2 mm, less than 1.1 mm, less than 1 mm, less than 0.9 mm, less than 0.8 mm, less than 0.7 mm, less than 0.6 mm, less than 0.5 mm, less than 0.4 mm, less than 0.3 mm, less than 0.2 mm, or less than 0.1 mm.

Sixth Mode: An Aerosol Generation Apparatus has a Fluid-Transfer Article with a First Region which Holds an Aerosol Precursor Aspects and embodiments of the sixth mode of the present disclosure will now be discussed with reference to the accompanying figures. Further aspects and embodiments of the sixth mode will be apparent to those skilled in the art. All documents mentioned in this text are incorporated herein by reference.

In general outline, one or more embodiments in accordance with the present disclosure may provide a system for aerosol delivery in which an aerosol carrier may be inserted into a receptacle (e.g., a "heating chamber") of an apparatus for initiating and maintaining release of an aerosol from the aerosol carrier. Another end, or another end portion, of the aerosol carrier may protrude from the apparatus and can be inserted into the mouth of a user for the inhalation of aerosol released from the aerosol carrier cartridge during operation of the apparatus.

Hereinafter, and for convenience only, "system for aerosol delivery" shall be referred to as "aerosol delivery system".

Figure 53:
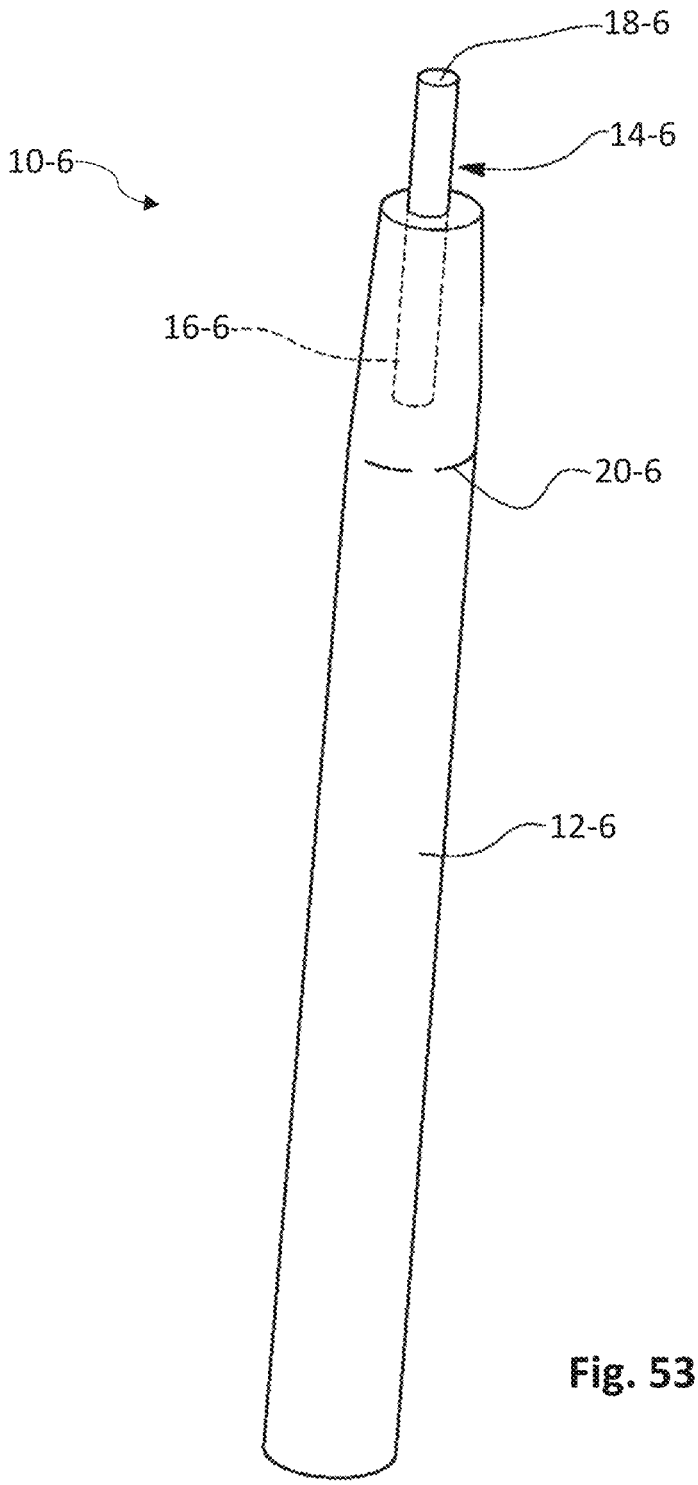
FIG. 53 is a perspective view illustration of a system for aerosol delivery according to one or more embodiments of the sixth mode of the present disclosure.

Referring now to FIG. 53, there is illustrated a perspective view of an aerosol delivery system 10-6 comprising an aerosol generation apparatus 12-6 operative to initiate and maintain release of aerosol from a fluid-transfer article in an aerosol carrier 14-6. In the arrangement of FIG. 53, the aerosol carrier 14-6 is shown with a first end 16-6 thereof and a portion of the length of the aerosol carrier 14-6 located within a receptacle of the apparatus 12-6. A remaining portion of the aerosol carrier 14-6 extends out of the receptacle. This remaining portion of the aerosol carrier 14-6, terminating at a second end 18-6 of the aerosol carrier, is configured for insertion into a user's mouth. A vapor and/or aerosol is produced when a heater (not shown in FIG. 53) of the apparatus 12-6 heats a fluid-transfer article in the aerosol carrier 14-6 to release a vapor and/or an aerosol, and this can be delivered to the user, when the user sucks or inhales, via a fluid passage in communication with an outlet of the aerosol carrier 14-6 from the fluid-transfer article to the second end 18-6.

The device 12-6 also comprises air-intake apertures 20-6 in the housing of the apparatus 12-6 to provide a passage for air to be drawn into the interior of the apparatus 12-6 (when the user sucks or inhales) for delivery to the first end 16-6 of the aerosol carrier 14-6, so that the air can be drawn across an activation surface of a fluid-transfer article located within a housing of the aerosol carrier cartridge 14-6 during use. Optionally, these apertures may be perforations in the housing of the apparatus 12-6.

Figure 57:
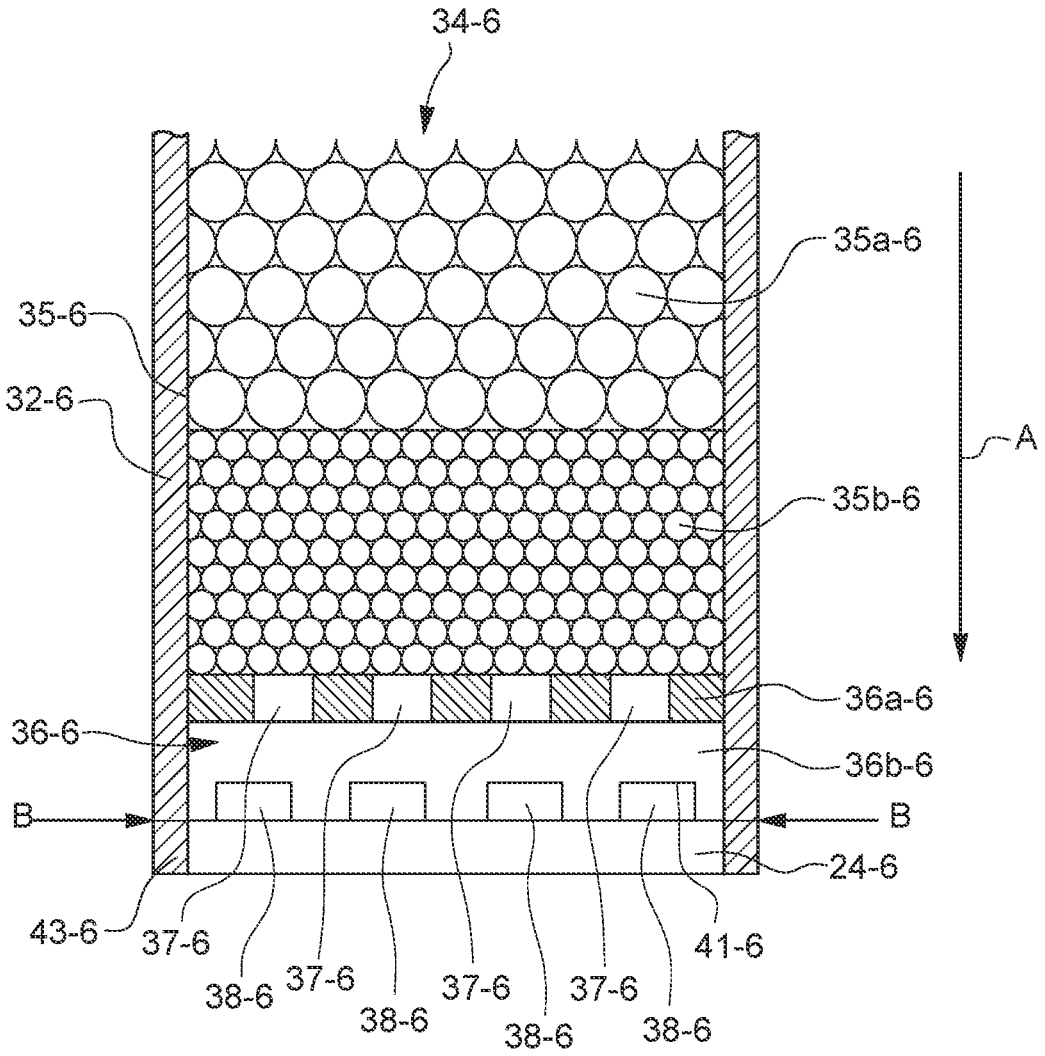
FIG. 57 is a cross-section side view of elements of an aerosol carrier and a part of an apparatus of the system for aerosol delivery according to one or more embodiments of the sixth mode of the present disclosure.
Figure 58:
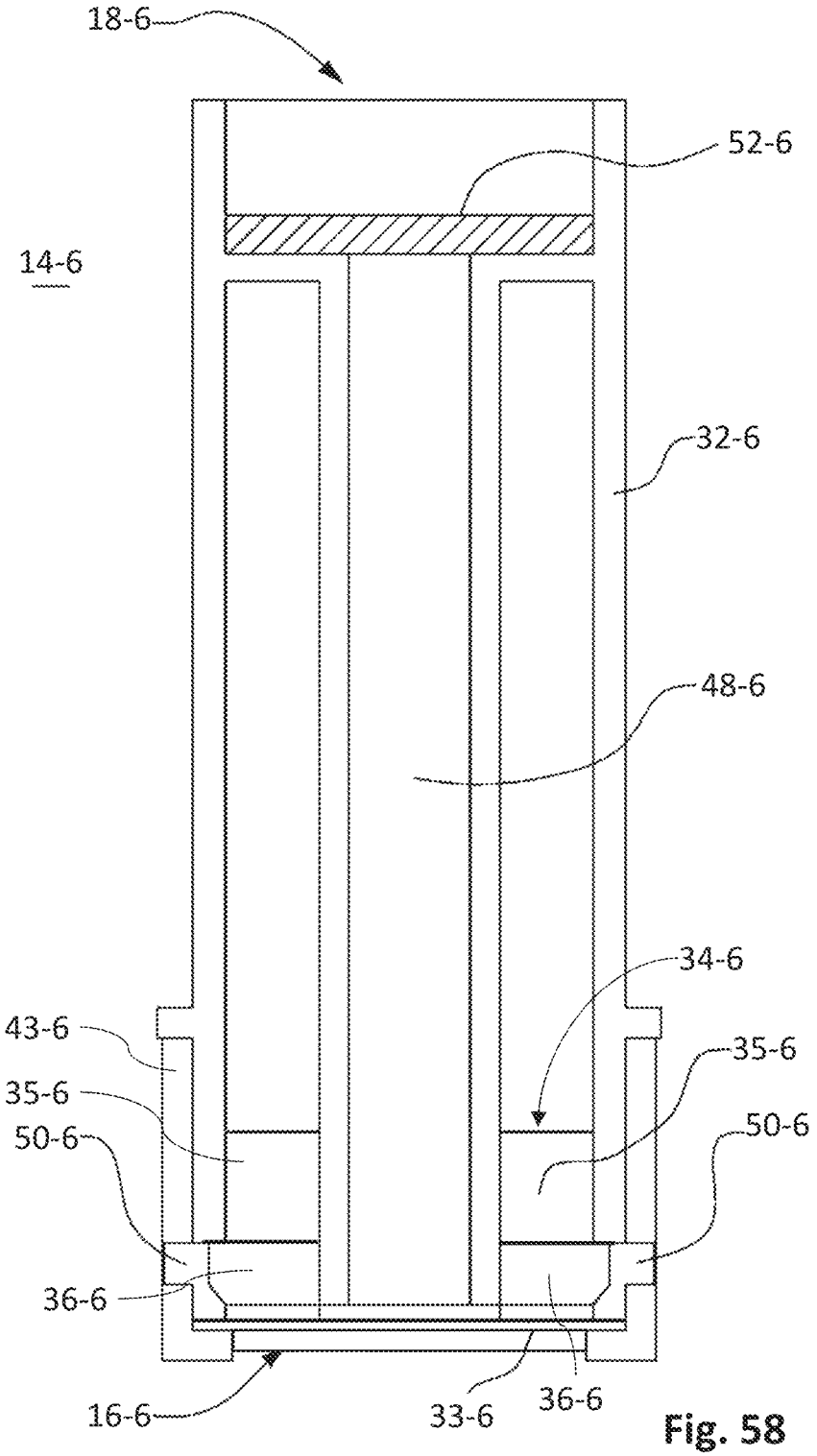
FIG. 58 is a cross-section side view of aerosol carrier according to one or more embodiments of the sixth mode of the present disclosure.
Figure 59:
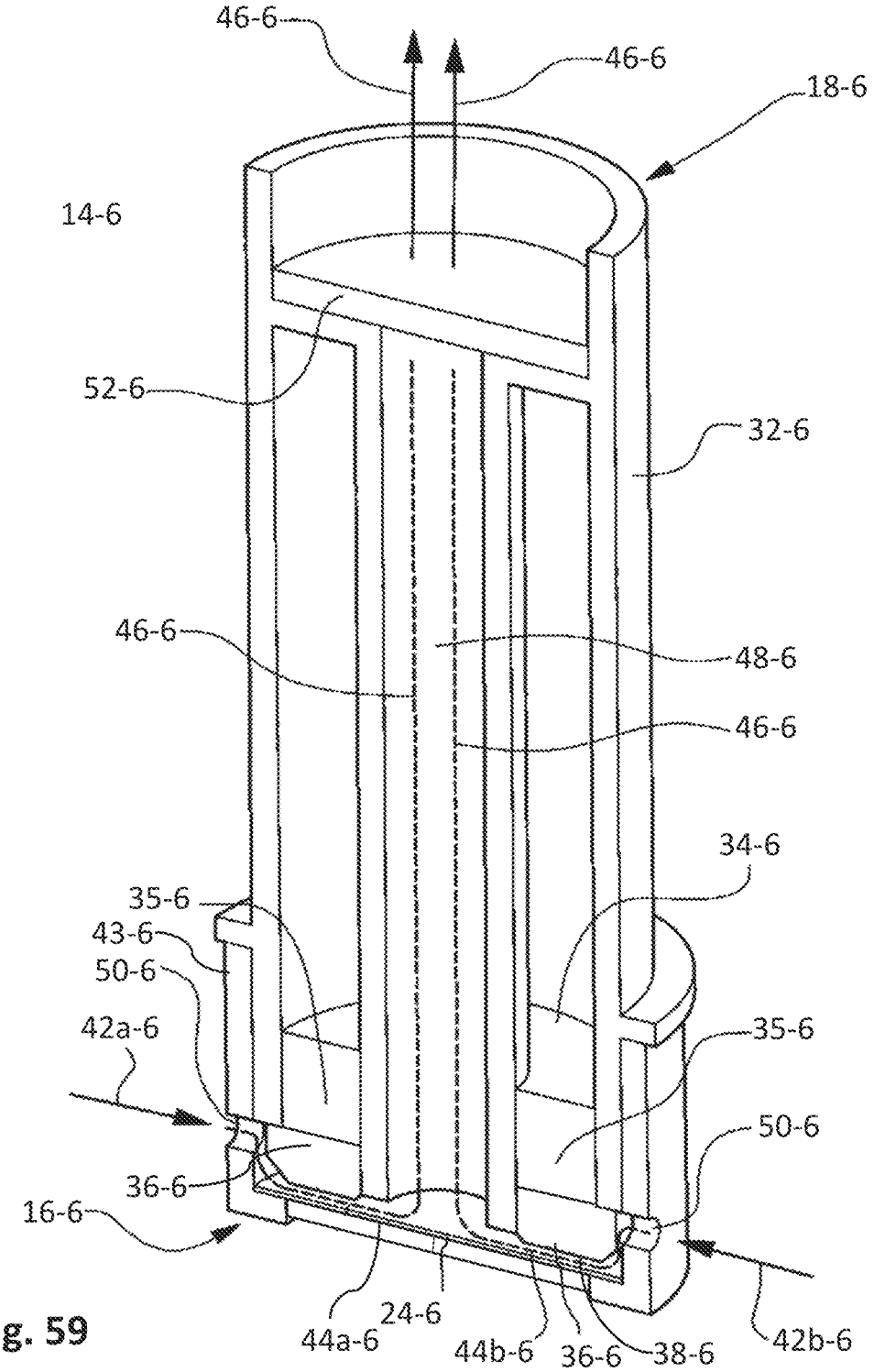
FIG. 59 is a perspective cross-section side view of the aerosol carrier of FIG. 58.

A fluid-transfer article 34-6 (not shown in FIG. 53, but described hereinafter with reference to FIGS. 57 to 59 is located within a housing of the aerosol carrier 14-6. The fluid-transfer article 34-6 contains an aerosol precursor material, which may include at least one of: nicotine; a nicotine precursor material; a nicotine compound; and one or more flavorings. The fluid-transfer article 34-6 is located within the housing of the aerosol carrier 14-6 to allow air drawn into the aerosol carrier 14-6 at, or proximal, the first end 16-6, and has first and second regions, as will be described.

The first region of the fluid-transfer article 34-6 may comprise a substrate of porous material where pores of the porous material hold, contain, carry, or bear the aerosol precursor material. In particular, the porous material of the fluid-transfer article may be a porous polymer material such as, for example, a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET). All such materials may be described as heat resistant polymeric wicking material in the context of the present disclosure.

Alternatively, in some embodiments it is envisaged that the first region of the fluid-transfer article 34-6 may take the form of a simple tank having a cavity defining a hollow reservoir to hold the aerosol precursor.

The aerosol carrier 14-6 is removable from the apparatus 12-6 so that it may be disposed of when expired. After removal of a used aerosol carrier 14-6, a replacement aerosol carrier 14-6 can be inserted into the apparatus 12-6 to replace the used aerosol carrier 14-6.

Figure 54:
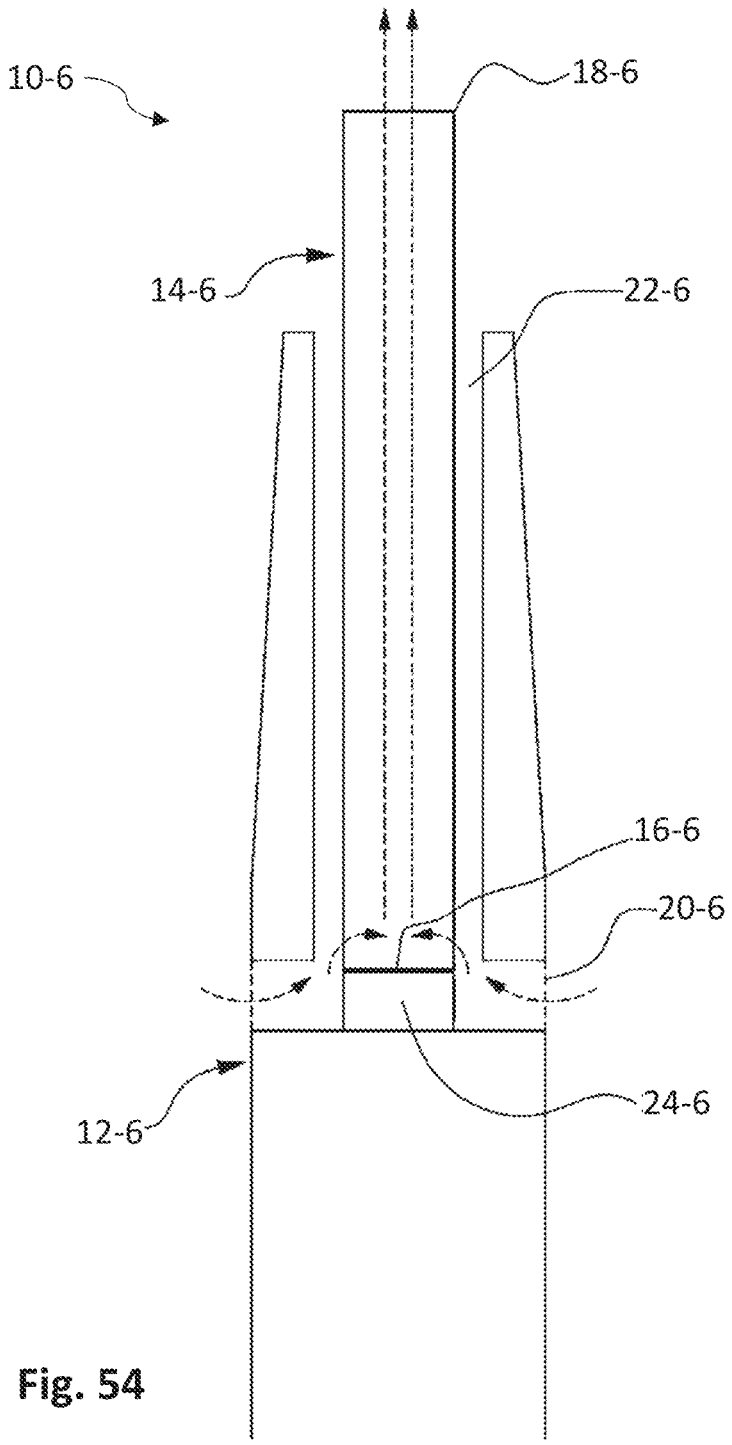
FIG. 54 is a cross-section side view illustration of part of an apparatus of the system for aerosol delivery of FIG. 53.

FIG. 54 is a cross-sectional side view illustration of a part of apparatus 12-6 of the aerosol delivery system 10-6. The apparatus 12-6 comprises a receptacle 22-6 in which is located a portion of the aerosol carrier 14-6. In one or more optional arrangements, the receptacle 22-6 may enclose the aerosol carrier 14-6. The apparatus 12-6 also comprises a heater 24-6, which interacts thermally with an activation surface of the fluid-transfer article 34-6 when an aerosol carrier 14-6 is located within the receptacle 22-6.

Air flows into the apparatus 12-6 (in particular, into a closed end of the receptacle 22-6) via air-intake apertures 20-6. From the closed end of the receptacle 22-6, the air is drawn into the aerosol carrier 14-6 (under the action of the user inhaling or sucking on the second end 18-6) and expelled at the second end 18-6. As the air flows into the aerosol carrier 14-6, it passes across the activation surface. Heat from the heater 24-6 heats the activation surface of the fluid-transfer article 34-6, which causes vaporization of aerosol precursor material at the activation surface of the fluid-transfer article 34-6 and an aerosol is created in the air flowing over the activation surface. Thus, through the application of heat to the activation surface, an aerosol is released, or liberated, from the fluid-transfer article, and is drawn from the material of the aerosol carrier unit by the air flowing across the activation surface and is transported in the air flow to via outlet conduits (not shown in FIG. 54) in the housing of the aerosol carrier 14-6 to the second end 18-6. The direction of air flow is illustrated by arrows in FIG. 54.

To achieve release of the captive aerosol from the fluid-transfer article, the activation surface of the fluid-transfer article 34-6 is heated by the heater 24-6. As a user sucks or inhales on second end 18-6 of the aerosol carrier 14-6, the aerosol released from the fluid-transfer article and entrained in the air flowing across the activation surface is drawn through the outlet conduits (not shown) in the housing of the aerosol carrier 14-6 towards the second end 18-6 and onwards into the user's mouth.

Figure 55:
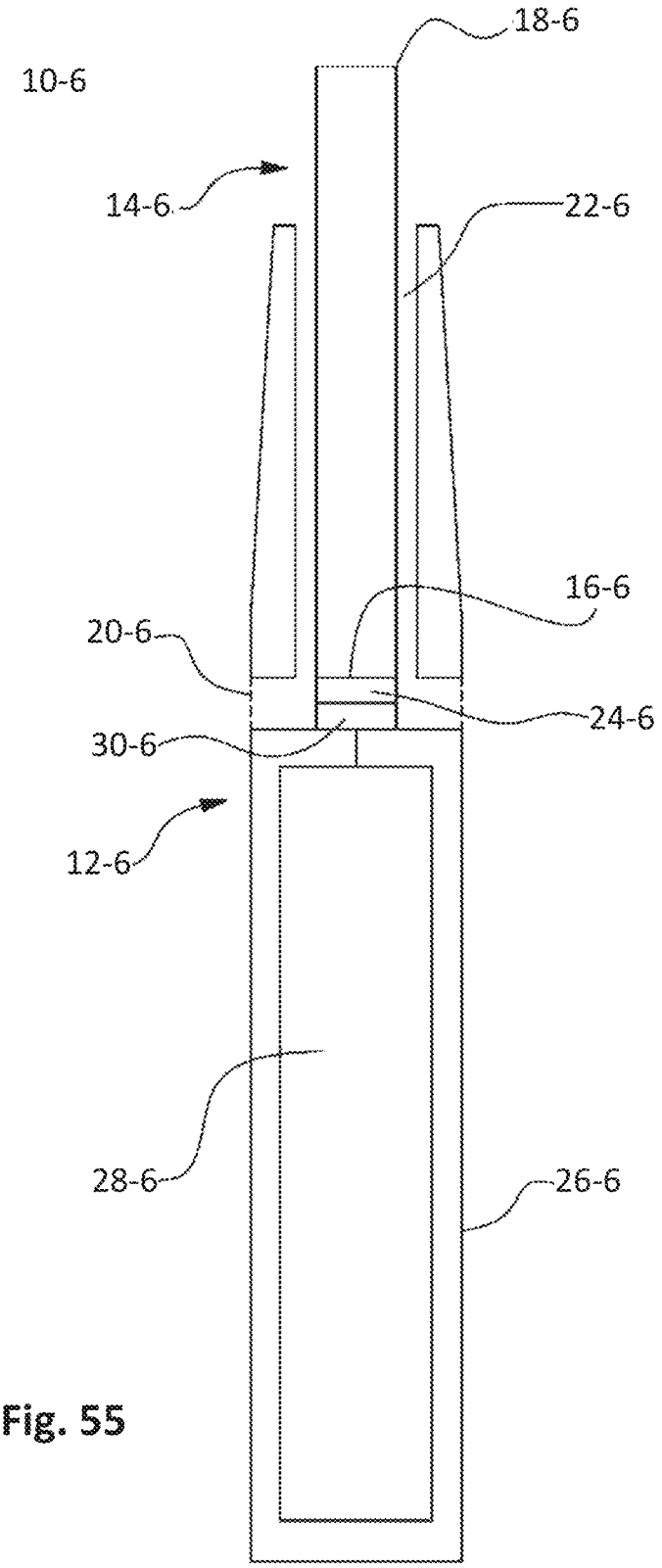
FIG. 55 is a cross-section side view illustration of the system and apparatus for aerosol delivery of FIG. 53.

Turning now to FIG. 55, a cross-sectional side view of the aerosol delivery system 10-6 is schematically illustrated showing the features described above in relation to FIGS. 53 and 54 in more detail. As can be seen, apparatus 12-6 comprises a housing 26-6, in which is located the receptacle 22-6. The housing 26-6 also contains control circuitry (not shown) operative by a user, or upon detection of air and/or vapor being drawn into the device 12-6 through air-intake apertures 20-6, i.e., when the user sucks or inhales. Additionally, the housing 26-6 comprises an electrical energy supply 28-6, for example a battery. Optionally, the battery comprises a rechargeable lithium-ion battery. The housing 26-6 also comprises a coupling 30-6 for electrically (and optionally mechanically) coupling the electrical energy supply 28-6 to control circuitry (not shown) for powering and controlling operation of the heater 24-6.

Responsive to activation of the control circuitry of apparatus 12-6, the heater 24-6 heats the activation surface of the fluid-transfer article 34-6 (not shown in FIG. 55). This heating process initiates (and, through continued operation, maintains) release of vapor and/or an aerosol from the activation surface of the fluid-transfer article 34-6. The vapor and/or aerosol formed as a result of the heating process is entrained into a stream of air being drawn across the activation surface of the fluid-transfer article 34-6 (as the user sucks or inhales). The stream of air with the entrained vapor and/or aerosol passes through the aerosol carrier 14-6 via outlet conduits (not shown) and exits the aerosol carrier 14-6 at second end 18-6 for delivery to the user. This process is briefly described above in relation to FIG. 54, where arrows schematically denote the flow of the air stream into the device 12-6 and through the aerosol carrier 14-6, and the flow of the air stream with the entrained vapor and/or aerosol through the aerosol carrier cartridge 14-6.

Figure 56:
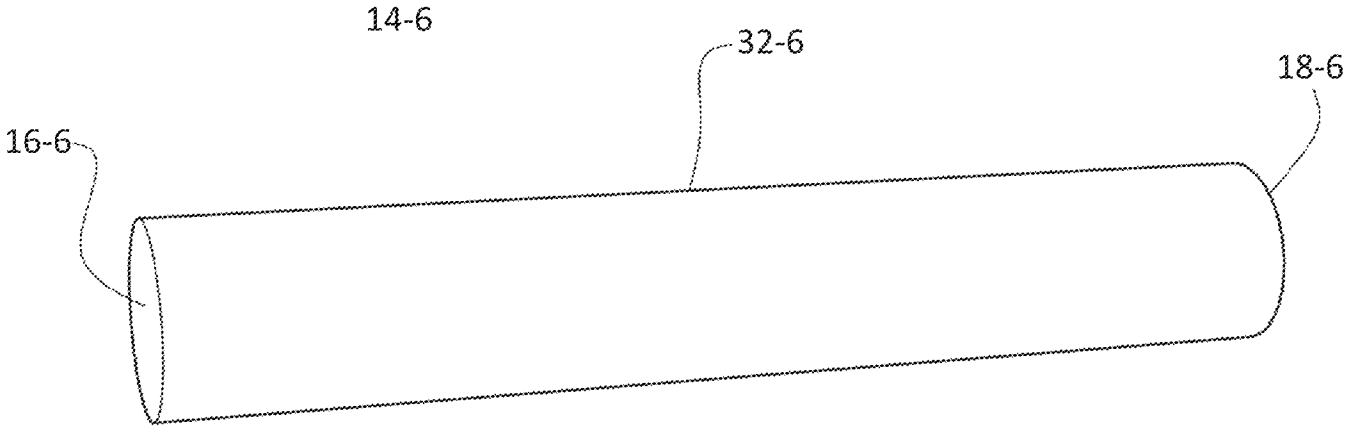
FIG. 56 is a perspective view illustration of an aerosol carrier for use in the system for aerosol delivery according to one or more embodiments of the sixth mode of the present disclosure.

FIGS. 56 and 57 schematically illustrate the aerosol carrier 14-6 in more detail (and, in FIG. 57, features within the receptacle in more detail). FIG. 56 illustrates an exterior of the aerosol carrier 14-6, and FIG. 57 illustrates internal components of the aerosol carrier 14-6 in one optional configuration.

FIG. 56 illustrates the exterior of the aerosol carrier 14-6, which comprises housing 32-6 for housing said fluid-transfer article (not shown). The particular housing 32-6 illustrated in FIG. 56 comprises a tubular member, which may be generally cylindrical in form, and which is configured to be received within the receptacle of the apparatus. First end 16-6 of the aerosol carrier 14-6 is for location to oppose the heater of the apparatus, and second end 18-6 (and the region adjacent the second end 18-6) is configured for insertion into a user's mouth.

FIG. 57 illustrates some internal components of the aerosol carrier 14-6 and of the heater 24-6 of apparatus 12-6, in one embodiment of the disclosure.

As described above, the aerosol carrier 14-6 comprises a fluid-transfer element 34-6. At least part of the fluid-transfer article 34-6 may be removable from the housing 32-6, to enable it to be replaced. The fluid-transfer article 34-6 acts as a reservoir for aerosol precursor and that aerosol precursor will be consumed as the apparatus is used. Once sufficient aerosol precursor has been consumed, the aerosol precursor will need to be replaced. It may then be easiest to replace it by replacing the fluid-transfer article 34-6, rather than trying to re-fill the fluid-transfer article 34-6 with aerosol precursor while it is in the housing 32-6.

In the illustrated embodiments, the fluid-transfer article 34-6 has a first region 35-6 formed by layers **35*a*-6 and 35*b*-6, and a second region 36-6. That second region 36-6 has a first part being an upper layer 36*a*-6 which is formed by a plate with a plurality of holes 37-6 therein, and a second part being a lower layer formed by a second plate 36*b*-6 made of a porous material which allows aerosol precursor to pass therethrough. In the arrangement of FIG. 57, the plate 36*a*-6 with holes 37-6 therein is in contact with the first region 35-6 of the fluid-transfer article 34-6, so that aerosol precursor may pass from that first region 35-6 directly into the holes 37-6, and through those holes to the second plate 36*b*-6**.

Since the second plate **36*b*-6 is porous, the aerosol precursor will pass to the surface of the plate 36*b*-6 remote from the first region 35-6 of the fluid-transfer article 34-6, which surface acts as an activation surface 41-6 of the fluid-transfer article 34-6. A heater is mounted so as to contact the activation surface 41-6. When the heater 24-6 is activated, the heat which it generates will be transferred to the activation surface 41-6**.

Further components not shown in FIG. 57 comprise: an inlet conduit, via which air can be drawn into the aerosol carrier 14-6; an outlet conduit, via which an air stream entrained with aerosol can be drawn from the aerosol carrier 14-6; a filter element; and a reservoir for storing aerosol precursor material and for providing the aerosol precursor material to the fluid-transfer article 34-6.

In FIG. 57, the aerosol carrier is shown as comprising the fluid-transfer article 34-6 located within housing 32. The fluid transfer article 34-6 comprises a first region 35-6 holding an aerosol precursor. In one or more arrangements, the first region of 35 of the fluid transfer article 34-6 comprises a reservoir for holding the aerosol precursor. The first region 35-6 can be the sole reservoir of the aerosol carrier 14-6, or it can be arranged in fluid communication with a separate reservoir, where aerosol precursor is stored for supply to the first region 35-6. As shown in FIG. 57, the first region 35-6 has a first layer **35*a*-6 and a second layer 35*b*-6. The material forming the first layer 35*a*-6 of the first region 35-6 comprises a porous structure, whose pore diameter size varies between one end of the first layer 35*a*-6 and another end of the first layer 35*a*-6. The pore diameter size may increase from a first end remote from heater 24-6 (the upper end is as shown in the figure) to a second end. The pore diameter size may change in a step-wise manner (i.e., a first part with pores having a diameter of first size, and a second part with pores having a diameter of second, smaller size), or the change in pore size in the first layer 35*a*-6 may be gradual rather than step-wise. This configuration of pores having a decreasing diameter size can provide a wicking effect, which can serve to draw fluid through the first layer 35*a*-6, towards heater 24-6**.

The first region 35-6 of the fluid transfer article 34-6 may also comprise a second layer **35*b*-6. Aerosol precursor is drawn from the first layer 35*a*-6 to the second layer 35*b*-6 by the wicking effect of the material forming the first layer 35*a*-6. Thus, the first layer 35*a*-6 is configured to transfer the aerosol precursor to the second layer 35*b*-6 of the first region 35-6 of the fluid-transfer article 34-6**.

The second layer **35*b*-6 itself may comprise a porous structure formed by a porous polymer material. It is then preferable that the pore diameter size of the porous structure of the second layer 35*b*-6 is smaller than the pore diameter size of the immediately adjacent part of the first layer 35*a*-6**. As mentioned above, the porous polymer material may be a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET).

However, as mentioned previously, in some embodiments it is envisaged that the first region 35-6 of the fluid-transfer article need not be of porous polymer material as described above. Instead, the first region 35-6 of the fluid-transfer article 34-6 may take the form of a simple tank having a cavity defining a hollow reservoir to hold the aerosol precursor. In such embodiments it is proposed that the plate **36*a*-6 with holes 37-6 therein will extend across the bottom of the tank so that aerosol precursor held in the tank will impinge directly on the plate 36*a*-6 and pass directly from the tank defining the first region 35-6 of the fluid-transfer article 34-6 into the holes 37-6 of the second region 36-6** of the fluid-transfer article.

As illustrated in FIG. 57, the second plate **36*b*-6 of second region 36-6 has a plurality of recesses 38-6 therein so that the activation surface 41-6 is convoluted, with parts in contact with the heater 24-6, and parts at the recesses 38-6 are spaced from the heater 24-6 to form the air-flow pathways along the activation surface 41-6, through which air can pass as it flows from the apertures 20-6 to the second end 18-6. The recesses 38-6** form channels for the air-flow pathways.

In FIG. 57, the recesses are rectangular in cross-section. Other shapes are also possible, such as square, V-shaped, or curved or arched.

As discussed above, the heater 24-6 transfers heat to the activation surface 41-6 thereby releasing aerosol precursor which has reached that activation surface 41-6 through the porous polymer material (or hollow reservoir) of the first region 35-6, and through the second region 36-6. That vapor and/or a mixture of vapor and aerosol, may then pass into the air adjacent the activation surface 41-6 and the heater 24-6. In particular, the vapor or mixture will pass into the spaces (channels) formed by the recesses 38-6, from the walls of those recesses. The sizes of the recesses 38-6, and the sizes of the parts of the activation surface 41-6 in contact with the heater 24-6 are chosen so as to balance the need for the heater 24-6 to heat the second part 36-6 of the intermediate structure 36-6 to release vapor from the activation surface 41-6, and the need for the recesses 38-6 to be large enough to permit an adequate flow of air along the air-flow pathways.

There is thus a fluid-flow path for air (hereinafter referred to as an air-flow pathway) along each of the channels formed by the recesses 38-6, linking the apertures 20-6 and the second end 18-6 of the aerosol carrier. When the user sucks or inhales, air is drawn along the air-flow pathways, along the activation surface 41-6 through the channels formed by the recesses 38-6.

One or more droplets of the aerosol precursor will be released from the second plate **36*b*-6 and heated, to release vapor or a mixture of aerosol and vapor into the air flowing in the air-flow pathway or pathways. The vapor or mixture passes, as the user sucks and inhales, to the second end 18-6**.

As mentioned above, the second region 36-6 of the fluid-transfer article 34-6 comprises a first plate **36*a*-6 and a second plate 36*b*-6. The first plate 36*a*-6 may be a molded polymer disc so that is then easy to form the holes 37-6 therein by molding the holes 37-6 when the plate 36*a*-6 is itself molded. The holes 37-6 are sufficiently large that they do not act as a capillary, but instead define non-capillary spaces in the second region 36-6. Hence, aerosol precursor is able to pass from the first region 35-6 of the fluid-transfer article to the second region 36-6 in a non-capillary manner, into the holes 37-6, and then pass through the second plate 36*b*-6 to the heater or heaters 24-6. The holes 37-6** may be relatively large, so that they fill with aerosol precursor when the apparatus is in use.

The second plate **36*b*-6 is made of a porous material which is more heat-resistant than the material of the plate 36*a*-6, as it is acted on directly by the heater 24-6. It may be fibrous, made from e.g., ceramic fiber, glass fiber or carbon fiber. Alternatively, it may be formed from a high-temperature porous material such as porous glass or porous ceramic. Another possibility is that the second plate 36*b*-6 may be of a porous polymer material, such as the materials described previously with reference to the layers 35*a*-6 and 35*b*-6 of the first region 35-6, provided that the polymer material is sufficiently resistant to the high temperatures to which it will be subject due to the heater or heaters 24-6**.

It is thought that the flow of air in the recesses 38-6 along the activation surface 41-6 and past the heater 24-6 will have the effect of creating the lower air pressure adjacent the activation surface 41-6 which will tend to draw liquid through the porous second plate **36*b*-6 to the activation surface 41-6. Thus, the transfer of aerosol precursor from the fluid-transfer article 34-6** is facilitated.

As mentioned above, the fluid-transfer article 34-6, formed by the first and second regions 35-6 and 36-6 and any further reservoir of aerosol precursor, forms the consumable part of the apparatus, in the sense that it can readily be replaced to enable the aerosol precursor to be replaced once it is consumed. The heater 24-6 is not part of the consumable elements. Thus, the housing 32-6 containing the fluid-transfer article 34-6 may be separable from a housing 43-6 supporting the heater 24-6 along the line B-B in FIG. 57. The further housing 43-6 may be integral with the housing 26-6 containing the electrical energy supply 28-6. It is for this reason that the heater 24-6 makes contact with, but is not bonded to, the activation surface 41-6. The contact ensures the most efficient heat transfer from the heater 24-6 to the second plate **36*b*-6 to heat the activation surface 41-6 but the heater 24-6 must be separable from that activation surface 41-6 to allow removal of the housing 32-6 from the further housing 43-6 when the fluid-transfer article 34-6 has become depleted. The line B to B may therefore correspond to the part of the activation surface 41-6 which contacts the heater 24-6**.

In FIG. 57, the heater 24-6 may be a coil, mesh or foil heater such as a radial or Clapton coil. Such a coil, mesh or foil heater is preferred so that any restriction caused by the heater 24-6 on release of aerosol or vapor from the activation surface 41-6 is minimized.

In the illustrative examples of FIG. 57, the first layer **35*a*-6 of the first region 35-6 of the fluid-transfer article 34-6 is located at an "upstream" end of the fluid-transfer article 34-6 and the second plate 35*b*-6 of the second region 35*b*-6 is located at a downstream" end of the fluid-transfer article 34-6. That is, aerosol precursor is wicked, or is drawn, from the "upstream" end of the fluid-transfer article 34-6 to the "downstream" end of the fluid-transfer article 34-6 (as denoted by arrow A in FIG. 57**).

In FIG. 57, the heater 24-6 contacts the parts of the second plate **36*b*-6 between the recesses 38-6. It thus makes direct (though unbonded) contact with parts of the activation surface 41-6. This ensures good heat transfer from the heater 24-6 to the second plate 36*b*-6, hence heating the activation surface 41-6, both where the activation surface 41-6 contacts the heater 24-6 and at the recesses 38-6. It would be possible for the heater 24-6 to be spaced from the second plate 36*b*-6, but this is not preferred, both because the first transfer would be less efficient, and also because there would then be some air flow between the heater 24-6 and the activation surface 41-6 not through the channels formed by the recesses 38-6**.

In the arrangements shown in FIG. 57, the ends of the channels formed by the recesses 38-6 are on opposite sides of the housing 32-6. FIGS. 58 and 59 show an alternative configuration, in which the fluid-transfer article is annular, and both the first region 35-6 and the second region 36-6 are then in the form of annuli. In FIGS. 58 and 59, the structure of the fluid-transfer article 34-6, including the first region 35-6 and the second region 36-6 may correspond generally to that shown in FIG. 57. The internal structure of the first and second regions 35-6 and 36-6 may be the same as in FIG. 57, but are not illustrated in detail in FIGS. 58 and 59 for simplicity. However, the air flow in the apparatus is discussed in more detail below. Thus, FIGS. 58 and 59 illustrate an aerosol carrier 14-6 according to one or more possible arrangements in more detail. FIG. 58 is a cross-section side view illustration of the aerosol carrier 14-6 and FIG. 59 is a perspective cross-section side view illustration of the aerosol carrier 14-6.

As can be seen from FIGS. 58 and 59, the aerosol carrier 14-6 is generally tubular in form. The aerosol carrier 14-6 comprises housing 32-6, which defines the external walls of the aerosol carrier 14-6 and which defines therein a chamber in which are disposed the fluid-transfer article 34-6 (adjacent the first end 16-6 of the aerosol carrier 14-6) and internal walls defining the fluid communication pathway 48-6. Fluid communication pathway 48-6 defines a fluid pathway for an outgoing air stream from the channels 40-6 to the second end 18-6 of the aerosol carrier 14-6. In the examples illustrated in FIGS. 58 and 59, the fluid-transfer article 34-6 is an annular shaped element located around the fluid communication pathway 48-6. The housing 32-6 containing the fluid-transfer article 34-6 is separable from the housing 43-6 supporting the heater 24-6.

In walls of the housing 43-6, there are provided inlet apertures 50-6 to provide a fluid communication pathway for an incoming air stream to reach the activation surface 41-6 of the second region 36-6 of the fluid-transfer article 34-6.

In the illustrated example of FIGS. 58 and 59, the aerosol carrier 14-6 further comprises a filter element 52-6. The filter element 52-6 is located across the fluid communication pathway 48-6 such that an outgoing air stream passing through the fluid communication pathway 48-6 passes through the filter element 52-6.

With reference to FIG. 59, when a user sucks on a mouthpiece of the apparatus (or on the second end 18-6 of the aerosol carrier 14-6, if configured as a mouthpiece), air is drawn into the carrier through inlet apertures 50-6 extending through walls in the housing 32-6 of the aerosol carrier 14-6.

An incoming airstream **42*a*-6 from a first side of the aerosol carrier 14-6 is directed to a first side of the second region 36-6 (e.g., via a gas communication pathway within the housing of the carrier). An incoming air stream 42*b*-6 from a second side of the aerosol carrier 14-6 is directed to a second side of the second region 36-6 (e.g., via a gas communication pathway within the housing of the carrier). When the incoming air stream 42*a*-6 from the first side of the aerosol carrier 14-6 reaches the first side of the second region 36-6, the incoming air stream 42*a*-6 from the first side of the aerosol carrier 14-6 flows along the activation surface 41-6 of the second region 36-6 through the recesses 38-6 in the second plate 36*b*-6. Likewise, when the incoming air stream 42*b*-6 from the second side of the aerosol carrier 14-6 reaches the second side of the second region 36-6, the incoming air stream 42*b*-6 from the second side of the aerosol carrier 14-6 flows along the activation surface 41-6 of the second region 36-6, again through the recesses in the second plate 36*b*-6. The air streams from each side are denoted by dashed lines 44*a*-6 and 44*b*-6 in FIG. 60 As these air streams 44*a*-6 and 44*b*-6 flow, aerosol precursor on the activation surface 41-6 of the second region 36-6 is entrained in air streams 44*a*-6 and 44*b*-6**.

In use, the heater 24-6 of the apparatus 12-6 raise a temperature of the second plate **36*b*-6 of the second region 36-6 to a sufficient temperature to release, or liberate, captive substances (i.e., the aerosol precursor) to form a vapor and/or aerosol, which is drawn downstream. As the air streams 44*a*-6 and 44*b*-6 continue their passages, more released aerosol precursor is entrained within the air streams 44*a*-6 and 44*b*-6. When the air streams 44*a*-6 and 44*b*-6 entrained with aerosol precursor meet at a mouth of the outlet fluid communication pathway 48-6, they enter the outlet fluid communication pathway 48-6 and continue until they pass through filter element 52-6 and exit outlet fluid communication pathway 48-6, either as a single outgoing air stream, or as separate outgoing air streams 46-6 (as shown). The outgoing air streams 46-6 are directed to an outlet, from where it can be inhaled by the user directly (if the second end 18-6 of the aerosol capsule 14-6 is configured as a mouthpiece), or via a mouthpiece. The outgoing air streams 46-6** entrained with aerosol precursor are directed to the outlet (e.g., via a gas communication pathway within the housing of the carrier).

Figure 60:
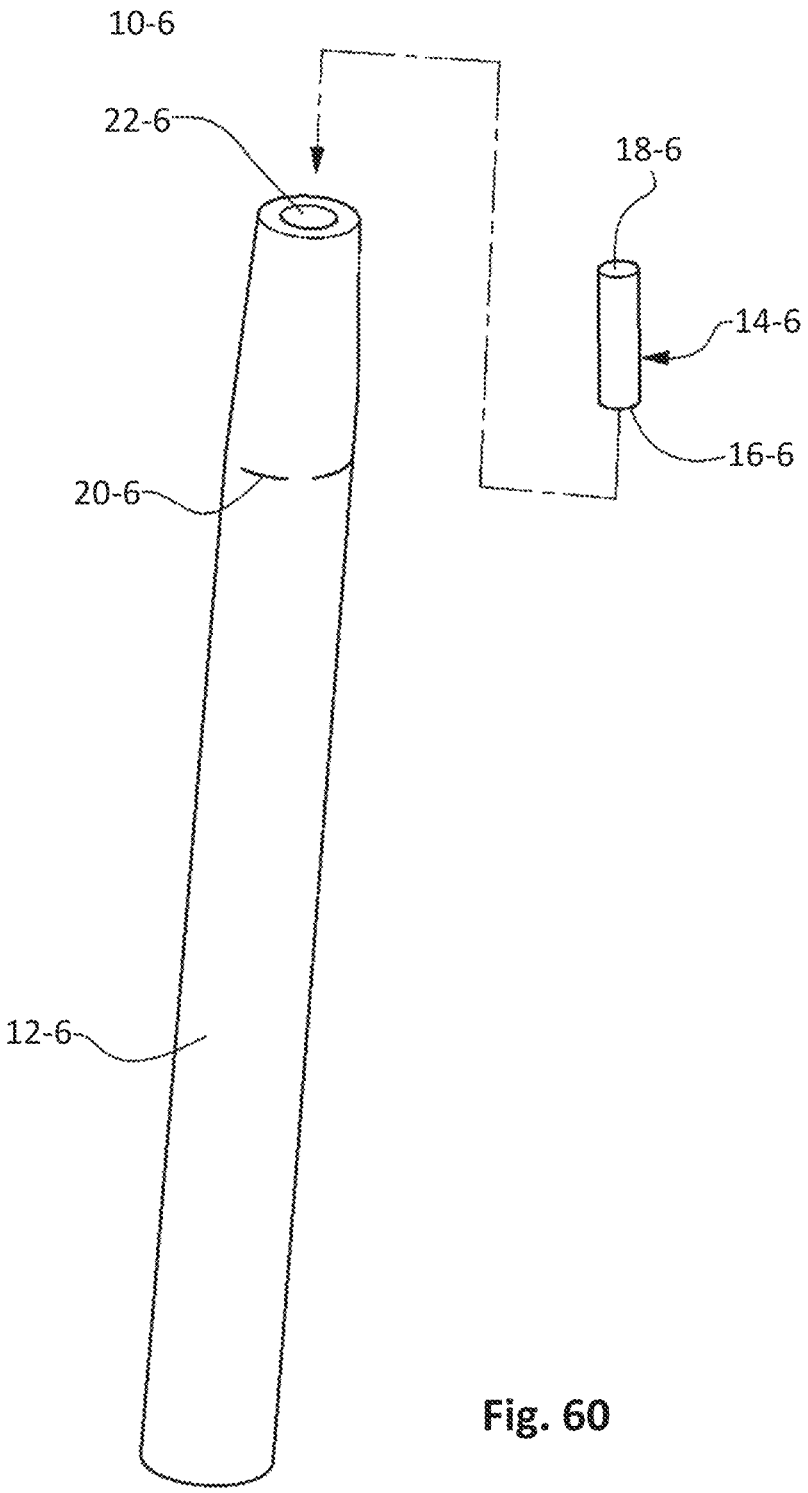
FIG. 60 is an exploded perspective view illustration of a kit-of-parts for assembling the system according to one or more embodiments of the sixth mode of the present disclosure.

FIG. 60 is an exploded perspective view illustration of a kit-of-parts for assembling an aerosol delivery system 10-6.

As will be appreciated, in the arrangements described above, the fluid-transfer article 34-6 is provided within a housing 32-6 of the aerosol carrier 14-6. In such arrangements, the housing of the carrier 14-6 serves to protect the aerosol precursor-containing fluid-transfer article 34-6, whilst also allowing the carrier 14-6 to be handled by a user without his/her fingers coming into contact with the aerosol precursor liquid retained therein.

In any of the embodiments described above the second plate **36*b*-6 of the second region 36-6** may have a thickness of less than 5 mm. In other embodiments it may have a thickness of: less than 3.5 mm, less than 3 mm, less than 2.5 mm, less than 2 mm, less than 1.9 mm, less than 1.8 mm, less than 1.7 mm, less than 1.6 mm, less than 1.5 mm, less than 1.4 mm, less than 1.3 mm, less than 1.2 mm, less than 1.1 mm, less than 1 mm, less than 0.9 mm, less than 0.8 mm, less than 0.7 mm, less than 0.6 mm, less than 0.5 mm, less than 0.4 mm, less than 0.3 mm, less than 0.2 mm, or less than 0.1 mm.

Seventh Mode: An Aerosol-Generation Apparatus has a Heater and a Fluid-Transfer Article for Holding an Aerosol Precursor Aspects and embodiments of the seventh mode of the present disclosure will now be discussed with reference to the accompanying figures. Further aspects and embodiments of the seventh mode will be apparent to those skilled in the art. All documents mentioned in this text are incorporated herein by reference.

In general outline, one or more embodiments in accordance with the present disclosure may provide a system for aerosol delivery in which an aerosol carrier may be inserted into a receptacle (e.g., a "heating chamber") of an apparatus for initiating and maintaining release of an aerosol from the aerosol carrier. Another end, or another end portion, of the aerosol carrier may protrude from the apparatus and can be inserted into the mouth of a user for the inhalation of aerosol released from the aerosol carrier cartridge during operation of the apparatus.

Hereinafter, and for convenience only, "system for aerosol delivery" shall be referred to as "aerosol delivery system".

Figure 61:
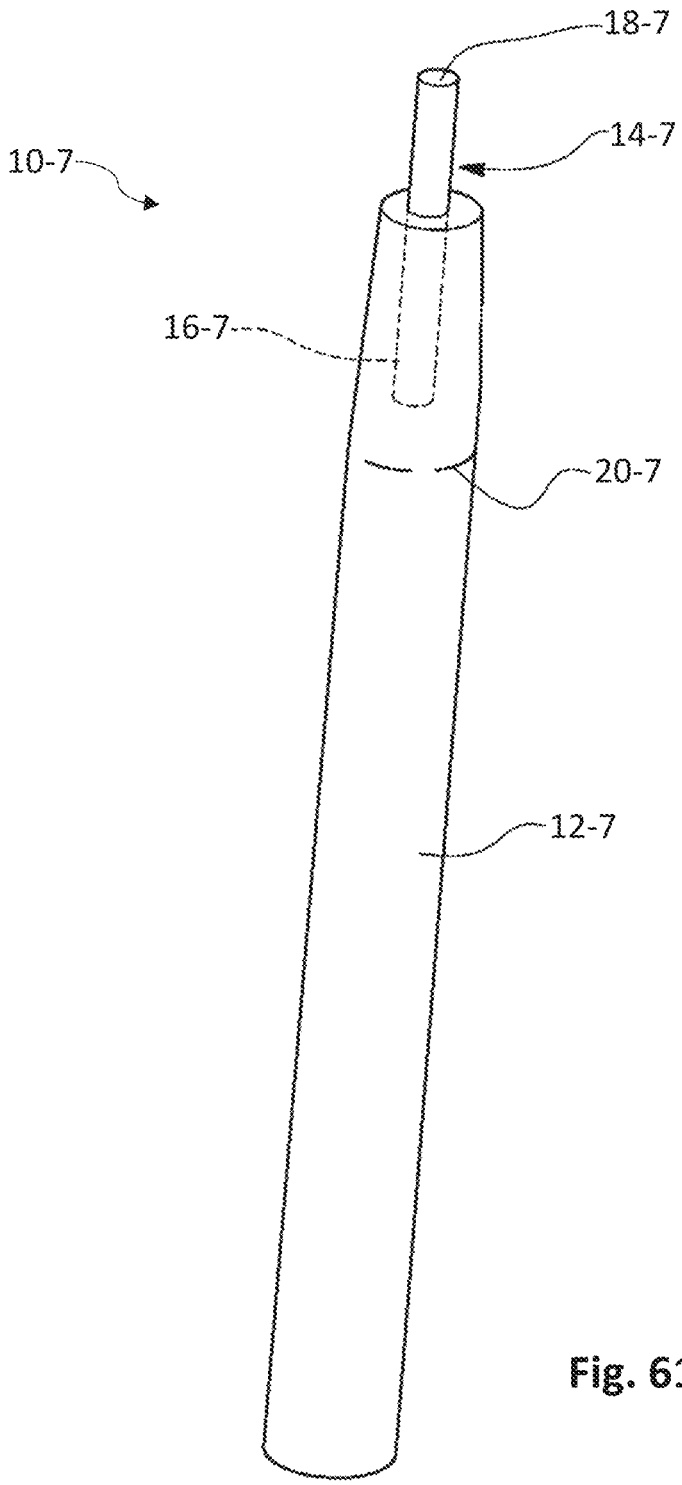
FIG. 61 is a perspective view illustration of a system for aerosol delivery according to one or more embodiments of the seventh mode of the present disclosure.

Referring now to FIG. 61, there is illustrated a perspective view of an aerosol delivery system 10-7 comprising an aerosol generation apparatus 12-7 operative to initiate and maintain release of aerosol from a fluid-transfer article in an aerosol carrier 14-7. In the arrangement of FIG. 61, the aerosol carrier 14-7 is shown with a first end 16-7 thereof and a portion of the length of the aerosol carrier 14-7 located within a receptacle of the apparatus 12-7. A remaining portion of the aerosol carrier 14-7 extends out of the receptacle. This remaining portion of the aerosol carrier 14-7, terminating at a second end 18-7 of the aerosol carrier, is configured for insertion into a user's mouth. A vapor and/or aerosol is produced when a heater (not shown in FIG. 61) of the apparatus 12-7 heats a fluid-transfer article in the aerosol carrier 14-7 to release a vapor and/or an aerosol, and this can be delivered to the user, when the user sucks or inhales, via a fluid passage in communication with an outlet of the aerosol carrier 14-7 from the fluid-transfer article to the second end 18-7.

The device 12-7 also comprises air-intake apertures 20-7 in the housing of the apparatus 12-7 to provide a passage for air to be drawn into the interior of the apparatus 12-7 (when the user sucks or inhales) for delivery to the first end 16-7 of the aerosol carrier 14-7, so that the air can be drawn across an activation surface of a fluid-transfer article located within a housing of the aerosol carrier cartridge 14-7 during use. Optionally, these apertures may be perforations in the housing of the apparatus 12-7.

A fluid-transfer article (not shown in FIG. 61, but described hereinafter with reference to FIGS. 65, 66, 67, 68, 69, 70, and 71) is located within a housing of the aerosol carrier 14-7. The fluid-transfer article contains an aerosol precursor material, which may include at least one of: nicotine; a nicotine precursor material; a nicotine compound; and one or more flavorings. The fluid-transfer article is located within the housing of the aerosol carrier 14-7 to allow air drawn into the aerosol carrier 14-7 at, or proximal, the first end 16-7 to flow across an activation surface of the fluid-transfer article. As air passes across the activation surface of the fluid-transfer article, an aerosol may be entrained in the air stream from a substrate forming the fluid-transfer article, e.g., via diffusion from the substrate to the air stream and/or via vaporization of the aerosol precursor material and release from the fluid-transfer article under heating.

The substrate forming the fluid-transfer article 34-7 comprises a porous material where pores of the porous material hold, contain, carry, or bear the aerosol precursor material. In particular, the porous material of the fluid-transfer article may be a polymeric wicking material such as, for example, a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET). All such materials may be described as heat resistant polymeric wicking material in the context of the present disclosure.

The aerosol carrier 14-7 is removable from the apparatus 12-7 so that it may be disposed of when expired. After removal of a used aerosol carrier 14-7, a replacement aerosol carrier 14-7 can be inserted into the apparatus 12-7 to replace the used aerosol carrier 14-7.

Figure 62:
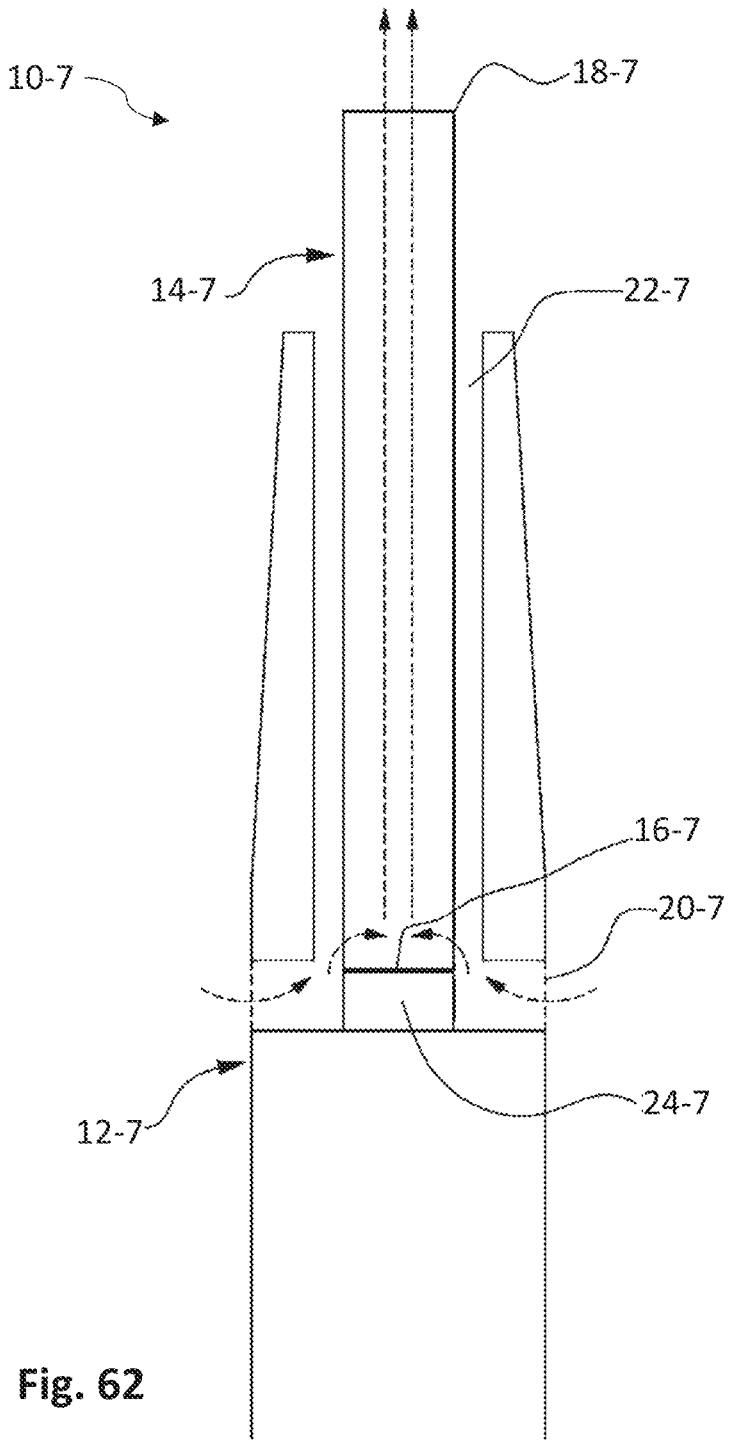
FIG. 62 is a cross-sectional side view illustration of part of an apparatus of the system for aerosol delivery of FIG. 61.

FIG. 62 is a cross-sectional side view illustration of a part of apparatus 12-7 of the aerosol delivery system 10-7. The apparatus 12-7 comprises a receptacle 22-7 in which is located a portion of the aerosol carrier 14-7. In one or more optional arrangements, the receptacle 22-7 may enclose the aerosol carrier 14-7. The apparatus 12-7 also comprise a heater 24-7, which opposes an activation surface of the fluid-transfer article (not shown in FIG. 62) of the aerosol carrier 14-7 when an aerosol carrier 14-7 is located within the receptacle 22-7.

Air flows into the apparatus 12-7 (in particular, into a closed end of the receptacle 22-7) via air-intake apertures 20-7. From the closed end of the receptacle 22-7, the air is drawn into the aerosol carrier 14-7 (under the action of the user inhaling or sucking on the second end 18-7) and expelled at the second end 18-7. As the airflows into the aerosol carrier 14-7, it passes across the activation surface of the fluid-transfer article. Heat from the heater 24-7, which opposes the activation surface of the fluid-transfer article, causes vaporization of aerosol precursor material at the activation surface of the fluid-transfer article and an aerosol is created in the air flowing over the activation surface. Thus, through the application of heat in the region of the activation surface of the fluid-transfer article, an aerosol is released, or liberated, from the fluid-transfer article, and is drawn from the material of the aerosol carrier unit by the air flowing across the activation surface and is transported in the air flow to via outlet conduits (not shown in FIG. 62) in the housing of the aerosol carrier 14-7 to the second end 18-7. The direction of air flow is illustrated by arrows in FIG. 62.

To achieve release of the captive aerosol from the fluid-transfer article, the fluid-transfer article of the aerosol carrier 14-7 is heated by the heater 24-7. As a user sucks or inhales on second end 18-7 of the aerosol carrier 14-7, the aerosol released from the fluid-transfer article and entrained in the air flowing across the activation surface of the fluid-transfer article is drawn through the outlet conduits (not shown) in the housing of the aerosol carrier 14-7 towards the second end 18-7 and onwards into the user's mouth.

Figure 63:
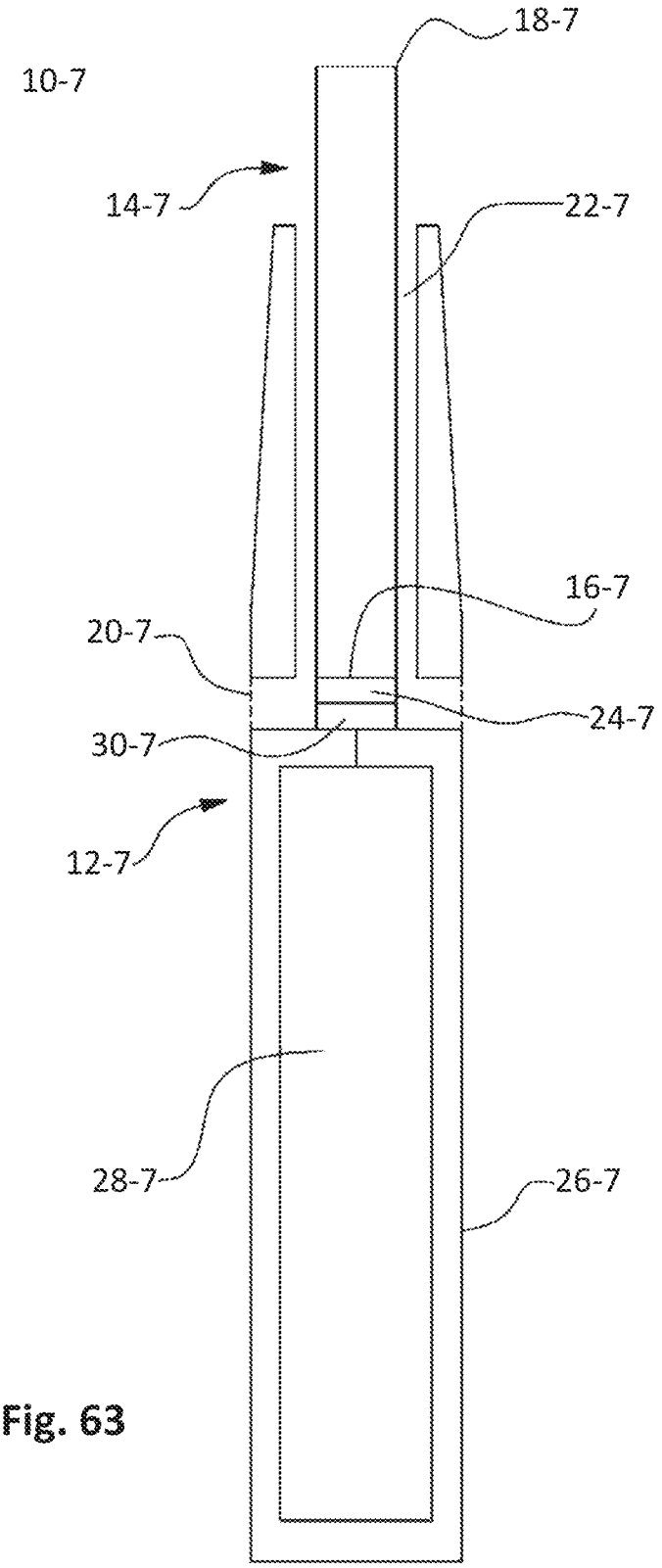
FIG. 63 is a cross-sectional side view illustration of the system and apparatus for aerosol delivery of FIG. 61.

Turning now to FIG. 63, a cross-sectional side view of the aerosol delivery system 10-7 is schematically illustrated showing the features described above in relation to FIGS. 61 and 62 in more detail.

As can be seen, apparatus 12-7 comprises a housing 26-7, in which are located the receptacle 22-7 and heater 24-7. The housing 26-7 also contains control circuitry (not shown) operative by a user, or upon detection of air and/or vapor being drawn into the device 12-7 through air-intake apertures 20-7, i.e., when the user sucks or inhales. Additionally, the housing 26-7 comprises an electrical energy supply 28, for example a battery. Optionally, the battery comprises a rechargeable lithium-ion battery. The housing 26-7 also comprises a coupling 30 for electrically (and optionally mechanically) coupling the electrical energy supply 28 to control circuitry (not shown) for powering and controlling operation of the heater 24-7.

Responsive to activation of the control circuitry of apparatus 12-7, the heater 24-7 heats the fluid-transfer article (not shown in FIG. 63) of aerosol carrier 14-7. This heating process initiates (and, through continued operation, maintains) release of vapor and/or an aerosol from the activation surface of the fluid-transfer article. The vapor and/or aerosol formed as a result of the heating process is entrained into a stream of air being drawn across the activation surface of the fluid-transfer article (as the user sucks or inhales). The stream of air with the entrained vapor and/or aerosol passes through the aerosol carrier 14-7 via outlet conduits (not shown) and exits the aerosol carrier 14-7 at second end 18-7 for delivery to the user. This process is briefly described above in relation to FIG. 62, where arrows schematically denote the flow of the air stream into the device 12-7 and through the aerosol carrier 14-7, and the flow of the air stream with the entrained vapor and/or aerosol through the aerosol carrier cartridge 14-7.

Figure 64:
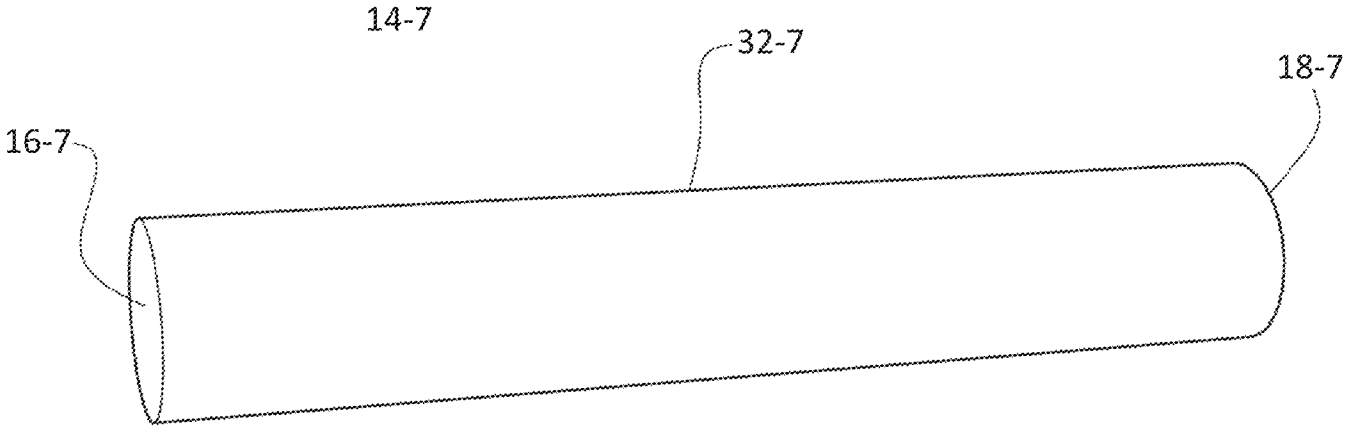
FIG. 64 is a perspective view illustration of an aerosol carrier for use in the system for aerosol delivery according to one or more embodiments of the seventh mode of the present disclosure.
Figure 65:
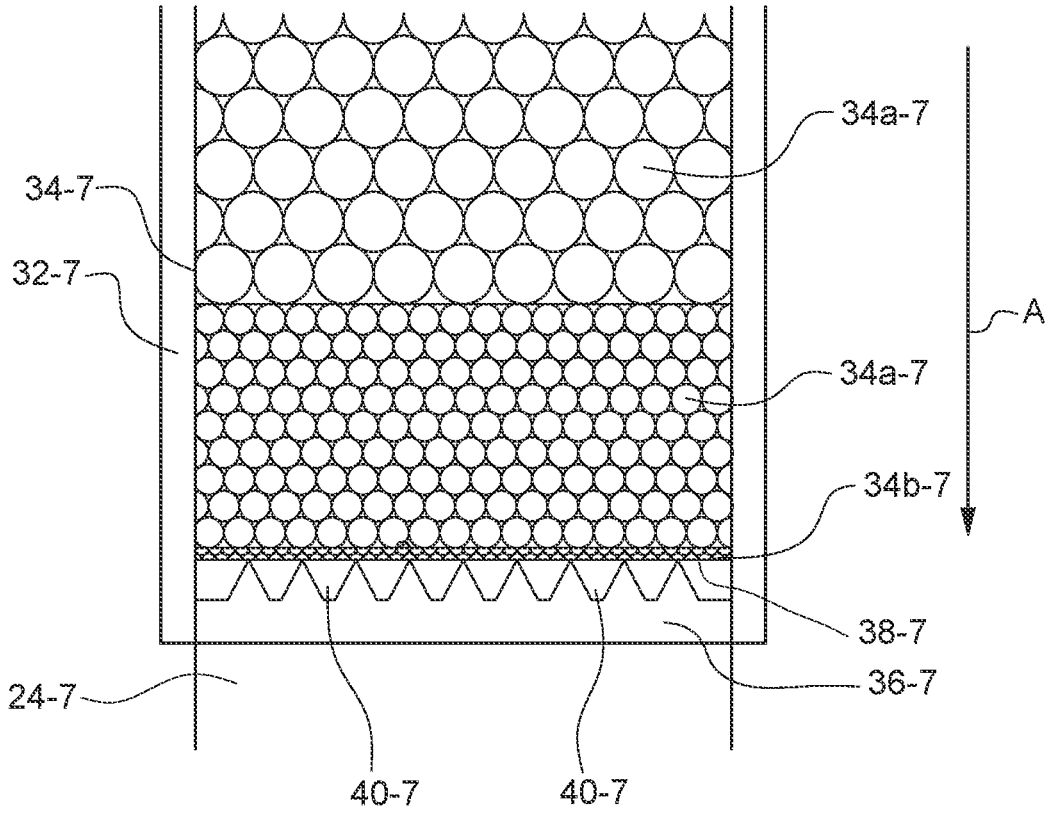
FIG. 65 is a cross-section side view of elements of an aerosol carrier and of part of an apparatus of the system for aerosol delivery according to one or more embodiments of the seventh mode of the present disclosure.
Figure 66:
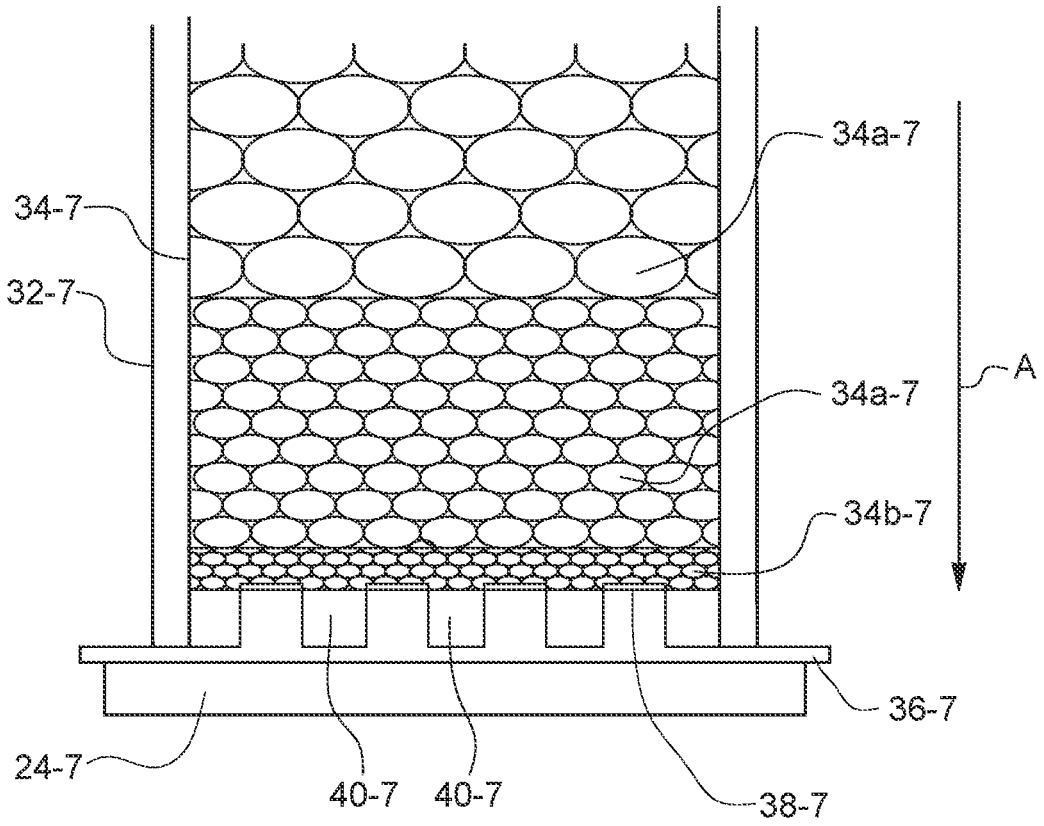
FIG. 66 is a cross-section side view of elements of an aerosol carrier and of part of an apparatus of the system for aerosol delivery according to one or more embodiments of the seventh mode of the present disclosure.

FIGS. 64 to 66 schematically illustrate the aerosol carrier 14-7 in more detail (and, in FIGS. 65 and 66, features within the receptacle in more detail). FIG. 64 illustrates an exterior of the aerosol carrier 14-7, FIG. 65 illustrates internal components of the aerosol carrier 14-7 in an optional arrangement, and FIG. 66 illustrates internal components of the aerosol carrier 14-7 in another optional arrangement.

FIG. 64 illustrates the exterior of the aerosol carrier 14-7, which comprises housing 32-7 for housing said fluid-transfer article (not shown) and at least one other internal component. The particular housing 32-7 illustrated in FIG. 64 comprises a tubular member, which may be generally cylindrical in form, and which is configured to be received within the receptacle of the apparatus. First end 16-7 of the aerosol carrier 14-7 is for location to oppose the heater of the apparatus, and second end 18-7 (and the region adjacent the second end 18-7) is configured for insertion into a user's mouth.

FIG. 65 illustrates some internal components of the aerosol carrier 14-7 and of the heater 24-7 of apparatus 12-7.

As described above, the aerosol carrier 14-7 comprises a fluid-transfer article 34-7. The aerosol carrier 14-7 optionally may comprise a conduction element 36-7 (as shown in FIG. 65) being part of the heater 24-7. In one or more arrangements, the aerosol carrier 14-7 is located within the receptacle of the apparatus such that the activation surface of the fluid-transfer article opposes the heater of the apparatus and receives heat directly from the heater of the apparatus. In an optional arrangement, such as illustrated in FIG. 65 for example, the aerosol carrier 14-7 comprises a conduction element 36-7. When aerosol carrier 14-7 is located within the receptacle of the apparatus such that an activation surface 38-7 of the fluid-transfer article 34-7 is located to oppose the heater 24-7 of the apparatus, the conduction element 36-7 is disposed between the rest of the heater 24-7 and the activation surface 38-7 of the fluid-transfer article 34-7. Heat may be transferred to the activation surface via conduction through conduction element 36-7 (i.e., application of heat to the activation surface is indirect).

Further components not shown in FIGS. 65 and 66 (see FIGS. 69 and 70) comprise: an inlet conduit, via which air can be drawn into the aerosol carrier 14-7; an outlet conduit, via which an air stream entrained with aerosol can be drawn from the aerosol carrier 14-7; a filter element; and a reservoir for storing aerosol precursor material and for providing the aerosol precursor material to the fluid-transfer article 34-7.

In FIGS. 65 and 66, aerosol carrier is shown as comprising the fluid-transfer article 34-7 located within housing 32-7. The material forming the fluid transfer article 34-7 comprises a porous structure, where pore diameter size varies between one end of the fluid-transfer article 34-7 and another end of the fluid-transfer article. In the illustrative examples of FIGS. 65 and 66, the pore diameter size gradually decreases from a first end remote from heater 24-7 (the upper end as shown in the figure) to a second end proximal heater 24-7 heater 24-7 (the lower end as shown in the figure). Although the figure illustrates the pore diameter size changing in a step-wise manner from the first to the second end (i.e., a first region with pores having a diameter of a first size, a second region with pores having a diameter of a second, smaller size, and a third region with pores having a diameter of a third, yet smaller size), the change in pore size from the first end to the second end may be gradual rather than step-wise. This configuration of pores having a decreasing diameter size from the first end and second end can provide a wicking effect, which can serve to draw fluid from the first end to the second end of the fluid-transfer article 34-7.

The fluid-transfer article 34-7 comprises a first region **34*a*-7 for holding an aerosol precursor. In one or more arrangements, the first region 34*a*-7 of the fluid-transfer article 34-7 comprises a reservoir for holding the aerosol precursor. The first region 34*a*-7 can be the sole reservoir of the aerosol carrier 14-7, or it can be arranged in fluid communication with a separate reservoir, where aerosol precursor is stored for supply to the first region 34***a*-7.

The fluid-transfer article 34-7 also comprises a second region 34*b*-7. Aerosol precursor is drawn from the first region 34*a*-7 to the second region 34*b*-7 by the wicking effect of the substrate material forming the fluid transfer article. Thus, the first region 34*a*-7 is configured to transfer the aerosol precursor to the second region 34*b*-7 of the article 34-7.

At the second end of fluid-transfer article 34-7, the surface of the second region 34*b*-7 defines the activation surface 38-7, which is disposed opposite a surface for conveying heat to the activation surface 38-7. In the illustrative examples of FIGS. 65 and 66, the opposing surface for conveying heat to the activation surface 38-7 comprises a conduction element 36-7 which is a part of the heater 24-7. The conduction element 36-7 is located for thermal interaction with the rest of the heater 24-7 and is arranged to transfer heat from the rest of the heater 24-7 to the activation surface 38-7. As noted above, however, the conduction element 36-7 may be absent in some arrangements, in which case the activation surface 38-7 is disposed to receive heat directly from heater 24-7.

The conduction element 36-7, if present, may comprise a thin film of thermally conductive material, such as, for example, a metal foil (for example, aluminum, brass, copper, gold, steel, silver, or an alloy comprising anyone of the foregoing together with thermally conductive plastics and/or ceramics).

The surface of the conduction element 36-7 is discontinuous such that at least one channel 40-7 is formed between the activation surface 38-7 and the conduction element 36-7 (or the upper surface of the heater 24-7 is discontinuous in the case of arrangements in which the conduction element 36-7 is absent). In some arrangements, the discontinuities may be such that the surface of the conduction element 36-7 or heater 24-7 itself is undulating.

In the illustrative examples of FIGS. 65 and 66, the conduction element 36-7 has a plurality of grooves or valleys therein to form an undulating surface, the grooves or valleys being disposed in a parallel arrangement in the conduction element 36-7. Since it is the surface of the conduction element 36-7 closest to the activation surface 38-7 which acts as the heating surface for the aerosol precursor, those grooves or valleys can be said to be in the heating surface. The grooves or valleys define a plurality of channels 40-7, between the activation surface 38-7 and the conduction element 36-7.

In the illustrative example of FIG. 65, the grooves or valleys in the conduction element 36-7 provide alternating peaks and troughs that give rise to a "saw-tooth" type profile. In one or more optional arrangements, the surface of the conduction element 36-7 may comprise a "castellated" type profile (i.e., a "square wave" type profile), for example, such as illustrated in the example of FIG. 66. In one or more optional arrangements, the surface of the conduction element 36-7 may comprise a "sinusoidal" type profile. The profile may comprise a mixture of two or more of the above profiles given as illustrative examples.

In the illustrative examples of FIGS. 65 and 66, the first region 34*a*-7 of the fluid-transfer article 34-7 is located at an "upstream" end of the fluid-transfer article 34-7 and the second region 34*b*-7 is located at a downstream" end of the fluid-transfer article 34-7. That is, aerosol precursor is wicked, or is drawn, from the "upstream" end of the fluid-transfer article 34-7 to the "downstream" end of the fluid-transfer article 34-7 (as denoted by arrow A in FIG. 65).

The aerosol precursor is configured to release an aerosol and/or vapor upon heating. Thus, when the activation surface 38-7 receives heat conveyed from heater 24-7, the aerosol precursor held at the activation surface 38-7 is heated. The aerosol precursor, which is captively held in material of the fluid-transfer article at the activation surface 38-7 is released into an air stream flowing through the channels 40-7 between the conduction element 36-7 and activation surface 38-7 (or between the heater 24-7 and the activation surface 38-7) as an aerosol and/or vapor.

The shape and/or configuration of the conduction element 36-7 (or the upper surface of the heater 24-7 if no conduction element is present) and the associated shape(s) and/or configuration(s) of the one or more channels 40-7 formed between the activation surface 38-7 and conduction element 36-7 (or between the activation surface 38-7 and heater 24-7) permit air to flow across the activation surface 38-7 (through the one or more channels 40-7) and also increase the surface area of the activation surface 38-7 of the fluid-transfer article 34-7 that is available for contact with a flow of air across the activation surface 38-7.

Figure 67:
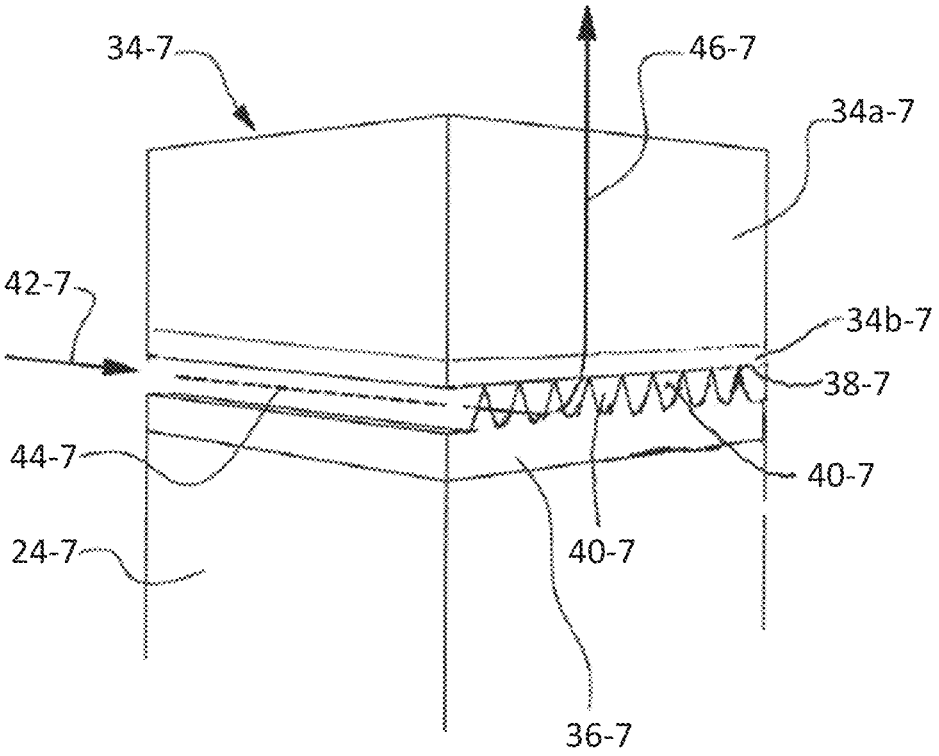
FIG. 67 is a perspective view illustration of the aerosol carrier and of part of an apparatus of the system for aerosol delivery according to one or more embodiments of the seventh mode of the present disclosure.
Figure 68:
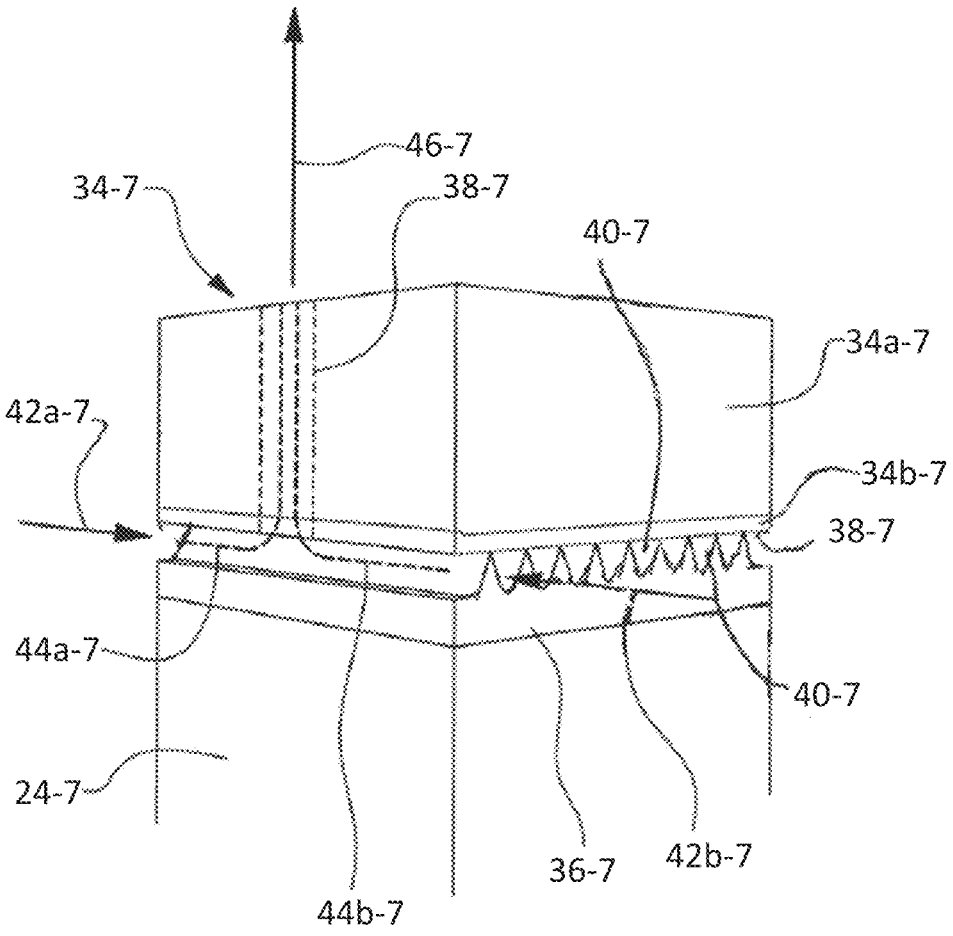
FIG. 68 is a perspective view illustration of the aerosol carrier and of part of an apparatus of the system for aerosol delivery according to one or more embodiments of the seventh mode of the present disclosure.

FIGS. 67 and 68 show perspective view illustrations of the fluid-transfer article 34-7 of the aerosol carrier and a heater 24-7 of the apparatus of the system for aerosol delivery. In particular, these figures illustrate airflows across the activation surface 38-7 when the apparatus is in use in a first arrangement of the fluid-transfer article 34-7 (see FIG. 67), and in a second arrangement of the fluid-transfer article 34-7 (see FIG. 68).

In the illustrated example of use of the apparatus schematically illustrated in FIG. 67, when a user sucks on a mouthpiece of the apparatus, air is drawn into the carrier through inlet apertures (not shown) provided in a housing of the carrier. An incoming air stream 42-7 is directed to the activation surface 38-7 of the fluid-transfer article 34-7 (e.g., via a fluid communication pathway within the housing of the carrier). When the incoming air stream 42-7 reaches a first side of the activation surface 38-7, the incoming air stream 42-7 flows across the activation surface 38-7 via the one or more channels 40-7 formed between the activation surface 38-7 and the conduction element 36-7 (or between the activation surface 38-7 and heater 24-7). The air stream flowing through the one or more channels 40-7 is denoted by dashed line 44-7 in FIG. 67. As the air stream 44-7 flows through the one or more channels 40-7, aerosol precursor at activation surface 38-7, across which the air stream 44-7 flows, is released from the activation surface 38-7 by heat conveyed to the activation surface from the heater 24-7. Aerosol precursor released from the activation surface 38-7 in this manner is then entrained in the air stream 44-7 flowing through the one or more channels 40-7.

In use, the heater 24-7 of the apparatus 12-7 conveys heat to the fluid transfer article 34-7 to raise the temperature of the activation surface 38-7 to a sufficient temperature to release, or liberate, captive substances (i.e., the aerosol precursor) held at the activation surface 38-7 of the fluid-transfer article 34-7 to form a vapor and/or aerosol, which is drawn downstream across the activation surface 38-7 of the fluid-transfer article. As the air stream 44-7 continues its passage in the one or more channels 40-7, more released aerosol precursor is entrained within the air stream 44-7. When the air stream 44-7 entrained with aerosol precursor exits the one or more channels 40-7 at a second side of the activation surface 38-7, it is directed to an outlet, from where it can be inhaled by the user via a mouthpiece. An outgoing air stream 46-7 entrained with aerosol precursor is directed to the outlet (e.g., via a fluid communication pathway within the housing of the carrier).

Therefore, operation of the apparatus will cause heat from the heater 24-7 to be conveyed to the activation surface 38-7 of the fluid-transfer article. At a sufficiently high temperature, captive substances held at the activation surface 38-7 of the fluid-transfer article 34-7 are released, or liberated, to form a vapor and/or aerosol. Thus, when a user draws on a mouthpiece of the apparatus, the released substances from the fluid-transfer article are drawn away from the activation surface 38-7 (entrained in a stream of air) and condense to form an aerosol that is drawn through the gas communication pathway for delivery to an outlet, which is in fluid communication with the mouthpiece.

As the aerosol precursor is released from the activation surface 38-7, a wicking effect of the fluid-transfer article 34-7 causes aerosol precursor within the body of the fluid-transfer article to migrate to the activation surface 38-7 to replace the aerosol precursor released from the activation surface 38-7 into air stream 44-7.

Operation of the heater 24-7 is controlled by control circuitry (not shown), which is operable to actuate the heater 24-7 responsive to an actuation signal from a switch operable by a user or configured to detect when the user draws air through a mouthpiece of the apparatus by sucking or inhaling. In an optional arrangement, the control circuitry operates to actuate the heater 24-7 with as little delay as possible from receipt of the actuation signal from the switch, or detection of the user drawing air through the mouthpiece. This may affect near instantaneous heating of the activation surface 38-7 of the fluid-transfer article 34-7.

In the illustrated example of use of the apparatus schematically illustrated in FIG. 68, rather than the case of FIG. 67 where air is drawn toward the activation surface 38-7 from one side only (and exits from the one or more channels 40-7 at an opposite side), a gas communication pathway for an incoming air stream is configured to deliver the incoming air stream to the activation surface 38-7 from both sides of the fluid-transfer article, and thus from both ends of the channels 40-7 formed therein. In such an arrangement, a gas communication pathway for an outlet airstream may be provided through the body of the fluid-transfer article 34-7. An outlet fluid communication pathway for an outlet airstream in the illustrative example of FIG. 68 is denoted by reference number 48-7.

Thus, in the illustrative example of FIG. 68, when a user draws on a mouthpiece of the apparatus, air is drawn into the carrier 14-7 through inlet apertures (not shown) provided in a housing of the carrier. An incoming air stream 42-7*a* from a first side is directed to a first side of the activation surface 38-7 of the fluid-transfer article 34-7 (e.g., via a gas communication pathway within the housing of the carrier 14-7). An incoming air stream 42-7*b* from a second side is directed to a second side of the activation surface 38-7 of the fluid-transfer article 34-7 (e.g., via a gas communication pathway within the housing of the carrier 14-7). When the incoming air stream 42-7*a* from the first side reaches the first side of the activation surface 38-7, the incoming air stream 42-7*a* flows across the activation surface 38-7 via the one or more channels 40-7 formed between the activation surface 38-7 and the conduction element 36-7 (or between the activation surface 38-7 and heater 24-7). Likewise, when the incoming air stream 42-7*b* from the second side reaches the second side of the activation surface 38-7, the incoming air stream 42-7*b* flows across the activation surface 38-7 via the one or more channels 40-7 formed between the activation surface 38-7 and the conduction element 36-7 (or between the activation surface 38-7 and heater 24-7). The air streams 42*a*-7, 42*b*-7 from each side flowing through the one or more channels 40-7 are denoted by dashed lines 44*a*-7 and 44*b*-7 in FIG. 68.

As air streams 44*a*-7 and 44*b*-7 flow through the one or more channels 40-7, aerosol precursor in the activation surface 38-7, across which the air streams 44*a*-7 and 44*b*-7 flow, is released from the activation surface 38-7 by heat conveyed to the activation surface from the heater 24-7. Aerosol precursor released from the activation surface 38-7 is entrained in air streams 44*a*-7 and 44*b*-7 flowing through the one or more channels 40-7. In use, the heater 24-7 of the apparatus 12-7 conveys heat to the fluid-transfer article 34-7 to raise a temperature of the activation surface 38-7 to a sufficient temperature to release, or liberate, captive substances (i.e., the aerosol precursor) held at the activation surface 38-7 of the fluid-transfer article 34-7 to form a vapor and/or aerosol, which is drawn downstream across the activation surface 38-7 of the fluid-transfer article.

As the air streams 44*a*-7 and 44*b*-7 continue their passages in the one or more channels 40-7, more released aerosol precursor is entrained within the air streams 44*a*-7 and 44*b*-7. When the air streams 44*a*-7 and 44*b*-7 entrained with aerosol precursor meet at a mouth of the outlet fluid communication pathway 48-7, they enter the outlet fluid communication pathway 48-7 and continue until they exit outlet fluid communication pathway 48-7, either as a single outgoing air stream 46-7 (as shown), or as separate outgoing air streams. The outgoing air stream 46-7 is directed to an outlet, from where it can be inhaled by the user via a mouthpiece. The outgoing air stream 46-7 entrained with aerosol precursor is directed to the outlet (e.g., via a gas communication pathway within the housing of the carrier 14-7).

Figure 69:
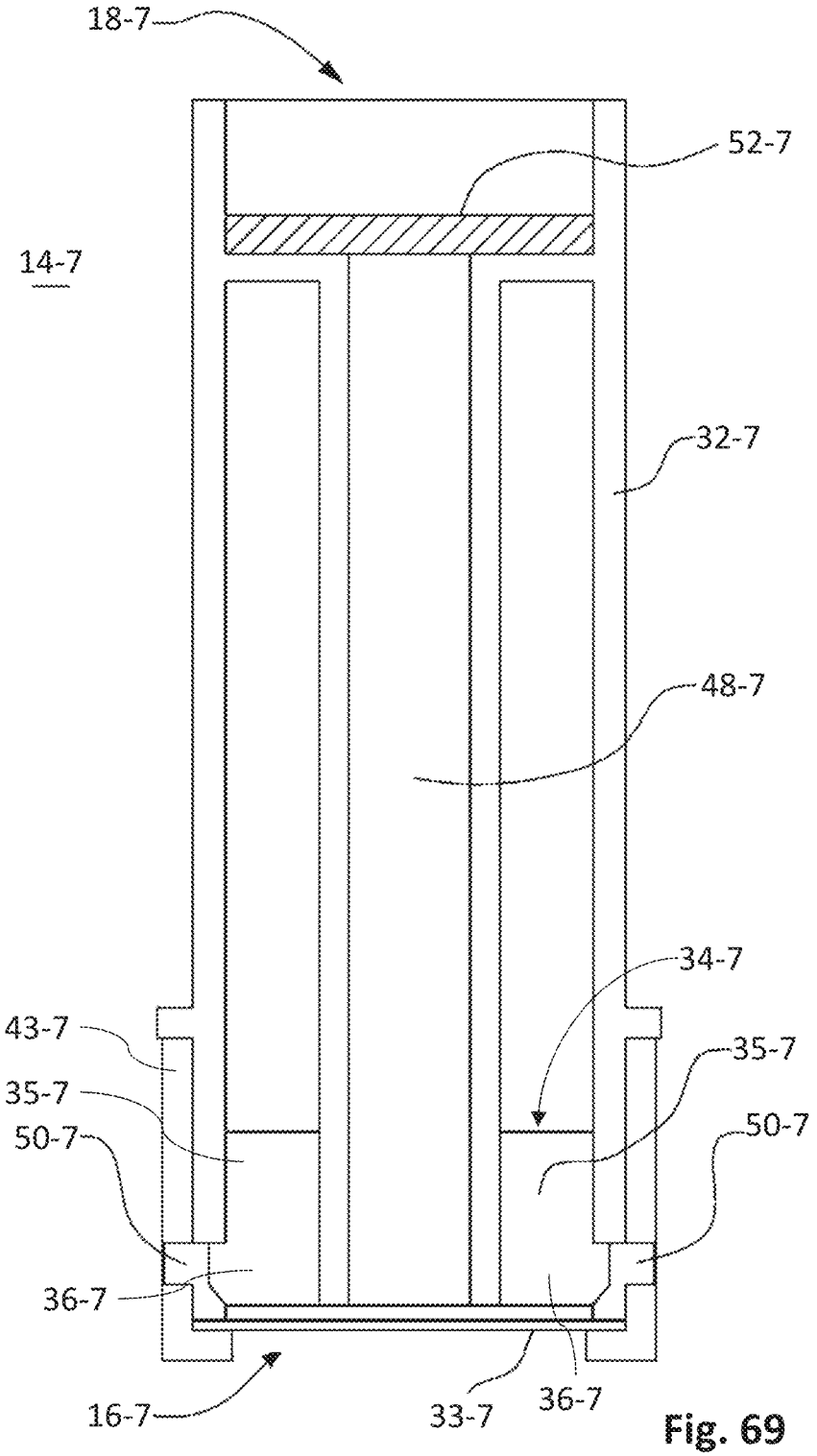
FIG. 69 is a cross-section side view of an aerosol carrier according to one or more embodiments of the seventh mode of the present disclosure.
Figure 70:
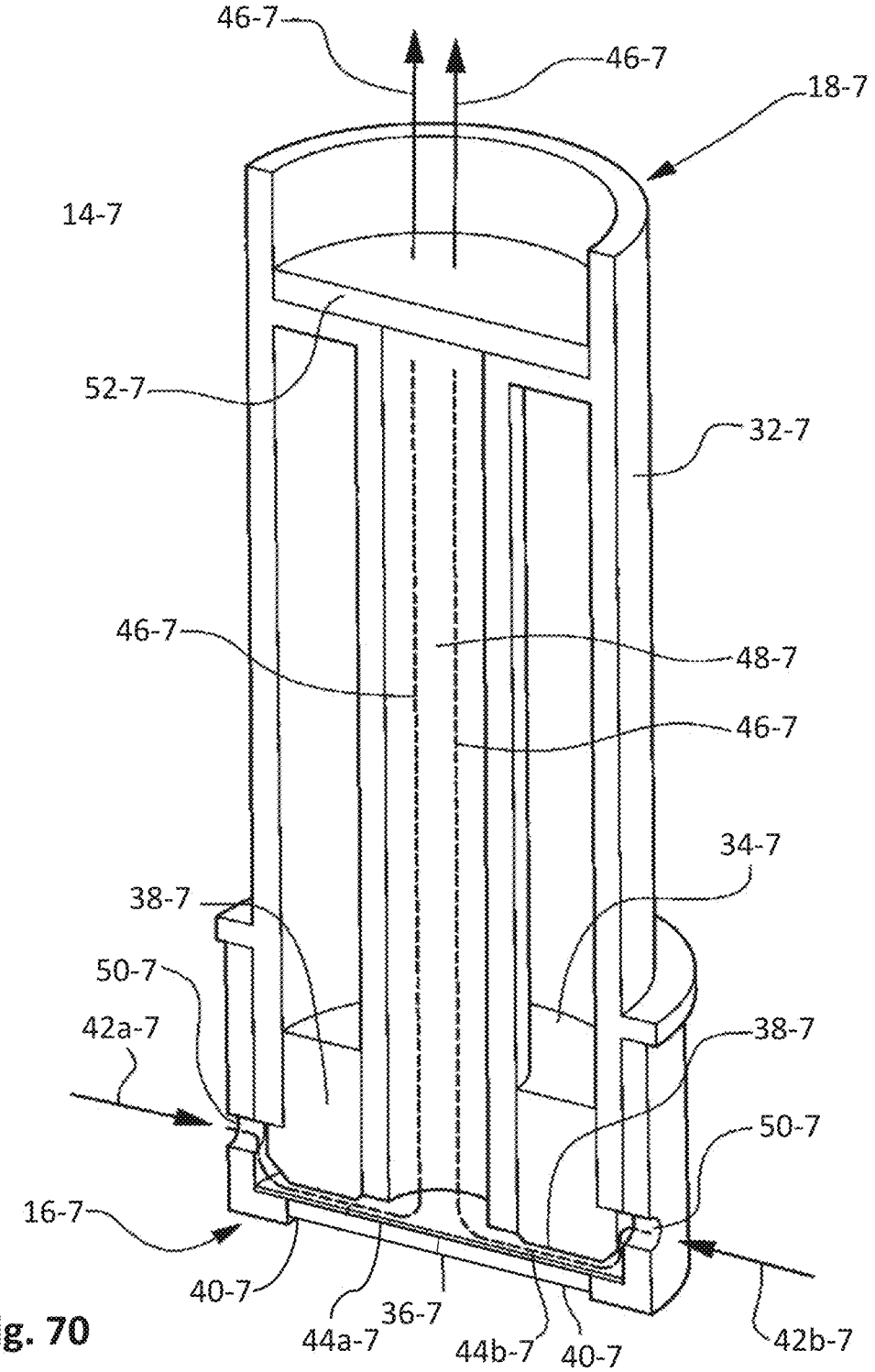
FIG. 70 is a perspective cross-section side view of the aerosol carrier of FIG. 69.

FIGS. 69 and 70 illustrate an aerosol carrier 14-7 according to one or more possible arrangements in more detail. FIG. 69 is a cross-section side view illustration of the aerosol carrier 14-7 and FIG. 70 is a perspective cross-section side view illustration of the aerosol carrier 14-7 of FIG. 69.

As can be seen from FIGS. 69 and 70, the aerosol carrier 14-7 is generally tubular in form. The aerosol carrier 14-7 comprises housing 32-7, which defines the external walls of the aerosol carrier 14-7 and which defines therein a chamber in which are disposed the fluid-transfer article 34-7 (adjacent the first end 16-7 of the aerosol carrier 14-7) and internal walls defining the fluid communication pathway 48-7. Fluid communication pathway 48-7 defines a fluid pathway for an outgoing air stream from the channels 40-7 to the second end 18-7 of the aerosol carrier 14-7. In the examples illustrated in FIGS. 69 and 70, the fluid-transfer article 34-7 is an annular shaped element located around the fluid communication pathway 48-7. Note that, in FIGS. 69 and 70, the channels 40-7 in the conduction element 36-7 extend radially and the sectional views of FIGS. 69 and 70 are along the length of two channels on opposite radial positions relative to the fluid communication pathway 48-7 in the fluid-transfer article.

In walls of the housing 32-7, there are provided inlet apertures 50-7 to provide a fluid communication pathway for an incoming air stream to reach the fluid-transfer article 34-7, and particularly the one or more channels 40-7 defined between the activation surface of the fluid-transfer article 34-7 and the conduction element 36-7 (or between the activation surface and the 15 heater).

In the illustrated example of FIGS. 69 and 70, the aerosol carrier 14-7 further comprises a filter element 52-7. The filter element 52-7 is located across the fluid communication pathway 48-7 such that an outgoing air stream passing through the fluid communication pathway 48-7 passes through the filter element 52-7.

With reference to FIG. 70, when a user sucks on a mouthpiece of the apparatus (or on the second end 18-7 of the aerosol carrier 14-7, if configured as a mouthpiece), air is drawn into the carrier through inlet apertures 50-7 extending through walls in the housing 32-7 of the aerosol carrier 14-7. An incoming air stream 42-7*a* from a first side of the aerosol carrier 14-7 is directed to a first side of the activation surface 38-7 of the fluid-transfer article 34-7 (e.g., via a gas communication pathway within the housing of the carrier). An incoming air stream 42-7*b* from a second side of the aerosol carrier 14-7 is directed to a second side of the activation surface 38-7 of the fluid-transfer article 34-7 (e.g., via a gas communication pathway within the housing of the carrier). When the incoming air stream 42-7*a* from the first side of the aerosol carrier 14-7 reaches the first side of the activation surface 38-7, the incoming air stream 42-7*a* from the first side of the aerosol carrier 14-7 flows across the activation surface 38-7 via the one or more channels 40-7 formed between the activation surface 38-7 and the conduction element 36-7 (or between the activation surface 38-7 and heater 24-7). Likewise, when the incoming air stream 42-7*b* from the second side of the aerosol carrier 14-7 reaches the second side of the activation surface 38-7, the incoming air stream 42-7*b* from the second side of the aerosol carrier 14-7 flows across the activation surface 38-7 via the one or more channels 40-7 formed between the activation surface 38-7 and the conduction element 36-7 (or between the activation surface 38-7 and heater 24-7). The air streams from each side flowing through the one or more channels 40-7 are denoted by dashed lines 44*a*-7 and 44*b*-7 in FIG. 68. As air streams 44*a*-7 and 44*b*-7 flow through the one or more channels 40-7, aerosol precursor in the activation surface 38-7, across which the air streams 44*a*-7 and 44*b*-7 flow, is released from the activation surface 38-7 by heat conveyed to the activation surface from the heater 24-7. Aerosol precursor released from the activation surface 38-7 is entrained in air streams 44*a*-7 and 44*b*-7 flowing through the one or more channels 40-7.

In use, the heater 24-7 of the apparatus 12-7 conveys heat to the activation surface 38-7 of the fluid-transfer article 34-7 to raise a temperature of the activation surface 38-7 to a sufficient temperature to release, or liberate, captive substances (i.e., the aerosol precursor) held at the activation surface 38-7 of the fluid-transfer article 34-7 to form a vapor and/or aerosol, which is drawn downstream across the activation surface 38-7 of the fluid-transfer article 34-7.

As the air streams 44*a*-7 and 44*b*-7 continue their passages in the one or more channels 40-7, more released aerosol precursor is entrained within the air streams 44*a*-7 and 44*b*-7. When the air streams 44*a*-7 and 44*b*-7 entrained with aerosol precursor meet at a mouth of the outlet fluid communication pathway 48-7, they enter the outlet fluid communication pathway 48-7 and continue until they pass through filter element 52-7 and exit outlet fluid communication pathway 48-7, either as a single outgoing air stream, or as separate outgoing air streams 46-7 (as shown). The outgoing air streams 46-7 are directed to an outlet, from where it can be inhaled by the user directly (if the second end 18-7 of the aerosol capsule 14-7 is configured as a mouthpiece), or via a mouthpiece. The outgoing air streams 46-7 entrained with aerosol precursor are directed to the outlet (e.g., via a gas communication pathway within the housing of the carrier).

When the user initially draws on a mouthpiece of the apparatus (or one the second end 18-7 of the aerosol carrier 14-7, if configured as a mouthpiece), this will cause an air column located in the fluid communication pathway 48-7 to move towards the outlet. In turn, this will draw air into the fluid communication pathway from the one or more channels 40-7. This will cause a pressure drop in the channels 40-7. To equalize the pressure in the channels 40-7, air will be drawn into the aerosol carrier 14-7, and thus into the channels 40-7 via the inlet apertures 50-7. During the period of lower pressure in the one or more channels 40-7 when the user begins to draw, aerosol precursor in the fluid-transfer medium will be released into the channels from the activation surface 38-7, because the aerosol precursor is drawn into the one or more channels by way of the lower pressure. This effect is in addition to the effect of releasing the aerosol precursor from the activation surface 38-7 by way of heat conveyed from the heater. The drawing of the aerosol precursor from the activation surface 38-7 by way of the user sucking on the mouthpiece of the apparatus (or one the second end 18-7 of the aerosol carrier 14-7, if configured as a mouthpiece) may produce a dragging effect on the volumetric rate of flow experienced by the user during a suction action, i.e., the user may have to suck harder to achieve a same volumetric rate of flow. This effect may manifest itself as a similar physical sensation experienced by the user as those experienced from a traditional smoking or tobacco product.

Figure 71:
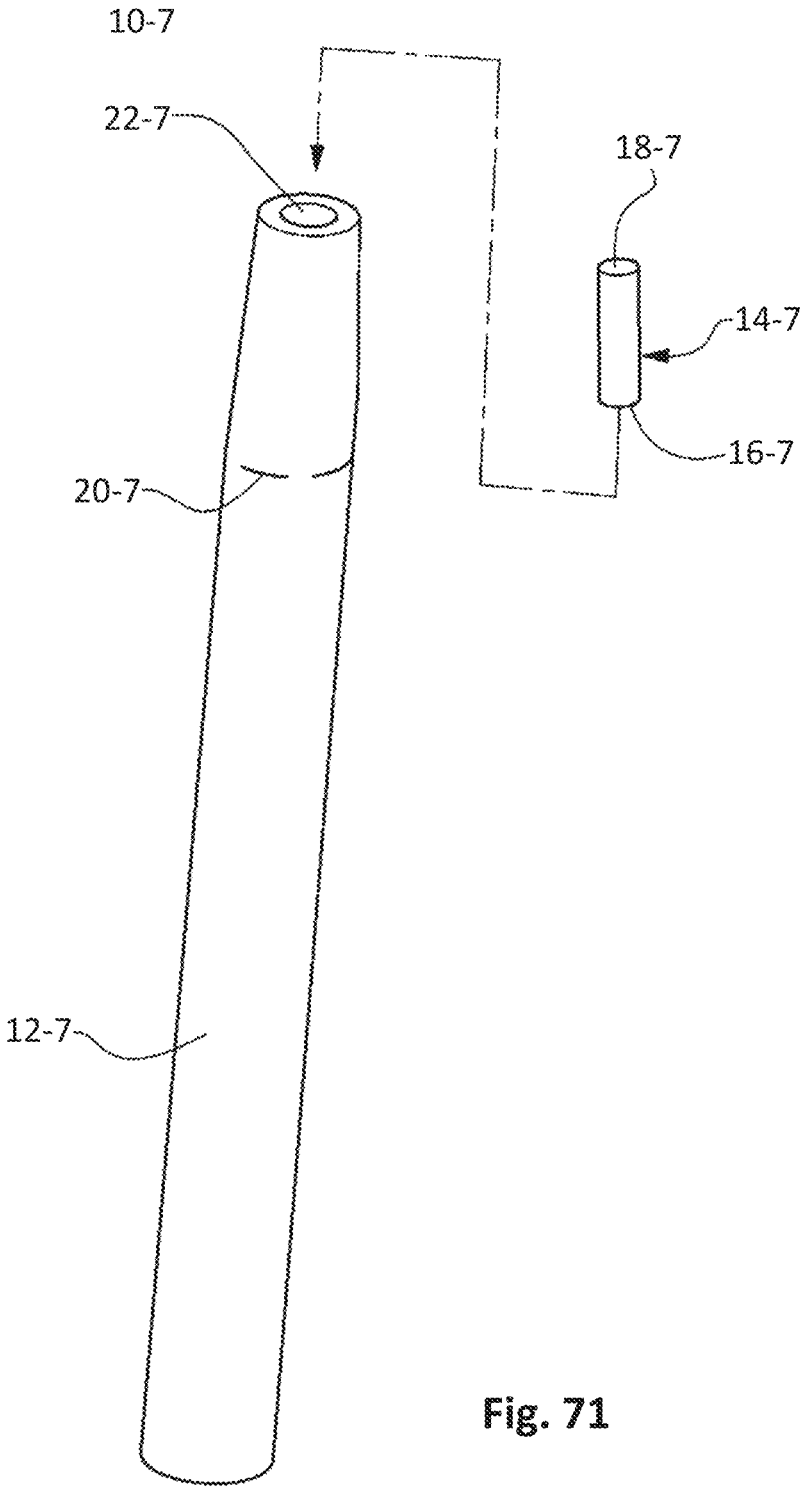
FIG. 71 is an exploded perspective view illustration of a kit-of-parts for assembling a system according to one or more embodiments of the seventh mode of the present disclosure.

FIG. 71 is an exploded perspective view illustration of a kit-of-parts for assembling an aerosol delivery system 10-7.

As will be appreciated, in the arrangements described above, the fluid-transfer article 34-7 is provided within a housing 32-7 of the aerosol carrier 14-7. In such arrangements, the housing of the carrier 14-7 serves to protect the aerosol precursor-containing fluid-transfer article 34-7, whilst also allowing the carrier 14-7 to be handled by a user without his/her fingers coming into contact with the aerosol precursor liquid retained therein. In such arrangements, it will be appreciated that the carrier 14-7 has a multi-part construction.

The second region 34*b*-7 of the fluid-transfer article may have a thickness of less than 5 mm. In other embodiments it may have a thickness of: less than 3.5 mm, less than 3 mm, less than 2.5 mm, less than 2 mm, less than 1.9 mm, less than 1.8 mm, less than 1.7 mm, less than 1.6 mm, less than 1.5 mm, less than 1.4 mm, less than 1.3 mm, less than 1.2 mm, less than 1.1 mm, less than 1 mm, less than 0.9 mm, less than 0.8 mm, less than 0.7 mm, less than 0.6 mm, less than 0.5 mm, less than 0.4 mm, less than 0.3 mm, less than 0.2 mm, or less than 0.1 mm.

There has been described in the foregoing one or more proposals for an aerosol delivery system, and parts thereof, that avoids or at least ameliorates problems of the prior art.

In one or more optional arrangements, a fluid-transfer article 34-7 containing nicotine and/or nicotine compounds may be substituted or supplemented with a fluid-transfer article configured to provide a flavored vapor and/or aerosol upon heating of the fluid-transfer article by the heater 24-7 of the apparatus 12-7. A precursor material for forming the flavored vapor and/or aerosol upon heating is held within pores, spaces, channels and/or conduits within the fluid-transfer article. The precursor material may be extracted from a tobacco plant starting material using a supercritical fluid extraction process. Optionally, the precursor material is nicotine-free and comprises tobacco-flavors extracted from the tobacco plant starting material. Further optionally, the extracted nicotine-free precursor material (e.g., flavors only) could have nicotine added thereto prior to loading of the precursor material into the substrate of the carrier unit. Further optionally, flavors and physiologically active material may be extracted from plants other than tobacco plants.

Eighth Mode: An Aerosol-Generation Apparatus has a Fluid-Transfer Article which Holds Aerosol Precursor and which Transfers that Aerosol Precursor to an Activation Surface Aspects and embodiments of the eighth mode of the present disclosure will now be discussed with reference to the accompanying figures. Further aspects and embodiments of the eighth mode will be apparent to those skilled in the art. All documents mentioned in this text are incorporated herein by reference.

In general outline, one or more embodiments of the eighth mode in accordance with the present disclosure may provide a system for aerosol delivery in which an aerosol carrier may be inserted into a receptacle (e.g., a "heating chamber") of an apparatus for initiating and maintaining release of an aerosol from the aerosol carrier.

Another end, or another end portion, of the aerosol carrier may protrude from the apparatus and can be inserted into the mouth of a user for the inhalation of aerosol released from the aerosol carrier cartridge during operation of the apparatus.

Hereinafter, and for convenience only, "system for aerosol delivery" shall be referred to as "aerosol delivery system".

Figure 72:
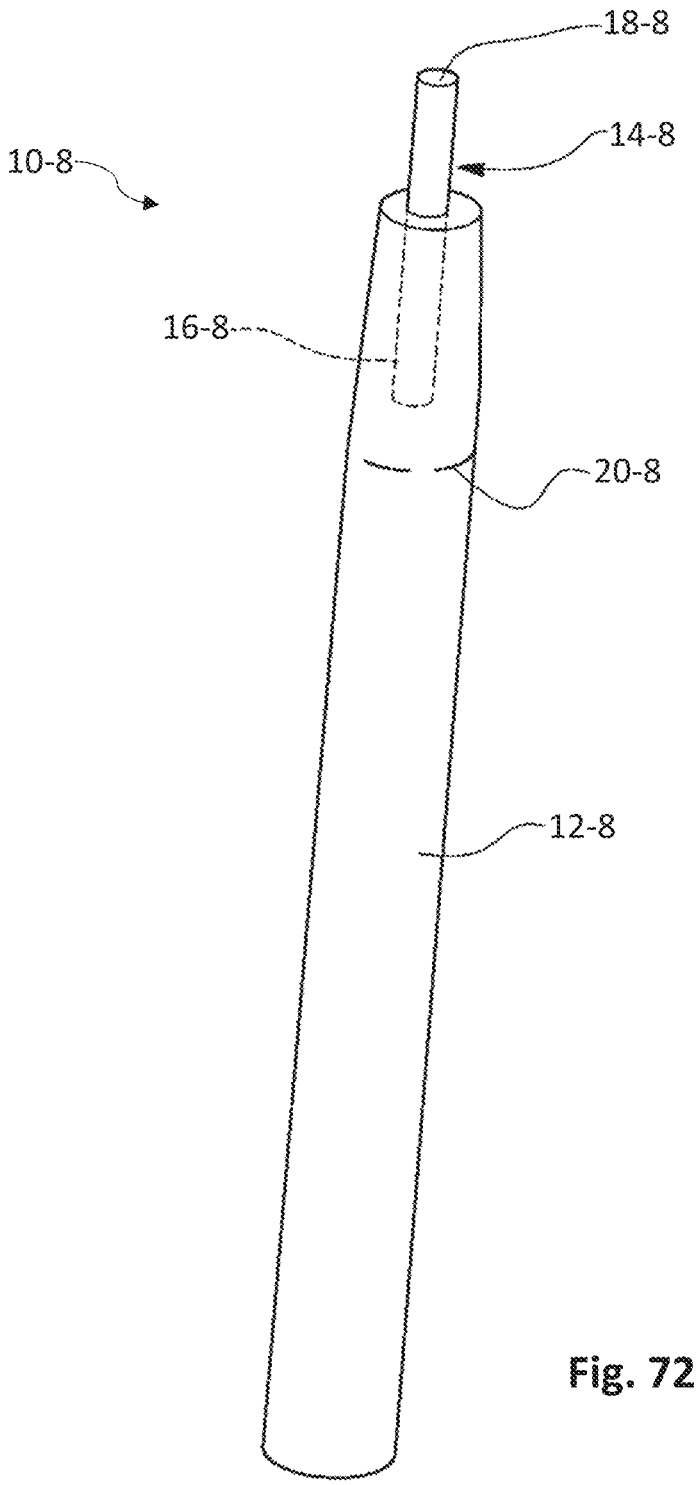
FIG. 72 is a perspective view illustration of a system for aerosol delivery according to one or more embodiments of the eighth mode of the present disclosure.

Referring now to FIG. 72, there is illustrated a perspective view of an aerosol delivery system 10-8 comprising an aerosol generation apparatus 12-8 operative to initiate and maintain release of aerosol from a fluid-transfer article in an aerosol carrier 14-8. In the arrangement of FIG. 72, the aerosol carrier 14-8 is shown with a first end 16-8 thereof and a portion of the length of the aerosol carrier 14-8 located within a receptacle of the apparatus 12-8. A remaining portion of the aerosol carrier 14-8 extends out of the receptacle. This remaining portion of the aerosol carrier 14-8, terminating at a second end 18-8 of the aerosol carrier, is configured for insertion into a user's mouth. A vapor and/or aerosol is produced when a heater (not shown in FIG. 72) of the apparatus 12-8 heats a fluid-transfer article in the aerosol carrier 14-8 to release a vapor and/or an aerosol, and this can be delivered to the user, when the user sucks or inhales, via a fluid passage in communication with an outlet of the aerosol carrier 14-8 from the fluid-transfer article to the second end 18-8.

The device 12-8 also comprises air-intake apertures 20-8 in the housing of the apparatus 12-8 to provide a passage for air to be drawn into the interior of the apparatus 12-8 (when the user sucks or inhales) for delivery to the first end 16-8 of the aerosol carrier 14-8, so that the air can be drawn across an activation surface of a fluid-transfer article located within a housing of the aerosol carrier cartridge 14-8 during use. Optionally, these apertures may be perforations in the housing of the apparatus 12-8.

A fluid-transfer article (not shown in FIG. 72, but described hereinafter with reference to FIGS. 76 to 78B is located within a housing of the aerosol carrier 14-8. The fluid-transfer article contains an aerosol precursor material, which may include at least one of: nicotine; a nicotine precursor material; a nicotine compound; and one or more flavorings. The fluid-transfer article is located within the housing of the aerosol carrier 14-8 to allow air drawn into the aerosol carrier 14-8 at, or proximal, the first end 16-8 to flow across an activation surface of the fluid-transfer article. As air passes across the activation surface of the fluid-transfer article, an aerosol may be entrained in the air stream from a substrate forming the fluid-transfer article, e.g., via diffusion from the substrate to the air stream and/or via vaporization of the aerosol precursor material and release from the fluid-transfer article under heating.

The substrate forming the fluid-transfer article 34-8 may at least partly comprise a porous material where pores of the porous material hold, contain, carry, or bear the aerosol precursor material. In particular, the porous material of the fluid-transfer article is a porous polymer material such as, for example, a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET). All such materials may be described as heat resistant polymeric wicking material in the context of the present disclosure.

The aerosol carrier 14-8 is removable from the apparatus 12-8 so that it may be disposed of when expired. After removal of a used aerosol carrier 14-8, a replacement aerosol carrier 14-8 can be inserted into the apparatus 12-8 to replace the used aerosol carrier 14-8.

Figure 73:
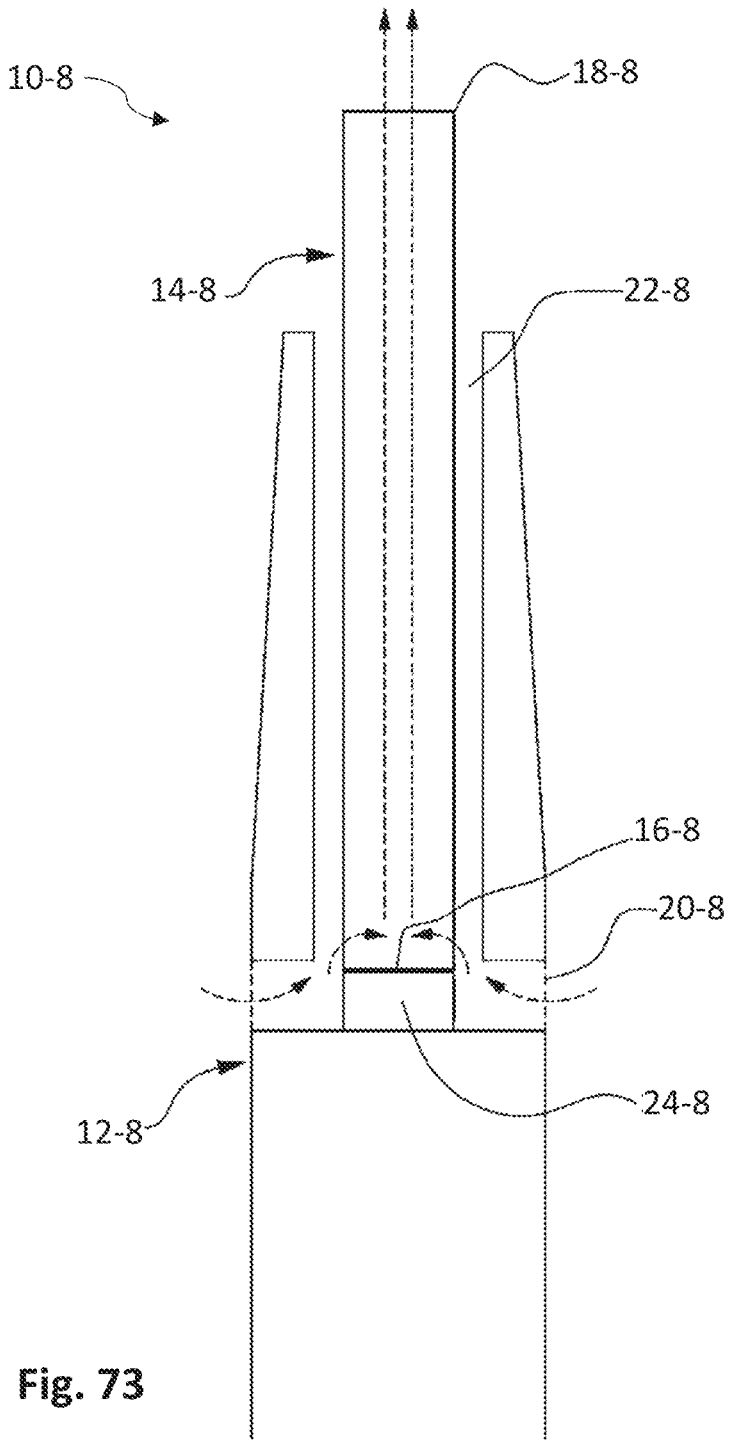
FIG. 73 is a cross-section side view illustration of part of an apparatus of the system for aerosol delivery of FIG. 72.

FIG. 73 is a cross-sectional side view illustration of a part of apparatus 12-8 of the aerosol delivery system 10-8. The apparatus 12-8 comprises a receptacle 22-8 in which is located a portion of the aerosol carrier 14-8. In one or more optional arrangements, the receptacle 22-8 may enclose the aerosol carrier 14-8. The apparatus 12-8 also comprises a heater 24-8, which opposes an activation surface of the fluid-transfer article (not shown in FIG. 73) of the aerosol carrier 14-8 when an aerosol carrier 14-8 is located within the receptacle 22-8.

Air flows into the apparatus 12-8 (in particular, into a closed end of the receptacle 22-8) via air-intake apertures 20-8. From the closed end of the receptacle 22-8, the air is drawn into the aerosol carrier 14-8 (under the action of the user inhaling or sucking on the second end 18-8) and expelled at the second end 18-8. As the air flows into the aerosol carrier 14-8, it passes across the activation surface of the fluid-transfer article. Heat from the heater 24-8, which acts on the activation surface of the fluid-transfer article, causes vaporization of aerosol precursor material at the activation surface of the fluid-transfer article and an aerosol is created in the air flowing over the activation surface. Thus, through the application of heat in the region of the activation surface of the fluid-transfer article, an aerosol is released, or liberated, from the fluid-transfer article, and is drawn from the material of the aerosol carrier unit by the air flowing across the activation surface and is transported in the air flow to via outlet conduits (not shown in FIG. 73) in the housing of the aerosol carrier 14-8 to the second end 18-8. The direction of air flow is illustrated by arrows in FIG. 73.

To achieve release of the captive aerosol from the fluid-transfer article, the fluid-transfer article of the aerosol carrier 14-8 is heated by the heater 24-8. As a user sucks or inhales on second end 18-8 of the aerosol carrier 14-8, the aerosol released from the fluid-transfer article and entrained in the air flowing across the activation surface of the fluid-transfer article is drawn through the outlet conduits (not shown) in the housing of the aerosol carrier 14-8 towards the second end 18-8 and onwards into the user's mouth.

Figure 74:
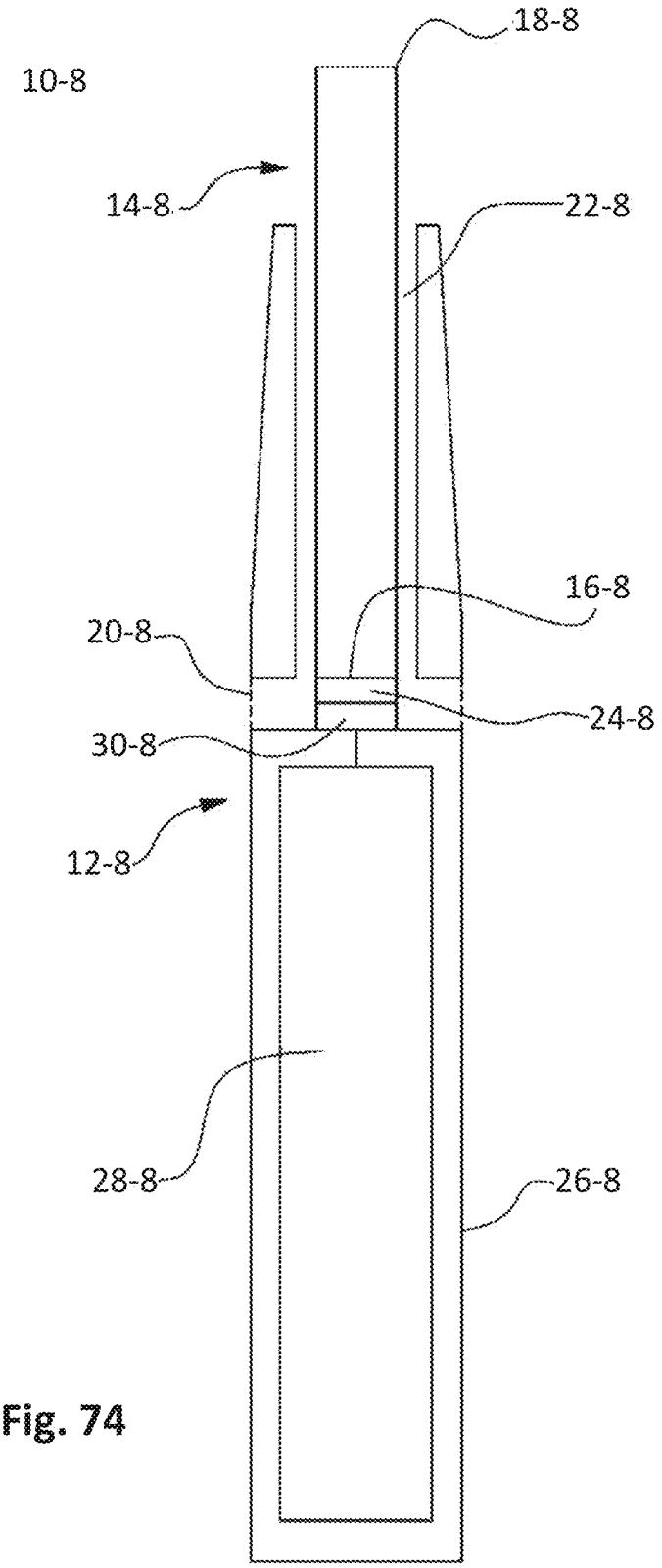
FIG. 74 is a cross-section side view illustration of the system and apparatus for aerosol delivery of FIG. 72.

Turning now to FIG. 74, a cross-sectional side view of the aerosol delivery system 10-8 is schematically illustrated showing the features described above in relation to FIGS. 72 and 73 in more detail. As can be seen, apparatus 12-8 comprises a housing 26-8, in which are located the receptacle 22-8 and heater 24-8. The housing 26-8 also contains control circuitry (not shown) operative by a user, or upon detection of air and/or vapor being drawn into the device 12-8 through air-intake apertures 20-8, i.e., when the user sucks or inhales. Additionally, the housing 26-8 comprises an electrical energy supply 28-8, for example a battery. Optionally, the battery comprises a rechargeable lithium-ion battery. The housing 26-8 also comprises a coupling 30-8 for electrically (and optionally mechanically) coupling the electrical energy supply 28-8 to control circuitry (not shown) for powering and controlling operation of the heater 24-8.

Responsive to activation of the control circuitry of apparatus 12-8, the heater 24-8 heats the fluid-transfer article (not shown in FIG. 74) of aerosol carrier 14-8. This heating process initiates (and, through continued operation, maintains) release of vapor and/or an aerosol from the activation surface of the fluid-transfer article. The vapor and/or aerosol formed as a result of the heating process is entrained into a stream of air (as the user sucks or inhales). The stream of air with the entrained vapor and/or aerosol passes through the aerosol carrier 14-8 via outlet conduits (not shown) and exits the aerosol carrier 14-8 at second end 18-8 for delivery to the user. This process is briefly described above in relation to FIG. 73, where arrows schematically denote the flow of the air stream into the device 12-8 and through the aerosol carrier 14-8, and the flow of the air stream with the entrained vapor and/or aerosol through the aerosol carrier cartridge 14-8.

Figure 75:
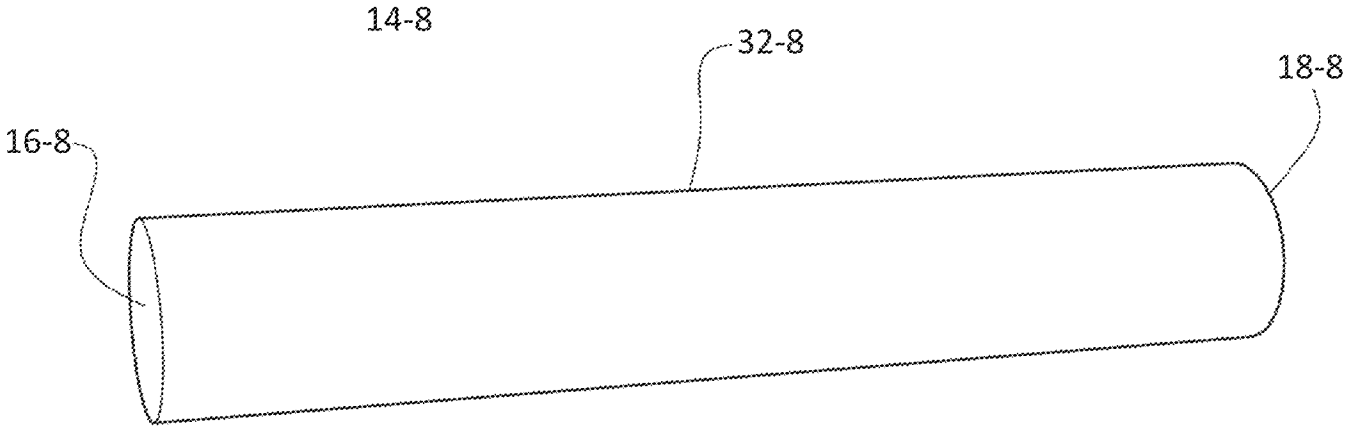
FIG. 75 is a perspective view illustration of an aerosol carrier for use in the system for aerosol delivery according to one or more embodiments of the eighth mode of the present disclosure.
Figure 76:
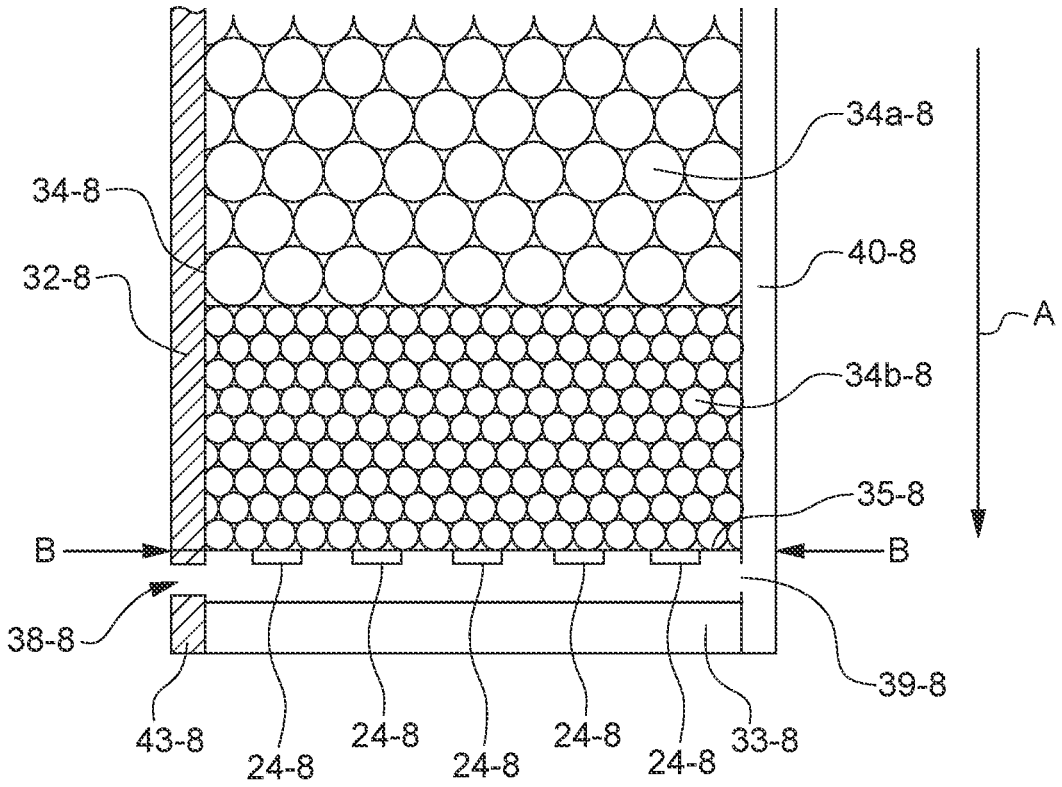
FIG. 76 is a cross-section side view of elements of an aerosol carrier and a part of an apparatus of the system for aerosol delivery according to one or more embodiments of the eighth mode of the present disclosure.
Figure 77:
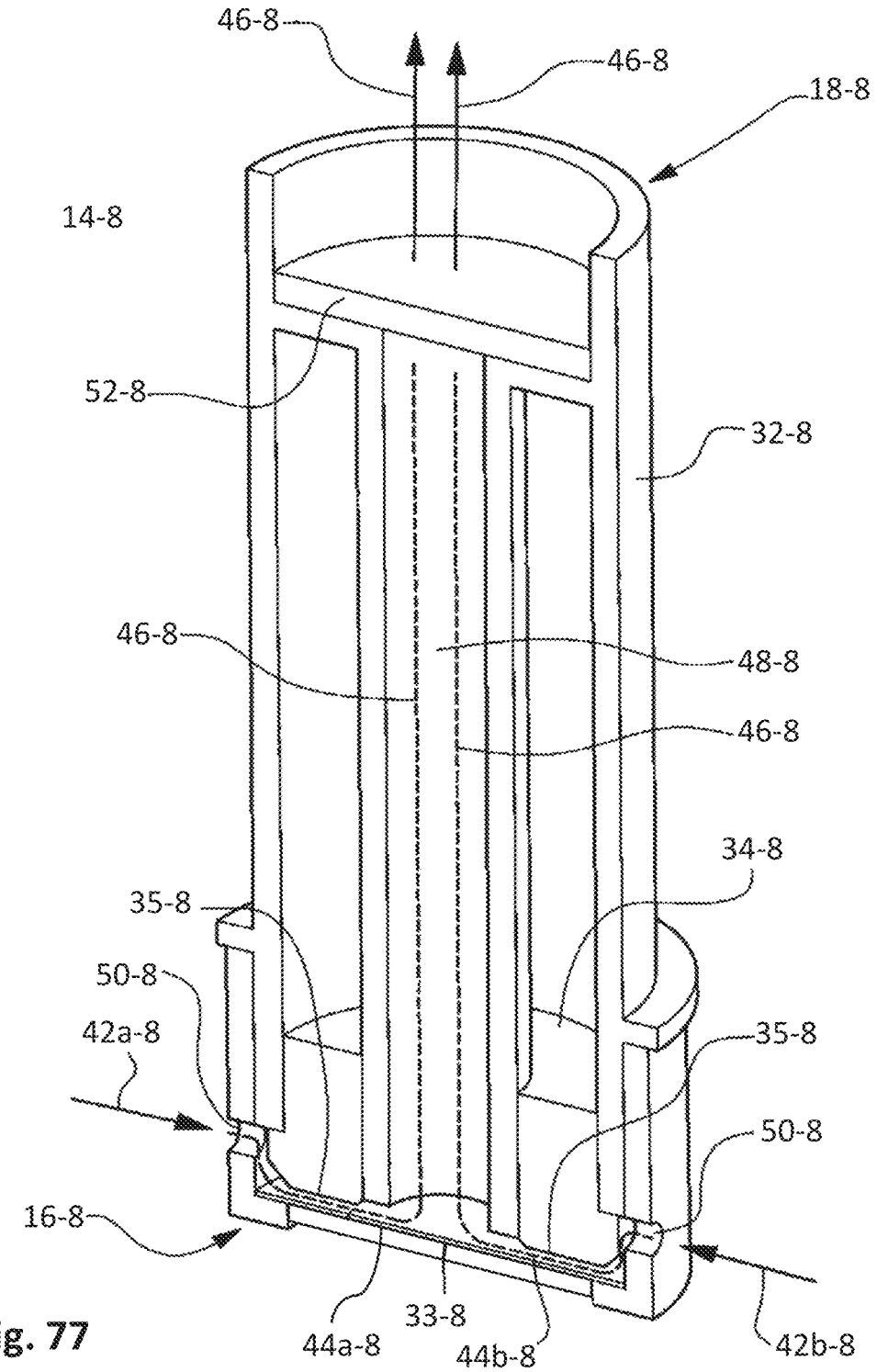
FIG. 77 is a cross-section side view of aerosol carrier according to one or more embodiments of the eighth mode of the present disclosure.

FIGS. 75 to 77 schematically illustrate the aerosol carrier 14-8 in more detail (and, in FIG. 76, features within the receptacle in more detail). FIG. 75 illustrates an exterior of the aerosol carrier 14-8, and FIG. 76 illustrates internal components of the aerosol carrier 14-8 in one optional configuration.

FIG. 75 illustrates the exterior of the aerosol carrier 14-8, which comprises housing 32-8 for housing said fluid-transfer article (not shown) and at least one other internal component. The particular housing 32-8 illustrated in FIG. 75 comprises a tubular member, which may be generally cylindrical in form, and which is configured to be received within the receptacle of the apparatus. First end 16-8 of the aerosol carrier 14-8 is for location to oppose the heater of the apparatus, and second end 18-8 (and the region adjacent the second end 18-8) is configured for insertion into a user's mouth.

FIG. 76 illustrates some internal components of the aerosol carrier 14-8 and of the heater 24-8 of apparatus 12-8, in in one embodiment of the disclosure.

As described above, the aerosol carrier 14-8 comprises a fluid-transfer article 34-8. In one or more arrangements, the aerosol carrier 14-8 is located within the receptacle of the apparatus such that the activation surface of the fluid-transfer article is in contact with the heater 24-8 of the apparatus and receives heat directly from the heater 24-8 of the apparatus.

Further components not shown in FIG. 76 comprise: an inlet conduit, via which air can be drawn into the aerosol carrier 14-8; an outlet conduit, via which an air stream entrained with aerosol can be drawn from the aerosol carrier 14-8; a filter element; and a reservoir for storing aerosol precursor material and for providing the aerosol precursor material to the fluid-transfer article 34-8.

In FIG. 76, the aerosol carrier is shown as comprising the fluid-transfer article 34-8 located within housing 32-8. The fluid transfer article 34-8 comprises a first region **34*a*-8 holding an aerosol precursor. In one or more arrangements, the first region of 34*a* of the fluid transfer article 34-8 comprises a reservoir for holding the aerosol precursor. The first region 34*a*-8 can be the sole reservoir of the aerosol carrier 14-8, or it can be arranged in fluid communication with a separate reservoir, where aerosol precursor is stored for supply to the first region 34*a*-8. As shown in FIG. 76, the material forming the first region of 34*a* comprises a porous structure, whose pore diameter size varies between one end of the first region 34*a*-8 and another end of the first region 34*a*-8. The pore diameter size decreases from a first end remote from heater 24-8 (the upper end is as shown in the figure) to a second end. The pore diameter size may change in a step-wise manner (i.e., a first part with pores having a diameter of first size, and a second part with pores having a diameter of second, smaller size), or the change in pore size in the first region 34*a*-8 may be gradual rather than step-wise. This configuration of pores having a decreasing diameter size can provide a wicking effect, which can serve to draw fluid through the first region 34*a*-8, towards heater 24-8**.

Alternatively, the first region **34*a*-8** may be a simple liquid reservoir, void except when filled with liquid, and the porous material is not used.

The fluid transfer article 34-8 also comprises a second region **34*b*-8. Aerosol precursor is drawn from the first region of 34*a* through the second region 34*b*-8 by the wicking effect of the material forming the second region 34*b*-8. Thus, the second region 34*b*-8 is configured to transfer the aerosol precursor to an activation surface 35-8 of the article 34-8**.

The second region **34*b*-8 itself may comprise a porous structure formed by a porous polymer material. It is then preferable that the pore diameter size of the porous structure of the second region 34*b*-8 is smaller than the pore diameter size of the immediately adjacent part of the first region 34*a*-8**. As mentioned above, the porous polymer material may be a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET).

Other materials may be used to form the second region **34*b*-8**. For example, it may be formed of fibrous material such as glass or ceramic fiber material, or from sintered glass, ceramic or carbon, or from carbon or glass foam.

In FIG. 76, the second region **34*b*-8 terminates in the activation surface 35-8 which is in abutting unbonded contact with the heater 24-8. In FIG. 76, the heater 24-8 comprises a plurality of heater elements, with gaps forming spacing between the heater elements. When the heater 24-8 is activated, aerosol precursor at the activation surface 35-8** is released as vapor and/or a mixture of vapor and aerosol, which may then pass through the gaps in the heater.

FIG. 76 also illustrates an opening 38-8 in a housing 43-8, which opening 38-8 is in communication with the air-intake apertures 20-8. A further opening 39-8 communicates with a duct 40-8 within the housing 32-8, which duct 40-8 communicates with the second end 18-8. The housing 43-8 supports the heater 24-8. The housing 43-8 may be integral with the housing 26-8 containing the electrical energy supply 28-8.

There is thus a fluid-flow path for air (hereinafter referred to as an air-flow pathway) between openings 38-8 and 39-8, linking the apertures 20-8 and the second end 18-8 of the aerosol carrier. When the user sucks or inhales, air is drawn along the air-flow pathway, along the activation surface 35-8 of the second region **34*b*-8**.

One or more droplets of the aerosol precursor will form at the activation surface 35-8 and be heated, to release vapor or a mixture of aerosol and vapor from the activation surface 35-8, and through the gaps in the heater 24-8, into the air flowing in the air-flow pathway between the openings 38-8, 39-8. The vapor or mixture passes, as the user sucks and inhales, to the second end 18-8.

As mentioned above, the heater 24-8 is not bonded to the activation surface 35-8, but is separable therefrom. When in the position shown in FIG. 76, the activation surface makes contact with the heater 24-8, to be directly heated. To assist in this, the activation surface 35-8 is preferably planar. However, the housing 32-8 containing the fluid-transfer article 34-8 is separable from the housing 43-8 which supports the heater 24-8, along the line B-B in FIG. 76. This allows the carrier 14-8 including the housing 32-8 and the fluid-transfer article 34-8 to be removed from the rest of the apparatus, without removing the heater 24-8.

FIG. 76 also illustrates a plate 33-8 of housing 43-8, which plate 33-8 is spaced from the activation surface 35-8 and forms a boundary of the air-flow pathway along the activation surface 35-8.

In the illustrative examples of FIG. 76, the first region **34*a*-8 of the fluid-transfer article 34-8 is located at an "upstream" end of the fluid-transfer article 34-8 and the second region 34*b*-8 is located at a downstream" end of the fluid-transfer article 34-8. That is, aerosol precursor is wicked, or is drawn, from the "upstream" end of the fluid-transfer article 34-8 to the "downstream" end of the fluid-transfer article 34-8 (as denoted by arrow A in FIG. 76**).

When the heater 24-8 is active, heated aerosol precursor in the form of vapor and/or vapor/aerosol mixture must pass into the air-flow pathway between the openings 38-8 and 39-8. It must therefore pass through the heater 24-8, which is why there need to be gaps in the heater 24-8 as mentioned previously. The relative proportion of the activation surface 35-8 covered by elements of the heater 24-8 compared with the area open to the air-flow pathway due to the gaps in the heater, will represent a balance between the heating effect needed to vaporize the aerosol precursor, and the movement of that vapor into the air-flow pathway. The heater 24-8 may thus be a mesh heater, with the spaces in the mesh forming the gaps referred to previously. Alternatively, the heater may be a foil heater, provided that the foil does not cover all of the activation surface 35-8. Other heating configurations may be possible.

Figure 78A:
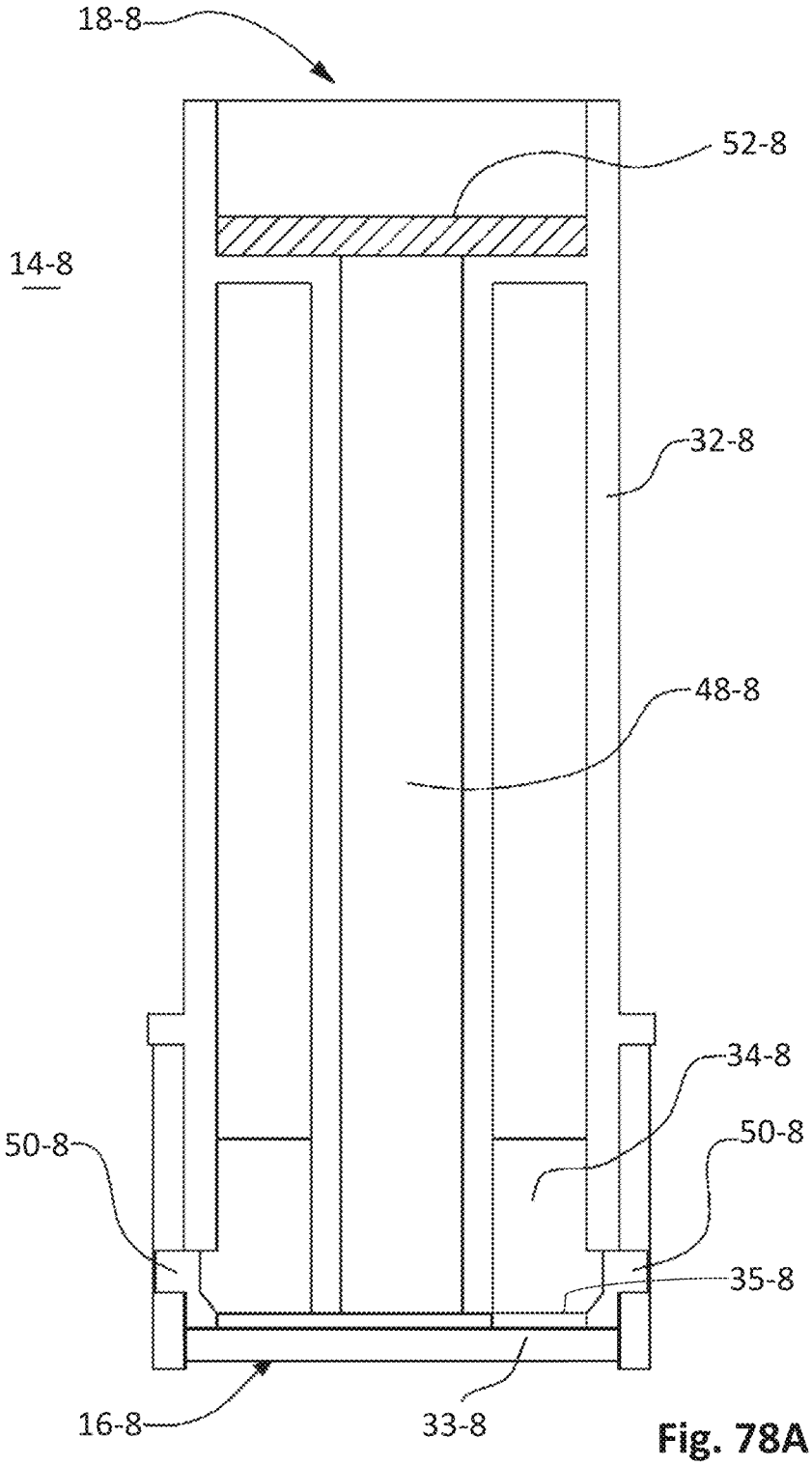
FIG. 78A is a perspective cross-section side view of the aerosol carrier of FIG. 78.
Figure 78B:
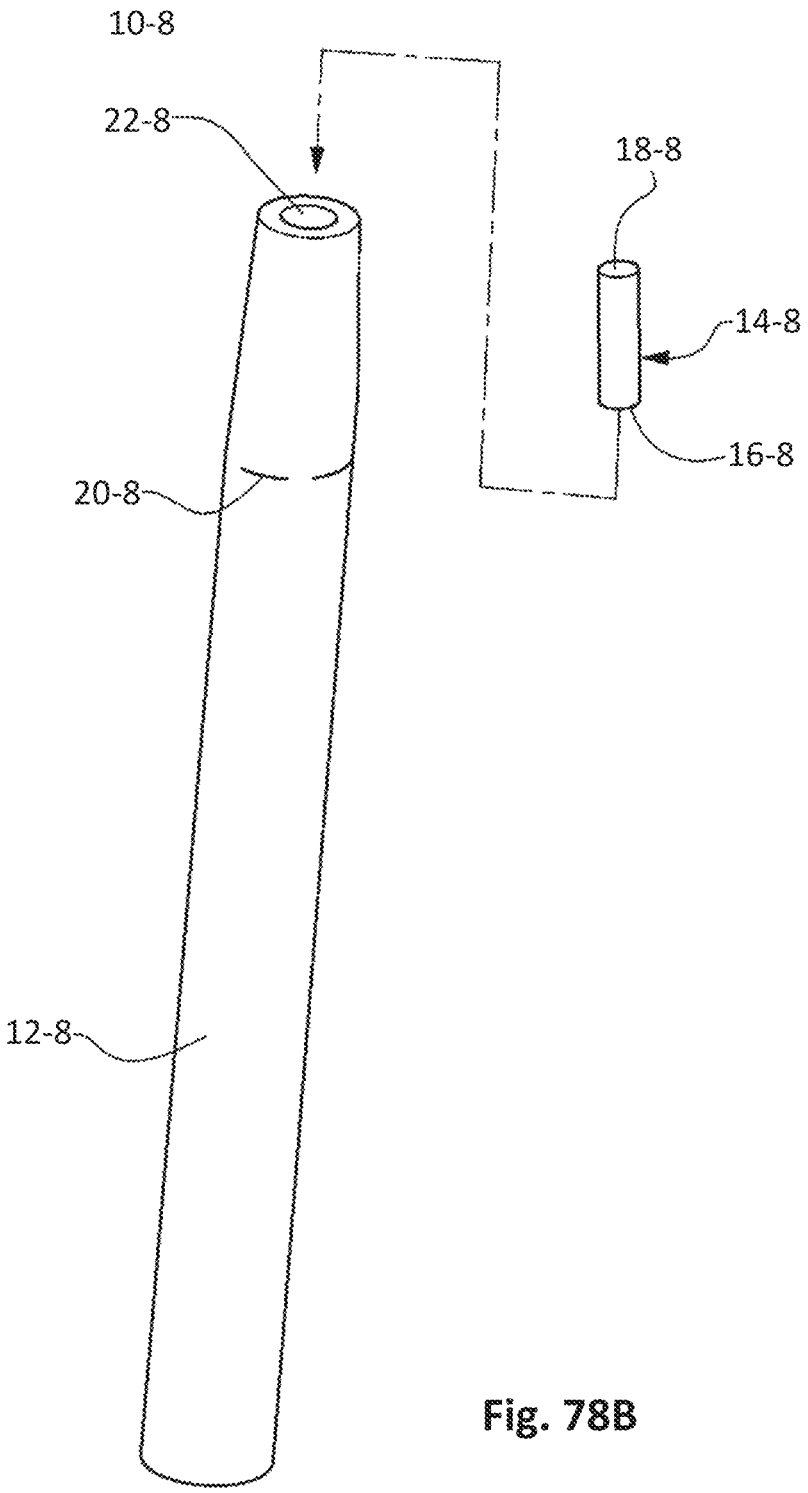
FIG. 78B is an exploded perspective view illustration of a kit-of-parts for assembling the system according to one or more embodiments of the eighth mode of the present disclosure.

In the arrangement shown in FIG. 76, the apertures 38-8, 39-8 are on opposite sides of the housing 32-8. FIGS. 77 and 78 show an alternative configuration, in which the fluid-transfer article is annular, and the second part **34*b*-8 is then in the form of annular diaphragm. In FIGS. 77 and 78, the arrangement of the fluid-transfer article 34-8 and heater 24-8 may be generally the same as in FIG. 76, albeit with an annular construction. The heater 24-8 is not illustrated in FIGS. 77 and 78A, to enable the air flow and the apparatus to be illustrated clearly. The parts which are similar to those in FIG. 76 are indicated by the same reference numerals. Thus, FIGS. 77, 78A and 78B illustrate an aerosol carrier 14-8** according to one or more possible arrangements in more detail.

As can be seen from FIGS. 77 and 78, the aerosol carrier 14-8 is generally tubular in form. The aerosol carrier 14-8 comprises housing 32-8, which defines the external walls of the aerosol carrier 14-8 and which defines therein a chamber in which are disposed the fluid-transfer article 34-8 (adjacent the first end 16-8 of the aerosol carrier 14-8) and internal walls defining the fluid communication pathway 48-8. Fluid communication pathway 48-8 defines a fluid pathway for an outgoing air stream from the channels 40-8 to the second end 18-8 of the aerosol carrier 14-8. In the examples illustrated in FIGS. 77 and 78A, the fluid-transfer article 34-8 is an annular shaped element located around the fluid communication pathway 48-8.

In walls of the housing 43-8 supporting the heater 24-8, there are provided inlet apertures 50-8 to provide a fluid communication pathway for an incoming air stream to reach the fluid-transfer article 34-8, and in particular the air-flow pathway defined between the activation surface of the fluid-transfer article 34-8 and the plate 33-8.

In the illustrated example of FIGS. 77 and 78A, the aerosol carrier 14-8 further comprises a filter element 52-8. The filter element 52-8 is located across the fluid communication pathway 48-8 such that an outgoing air stream passing through the fluid communication pathway 48-8 passes through the filter element 52-8.

With reference to FIG. 77, when a user sucks on a mouthpiece of the apparatus (or on the second end 18-8 of the aerosol carrier 14-8, if configured as a mouthpiece), air is drawn into the carrier through inlet apertures 50-8 extending through walls in the housing 43-8.

An incoming airstream **42*a*-8 from a first side of the aerosol carrier 14-8 is directed to a first side of the second part 34*b*-8 of the fluid-transfer article 34-8 (e.g., via a gas communication pathway within the housing of the carrier). An incoming air stream 42*b*-8 from a second side of the aerosol carrier 14-8 is directed to a second side of the second part 34*a*-8 of the fluid-transfer article 34-8 (e.g., via a gas communication pathway within the housing of the carrier). When the incoming air stream 42*a*-8 from the first side of the aerosol carrier 14-8 reaches the first side of the second part 34*b*-8, the incoming air stream 42*a*-8 from the first side of the aerosol carrier 14-8 flows between the second part 34*b*-8 and the plate 33-8. Likewise, when the incoming air stream 42*b*-8 from the second side of the aerosol carrier 14-8 reaches the second side of the second part 34*a*-8, the incoming air stream 42*b*-8 from the second side of the aerosol carrier 14-8 flows between the second part 34*a*-8 and the plate 33-8. The air streams from each side are denoted by dashed lines 44*a*-8 and 44*b*-8 in FIG. 79 As these air streams 44*a*-8 and 44*b*-8 flow, aerosol precursor on the activation surface 35-8 is entrained in air streams 44*a*-8 and 44*b*-8**.

In use, the heater 24-8 of the apparatus is operable to raise a temperature of the activation surface 35-8 to a sufficient temperature to release, or liberate, captive substances (i.e., the aerosol precursor) to form a vapor and/or aerosol, which is drawn downstream. As the air streams **44*a*-8 and 44*b*-8 continue their passages, more released aerosol precursor is entrained within the air streams 44*a*-8 and 44*b*-8. When the air streams 44*a*-8 and 44*b*-8 entrained with aerosol precursor meet at a mouth of the outlet fluid communication pathway 48-8, they enter the outlet fluid communication pathway 48-8 and continue until they pass through filter element 52-8 and exit outlet fluid communication pathway 48-8, either as a single outgoing air stream, or as separate outgoing air streams 46-8 (as shown). The outgoing air streams 46-8 are directed to an outlet, from where it can be inhaled by the user directly (if the second end 18-8 of the aerosol capsule 14-8 is configured as a mouthpiece), or via a mouthpiece. The outgoing air streams 46-8** entrained with aerosol precursor are directed to the outlet (e.g., via a gas communication pathway within the housing of the carrier).

In any of the embodiments described above the second part **34*b*-8** may have a thickness of less than 5 mm. In other embodiments it may have a thickness of: less than 3.5 mm, less than 3 mm, less than 2.5 mm, less than 2 mm, less than 1.9 mm, less than 1.8 mm, less than 1.7 mm, less than 1.6 mm, less than 1.5 mm, less than 1.4 mm, less than 1.3 mm, less than 1.2 mm, less than 1.1 mm, less than 1 mm, less than 0.9 mm, less than 0.8 mm, less than 0.7 mm, less than 0.6 mm, less than 0.5 mm, less than 0.4 mm, less than 0.3 mm, less than 0.2 mm, or less than 0.1 mm.

Figure 79:
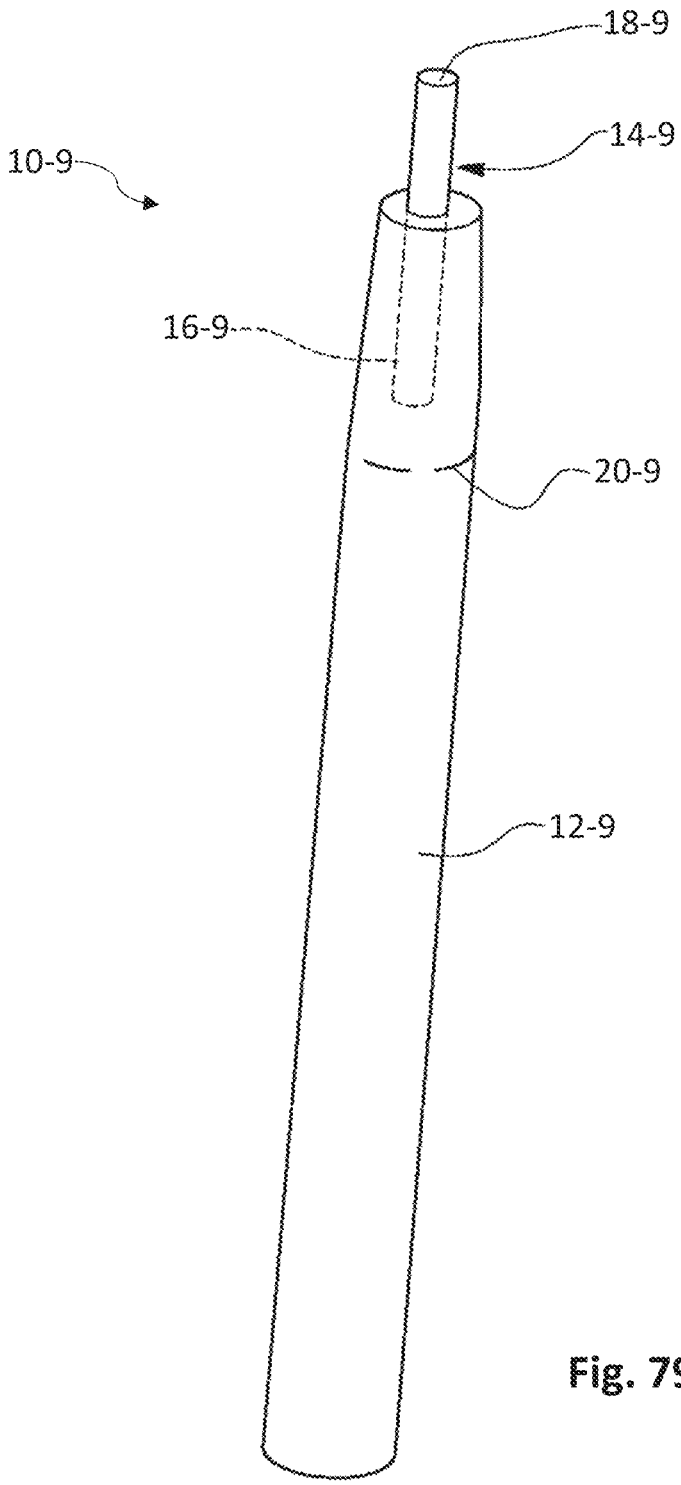
FIG. 79 is a perspective view illustration of a system for aerosol delivery according to one or more embodiments of the ninth mode of the present disclosure.

FIG. 79 is an exploded perspective view illustration of a kit-of-parts for assembling an aerosol delivery system 10-8.

As will be appreciated, in the arrangements of the eighth mode described above, the fluid-transfer article 34-8 is provided within a housing 32-8 of the aerosol carrier 14-8. In such arrangements, the housing of the carrier 14-8 serves to protect the aerosol precursor-containing fluid-transfer article 34-8, whilst also allowing the carrier 14-8 to be handled by a user without his/her fingers coming into contact with the aerosol precursor liquid retained therein.

Ninth Mode: An Aerosol Generation Apparatus has a Fluid-Transfer Article with a First Region which Holds an Aerosol Precursor Aspects and embodiments of the ninth mode of the present disclosure will now be discussed with reference to the accompanying figures. Further aspects and embodiments of the ninth mode will be apparent to those skilled in the art. All documents mentioned in this text are incorporated herein by reference.

In general outline, one or more embodiments of the ninth mode in accordance with the present disclosure may provide a system for aerosol delivery in which an aerosol carrier may be inserted into a receptacle (e.g., a "heating chamber") of an apparatus for initiating and maintaining release of an aerosol from the aerosol carrier. Another end, or another end portion, of the aerosol carrier may protrude from the apparatus and can be inserted into the mouth of a user for the inhalation of aerosol released from the aerosol carrier cartridge during operation of the apparatus.

Hereinafter, and for convenience only, "system for aerosol delivery" shall be referred to as "aerosol delivery system".

Referring now to FIG. 79, there is illustrated a perspective view of an aerosol delivery system 10-9 comprising an aerosol generation apparatus 12-9 operative to initiate and maintain release of aerosol from a fluid-transfer article in an aerosol carrier 14-9. In the arrangement of FIG. 79, the aerosol carrier 14-9 is shown with a first end 16-9 thereof and a portion of the length of the aerosol carrier 14-9 located within a receptacle of the apparatus 12-9. A remaining portion of the aerosol carrier 14-9 extends out of the receptacle. This remaining portion of the aerosol carrier 14-9, terminating at a second end 18-9 of the aerosol carrier, is configured for insertion into a user's mouth. A vapor and/or aerosol is produced when a heater (not shown in FIG. 79) of the apparatus 12-9 heats a fluid-transfer article in the aerosol carrier 14-9 to release a vapor and/or an aerosol, and this can be delivered to the user, when the user sucks or inhales, via a fluid passage in communication with an outlet of the aerosol carrier 14-9 from the fluid-transfer article to the second end 18-9.

The device 12-9 also comprises air-intake apertures 20-9 in the housing of the apparatus 12-9 to provide a passage for air to be drawn into the interior of the apparatus 12-9 (when the user sucks or inhales) for delivery to the first end 16-9 of the aerosol carrier 14-9, so that the air can be drawn across an activation surface of a fluid-transfer article located within a housing of the aerosol carrier cartridge 14-9 during use. Optionally, these apertures may be perforations in the housing of the apparatus 12-9.

A fluid-transfer article 34-9 (not shown in FIG. 79, but described hereinafter with reference to FIGS. 83 to 86 is located within a housing of the aerosol carrier 14-9. The fluid-transfer article 34-9 contains an aerosol precursor material, which may include at least one of: nicotine; a nicotine precursor material; a nicotine compound; and one or more flavorings. The fluid-transfer article 34-9 is located within the housing of the aerosol carrier 14-9 to allow air drawn into the aerosol carrier 14-9 at, or proximal, the first end 16-9, and has first and second regions, as will be described.

The first region of the fluid-transfer article 34-9 may comprise a substrate of porous material where pores of the porous material hold, contain, carry, or bear the aerosol precursor material. In particular, the porous material of the fluid-transfer article may be a porous polymer material such as, for example, a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET). All such materials may be described as heat resistant polymeric wicking material in the context of the present disclosure.

Alternatively, in some embodiments it is envisaged that the first region of the fluid-transfer article 34-9 may take the form of a simple tank having a cavity defining a hollow reservoir to hold the aerosol precursor.

The aerosol carrier 14-9 is removable from the apparatus 12-9 so that it may be disposed of when expired. After removal of a used aerosol carrier 14-9, a replacement aerosol carrier 14-9 can be inserted into the apparatus 12-9 to replace the used aerosol carrier 14-9.

Figure 80:
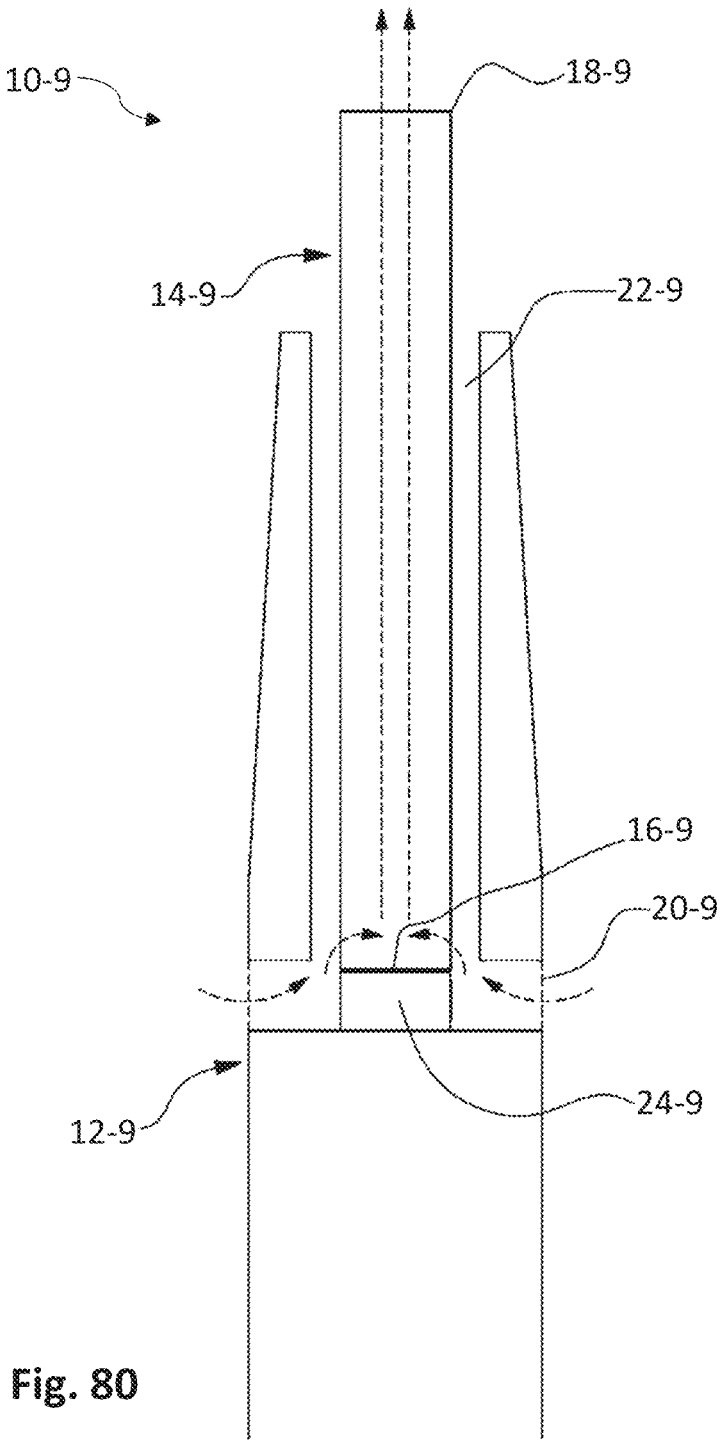
FIG. 80 is a cross-section side view illustration of part of an apparatus of the system for aerosol delivery of FIG. 79.

FIG. 80 is a cross-sectional side view illustration of a part of apparatus 12-9 of the aerosol delivery system 10-9. The apparatus 12-9 comprises a receptacle 22-9 in which is located a portion of the aerosol carrier 14-9. In one or more optional arrangements, the receptacle 22-9 may enclose the aerosol carrier 14-9. The apparatus 12-9 also comprises a heater 24-9, which is in contact with an activation surface of the fluid-transfer article 34-9 when an aerosol carrier 14-9 is located within the receptacle 22-9. Optional configurations of the heater 24-9 will be discussed later.

Air flows into the apparatus 12-9 (in particular, into a closed end of the receptacle 22-9) via air-intake apertures 20-9. From the closed end of the receptacle 22-9, the air is drawn into the aerosol carrier 14-9 (under the action of the user inhaling or sucking on the second end 18-9) and expelled at the second end 18-9. As the air flows into the aerosol carrier 14-9, it passes across the activation surface. Heat from the heater 24-9, which is in contact with the activation surface of the fluid-transfer article 34-9, causes vaporization of aerosol precursor material at the activation surface of the fluid-transfer article 34-9 and an aerosol is created in the air flowing over the activation surface. Thus, through the application of heat to the activation surface, an aerosol is released, or liberated, from the fluid-transfer article, and is drawn from the material of the aerosol carrier unit by the air flowing across the activation surface and is transported in the air flow to via outlet conduits (not shown in FIG. 80) in the housing of the aerosol carrier 14-9 to the second end 18-9. The direction of airflow is illustrated by arrows in FIG. 80.

To achieve release of the captive aerosol from the fluid-transfer article, the activation surface of the fluid-transfer article 34-9 is heated by the heater 24-9. As a user sucks or inhales on second end 18-9 of the aerosol carrier 14-9, the aerosol released from the fluid-transfer article and entrained in the air flowing across the activation surface is drawn through the outlet conduits (not shown) in the housing of the aerosol carrier 14-9 towards the second end 18-9 and onwards into the user's mouth.

Figure 81:
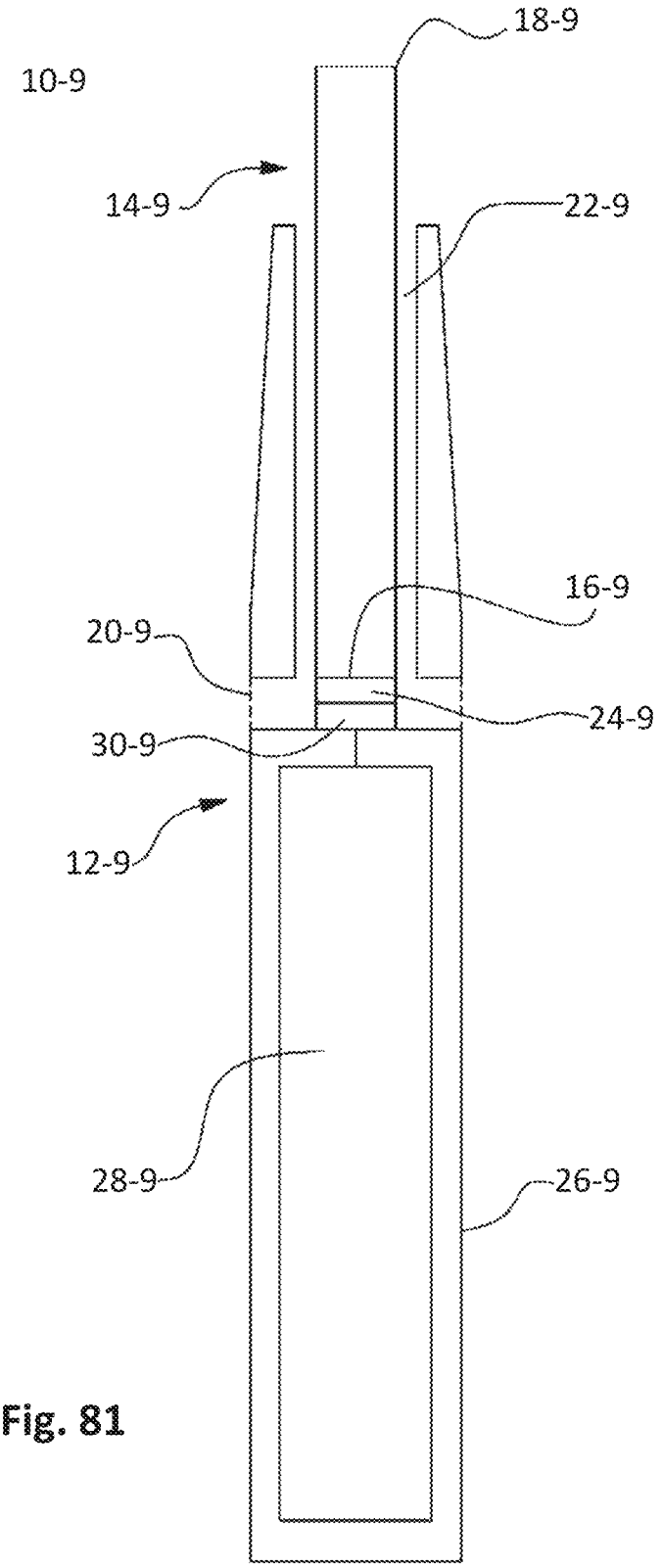
FIG. 81 is a cross-section side view illustration of the system and apparatus for aerosol delivery of FIG. 79.

Turning now to FIG. 81, a cross-sectional side view of the aerosol delivery system 10-9 is schematically illustrated showing the features described above in relation to FIGS. 79 and 80 in more detail. As can be seen, apparatus 12-9 comprises a housing 26-9, in which is located the receptacle 22-9. The housing 26-9 also contains control circuitry (not shown) operative by a user, or upon detection of air and/or vapor being drawn into the device 12-9 through air-intake apertures 20-9, i.e., when the user sucks or inhales. Additionally, the housing 26-9 comprises an electrical energy supply 28-9, for example a battery. Optionally, the battery comprises a rechargeable lithium-ion battery. The housing 26-9 also comprises a coupling 30-9 for electrically (and optionally mechanically) coupling the electrical energy supply 28-9 to control circuitry (not shown) for powering and controlling operation of the heater 24-9.

Responsive to activation of the control circuitry of apparatus 12-9, the heater 24-9 heats the activation surface of the fluid-transfer article 34-9 (not shown in FIG. 81). This heating process initiates (and, through continued operation, maintains) release of vapor and/or an aerosol from the activation surface of the fluid-transfer article 34-9. The vapor and/or aerosol formed as a result of the heating process is entrained into a stream of air being drawn across the activation surface of the fluid-transfer article 34-9 (as the user sucks or inhales). The stream of air with the entrained vapor and/or aerosol passes through the aerosol carrier 14-9 via outlet conduits (not shown) and exits the aerosol carrier 14-9 at second end 18-9 for delivery to the user. This process is briefly described above in relation to FIG. 80, where arrows schematically denote the flow of the air stream into the device 12-9 and through the aerosol carrier 14-9, and the flow of the air stream with the entrained vapor and/or aerosol through the aerosol carrier cartridge 14-9.

Figure 82:
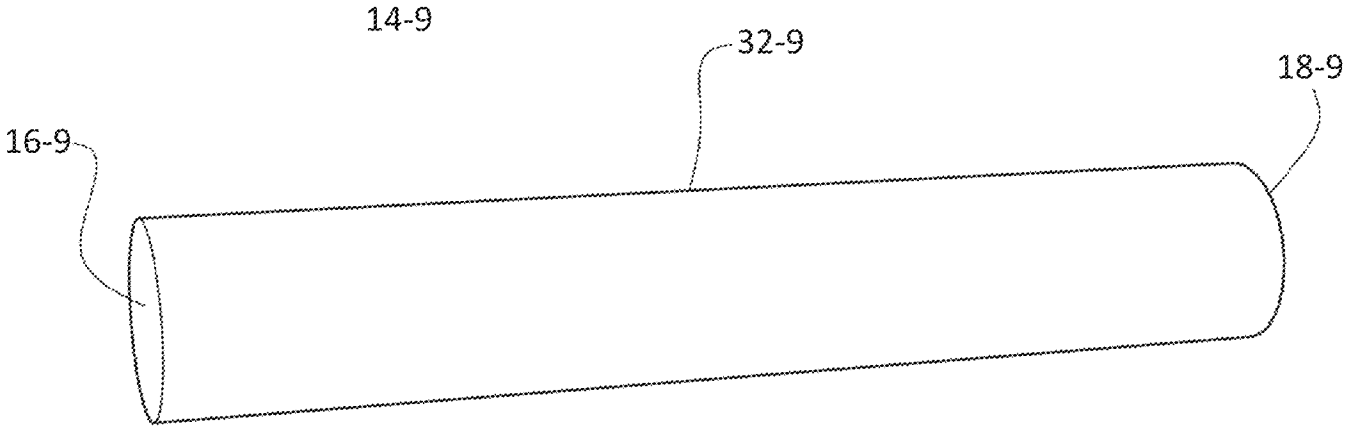
FIG. 82 is a perspective view illustration of an aerosol carrier for use in the system for aerosol delivery according to one or more embodiments of the ninth mode of the present disclosure.
Figure 83:
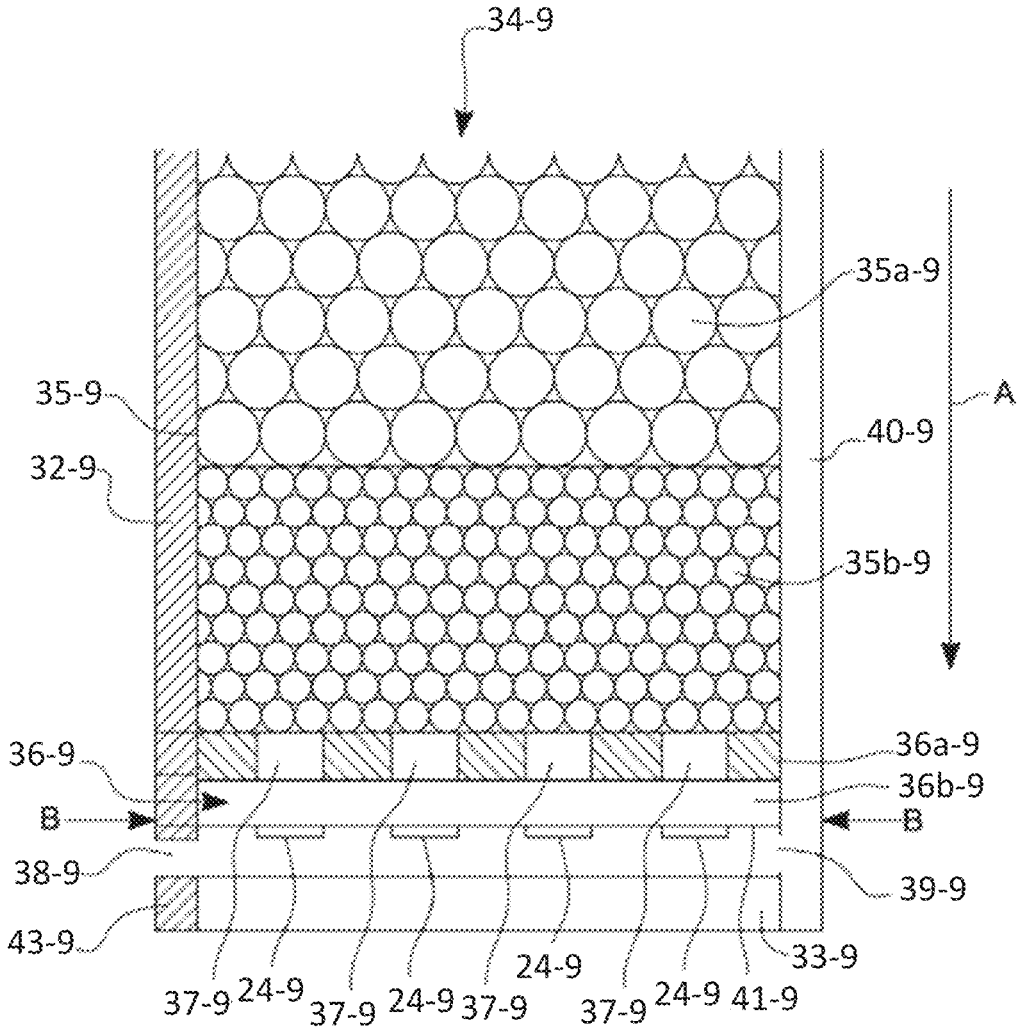
FIG. 83 is a cross-section side view of elements of an aerosol carrier and a part of an apparatus of the system for aerosol delivery according to one or more embodiments of the ninth mode of the present disclosure.
Figure 84:
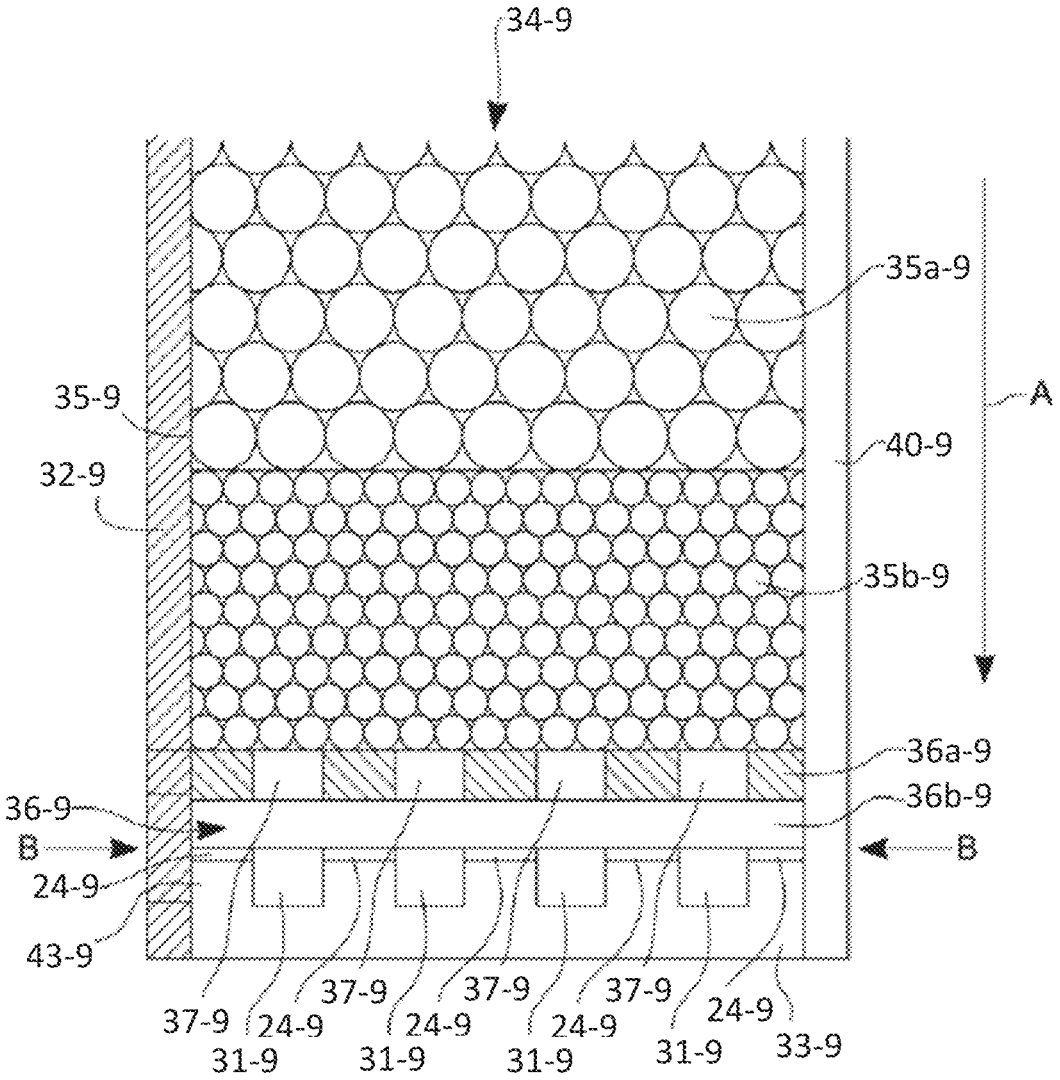
FIG. 84 is a cross-section side view of elements of an aerosol carrier and a part of an apparatus of the system for aerosol delivery according to one or more embodiments of the ninth mode of the present disclosure, in an alternative configuration from that of FIG. 83.

FIGS. 82 to 84 schematically illustrate the aerosol carrier 14-9 in more detail (and, in FIGS. 83 and 84, features within the receptacle in more detail). FIG. 82 illustrates an exterior of the aerosol carrier 14-9, FIG. 83 illustrates internal components of the aerosol carrier 14-9 in one optional configuration, and FIG. 84 illustrates internal components of the aerosol carrier 14-9 in another optional configuration.

FIG. 82 illustrates the exterior of the aerosol carrier 14-9, which comprises housing 32-9 for housing said fluid-transfer article (not shown). The particular housing 32-9 illustrated in FIG. 82 comprises a tubular member, which may be generally cylindrical in form, and which is configured to be received within the receptacle of the apparatus. First end 16-9 of the aerosol carrier 14-9 is for location to oppose the heater of the apparatus, and second end 18-9 (and the region adjacent the second end 18-9) is configured for insertion into a user's mouth.

FIG. 83 illustrates some internal components of the aerosol carrier 14-9 and of the heater 24-9 of apparatus 12-9, in one embodiment of the disclosure.

As described above, the aerosol carrier 14-9 comprises a fluid-transfer element 34-9. At least part of the fluid-transfer article 34-9 may be removable from the housing 32-9, to enable it to be replaced. The fluid-transfer article 34-9 acts as a reservoir for aerosol precursor and that aerosol precursor will be consumed as the apparatus is used. Once sufficient aerosol precursor has been consumed, the aerosol precursor will need to be replaced. It may then be easiest to replace it by replacing the fluid-transfer article 34-9, rather than trying to re-fill the fluid-transfer article 34-9 with aerosol precursor while it is in the housing 32-9.

In the illustrated embodiments, the fluid-transfer article 34-9 has a first region 35-9 formed by layers **35*a*-9 and 35*b*-9, and a second region 36-9. That second region 36-9 has a first part being an upper layer 36*a*-9 which is formed by a plate with a plurality of holes 37-9 therein, and a second part being a lower layer formed by a second plate 36*b*-9 made of a porous material which allows aerosol precursor to pass therethrough. In the arrangement of FIG. 83, the plate 36*a*-9 with holes 37-9 therein is in contact with the first region 35-9 of the fluid-transfer article 34-9, so that aerosol precursor may pass from that first region 35-9 directly into the holes 37-9, and through those holes to the second plate 36*b*-9**.

Since the second plate **36*b*-9 is porous, the aerosol precursor will pass to the surface of the plate 36*b*-9 remote from the first region 35-9 of the fluid-transfer article 34-9, which surface acts as an activation surface 41-9 of the fluid-transfer article 34-9. One or more heaters 24-9 are mounted on the activation surface 41-9. When the heater or heaters 24-9 are activated, the heat which they generate will be transferred to the activation surface 41-9**.

Further components not shown in FIG. 83 comprise: an inlet conduit, via which air can be drawn into the aerosol carrier 14-9; an outlet conduit, via which an air stream entrained with aerosol can be drawn from the aerosol carrier 14-9; a filter element; and a reservoir for storing aerosol precursor material and for providing the aerosol precursor material to the fluid-transfer article 34-9.

In FIG. 83, the aerosol carrier is shown as comprising the fluid-transfer article 34-9 located within housing 32-9. The fluid transfer article 34-9 comprises a first region 35-9 holding an aerosol precursor. In one or more arrangements, the first region of 35 of the fluid transfer article 34-9 comprises a reservoir for holding the aerosol precursor.

The first region 35-9 can be the sole reservoir of the aerosol carrier 14-9, or it can be arranged in fluid communication with a separate reservoir, where aerosol precursor is stored for supply to the first region 35-9. As shown in FIG. 83, the first region 35-9 has a first layer **35*a*-9 and a second layer 35*b*-9. The material forming the first layer 35*a*-9 of the first region 35-9 comprises a porous structure, whose pore diameter size varies between one end of the first layer 35*a*-9 and another end of the first layer 35*a*-9. The pore diameter size may increase from a first end remote from heater or heaters 24-9 (the upper end is as shown in the figure) to a second end. The pore diameter size may change in a step-wise manner (i.e., a first part with pores having a diameter of first size, and a second part with pores having a diameter of second, smaller size), or the change in pore size in the first layer 35*a*-9 may be gradual rather than step-wise. This configuration of pores having a decreasing diameter size can provide a wicking effect, which can serve to draw fluid through the first layer 35***a*-9, towards heater or heaters 24-9.

The first region 35-9 of the fluid transfer article 34-9 may also comprise a second layer 35*b*-9. Aerosol precursor is drawn from the first layer 35*a*-9 to the second layer 35*b*-9 by the wicking effect of the material forming the first layer 35*a*-9. Thus, the first layer 35*a*-9 is configured to transfer the aerosol precursor to the second layer 35*b*-9 of the first region 35-9 of the fluid-transfer article 34-9.

The second layer 35*b*-9 itself may comprise a porous structure formed by a porous polymer material. It is then preferable that the pore diameter size of the porous structure of the second layer 35*b*-9 is smaller than the pore diameter size of the immediately adjacent part of the first layer 35*a*-9. As mentioned above, the porous polymer material may be a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET).

However, as mentioned previously, in some embodiments it is envisaged that the first region 35-9 of the fluid-transfer article need not be of porous polymer material as described above. Instead, the first region 35-9 of the fluid-transfer article 34-9 may take the form of a simple tank having a cavity defining a hollow reservoir to hold the aerosol precursor. In such embodiments it is proposed that the plate 36*a*-9 with holes 37-9 therein will extend across the bottom of the tank so that aerosol precursor held in the tank will impinge directly on the plate 36*a*-9 and pass directly from the tank defining the first region 35-9 of the fluid-transfer article 34-9 into the holes 37-9 of the second region 36-9 of the fluid-transfer article.

As discussed above, the heater or heaters 24-9 transfer heat to the activation surface 41-9, thereby releasing aerosol precursor which has reached that activation surface 41-9 from the porous polymer material (or hollow reservoir) of the first region 35-9, through the second region 36-9. That vapor and/or a mixture of vapor and aerosol, may then pass into the air adjacent the activation surface 41-9 and the heater or heaters 24-9.

FIG. 83 also illustrates an opening 38-9, which opening 38-9 is in communication with the air-intake apertures 20-9. A further opening 39-9 communicates with a duct 40-9 within the housing 32-9, which duct 40-9 communicates with the second end 18-9.

There is thus a fluid-flow path for air (referred to as an air-flow pathway) between openings 38-9 and 39-9, linking the apertures 20-9 and the second end 18-9 of the aerosol carrier. When the user sucks or inhales, air is drawn along the air-flow pathway, along the activation surface 41-9. A plate 33-9 forms a lower surface of the air-flow pathway, the plate 33-9 being spaced from the activation surface 41-9. It can be seen that the air-flow pathway is in direct contact with parts of the activation surface 41-9, as the heater or heaters 24-9 may partially block that path from the activation surface to the fluid flow pathway. The fluid flow pathway is on the opposite side of the heater or heaters 24-9 from the activation surface 41-9, so vapor must pass around the heater or heaters 24-9 if it cannot pass therethrough.

One or more droplets of the aerosol precursor will be released from the second plate 36*b*-9 and heated, to release vapor or a mixture of aerosol and vapor into the air flowing in the air-flow pathway between the openings 38-9, 39-9. The vapor or mixture passes, as the user sucks and inhales, to the second end 18-9.

As mentioned above, the second region 36-9 of the fluid-transfer article 34-9 comprises a first plate 36*a*-9 and a second plate 36*b*-9. The first plate 36*a*-9 may be a molded polymer disc so that is then easy to form the holes 37-9 therein by molding the holes 37-9 when the plate 36*a*-9 is itself molded. The holes 37-9 are sufficiently large that they do not act as a capillary, but instead define non-capillary spaces in the second region 36-9. Hence, aerosol precursor is able to pass from the first region 35-9 of the fluid-transfer article to the second region 36-9 in a non-capillary manner, into the holes 37-9, and then pass through the second plate 36*b*-9 to the heater or heaters 24-9.

The second plate 36*b*-9 is made of a porous material which is more heat-resistant than the material of the plate 36*a*-9, as it is acted on directly by the heater or heaters 24-9. It may be fibrous, made from e.g., ceramic fiber, glass fiber or carbon fiber. Alternatively, it may be formed from a high-temperature porous material such as porous glass or porous ceramic. Another possibility is that the second plate 36*b*-9 may be of a porous polymer material, such as the materials described previously with reference to the layers 35*a*-9 and 35*b*-9 of the first region 35-9, provided that the polymer material is sufficiently resistant to the high temperatures to which it will be subject due to the heater or heaters 24-9.

It is thought that the flow of air between openings 38-9 and 39-9 along the activation surface 41-9 and past the heater or heaters 24-9 will have the effect of creating the lower air pressure adjacent the activation surface 41-9 which will tend to draw liquid through the porous second plate 36*b*-9 to the activation surface 41-9. Thus, the transfer of aerosol precursor from the fluid-transfer article 34-9 is facilitated.

As mentioned above, the fluid-transfer article 34-9, formed by the first and second regions 35-9 and 36-9 and any further reservoir of aerosol precursor, forms the consumable part of the apparatus, in the sense that it can readily be replaced to enable the aerosol precursor to be replaced once it is consumed. The heater or heaters 24-9 are not part of the consumable elements. Thus, the housing 32-9 containing the fluid-transfer article 34-9 may be separable from a housing 43-9 supporting the heater or heaters 24-9 along the line B-B in FIG. 83 The plate 33-9 may be integral with the further housing 43-9, and the openings 38-9 and 39-9 are formed in the further housing 43-9. The further housing 43-9 may be integral with the housing 26-9 containing the electrical energy supply 28-9. It is for this reason that the heater or heaters 24-9 make contact with, but are not bonded to, the activation surface 41-9. The contact ensures the most efficient heat transfer from the heater or heaters 24-9 to the second plate 36*b*-9 to heat the activation surface 41-9 but the heater or heaters 24-9 must be separable from that activation surface 41-9 to allow removal of the housing 32-9 from the further housing 43-9 when the fluid-transfer article 34-9 has become depleted. The line B to B may therefore correspond to the plane of the activation surface 41-9.

In FIG. 83, the heater or heaters 24-9 may be separate or be interconnected to form a single heater. For example, the heater may be a coil, mesh or foil heater in which the parts of the heater 24-9 illustrated in FIG. 83 may be parts of a common structure. Such a coil, mesh or foil heater is preferred so that any restriction caused by the heater or heaters 24-9 on release of aerosol or vapor from the activation surface is minimized, as vapor and/or aerosol may pass through the heater or heaters 24-9. However, it is also possible for the heater or heaters 24-9 to be a solid unbroken strip or strips, provided that there is then enough of the activation surface 41-9 not covered by the heater or heaters 24-9 to allow sufficient release of vapor and/or aerosol from the activation surface 41-9.

In the illustrative examples of FIG. 83, the first layer 35*a*-9 of the first region 35-9 of the fluid-transfer article 34-9 is located at an "upstream" end of the fluid-transfer article 34-9 and the second plate 35*b*-9 of the second region 35*b*-9 is located at a downstream" end of the fluid-transfer article 34-9. That is, aerosol precursor is wicked, or is drawn, from the "upstream" end of the fluid-transfer article 34-9 to the "downstream" end of the fluid-transfer article 34-9 (as denoted by arrow A in FIG. 83).

In the arrangement of FIG. 83, the plate 33-9 has a planar surface facing the activation surface 41-9. FIG. 84 illustrates an arrangement in which the plate 33-9 has projections and recesses in its upper surface, so that the recesses can form channels 31-9 for air to flow therethrough. Other features which are the same as those of FIG. 83 are indicated by the same reference numerals. Thus, the channels 31-9 form the air-flow pathway along the activation surface 41-9. In FIG. 84, the projections and recesses form a square-wave or "castellated" structure. Further shapes are possible, however, such as alternating peaks and troughs or recesses with curved walls. All such arrangements permit channels 31-9 to be formed and allow air to flow along the activation surface 41-9. This control of air flow improves the mixing of the vaporized aerosol precursor into the air flow.

In the embodiment of FIG. 84, the peaks in the upper surface of the plate 33-9 extend to the heater or heaters 24-9, with the recesses between those peaks which form the channels 31-9 then being aligned with the holes 37-9 formed in the second plate 35*b*-9 of the fluid-transfer article 34-9. Other alignments are possible, and the projections need not reach all the way to the heater or heaters 24-9. In general, however, the heater or heaters 24-9 may restrict release of the vaporized aerosol precursor from parts of the activation surface 41-9 on which those heater or heaters 24-9 are formed, so it will normally be desirable that the channels 31-9 are aligned with the part or parts of the activation surface 41-9 other than the part or parts on which the heater or heaters 24-9 are formed.

Note also that, in FIG. 84, the openings 38-9 and 39-9 are not visible since they will be at the ends of the channels 31-9 to allow air to pass from the opening 38-9 in to the channels 31-9, and from those channels 31-9 out of the opening 39-9. Also, as in FIG. 83, the housing 32-9 containing the fluid-transfer article 34-9 may be separable from the housing 43-9 containing the intermediate structure 36-9 and the heater or heaters 24-9 along the line B-B in FIG. 84.

Figure 85:
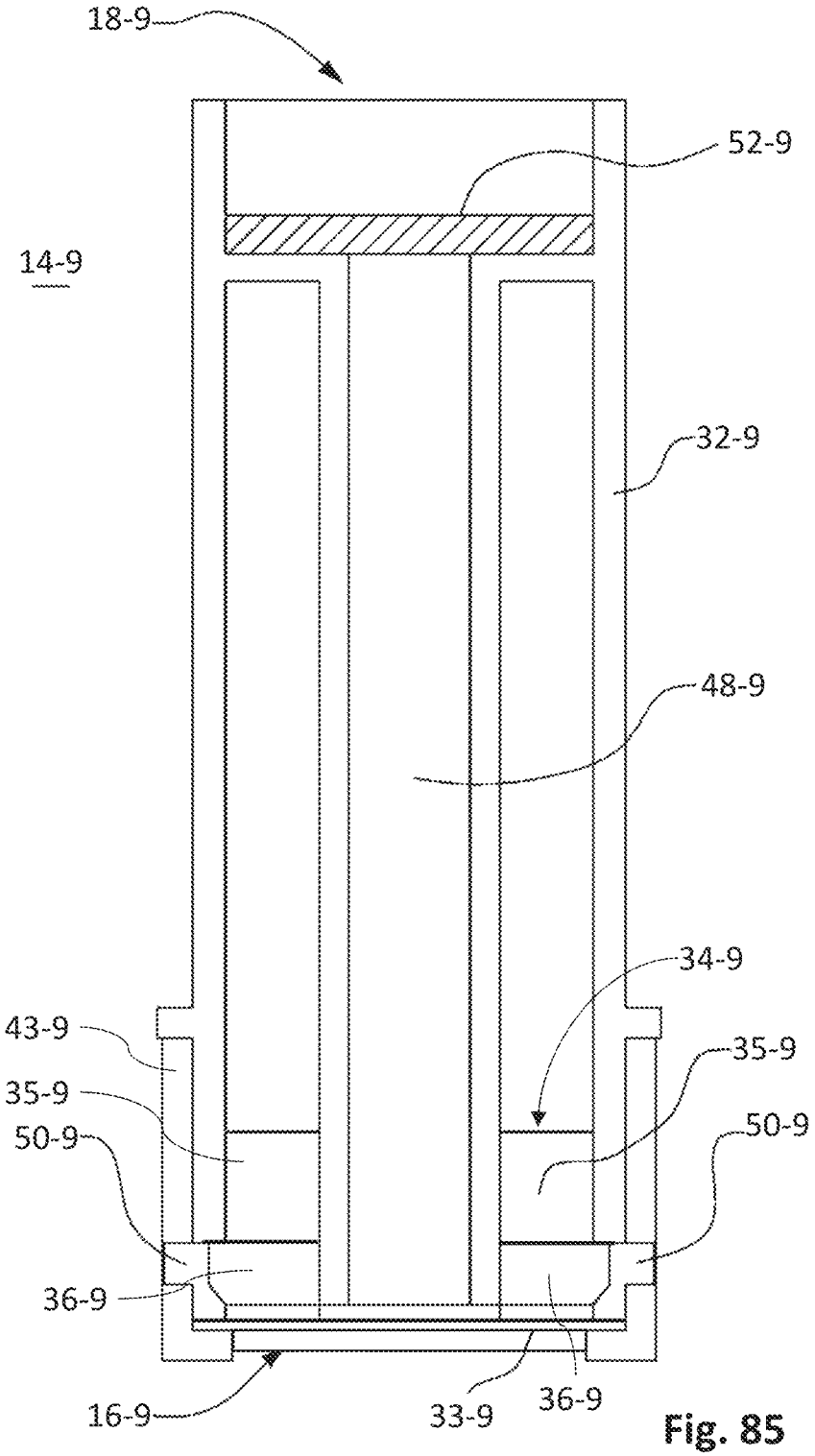
FIG. 85 is a cross-section side view of aerosol carrier according to one or more embodiments of the ninth mode of the present disclosure.
Figure 86:
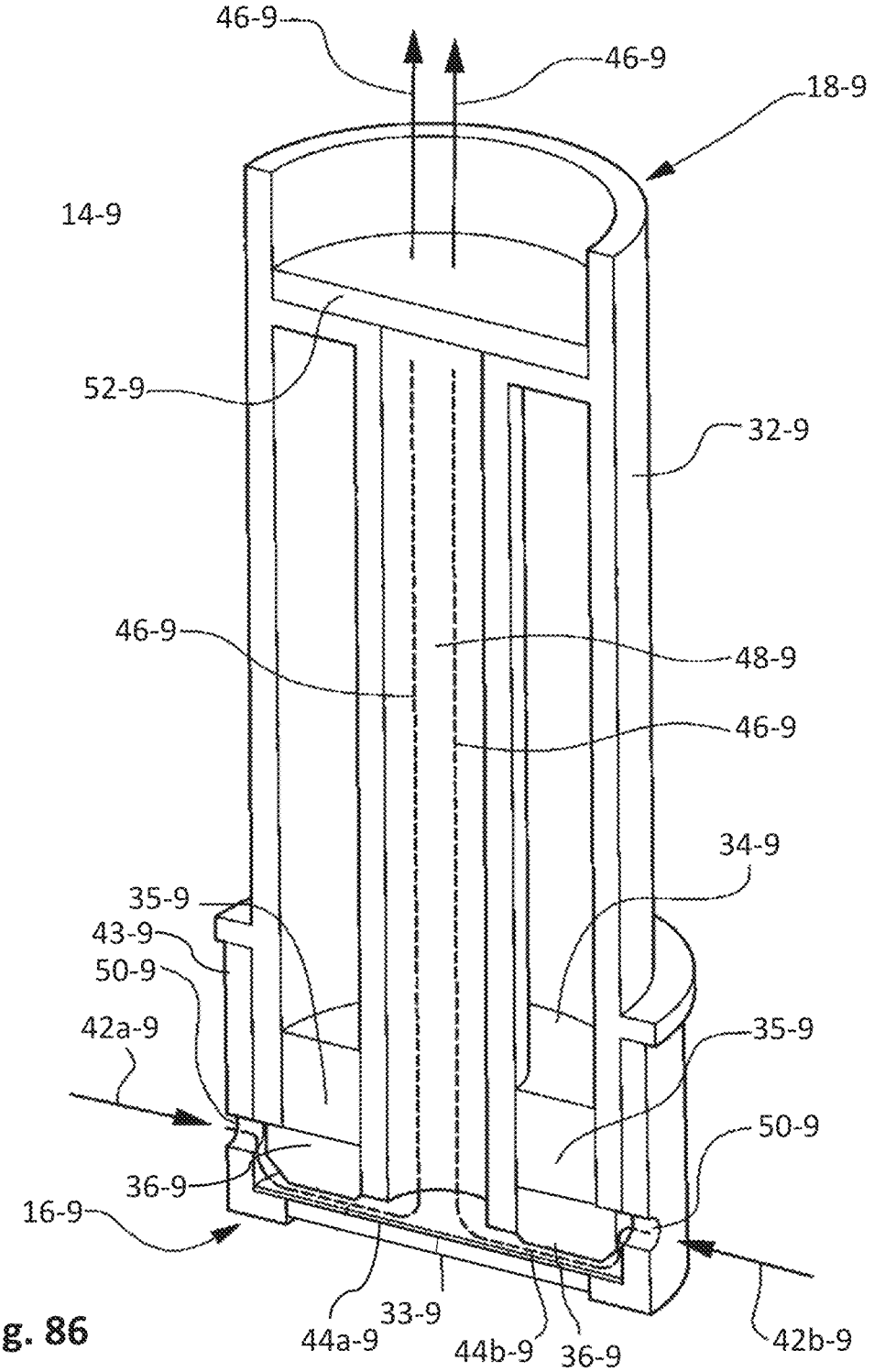
FIG. 86 is a perspective cross-section side view of the aerosol carrier of FIG. 85.
Figure 87:
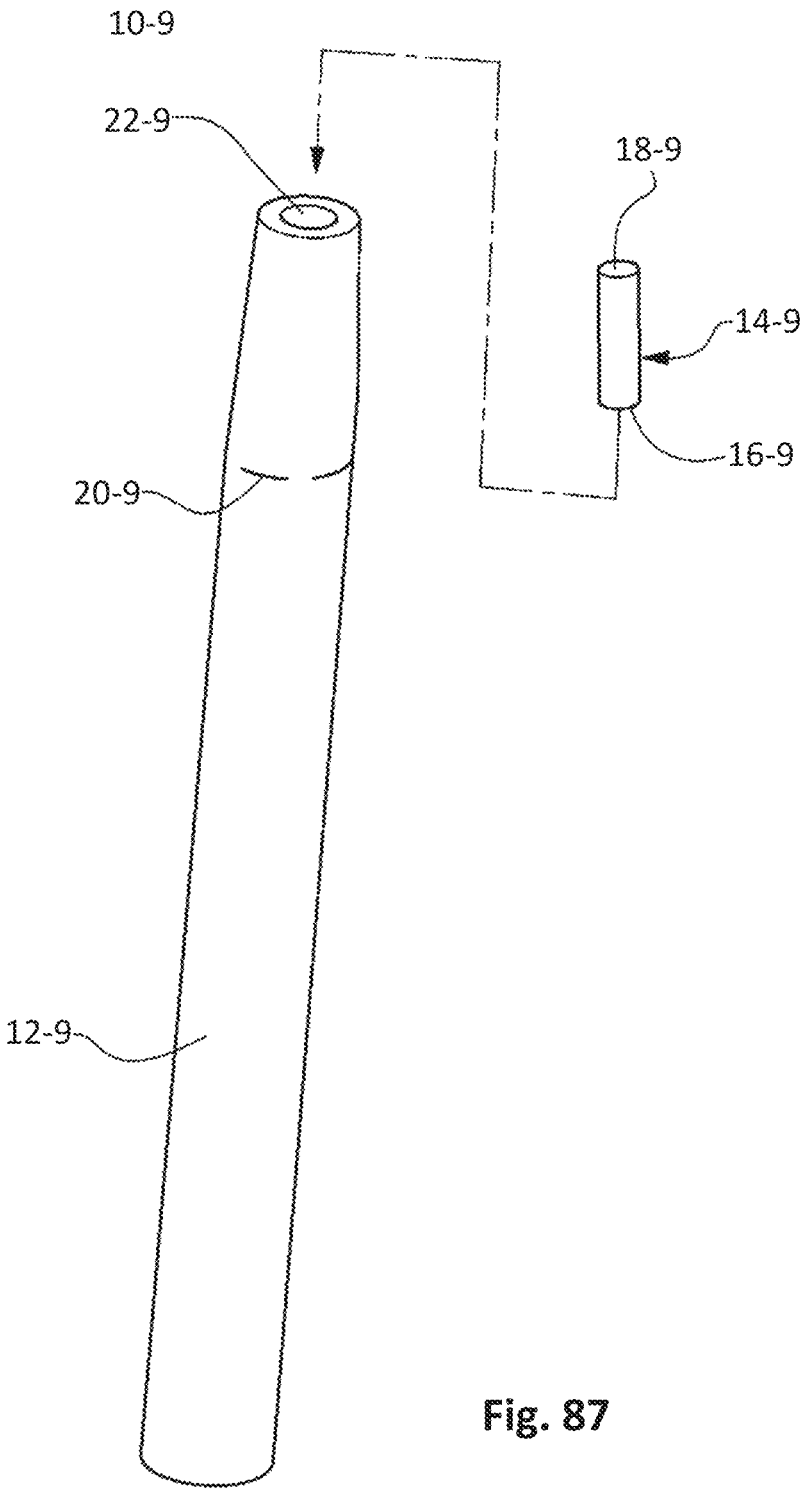
FIG. 87 is an exploded perspective view illustration of a kit-of-parts for assembling the system according to one or more embodiments of the ninth mode of the present disclosure.

In the arrangements shown in FIGS. 83 and 84, the apertures 38-9, 39-9 are on opposite sides of the housing 32-9. FIGS. 85 and 86 shows an alternative configuration, in which the fluid-transfer article is annular, and both the first region 35-9 and the second region 36-9 are then in the form of annuli. In FIGS. 86 and 87, the structure of the fluid-transfer article 34-9, including the first region 35-9 and the second region 36-9 may correspond generally to that shown in FIG. 83 The internal structure of the first and second regions 35-9 and 36-9 may be the same as in FIG. 83, but are not illustrated in detail in FIGS. 85 and 86 for simplicity. The heater or heaters 24-9 also cannot be seen in FIGS. 85 and 86, but may be formed as in the arrangement of FIG. 83 or FIG. 84 However, the air flow in the apparatus is discussed in more detail below. Thus, FIGS. 85 and 86 illustrate an aerosol carrier 14-9 according to one or more possible arrangements in more detail. FIG. 85 is a cross-section side view illustration of the aerosol carrier 14-9 and FIG. 86 is a perspective cross-section side view illustration of the aerosol carrier 14-9.

As can be seen from FIGS. 85 and 86, the aerosol carrier 14-9 is generally tubular in form. The aerosol carrier 14-9 comprises housing 32-9, which defines the external walls of the aerosol carrier 14-9 and which defines therein a chamber in which are disposed the fluid-transfer article 34-9 (adjacent the first end 16-9 of the aerosol carrier 14-9) and internal walls defining the fluid communication pathway 48-9. Fluid communication pathway 48-9 defines a fluid pathway for an outgoing air stream from the channels 40-9 to the second end 18-9 of the aerosol carrier 14-9. In the examples illustrated in FIGS. 85 and 86, the fluid-transfer article 34-9 is an annular shaped element located around the fluid communication pathway 48-9. The housing 32-9 containing the fluid-transfer article 34-9 is separable from the housing 43-9 supporting heater or heaters 24-9.

In walls of the housing 43-9, there are provided inlet apertures 50-9 to provide a fluid communication pathway for an incoming air stream to reach the activation surface 41-9 of the second region 36-9 of the fluid-transfer article 34-9.

In the illustrated example of FIGS. 85 and 86, the aerosol carrier 14-9 further comprises a filter element 52-9. The filter element 52-9 is located across the fluid communication pathway 48-9 such that an outgoing air stream passing through the fluid communication pathway 48-9 passes through the filter element 52-9.

With reference to FIG. 86, when a user sucks on a mouthpiece of the apparatus (or on the second end 18-9 of the aerosol carrier 14-9, if configured as a mouthpiece), air is drawn into the carrier through inlet apertures 50-9 extending through walls in the housing 32-9 of the aerosol carrier 14-9.

An incoming airstream 42*a*-9 from a first side of the aerosol carrier 14-9 is directed to a first side of the second region 36-9 (e.g., via a gas communication pathway within the housing of the carrier). An incoming air stream 42*b*-9 from a second side of the aerosol carrier 14-9 is directed to a second side of the second region 36-9 (e.g., via a gas communication pathway within the housing of the carrier). When the incoming air stream 42*a*-9 from the first side of the aerosol carrier 14-9 reaches the first side of the second region 36-9, the incoming air stream 42*a*-9 from the first side of the aerosol carrier 14-9 flows along the activation surface 41-9 of the second region 36-9. Likewise, when the incoming air stream 42*b*-9 from the second side of the aerosol carrier 14-9 reaches the second side of the second region 36-9, the incoming air stream 42*b*-9 from the second side of the aerosol carrier 14-9 flows along the activation surface 41-9 of the second region 36-9. The air streams from each side are denoted by dashed lines 44*a*-9 and 44*b*-9 in FIG. 86 As these air streams 44*a*-9 and 44*b*-9 flow, aerosol precursor on the activation surface 41-9 of the second region 36-9 is entrained in air streams 44*a*-9 and 44*b*-9.

In use, the heater or heaters 24-9 of the apparatus 12-9 raise a temperature of the second plate 36*b*-9 of the second region 36-9 to a sufficient temperature to release, or liberate, captive substances (i.e., the aerosol precursor) to form a vapor and/or aerosol, which is drawn downstream. As the air streams 44*a*-9 and 44*b*-9 continue their passages, more released aerosol precursor is entrained within the air streams

44*a*-9 and 44*b*-9. When the air streams 44*a*-9 and 44*b*-9 entrained with aerosol precursor meet at a mouth of the outlet fluid communication pathway 48-9, they enter the outlet fluid communication pathway 48-9 and continue until they pass through filter element 52-9 and exit outlet fluid communication pathway 48-9, either as a single outgoing air stream, or as separate outgoing air streams 46-9 (as shown). The outgoing air streams 46-9 are directed to an outlet, from where it can be inhaled by the user directly (if the second end 18-9 of the aerosol capsule 14-9 is configured as a mouthpiece), or via a mouthpiece. The outgoing air streams 46-9 entrained with aerosol precursor are directed to the outlet (e.g., via a gas communication pathway within the housing of the carrier).

FIG. 87 is an exploded perspective view illustration of a kit-of-parts for assembling an aerosol delivery system 10-9.

As will be appreciated, in the arrangements described above, the fluid-transfer article 34-9 is provided within a housing 32-9 of the aerosol carrier 14-9. In such arrangements, the housing of the carrier 14-9 serves to protect the aerosol precursor-containing fluid-transfer article 34-9, whilst also allowing the carrier 14-9 to be handled by a user without his/her fingers coming into contact with the aerosol precursor liquid retained therein.

In any of the embodiments described above the second plate 36*b*-9 of the second region 36-9 may have a thickness of less than 5 mm. In other embodiments it may have a thickness of: less than 3.5 mm, less than 3 mm, less than 2.5 mm, less than 2 mm, less than 1.9 mm, less than 1.8 mm, less than 1.7 mm, less than 1.6 mm, less than 1.5 mm, less than 1.4 mm, less than 1.3 mm, less than 1.2 mm, less than 1.1 mm, less than 1 mm, less than 0.9 mm, less than 0.8 mm, less than 0.7 mm, less than 0.6 mm, less than 0.5 mm, less than 0.4 mm, less than 0.3 mm, less than 0.2 mm, or less than 0.1 mm.

Tenth Mode: A Dried Conductive Fluid is Used to Form at Least One Heater Element on an Activation Surface of a Fluid-Transfer Article Aspects and embodiments of the tenth mode of the present disclosure will now be discussed with reference to the accompanying figures. Further aspects and embodiments of the tenth mode will be apparent to those skilled in the art. All documents mentioned in this text are incorporated herein by reference.

In general outline, one or more embodiments of the tenth mode in accordance with the present disclosure may provide a system for aerosol delivery in which an aerosol carrier may be inserted into a receptacle (e.g., a "heating chamber") of an apparatus for initiating and maintaining release of an aerosol from the aerosol carrier.

Another end, or another end portion, of the aerosol carrier may protrude from the apparatus and can be inserted into the mouth of a user for the inhalation of aerosol released from the aerosol carrier cartridge during operation of the apparatus.

Hereinafter, and for convenience only, "system for aerosol delivery" shall be referred to as "aerosol delivery system".

Figure 88:
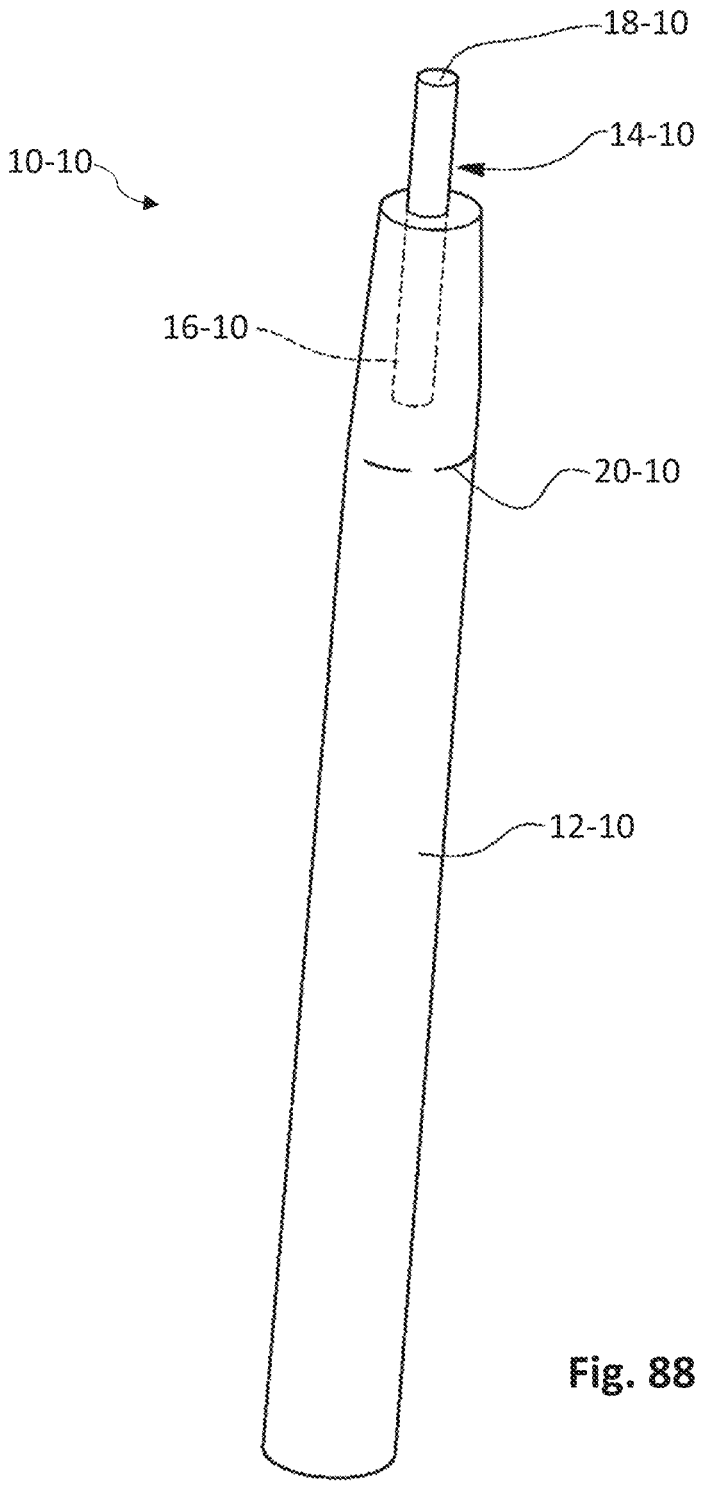
FIG. 88 is a perspective view illustration of a system for aerosol delivery according to one or more embodiments of the tenth mode of the present disclosure.

Referring now to FIG. 88, there is illustrated a perspective view of an aerosol delivery system 10-10 comprising an aerosol generation apparatus 12-10 operative to initiate and maintain release of aerosol from a fluid-transfer article in an aerosol carrier 14-10. In the arrangement of FIG. 88, the aerosol carrier 14-10 is shown with a first end 16-10 thereof and a portion of the length of the aerosol carrier 14-10 located within a receptacle of the apparatus 12-10. A remaining portion of the aerosol carrier 14-10 extends out of the receptacle. This remaining portion of the aerosol carrier 14-10, terminating at a second end 18-10 of the aerosol carrier, is configured for insertion into a user's mouth. A vapor and/or aerosol is produced when a heater (not shown in FIG. 88) of the apparatus 12-10 heats a fluid-transfer article in the aerosol carrier 14-10 to release a vapor and/or an aerosol, and this can be delivered to the user, when the user sucks or inhales, via a fluid passage in communication with an outlet of the aerosol carrier 14-10 from the fluid-transfer article to the second end 18-10.

The device 12-10 also comprises air-intake apertures 20-10 in the housing of the apparatus 12-10 to provide a passage for air to be drawn into the interior of the apparatus 12-10 (when the user sucks or inhales) for delivery to the first end 16-10 of the aerosol carrier 14-10, so that the air can be drawn across an activation surface of a fluid-transfer article located within a housing of the aerosol carrier cartridge 14-10 during use. Optionally, these apertures may be perforations in the housing of the apparatus 12-10.

A fluid-transfer article (not shown in FIG. 88, but described hereinafter with reference to FIGS. 92, 93, 94 95, 96, 97, 98 and 99) is located within a housing of the aerosol carrier 14-10. The fluid-transfer article contains an aerosol precursor material, which may include at least one of: nicotine; a nicotine precursor material; a nicotine compound; and one or more flavorings. The fluid-transfer article is located within the housing of the aerosol carrier 14-10 to allow air drawn into the aerosol carrier 14-10 at, or proximal, the first end 16-10 to flow across an activation surface of the fluid-transfer article. As air passes across the activation surface of the fluid-transfer article, an aerosol may be entrained in the air stream from a substrate forming the fluid-transfer article, e.g., via diffusion from the substrate to the air stream and/or via vaporization of the aerosol precursor material and release from the fluid-transfer article under heating.

The substrate forming the fluid-transfer article 34-10 comprises a porous material where pores of the porous material hold, contain, carry, or bear the aerosol precursor material. In particular, the porous material of the fluid-transfer article may be a polymeric wicking material such as, for example, a sintered material. Particular examples of material suitable for the fluid-transfer article include: Polyetherimide (PEI); Polytetrafluoroethylene (PTFE); Polyether ether ketone (PEEK); Polyimide (PI); Polyethersulphone (PES); and Ultra-High Molecular Weight Polyethylene. Other suitable materials may comprise, for example, BioVyon™ (by Porvair Filtration Group Ltd) and materials available from Porex®. Further optionally, a substrate forming the fluid-transfer article may comprise Polypropylene (PP) or Polyethylene Terephthalate (PET). All such materials may be described as heat resistant polymeric wicking material in the context of the present disclosure.

The aerosol carrier 14-10 is removable from the apparatus 12-10 so that it may be disposed of when expired. After removal of a used aerosol carrier 14-10, a replacement aerosol carrier 14-10 can be inserted into the apparatus 12-10 to replace the used aerosol carrier 14-10.

Figure 89:
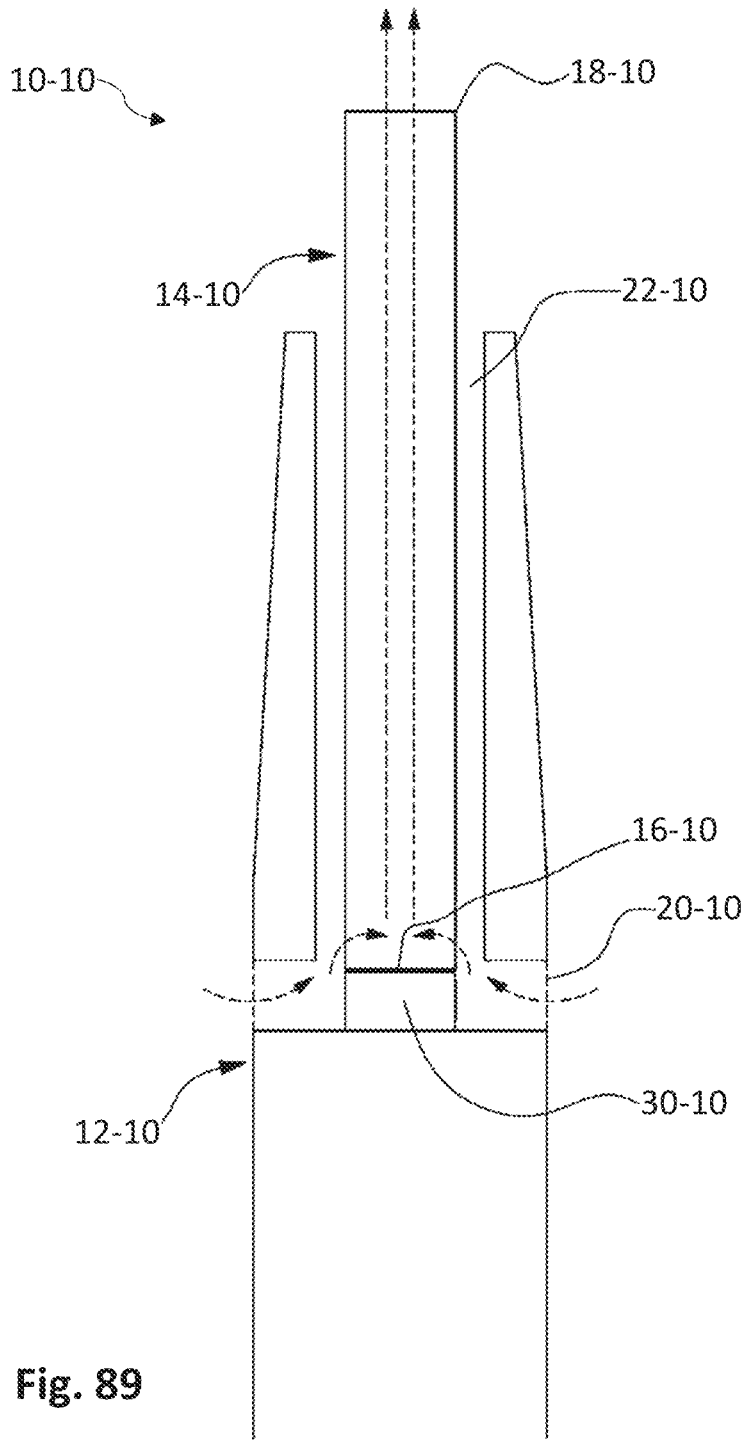
FIG. 89 is a cross-sectional side view illustration of part of an apparatus of the system for aerosol delivery of FIG. 88.

FIG. 89 is a cross-sectional side view illustration of a part of apparatus 12-10 of the aerosol delivery system 10-10. The apparatus 12-10 comprises a receptacle 22-10 in which is located a portion of the aerosol carrier 14-10. In one or more optional arrangements, the receptacle 22-10 may enclose the aerosol carrier 14-10. The apparatus 12-10 also comprise a heater which will be described in more detail later.

Air flows into the apparatus 12-10 (in particular, into a closed end of the receptacle 22-10) via air-intake apertures 20-10. From the closed end of the receptacle 22-10, the air is drawn into the aerosol carrier 14-10 (under the action of the user inhaling or sucking on the second end 18-10) and expelled at the second end 18-10. As the air flows into the aerosol carrier 14-10, it passes across the activation surface of the fluid-transfer article. Heat from the heater causes vaporization of aerosol precursor material at the activation surface of the fluid-transfer article and an aerosol is created in the air flowing over the activation surface. Thus, through the application of heat in the region of the activation surface of the fluid-transfer article, an aerosol is released, or liberated, from the fluid-transfer article, and is drawn from the material of the aerosol carrier unit by the air flowing across the activation surface and is transported in the air flow to via outlet conduits (not shown in FIG. 89) in the housing of the aerosol carrier 14-10 to the second end 18-10. The direction of air flow is illustrated by arrows in FIG. 89.

To achieve release of the captive aerosol from the fluid-transfer article, the fluid-transfer article of the aerosol carrier 14-10 is heated by the heater. As a user sucks or inhales on second end 18-10 of the aerosol carrier 14-10, the aerosol released from the fluid-transfer article and entrained in the air flowing across the activation surface of the fluid-transfer article is drawn through the outlet conduits (not shown) in the housing of the aerosol carrier 14-10 towards the second end 18-10 and onwards into the user's mouth.

Figure 90:
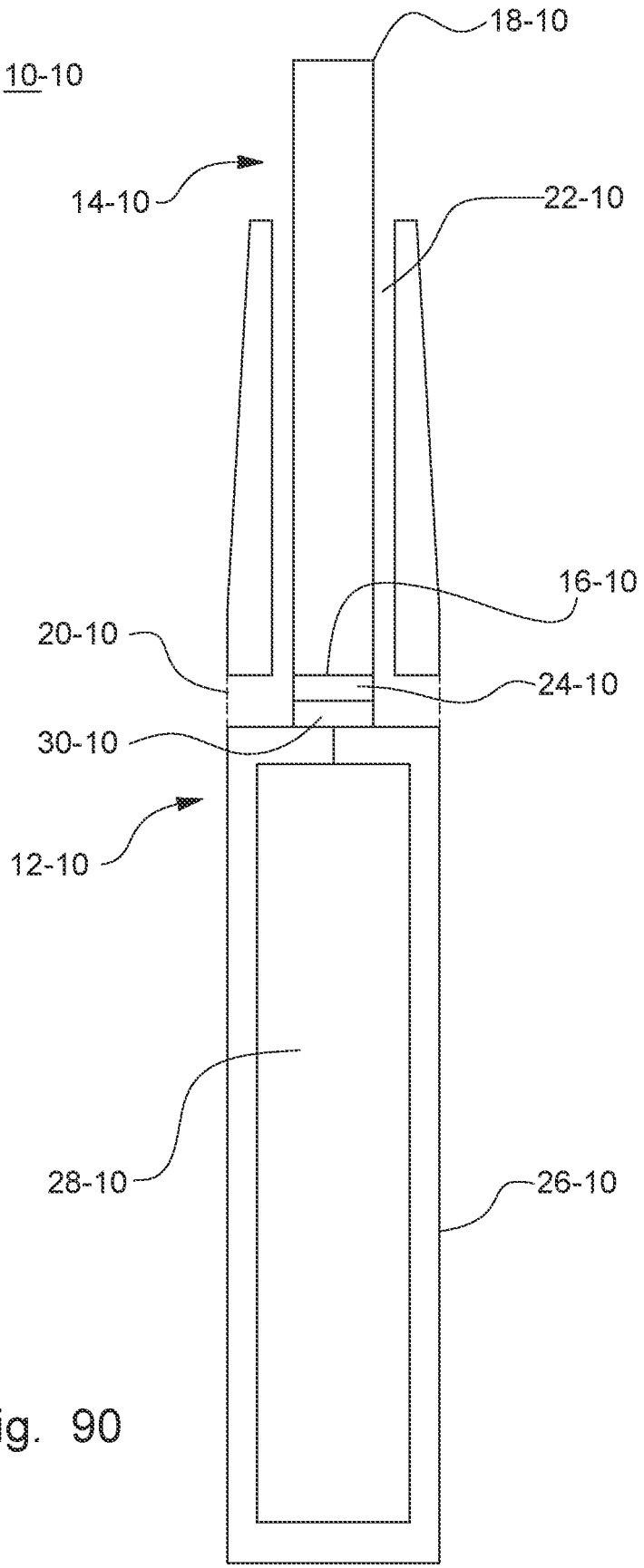
FIG. 90 is a cross-sectional side view illustration of the system and apparatus for aerosol delivery of FIG. 88.

Turning now to FIG. 90, a cross-sectional side view of the aerosol delivery system 10-10 is schematically illustrated showing the features described above in relation to FIGS. 88 and 89 in more detail.

As can be seen, apparatus 12-10 comprises a housing 26-10, in which are located the receptacle 22-10 and heater. The housing 26-10 also contains control circuitry (not shown) operative by a user, or upon detection of air and/or vapor being drawn into the device 12-10 through air-intake apertures 20-10, i.e., when the user sucks or inhales. Additionally, the housing 26-10 comprises an electrical energy supply 28-10, for example a battery. Optionally, the battery comprises a rechargeable lithium-ion battery. The housing 26-10 also comprises a coupling 30-10 for electrically (and optionally mechanically) coupling the electrical energy supply 28-10 to control circuitry (not shown) for powering and controlling operation of the heater.

Responsive to activation of the control circuitry of apparatus 12-10, the heater heats the fluid-transfer article (not shown in FIG. 90) of aerosol carrier 14-10. This heating process initiates (and, through continued operation, maintains) release of vapor and/or an aerosol from the activation surface of the fluid-transfer article. The vapor and/or aerosol formed as a result of the heating process is entrained into a stream of air being drawn across the activation surface of the fluid-transfer article (as the user sucks or inhales). The stream of air with the entrained vapor and/or aerosol passes through the aerosol carrier 14-10 via outlet conduits (not shown) and exits the aerosol carrier 14-10 at second end 18-10 for delivery to the user. This process is briefly described above in relation to FIG. 89, where arrows schematically denote the flow of the air stream into the device 12-10 and through the aerosol carrier 14-10, and the flow of the air stream with the entrained vapor and/or aerosol through the aerosol carrier cartridge 14-10.

Figure 91:
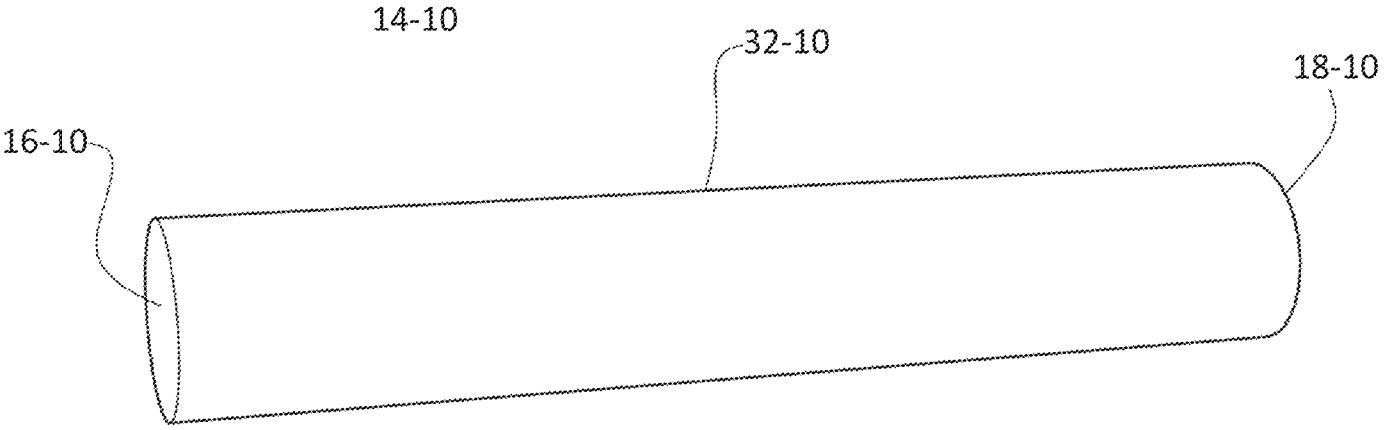
FIG. 91 is a perspective view illustration of an aerosol carrier for use in the system for aerosol delivery according to one or more embodiments of the tenth mode of the present disclosure.
Figure 92:
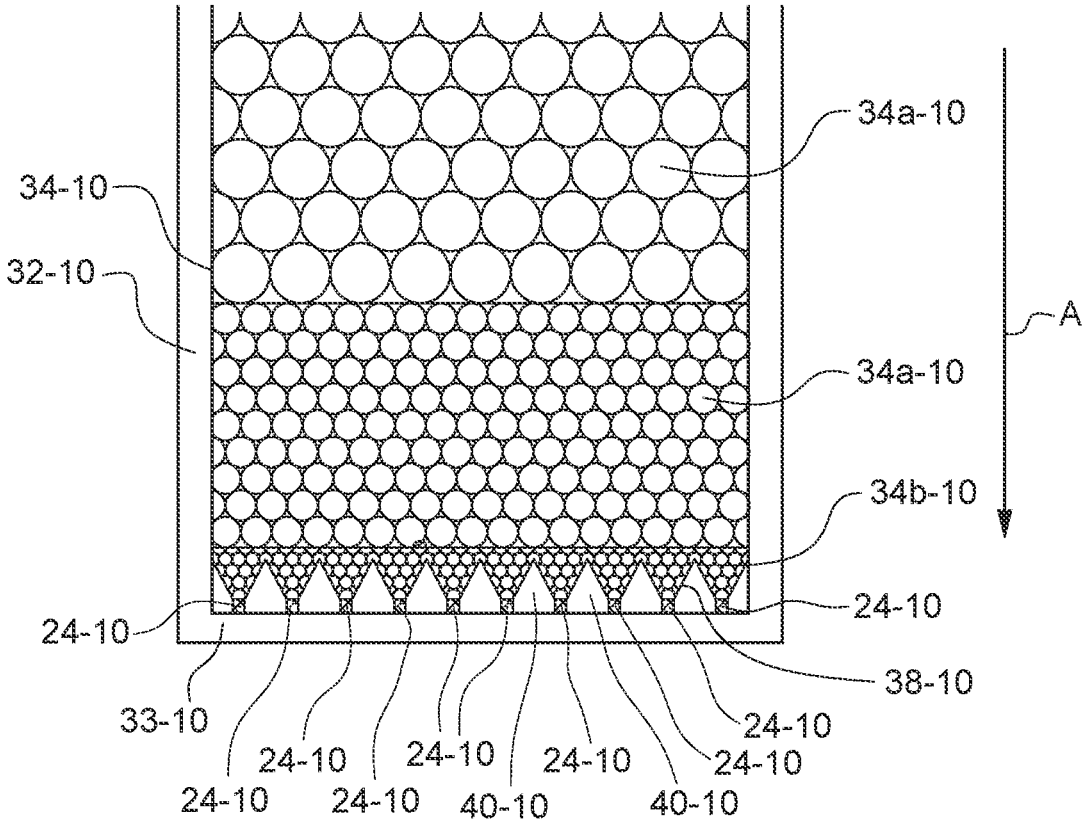
FIG. 92 is a cross-section side view of elements of an aerosol carrier and of part of an apparatus of the system for aerosol delivery according to one or more embodiments of the tenth mode of the present disclosure.
Figure 93:
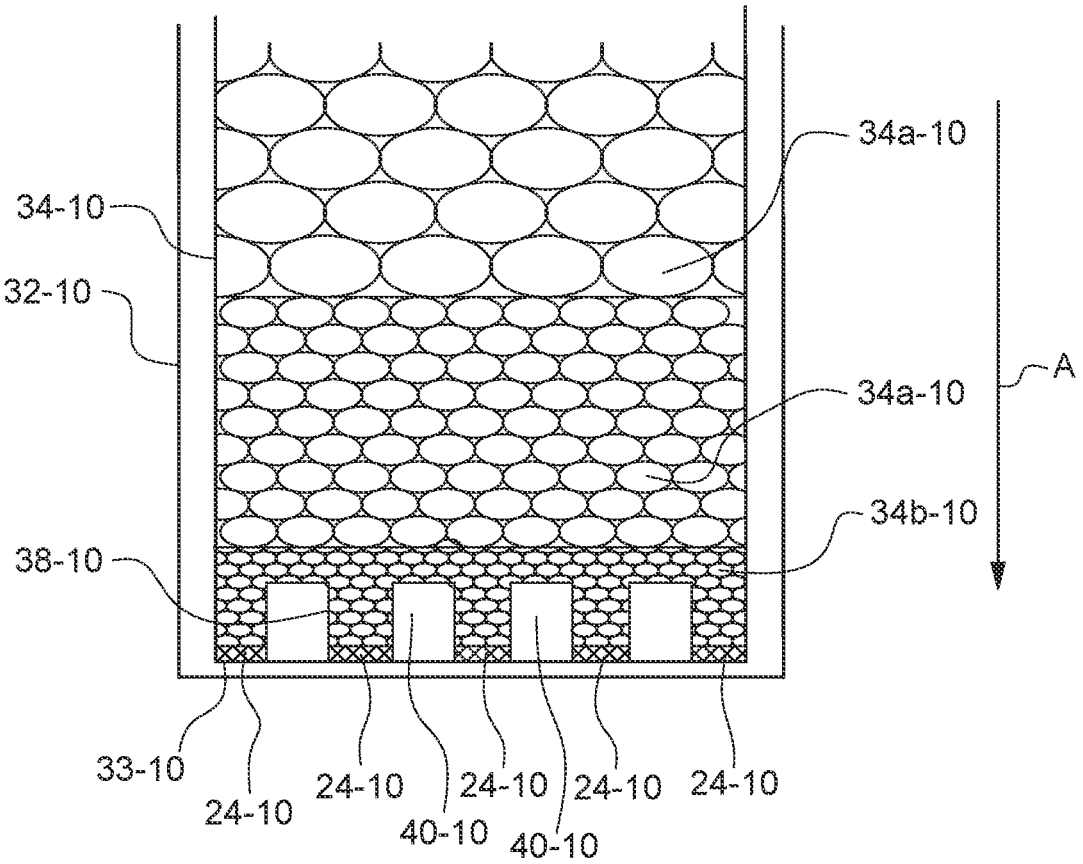
FIG. 93 is a cross-section side view of elements of an aerosol carrier and of part of an apparatus of the system for aerosol delivery according to one or more embodiments of the tenth mode of the present disclosure.

FIGS. 91 to 93 schematically illustrate the aerosol carrier 14-10 in more detail (and, in FIGS. 92 and 93, features within the receptacle in more detail). FIG. 91 illustrates an exterior of the aerosol carrier 14-10, FIG. 92 illustrates internal components of the aerosol carrier 14-10 in an optional arrangement, and FIG. 93 illustrates internal components of the aerosol carrier 14-10 in another optional arrangement.

FIG. 91 illustrates the exterior of the aerosol carrier 14-10, which comprises housing 32-10 for housing said fluid-transfer article (not shown) and at least one other internal component. The particular housing 32-10 illustrated in FIG. 91 comprises a tubular member, which may be generally cylindrical in form, and which is configured to be received within the receptacle of the apparatus. First end 16-10 of the aerosol carrier 14-10 is for location to oppose the heater of the apparatus, and second end 18-10 (and the region adjacent the second end 18-10) is configured for insertion into a user's mouth.

FIG. 92 illustrates some internal components of the aerosol carrier 14-10 and of the heater 24-10 of apparatus 12-10.

Further components not shown in FIGS. 92 and 93 (see FIGS. 98 and 99) comprise: an inlet conduit, via which air can be drawn into the aerosol carrier 14-10; an outlet conduit, via which an air stream entrained with aerosol can be drawn from the aerosol carrier 14-10; a filter element; and a reservoir for storing aerosol precursor material and for providing the aerosol precursor material to the fluid-transfer article 34-10.

In FIGS. 92 and 93, the aerosol carrier is shown as comprising the fluid-transfer article 34-10 located within housing 32-10. The material forming the fluid transfer article 34-10 comprises a porous structure, where pore diameter size varies between one end of the fluid-transfer article 34-10 and another end of the fluid-transfer article. In the illustrative examples of FIGS. 92 and 93, the pore diameter size gradually decreases from a first end remote from heater 24-10 (the upper end as shown in the figure) to a second end proximal heater 24-10 (the lower end as shown in the figure). Although the figure illustrates the pore diameter size changing in a step-wise manner from the first to the second end (i.e., a first region with pores having a diameter of a first size, a second region with pores having a diameter of a second, smaller size, and a third region with pores having a diameter of a third, yet smaller size), the change in pore size from the first end to the second end may be gradual rather than step-wise. This configuration of pores having a decreasing diameter size from the first end and second end can provide a wicking effect, which can serve to draw fluid from the first end to the second end of the fluid-transfer article 34-10.

The fluid-transfer article 34-10 comprises a first region **34*a*-10 for holding an aerosol precursor. In one or more arrangements, the first region 34*a*-10 of the fluid-transfer article 34-10 comprises a reservoir for holding the aerosol precursor. The first region 34*a*-10 can be the sole reservoir of the aerosol carrier 14-10, or it can be arranged in fluid communication with a separate reservoir, where aerosol precursor is stored for supply to the first region 34*a*-10**.

The fluid-transfer article 34-10 also comprises a second region **34*b*-10. Aerosol precursor is drawn from the first region 34*a*-10 to the second region 34*b*-10 by the wicking effect of the substrate material forming the fluid transfer article. Thus, the first region 34*a*-10 is configured to transfer the aerosol precursor to the second region 34*b*-10 of the article 34-10**.

At the second end of fluid-transfer article 34-10, the surface of the second region **34*b*-10 defines an activation surface 38-10. The activation surface 38-10 is discontinuous such that at least one channel 40-10 is formed in the activation surface 38-10. In some arrangements, the discontinuities may be such that the activation surface 38-10** is undulating.

In the illustrative examples of FIGS. 92 and 93, the activation surface 38-10 comprises a plurality of grooves or valleys therein to form an undulating surface, the grooves or valleys being disposed in a parallel arrangement across the activation surface 38-10. Thus, there are a plurality of channels 40-10 in the activation surface 38-10.

In the illustrative example of FIG. 92, the grooves or valleys in the activation surface 38-10 provide alternating peaks and troughs that give rise to a "saw-tooth" type profile. In one or more optional arrangements, the activation surface may comprise a "castellated" type profile (i.e., a "square wave" type profile), for example, such as illustrated in the example of FIG. 93. In one or more optional arrangements, the activation surface may comprise a "sinusoidal" type profile. The profile may comprise a mixture of two or more of the above profiles given as illustrative examples.

In the illustrative examples of FIGS. 92 and 93, the first region **34*a*-10 of the fluid-transfer article 34-10 is located at an "upstream" end of the fluid-transfer article 34-10 and the second region 34*b*-10 is located at a downstream" end of the fluid-transfer article 34-10. That is, aerosol precursor is wicked, or is drawn, from the "upstream" end of the fluid-transfer article 34-10 to the "downstream" end of the fluid-transfer article 34-10 (as denoted by arrow A in FIG. 92**).

The aerosol precursor is configured to release an aerosol and/or vapor upon heating. Thus, when the activation surface 38-10 receives heat conveyed from the heater, the aerosol precursor held at the activation surface 38-10 is heated. The aerosol precursor, which is captively held in material of the fluid-transfer article at the activation surface 38-10 is released into an air stream flowing through the channels 40-10.

The shape and/or configuration of the activation surface 38-10 and the associated shape(s) and/or configuration(s) of the one or more channels 40-10 formed in the activation surface permit air to flow across the activation surface 38-10 (through the one or more channels 40-10) and also increase the surface area of the activation surface 38-10 of the fluid-transfer article 34-10 that is available for contact with a flow of air across the activation surface 38-10.

As mentioned above, the apparatus has a heater. In the illustrated examples of FIGS. 92 and 93, the heater is formed by conductive fluid which is applied to parts of the activation surface 38-10 and dried thereon, to form conductive heater elements 24-10. In FIG. 92, the conductive elements 24-10 are formed on the peaks of the activation surface 38-10, and in FIG. 93 they are formed on the lowermost part of the castellations. The heater elements 24-10 are connected e.g., to the battery 28-10 via e.g., suitable electrical connections of the coupling 30-10.

In accordance with one preferred arrangement, the heater elements 24-10 are formed by dipping the activation surface 38-10 into liquid conductive fluid, so that the conductive fluid adheres or otherwise attaches to the appropriate parts of the activation surface 38-10. The conductive material is then dried, so that the conductive fluid becomes solid, thereby forming the heater elements 24-10. A material generally known as carbo e-therm may be used as the conductive fluid, although other known conductive fluids may be used instead. Dipping of the activation surface 38-10 in to the conductive fluid thus becomes a simple way to produce the heater in contact with the activation surface 38-10, the heater elements 24-10 forming the active part of that heater.

In the arrangement of FIG. 92, the heater elements 24-10 are formed only on the peaks of the activation surface, with the rest of the activation surface 38-10 being exposed in the channels 40-10. The heater elements 24-10 may limit or restrict the release of the aerosol and/or vapor on heating, as they cover parts of the activation surface, but the size of the heater elements 24-10 will also affect the amount of heat that can be transferred to the fluid-transfer article 34-10. Hence, it may be necessary to make the heater elements larger, so that they extend at least partially on the side walls of the channels 40-10 between the peaks and troughs in FIG. 92 Similarly, in the arrangement of FIG. 93, the heater elements 24-10 are shown on the flat surfaces of the castellations, but they may again extend on the side walls thereof if a greater heating area is needed.

In the illustrative examples of FIGS. 92 and 93, the heater elements 24-10 are also in contact with a base plate 33-10 of the casing 32-10, which base plate 33-10 is between the channels 40-10 and the coupling 30-10. It is possible, however, for there to be a gap between the heater elements 24-10 and the base plate 33-10. In such a case, air may pass from one channel 40-10 to another around the heater elements 24-10.

Figure 94:
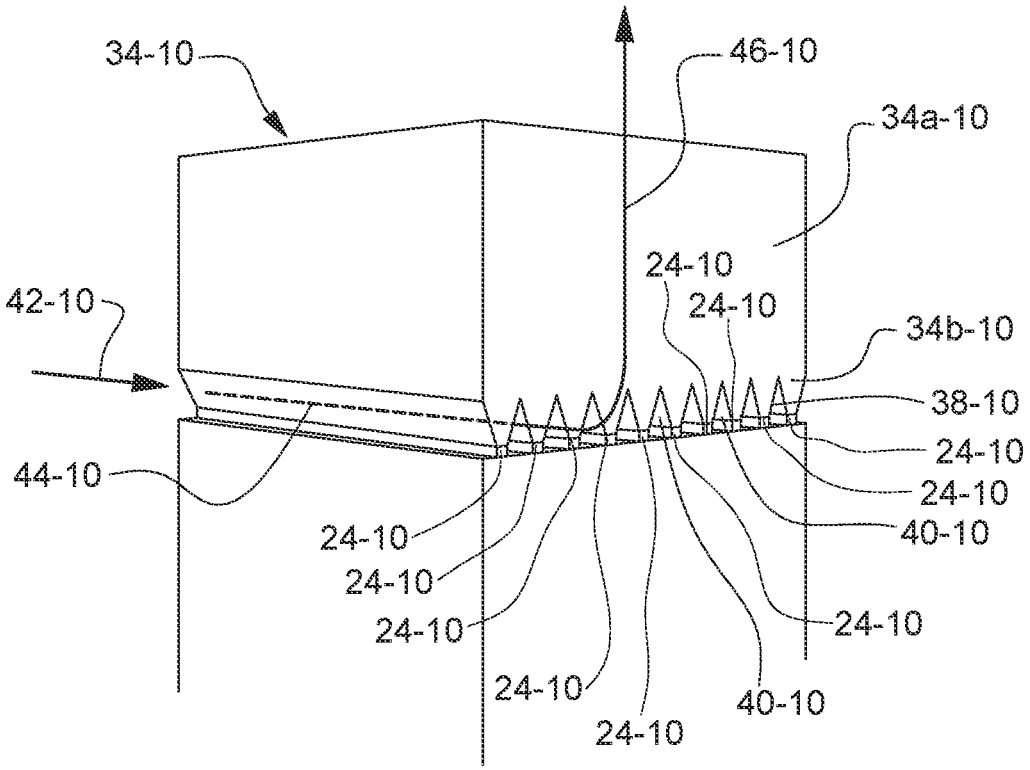
FIG. 94 is a perspective view illustration of the aerosol carrier and of part of an apparatus of the system for aerosol delivery according to one or more embodiments of the tenth mode of the present disclosure.
Figure 95:
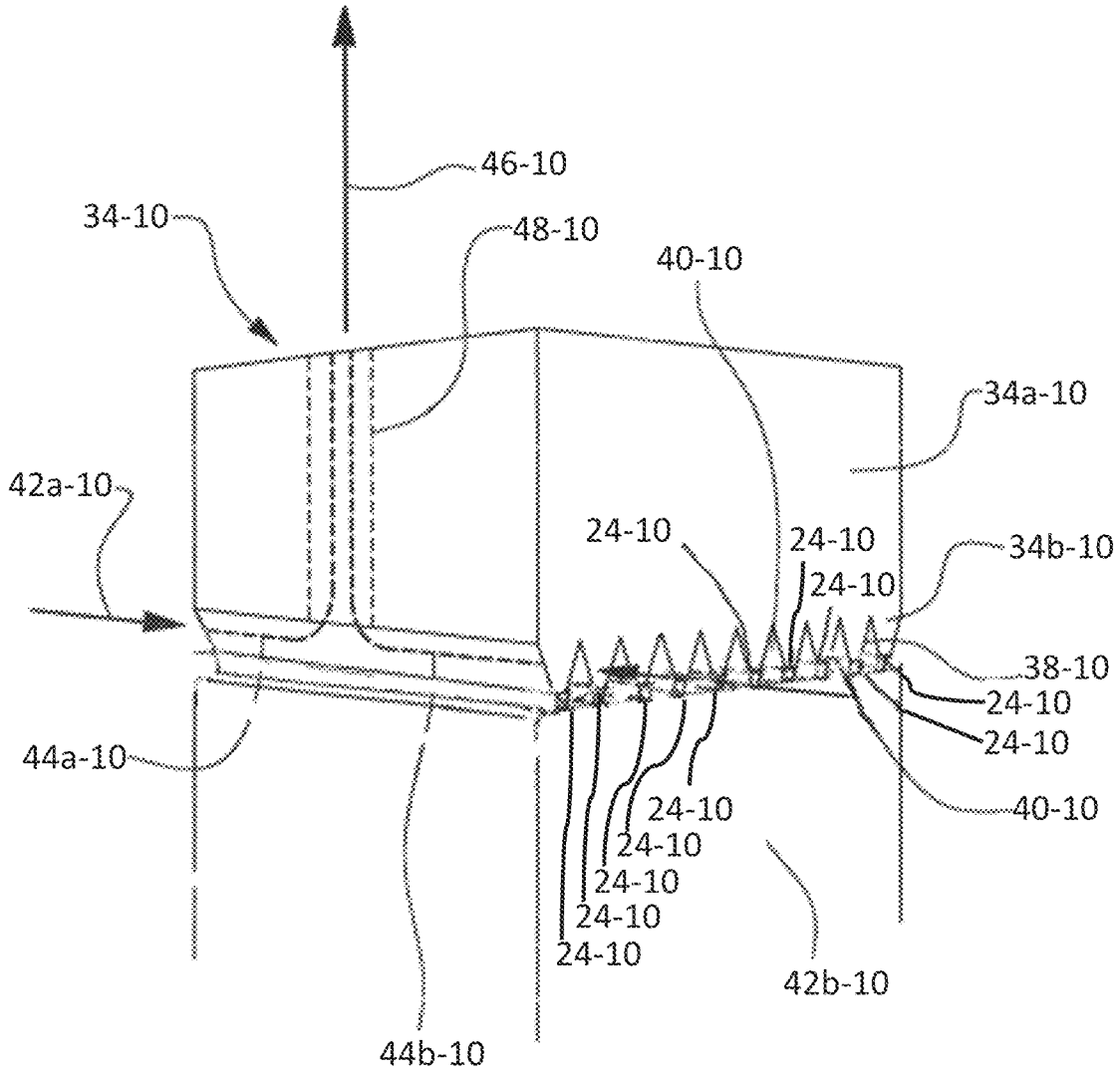
FIG. 95 is a perspective view illustration of the aerosol carrier and of part of an apparatus of the system for aerosol delivery according to one or more embodiments of the tenth mode of the present disclosure.

FIGS. 94 and 95 show perspective view illustrations of the fluid-transfer article 34-10 of aerosol carrier and heater elements 24-10 of the apparatus of the system for aerosol delivery. In particular, these figures illustrate air flows across the activation surface 38-10 when the apparatus is in use in a first arrangement of the fluid-transfer article 34-10 (see FIG. 94), and in a second arrangement of the fluid-transfer article 34-10 (see FIG. 95).

In the illustrated example of use of the apparatus schematically illustrated in FIG. 94, when a user sucks on a mouthpiece of the apparatus, air is drawn into the carrier through inlet apertures (not shown) provided in a housing of the carrier. An incoming air stream 42-10 is directed to the activation surface 38-10 of the fluid-transfer article 34-10 (e.g., via a fluid communication pathway within the housing of the carrier). When the incoming air stream 42-10 reaches a first side of the activation surface 38-10, the incoming air stream 42-10 flows across the activation surface 38-10 via the one or more channels 40-10. The air stream flowing through the one or more channels 40-10 is denoted by dashed line 44-10 in FIG. 94 As the air stream 44-10 flows through the one or more channels 40-10, aerosol precursor at activation surface 38-10, across which the airstream 44-10 flows, is released from the activation surface 38-10 by heat conveyed to the activation surface from the heater elements 24-10. Aerosol precursor released from the activation surface 38-10 in this manner is then entrained in the air stream 44-10 flowing through the one or more channels 40-10.

In use, the heater elements 24-10 of the apparatus 12-10 convey heat to the fluid transfer article 34-10 to raise the temperature of the activation surface 38-10 to a sufficient temperature to release, or liberate, captive substances (i.e., the aerosol precursor) held at the activation surface 38-10 of the fluid-transfer article 34-10 to form a vapor and/or aerosol, which is drawn downstream across the activation surface 38-10 of the fluid-transfer article. As the air stream 44-10 continues its passage in the one or more channels 40-10, more released aerosol precursor is entrained within the air stream 44-10. When the air stream 44-10 entrained with aerosol precursor exits the one or more channels 40-10 at a second side of the activation surface 38-10, it is directed to an outlet, from where it can be inhaled by the user via a mouthpiece. An outgoing air stream 46-10 entrained with aerosol precursor is directed to the outlet (e.g., via a fluid communication pathway within the housing of the carrier).

Therefore, operation of the apparatus will cause heat from the heater elements 24-10 to be transferred to the activation surface 38-10 of the fluid-transfer article. At a sufficiently high temperature, captive substances held at the activation surface 38-10 of the fluid-transfer article 34-10 are released, or liberated, to form a vapor and/or aerosol. Thus, when a user draws on a mouthpiece of the apparatus, the released substances from the fluid-transfer article are drawn away from the activation surface 38-10 (entrained in a stream of air) and condense to form an aerosol that is drawn through a gas communication pathway for delivery to an outlet, which is in fluid communication with the mouthpiece.

As the aerosol precursor is released from the activation surface 38-10, a wicking effect of the fluid-transfer article 34-10 causes aerosol precursor within the body of the fluid-transfer article to migrate to the activation surface 38-10 to replace the aerosol precursor released from the activation surface 38-10 into air stream 44-10.

Operation of the heater elements 24-10 is controlled by control circuitry (not shown), which is operable to actuate the heater elements 24-10 responsive to an actuation signal from a switch operable by a user or configured to detect when the user draws air through a mouthpiece of the apparatus by sucking or inhaling. In an optional arrangement, the control circuitry operates to actuate the heater elements 24-10 with as little delay as possible from receipt of the actuation signal from the switch, or detection of the user drawing air through the mouthpiece. This may affect near instantaneous heating of the activation surface 38-10 of the fluid-transfer article 34-10.

In the illustrated example of use of the apparatus schematically illustrated in FIG. 95, rather than the case of FIG. 94 where air is drawn toward the activation surface 38-10 from one side only (and exits from the one or more channels 40-10 at an opposite side), a gas communication pathway for an incoming air stream is configured to deliver the incoming air stream to the activation surface 38-10 from both sides of the fluid-transfer article, and thus from both ends of the channels 40-10 formed therein. In such an arrangement, a gas communication pathway for an outlet airstream may be provided through the body of the fluid-transfer article 34-10. An outlet fluid communication pathway for an outlet airstream in the illustrative example of FIG. 95 is denoted by reference number 48-10.

Thus, in the illustrative example of FIG. 95, when a user draws on a mouthpiece of the apparatus, air is drawn into the carrier 14-10 through inlet apertures (not shown) provided in a housing of the carrier. An incoming air stream 42-10*a* from a first side is directed to a first side of the activation surface 38-10 of the fluid-transfer article 34-10 (e.g., via a gas communication pathway within the housing of the carrier 14-10). An incoming air stream 42-10*b* from a second side is directed to a second side of the activation surface 38-10 of the fluid-transfer article 34-10 (e.g., via a gas communication pathway within the housing of the carrier 14-10). When the incoming air stream 42-10*a* from the first side reaches the first side of the activation surface 38-10, the incoming air stream 42-10*a* flows across the activation surface 38-10 via the one or more channels 40-10. Likewise, when the incoming air stream 42-10*b* from the second side reaches the second side of the activation surface 38-10, the incoming air stream 42-10*b* flows across the activation surface 38-10 via the one or more channels 40-10. The air streams 42*a*-10, 42*b*-10 from each side flowing through the one or more channels 40-10 are denoted by dashed lines 44*a*-10 and 44*b*-10 in FIG. 95 As air streams 44*a*-10 and 44*b*-10 flow through the one or more channels 40-10, aerosol precursor in the activation surface 38-10, across which the air streams 44*a*-10 and 44*b*-10 flow, is released from the activation surface 38-10 by heat conveyed to the activation surface from the heater elements 24-10. Aerosol precursor released from the activation surface 38-10 is entrained in air streams 44*a*-10 and 44*b*-10 flowing through the one or more channels 40-10.

In use, the heater elements 24-10 of the apparatus 12-10 convey heat to the fluid-transfer article 34-10 to raise a temperature of the activation surface 38-10 to a sufficient temperature to release, or liberate, captive substances (i.e., the aerosol precursor) held at the activation surface 38-10 of the fluid-transfer article 34-10 to form a vapor and/or aerosol, which is drawn downstream across the activation surface 38-10 of the fluid-transfer article. As the air streams 44*a*-10 and 44*b*-10 continue their passages in the one or more channels 40-10, more released aerosol precursor is entrained within the air streams 44*a*-10 and 44*b*-10. When the air streams 44*a*-10 and 44*b*-10 entrained with aerosol precursor meet at a mouth of the outlet fluid communication pathway 48-10, they enter the outlet fluid communication pathway 48-10 and continue until they exit outlet fluid communication pathway 48-10, either as a single outgoing air stream 46-10 (as shown), or as separate outgoing air streams. The outgoing air stream 46-10 is directed to an outlet, from where it can be inhaled by the user via a mouthpiece. The outgoing air stream 46-10 entrained with aerosol precursor is directed to the outlet (e.g., via a gas communication pathway within the housing of the carrier 14-10).

Figure 96:
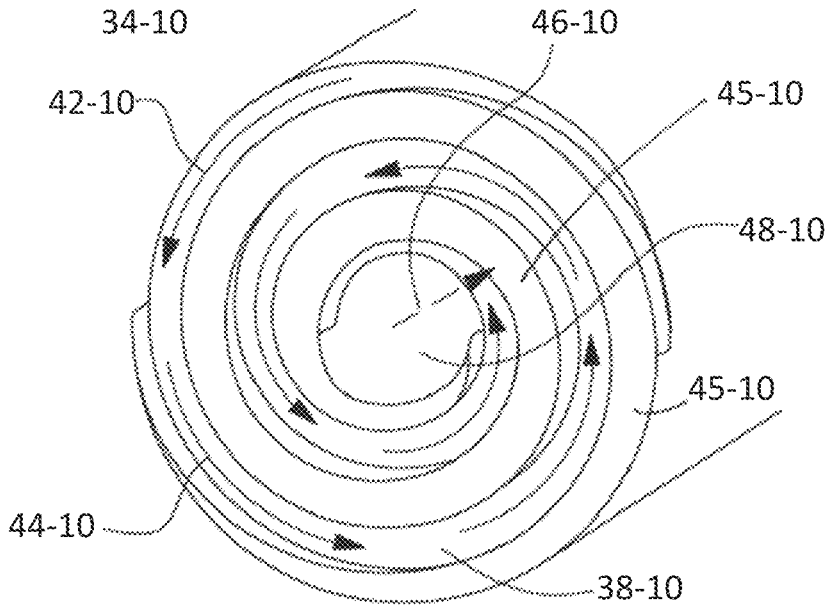
FIG. 96 is a perspective end view illustration of a fluid-transfer article of the aerosol carrier according to one or more embodiments of the tenth mode of the present disclosure.
Figure 97:
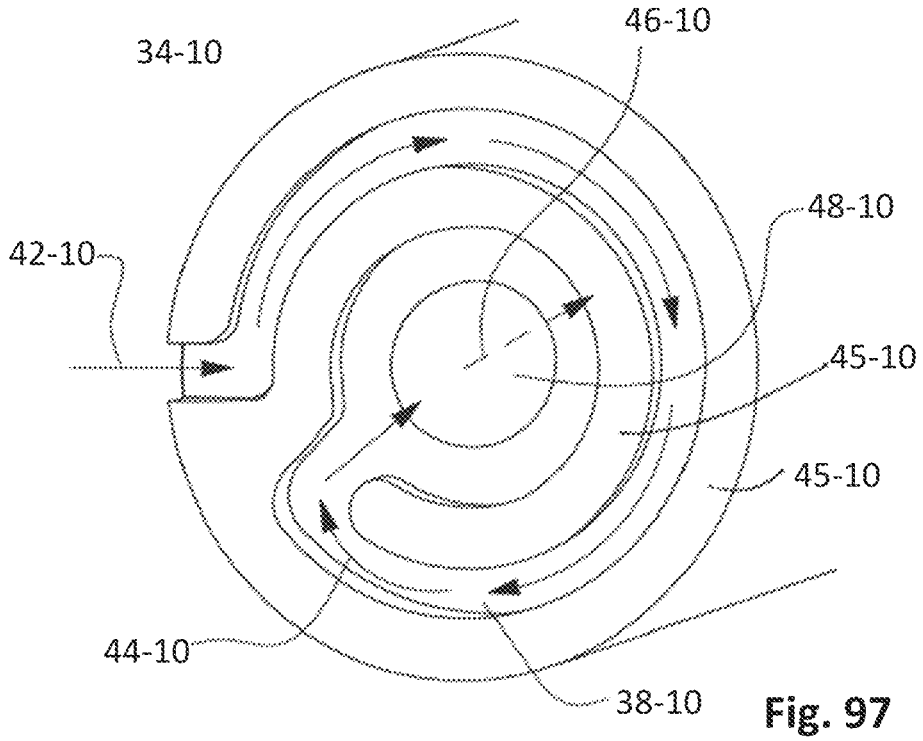
FIG. 97 is a perspective end view illustration of a fluid-transfer article of the aerosol carried according to one or more embodiments of the tenth mode of the present disclosure.

FIGS. 96 and 97 are perspective end view illustrations of a fluid-transfer article 34-10 of the aerosol carrier according to one or more arrangements. These figures show different types of channel configurations as illustrative examples. In both illustrative examples of a channel configuration, as shown in FIGS. 96 and 97, the fluid-transfer article 34-10 comprises a cylindrical member, which comprises a central bore extending therethrough for fluid communication between the activation surface 38-10 and an outlet, from where an outgoing air stream can be delivered for inhalation. The central bore serves as a fluid communication pathway 48-10 (e.g., as described above in relation to FIG. 96). Note that, in the arrangements of FIGS. 96 and 97, the channels 40-10 extend radially and the sectional views of FIGS. 96 and 97 are along the length of two channels at opposite radial positions relative to the central bore of the fluid-transfer article. The heating elements 24-10 are therefore not visible in FIGS. 96 and 97, although they will be present in similar positions, relative to the channels 40-10, as the heating elements 24-10 and channels 40-10 in FIGS. 92 to 95.

In both illustrative examples of FIGS. 96 and 97, an incoming air stream 42-10 is directed to a mouth of a channel 40-10 formed between the activation surface 38-10 of the fluid-transfer article 34-10 and conduction element (not shown), or between the activation surface 38-10 and a heater (not shown). In both illustrative examples of FIGS. 96 and 97, the mouth of the channel 40-10 is located at an outer edge of the fluid-transfer article 34-10 and an exit from the channel 40-10 (in fluid communication with the fluid communication pathway 48-10) is located toward a center of the fluid-transfer article. Therefore, the incoming air stream 42-10 enters the channel 40-10 via channel mouth at the outer edge of the fluid-transfer article 34-10 and moves toward the center of the fluid-transfer article 34-10 as directed by the channel 40-10. As described above, as the air stream passes across activation surface 38-10 through channel 40-10, aerosol precursor is released from the activation surface 38-10 and is entrained in air stream 44-10. Air stream 44-10 continues to flow through the channel 40-10 until it reaches an exit thereof, from where it enters the fluid communication pathway 48-10 and proceeds as an outgoing air stream 46-10 entrained with aerosol precursor toward the outlet.

In both illustrative examples of FIGS. 96 and 97, the heater elements 24-10 are not shown, but they will be formed on the raised parts 45-10 of the activation surface, and optionally on part of the sides of the channels 40-10.

In both illustrative examples of FIGS. 96 and 97, the valleys or grooves of the activation surface 38-10 that form part of the channel 40-10 are arranged to define a circuitous route 20-10 across the activation surface. In the illustrative examples, the route is a spiral path, but in optional arrangements, may be meandering or circuitous in some other manner. In optional arrangements, the activation surface may be located to face outwardly from the cylinder, such that the groove(s) or valley(s) may be in the outer surface of the cylinder forming the fluid-transfer article. These grooves or valleys may be arranged in parallel in a direction along the length of the cylinder. The groove(s) or valley(s) may be arranged in a spiral manner around the outside of the cylinder. In optional arrangements, the activation surface 38-10 may be located to face inwardly from the cylinder (i.e., surrounding the central bore), such that the groove(s) or valley(s) may be in the inner surface of the cylinder forming the fluid-transfer article 34-10. These grooves or valleys may be arranged in parallel in a direction along the length of the cylinder. The groove(s) or valley(s) may be arranged in a spiral manner around the inside of the cylinder.

Figure 98:
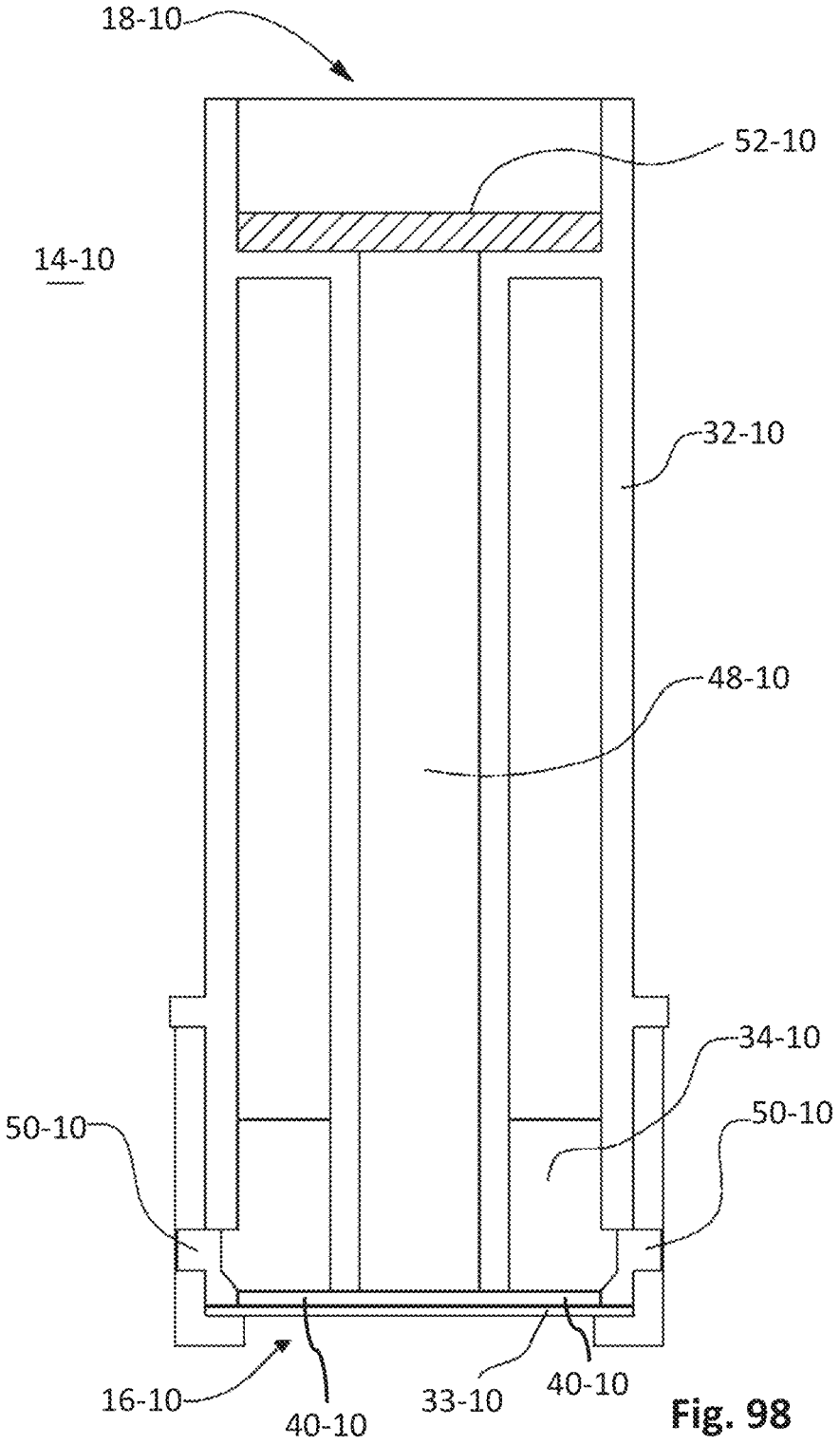
FIG. 98 is a cross-section side view of an aerosol carrier according to one or more embodiments of the tenth mode of the present disclosure.
Figure 99:
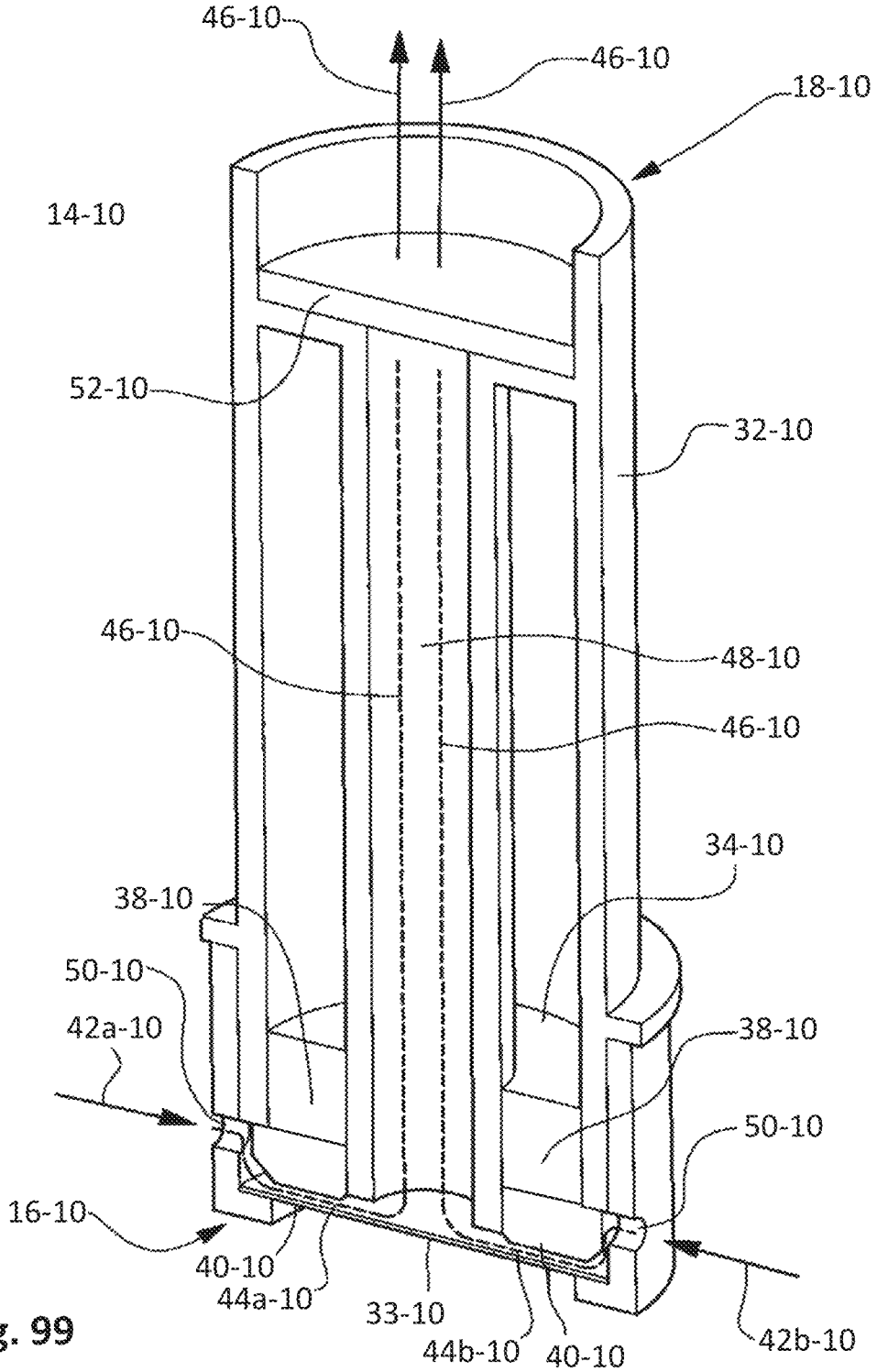
FIG. 99 is a perspective cross-section side view of the aerosol carrier of FIG. 98.

FIGS. 98 and 99 illustrate an aerosol carrier 14-10 according to one or more possible arrangements in more detail. FIG. 98 is a cross-section side view illustration of the aerosol carrier 14-10 and FIG. 99 is a perspective cross-section side view illustration of the aerosol carrier 14-10 of FIG. 98.

As can be seen from FIGS. 98 and 99, the aerosol carrier 14-10 is generally tubular in form. The aerosol carrier 14-10 comprises housing 32-10, which defines the external walls of the aerosol carrier 14-10 and which defines therein a chamber in which are disposed the fluid-transfer article 34-10 (adjacent the first end 16-10 of the aerosol carrier 14-10) and internal walls defining the fluid communication pathway 48-10. Fluid communication pathway 48-10 defines a fluid pathway for an outgoing air stream from the channels 40-10 to the second end 18-10 of the aerosol carrier 14-10. In the examples illustrated in FIGS. 98 and 99, the fluid-transfer article 34-10 is an annular shaped element located around the fluid communication pathway 48-10, and the channels 40-10 formed so as to extend radially across its activation surface.

In walls of the housing 32-10, there are provided inlet apertures 50-10 to provide a fluid communication pathway for an incoming air stream to reach the fluid-transfer article 34-10, and particularly the one or more channels 40-10 in the activation surface of the fluid-transfer article 34-10. Note that, although the heater elements 24-10 are not shown in FIGS. 98 and 99, will be present on the activation surface 38-10 parts other than at the channels 40-10.

In the illustrated example of FIGS. 98 and 99, the aerosol carrier 14-10 further comprises a filter element 52-10. The filter element 52-10 is located across the fluid communication pathway 48-10 such that an outgoing air stream passing through the fluid communication pathway 48-10 passes through the filter element 52-10.

With reference to FIG. 99, when a user sucks on a mouthpiece of the apparatus (or on the second end 18-10 of the aerosol carrier 14-10, if configured as a mouthpiece), air is drawn into the carrier through inlet apertures 50-10 extending through walls in the housing 32-10 of the aerosol carrier 14-10. An incoming air stream 42-10*a* from a first side of the aerosol carrier 14-10 is directed to a first side of the activation surface 38-10 of the fluid-transfer article 34-10 (e.g., via a gas communication pathway within the housing of the carrier). An incoming air stream 42-10*b* from a second side of the aerosol carrier 14-10 is directed to a second side of the activation surface 38-10 of the fluid-transfer article 34-10 (e.g., via a gas communication pathway within the housing of the carrier). When the incoming air stream 42-10*a* from the first side of the aerosol carrier 14-10 reaches the first side of the activation surface 38-10, the incoming air stream 42-10*a* from the first side of the aerosol carrier 14-10 flows across the activation surface 38-10 via the one or more channels 40-10 in the activation surface 38-10. Likewise, when the incoming air stream 42-10*b* from the second side of the aerosol carrier 14-10 reaches the second side of the activation surface 38-10, the incoming air stream 42-10*b* from the second side of the aerosol carrier 14-10 flows across the activation surface 38-10 via the one or more channels 40-10 in the activation surface 38-10. The air streams from each side flowing through the one or more channels 40-10 are denoted by dashed lines 44*a*-10 and 44*b*-10 in FIG. 99 As air streams 44*a*-10 and 44*b*-10 flow through the one or more channels 40-10, aerosol precursor in the activation surface 38-10, across which the air streams 44*a*-10 and 44*b*-10 flow, is released from the activation surface 38-10 by heat conveyed to the activation surface from the heater elements 24-10. Aerosol precursor released from the activation surface 38-10 is entrained in air streams 44*a*-10 and 44*b*-10 flowing through the one or more channels 40-10.

In use, the heater elements 24-10 of the apparatus 12-10 convey heat to the activation surface 38-10 of the fluid-transfer article 34-10 to raise a temperature of the activation surface 38-10 to a sufficient temperature to release, or liberate, captive substances (i.e., the aerosol precursor) held at the activation surface 38-10 of the fluid-transfer article 34-10 to form a vapor and/or aerosol, which is drawn downstream across the activation surface 38-10 of the fluid-transfer article 34-10. As the air streams 44*a*-10 and 44*b*-10 continue their passages in the one or more channels 40-10, more released aerosol precursor is entrained within the air streams 44*a*-10 and 44*b*-10. When the air streams 44*a*-10 and 44*b*-10 entrained with aerosol precursor meet at a mouth of the outlet fluid communication pathway 48-10, they enter the outlet fluid communication pathway 48-10 and continue until they pass through filter element 52-10 and exit outlet fluid communication pathway 48-10, either as a single outgoing air stream, or as separate outgoing air streams 46-10 (as shown). The outgoing air streams 46-10 are directed to an outlet, from where it can be inhaled by the user directly (if the second end 18-10 of the aerosol capsule 14-10 is configured as a mouthpiece), or via a mouthpiece. The outgoing air streams 46-10 entrained with aerosol precursor are directed to the outlet (e.g., via a gas communication pathway within the housing of the carrier).

When the user initially draws on a mouthpiece of the apparatus (or one the second end 18-10 of the aerosol carrier 14-10, if configured as a mouthpiece), this will cause an air column located in the fluid communication pathway 48-10 to move towards the outlet. In turn, this will draw air into the fluid communication pathway from the one or more channels 40-10. This will cause a pressure drop in the channels 40-10. To equalize the pressure in the channels 40-10, air will be drawn into the aerosol carrier 14-10, and thus into the channels 40-10 via the inlet apertures 50-10. During the period of lower pressure in the one or more channels 40-10 when the user begins to draw, aerosol precursor in the fluid-transfer medium will be released into the channels from the activation surface 38-10, because the aerosol precursor is drawn into the one or more channels by way of the lower pressure. This effect is in addition to the effect of releasing the aerosol precursor from the activation surface 38-10 by way of heat conveyed from the heater. The drawing of the aerosol precursor from the activation surface 38-10 by way of the user sucking on the mouthpiece of the apparatus (or one the second end 18-10 of the aerosol carrier 14-10, if configured as a mouthpiece) may produce a dragging effect on the volumetric rate of flow experienced by the user during a suction action, i.e., the user may have to suck harder to achieve a same volumetric rate of flow. This effect may manifest itself as a similar physical sensation experienced by the user as those experienced from a traditional smoking or tobacco product.

Figure 100:
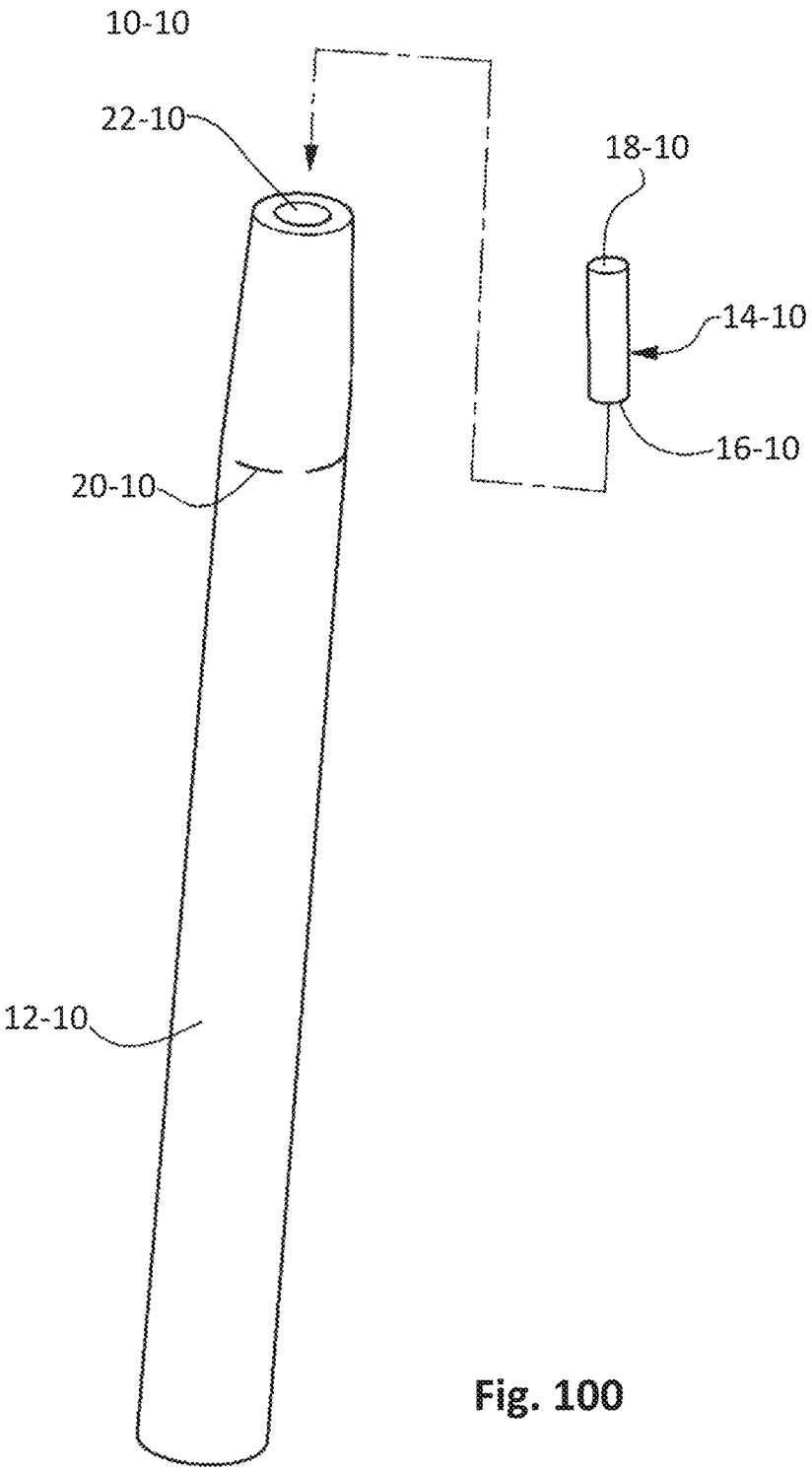
FIG. 100 is an exploded perspective view illustration of a kit-of-parts for assembling a system according to one or more embodiments of the tenth mode of the present disclosure.

FIG. 100 is an exploded perspective view illustration of a kit-of-parts for assembling an aerosol delivery system 10-10.

As will be appreciated, in the arrangements described above, the fluid-transfer article 34-10 is provided within a housing 32-10 of the aerosol carrier 14-10. In such arrangements, the housing of the carrier 14-10 serves to protect the aerosol precursor-containing fluid-transfer article 34-10, whilst also allowing the carrier 14-10 to be handled by a user without his/her fingers coming into contact with the aerosol precursor liquid retained therein. In such arrangements, it will be appreciated that the carrier 14-10 has a multi-part construction. In some cases, this might be considered somewhat disadvantageous because it requires a relatively complicated assembly procedure which can be both time-consuming and expensive.

Figure 101:
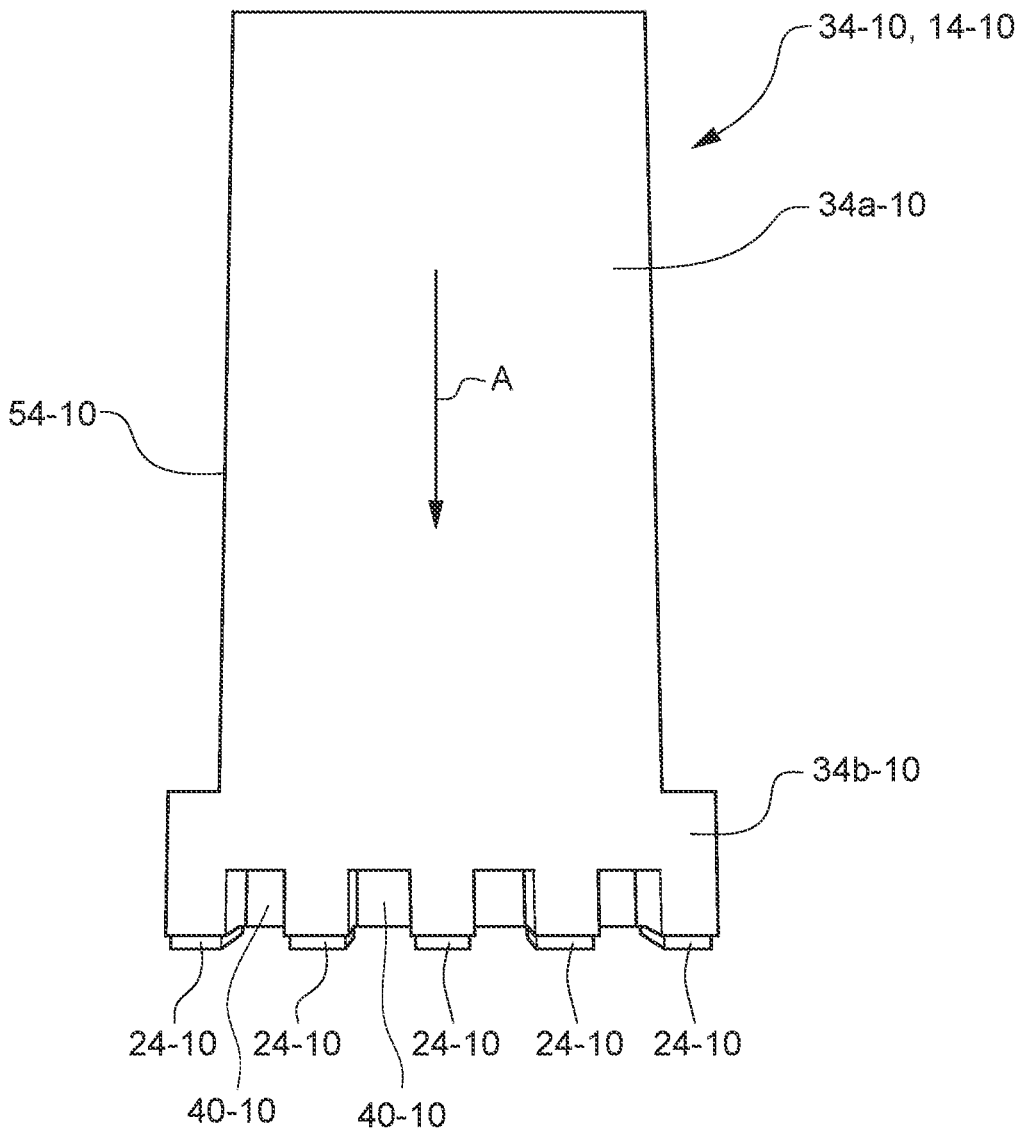
FIG. 101 is a cross-section side view of elements of an aerosol carrier and of part of an apparatus of the system for aerosol delivery according to one or more embodiments of the tenth mode of the present disclosure.

Turning now to consider FIG. 101, there is illustrated another possible aspect of the tenth mode of the fluid-transfer article 34-10, which may be employed in some arrangements, and which may permit the creation of a significantly simplified carrier 14-10.

FIG. 101 illustrates an alternative fluid-transfer article 34-10 with airflow channels 40-10 in the activation surface 38-10. In the arrangement of FIG. 101, the substrate forming the fluid-transfer article 34-10 again comprises a porous material where pores of the porous material hold, contain, carry, or bear the aerosol precursor material. It is envisaged, for example, that the same types of substrate material may be used in the arrangement illustrated in FIG. 101 as in the previously-described arrangements. In particular, therefore, the porous material of the fluid-transfer article 34-10 may be a polymeric wicking material. However, in the arrangement illustrated in FIG. 101, the substrate material includes an integrally formed peripheral wall 54-10.

It is proposed that the peripheral wall 54-10 may be formed by treating the outermost surface of the porous substrate material of the fluid-transfer article 34-10 so as to render the surface substantially liquid-impermeable. For example, it is envisaged that in some arrangements the substrate material may be locally heated so as to fuse the material and close up its internal pores in the localized region of the surface. Alternatively, it is envisaged that the substrate material may be treated by a sintering process in order to create the liquid-impermeable peripheral wall 54-10. The peripheral wall 54-10 may alternatively be created by a chemical treatment process to render the substrate material substantially liquid-impermeable in the region of its outermost surface. As will therefore be appreciated, the peripheral wall 54-10 may be considered to take the form of a skin formed from the material of the substrate itself.

The peripheral wall may be created in this manner so as to substantially completely circumscribe the substrate material. It is to be appreciated, however, that the activation surface 38-10 of the fluid-transfer article 34-10 will not be treated in this manner, thereby ensuring that it will retain the function described above in detail in cooperation with the heater elements 24-10. The thickness of the peripheral wall 54-10 formed from the substrate may vary depending on the desired physical properties of the fluid-transfer article 34-10. For example, a relatively thin wall 54-10 might be desirable in some circumstances, as this may retain some flexibility in the material, thereby providing a fluid-transfer article which will feel soft in the hands of a user. Alternatively, a relatively thick peripheral wall 54-10 might be desirable in arrangements where the wall 54-10 is required to provide some structural rigidity to the fluid-transfer article 34-10. The wall 54-10 may therefore have a thickness of less than 3 mm; or less than 2.5 mm; or less than 2 mm; or less than 1.5 mm; or less than 1 mm; or less than 0.9 mm; or less than 0.8 mm; or less than 0.7 mm; or less than 0.6 mm; or less than 0.5 mm; or less than 0.4 mm; or less than 0.3 mm; or less than 0.2 mm; or less than 0.1 mm in some embodiments.

As will be appreciated, the liquid-impermeable nature of the resulting peripheral wall or skin means that the fluid-transfer article 34-10 may be handled by a user without getting his or her fingers wet from the aerosol precursor liquid retained therein. This opens up the possibility of the fluid-transfer article 34-10 being used without an enclosing housing 32-10, as was necessary in the previously-described arrangements. It is therefore envisaged that in some arrangements, the fluid-transfer article 34-10 may itself define an entire aerosol carrier 14-10. Furthermore, it is envisaged that in some embodiments, a fluid-transfer article 34-10 in accordance with this proposal may be provided in the form of a unitary monolithic element of substrate material and could, therefore, take the form of a single-piece consumable or carrier 14-10 for an aerosol-delivery system 10-10, which may be provided pre-filled with aerosol precursor liquid and which may be discarded when the initial volume of precursor has been used. A single-piece consumable of this type offers very significant advantages in terms of cost of manufacture, and from an environmental point of view.

Figure 102:
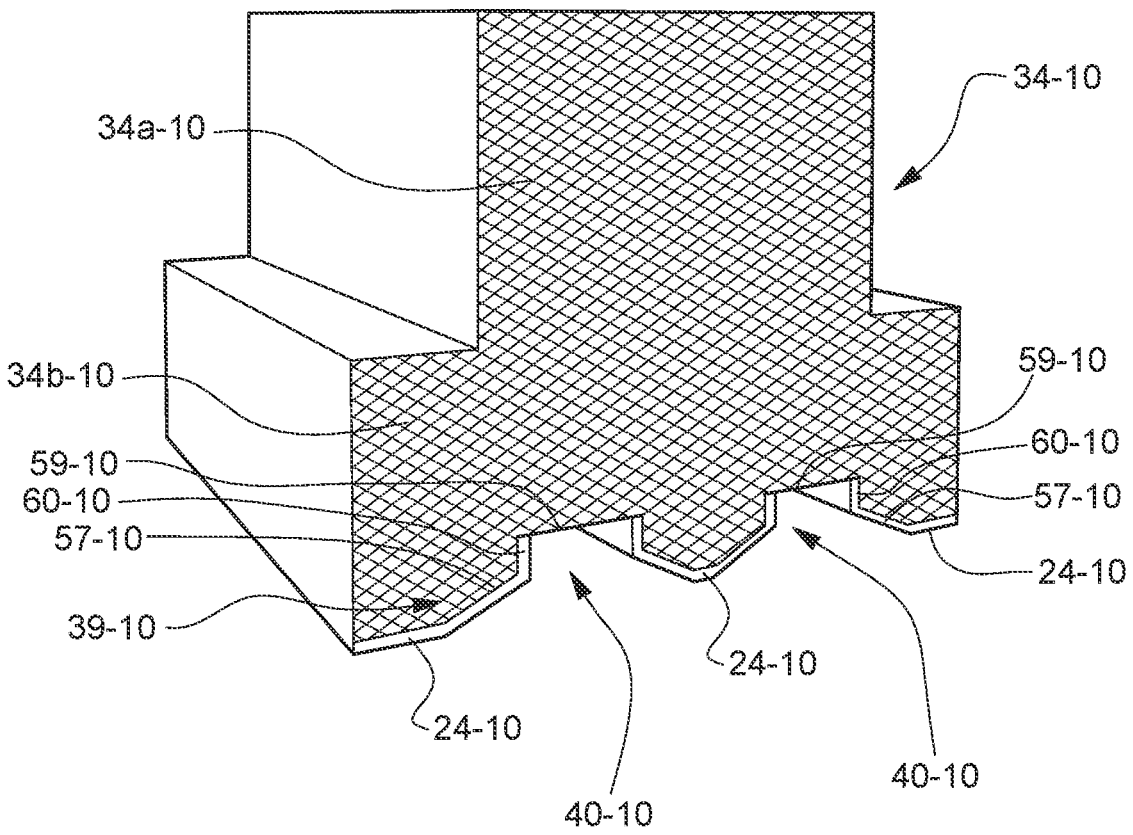
FIG. 102 is a cross-section view of elements of an aerosol carrier and of part of an apparatus of the system for aerosol delivery according to one or more embodiments of the tenth mode of the present disclosure.

Turning now to consider FIG. 102, there is illustrated a fluid-transfer article 34-10 in combination with heater elements 24-10. The fluid-transfer article 34-10 may have a peripheral wall or skin formed in the manner described above, although this is not essential and indeed is not present in the particular arrangement illustrated in FIG. 102. The particular feature of the fluid-transfer article 34-10 illustrated in FIG. 102 which is of relevance is the cross-sectional profile of the channels 40-10 defined in the activation surface 38-10 of the second region **34*b*-10 of the article. As will be noted, the channels 40-10 visible in FIG. 102 have a significantly different profile to the "saw-tooth" type profile illustrated in FIG. 92, and to the "castellated" type profile illustrated in FIG. 93 Nevertheless, as will be explained, the channel profile illustrated in FIG. 102 shares a characteristic with the "saw-tooth" type profile illustrated in FIG. 92**.

The activation surface 38-10 of the arrangement of FIG. 102 is discontinuous in a manner such that it includes a plurality of spaced-apart angled surface portions 57-10. The angled surface portions 57-10 of the activation surface 38-10 are arranged in pairs, the members of each pair cooperating to define opposing angled walls of a respective channel 40-10. In the particular channel configuration illustrated in FIG. 102, each channel 40-10 also comprises a respective ceiling portion 59-10 between the two spaced-apart angled surfaces 57-10. Each channel 40-10 further comprises a pair of opposed side walls 60-10, each of which interconnects an edge of a respective angled surface portion 57-10 and a respective side edge of the ceiling portion 59-10.

In the arrangement of FIG. 102, the heater elements 24-10 cover not only the peaks of the activation surface 38-10, but also the angled surface portions 57-10 in the side walls 60-10. This maximizes the heat that can be transferred to the fluid-transfer article 34-10, but it also has the effect of limiting the parts of the activation surface from which aerosol precursor can pass to the ceiling portions 59-10. If this is found to be insufficient, the side walls 57-10 may be left uncovered by the heater elements 24-10.

In the arrangement illustrated in FIG. 102, the ceiling portion 59-10 of each channel 40-10 presents a substantially planar surface in spaced-relation to the heating surface 55-10. However, as will be explained below in relation to FIG. 93, in other arrangements the ceiling portion may alternatively present an arcuate surface towards the heating surface 55-10.

As will be observed, the "saw-tooth" channel profile illustrated in FIG. 92 can be considered somewhat similar to the profile illustrated in FIG. 102, in the sense that it is also defined by an activation surface 38-10 which is discontinuous in a manner effective to include angled surface portions arranged to form acute intersection angles with a planar heating surface.

It is believed that the aforementioned angled surfaces 57-10, and more particularly their acute intersection angles 58-10 to the heater surface 55-10 aid in the release of liquid aerosol precursor from the substrate material of the fluid-transfer article 34-10. It is believed that the sharp corners defined at the angled points of intersection between the angled surfaces 57-10 and the heater surface 55-10 create improved vaporization sites for the release of aerosol precursor, and allow the liquid to form menisci along the corner edges of the channels 40-10, at the sites of the acute angles 58-10, on the heating surface 55-10. This has been found to promote more efficient and quicker heating and vaporization of the precursor liquid at the heating surface 55-10.

Figure 103:
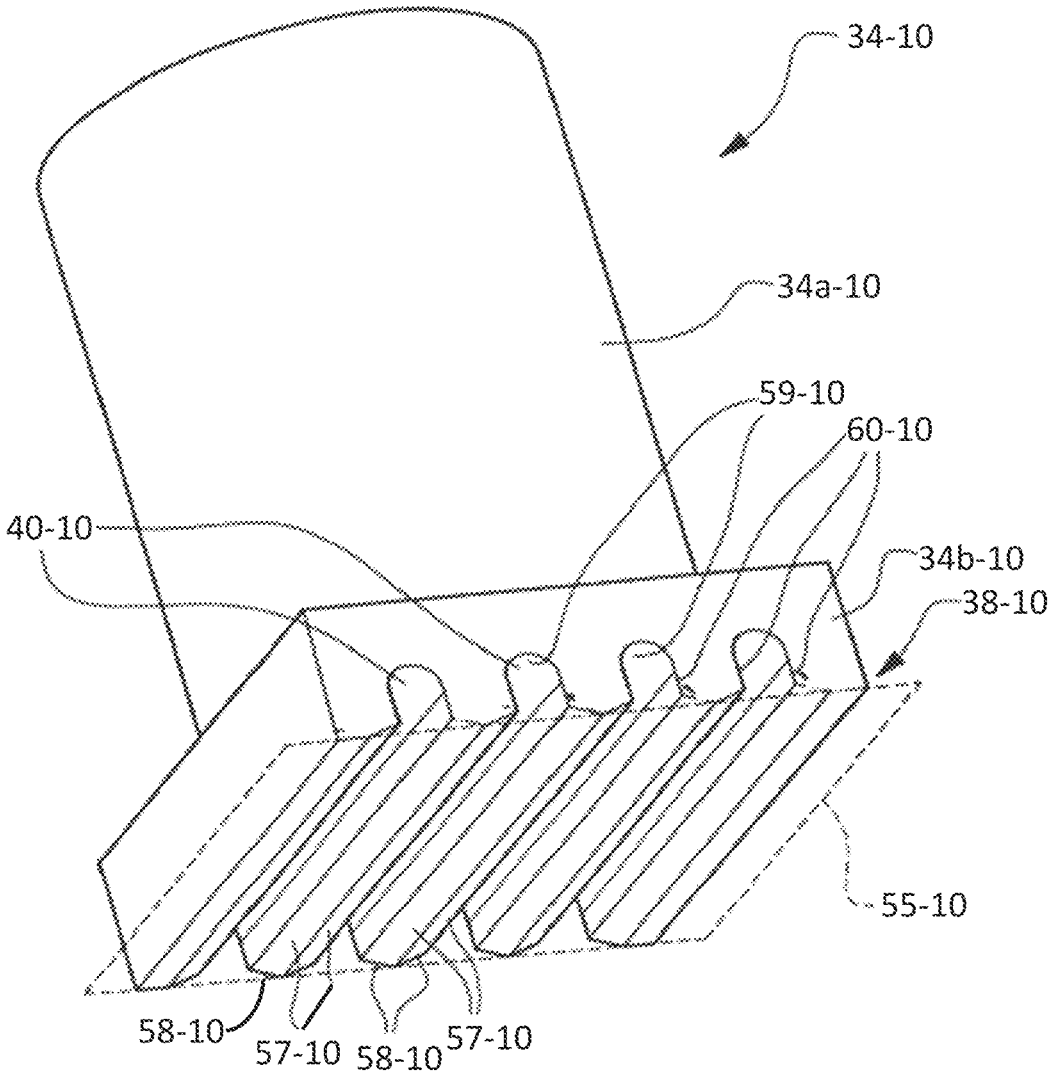
FIG. 103 is a perspective view of a fluid-transfer article of the system for aerosol delivery according to one or more embodiments of the tenth mode of the present disclosure.

Turning now to consider FIG. 103, there is illustrated a fluid-transfer article 34-10 having another configuration of activation surface 38-10. The fluid-transfer article 34-10 is illustrated as viewed from below the activation surface 38-10, and in the absence of heater elements 24-10 for the sake of clarity.

As will be observed from FIG. 103, the activation surface 38-10 is again discontinuous in a manner such that it includes a plurality of spaced-apart angled surface portions 57-10, each of which will form an acute intersection angle with a plane 55-10 aligned with their peaks. In the particular arrangement illustrated, the intersection angles are considerably smaller than in the configuration illustrated in FIG. 102 and may, for example, be less than 20 degrees, although this is not essential.

Furthermore, it will also be observed that the angled surface portions 57-10 of the activation surface 38-10 are again arranged in pairs, the members of each pair cooperating to define opposing angled walls of a respective channel 40-10. In the particular channel configuration illustrated in FIG. 103, each channel 40-10 also comprises a respective pair of generally planar side walls 60-10 which are oriented so as to be substantially perpendicular to the plane 55-10 when the fluid-transfer article 34-10 and a heater 24-10 (or conduction element 36-10) are interengaged. The side walls 60-10 extend upwardly from the edges of respective angled surface portions 57-10, and are interconnected by a ceiling portion 59-10 of the respective channel 40-10. In this arrangement, the ceiling portion 59-10 of each channel 40-10 defines an arcuate surface portion, which it will be understood forms part of the discontinuous activation surface 38-10 of the fluid-transfer article. The arcuate surface portion of each channel 40-10 is arranged to oppose the heating surface 55-10, in spaced-relation thereto, and is concave towards the plane 55-10.

In such an arrangement, the heater elements 24-10 may be formed on the angled surface portions 57-10, and possibly also on parts of the side walls 60-10.

In preferred arrangements of the type illustrated in FIG. 103, it is proposed that the arcuate ceiling portion 59-10 of each channel will blend smoothly into the side walls 60-10 of the channel, thereby eliminating sharp corner edges in the upper region of the channel 40-10. Such sharp corners can be seen, by comparison, in the arrangement of FIG. 102, and are denoted at 61. It has been found that by eliminating such sharp corners from the upper regions of the channels' cross-sectional profile, more efficient release or liberation of the aerosol precursor liquid from the porous substrate of the fluid-transfer article 34-10 may be achieved. This is because it has been found that liquid held in the wicking material has a tendency to collect at sharp corners of the channel profiles. This can present a disadvantage at the top of each channel 40-10. This is because if excessive precursor liquid collects around the upper regions of the channel 40-10, it can be drawn out of the porous wicking material and sufficiently away from the heating surface 55-10 by the airflow through the channel without having been heated and thus vaporized by contact with the heating surface.

In some arrangements, the or each channel 40-10 may be configured to have the above-described arrangement of spaced-apart side walls 60-10 and interconnecting arcuate ceiling portion 59-10 without the provision of the above-described angled surface portions 57-10, such that the lower edges of the side walls 60-10 will be configured for direct contact with the heating surface 55-10 of a heater 24-10 or conduction element 36-10.

The porous layer may have a thickness of less than 5 mm. In other embodiments it may have a thickness of: less than 3.5 mm, less than 3 mm, less than 2.5 mm, less than 2 mm, less than 1.9 mm, less than 1.8 mm, less than 1.7 mm, less than 1.6 mm, less than 1.5 mm, less than 1.4 mm, less than 1.3 mm, less than 1.2 mm, less than 1.1 mm, less than 1 mm, less than 0.9 mm, less than 0.8 mm, less than 0.7 mm, less than 0.6 mm, less than 0.5 mm, less than 0.4 mm, less than 0.3 mm, less than 0.2 mm, or less than 0.1 mm.

There has been described in the foregoing one or more proposals for an aerosol delivery system, and parts thereof, that avoids or at least ameliorates problems of the prior art.

In one or more optional arrangements, a fluid-transfer article 34-10 containing nicotine and/or nicotine compounds may be substituted or supplemented with a fluid-transfer article configured to provide a flavored vapor and/or aerosol upon heating of the fluid-transfer article by the heater elements 24-10 of the apparatus 12-10. A precursor material for forming the flavored vapor and/or aerosol upon heating is held within pores, spaces, channels and/or conduits within the fluid-transfer article. The precursor material may be extracted from a tobacco plant starting material using a supercritical fluid extraction process. Optionally, the precursor material is nicotine-free and comprises tobacco-flavors extracted from the tobacco plant starting material. Further optionally, the extracted nicotine-free precursor material (e.g., flavors only) could have nicotine added thereto prior to loading of the precursor material into the substrate of the carrier unit. Further optionally, flavors and physiologically active material may be extracted from plants other than tobacco plants.

Eleventh Mode: A Heater of an Aerosol Delivery Device is Supported by a Resilient Sealing Body Aspects and embodiments of the eleventh mode of the present disclosure will now be discussed with reference to the accompanying figures. Further aspects and embodiments of the eleventh mode will be apparent to those skilled in the art. All documents mentioned in this text are incorporated herein by reference.

Figure 104:
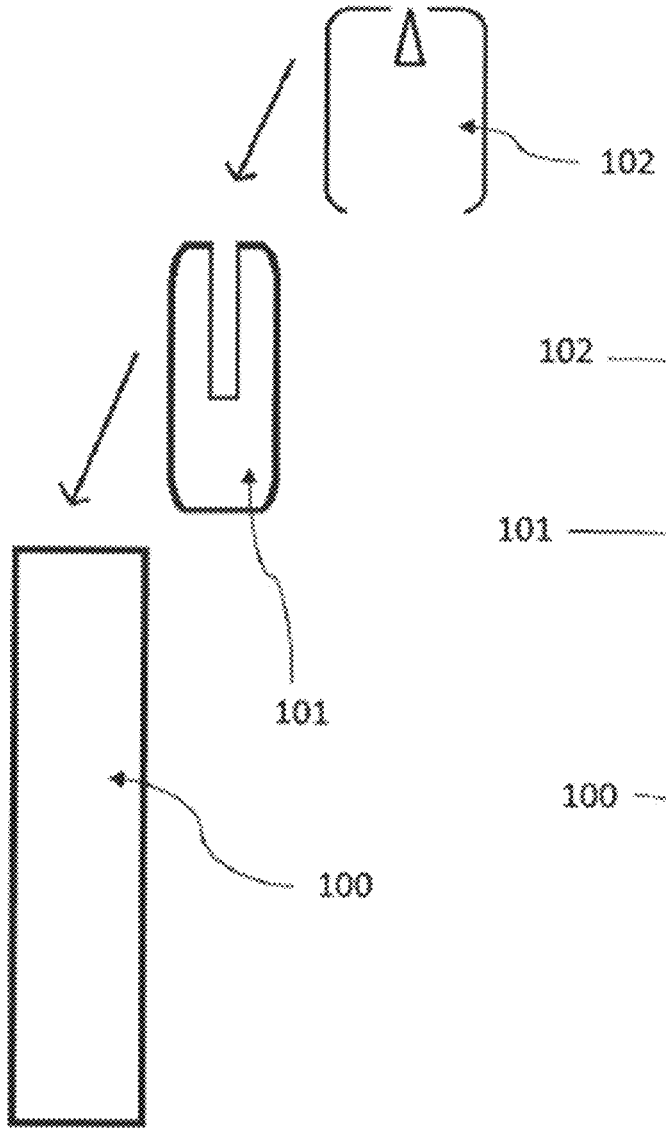
FIG. 104 shows a schematic drawing of a first arrangement of a smoking substitute system of the eleventh mode.
Figure 105:
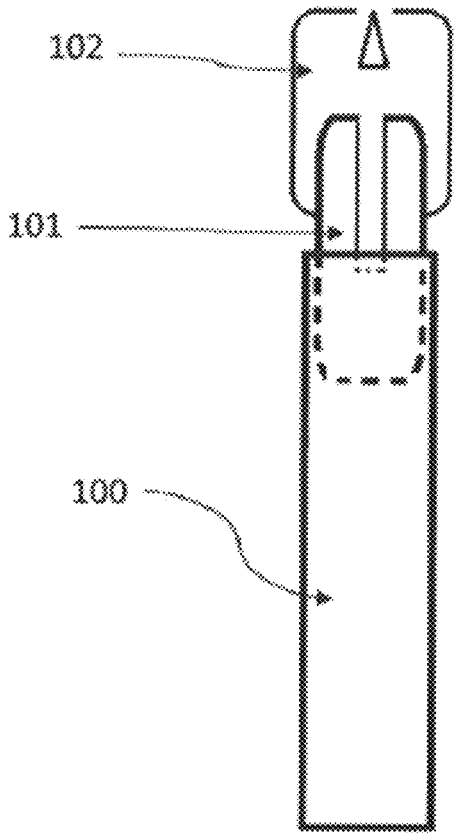
FIG. 105 shows another schematic drawing of the first arrangement of the smoking substitute system of the eleventh mode.

Referring to FIGS. 104 and 105, there is shown a smoking substitute system comprising a smoking substitute device 100. In this example, the substitute smoking system comprises a cartomizer 101 and a flavor pod 102. The cartomizer 101 may engage with the smoking substitute device 100 via a push-fit engagement, a screw-thread engagement, or a bayonet fit, for example. A cartomizer may also be referred to as a "pod". The smoking substitute system may be an aerosol delivery device according to the present disclosure.

The flavor pod 102 is configured to engage with the cartomizer 101 and thus with the substitute smoking device 100. The flavor pod 102 may engage with the cartomizer 101 via a push-fit engagement, a screw-thread engagement, or a bayonet fit, for example. FIG. 105 illustrates the cartomizer 101 engaged with the substitute smoking device 100, and the flavor pod 102 engaged with the cartomizer 101. As will be appreciated, in this example, the cartomizer 101 and the flavor pod 102 are distinct elements. Each of the cartomizer 101 and the flavor pod may be an aerosol delivery device.

As will be appreciated from the following description, the cartomizer 101 and the flavor pod 102 may alternatively be combined into a single component that implements the functionality of the cartomizer 101 and flavor pod 102. Such a single component may also be an aerosol delivery device according to the present disclosure. In other examples, the cartomizer may be absent, with only a flavor pod 102 present or vice versa.

A "consumable" component may mean that the component is intended to be used once until exhausted, and then disposed of as waste or returned to a manufacturer for reprocessing.

Figure 106:
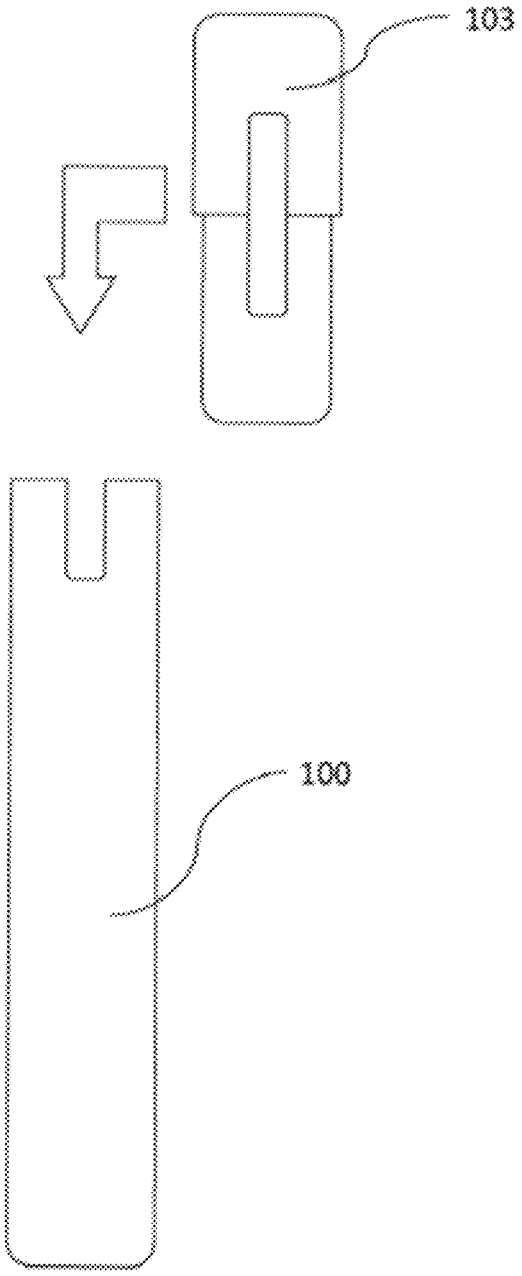
FIG. 106 shows a schematic drawing of a second arrangement of a smoking substitute system of the eleventh mode.
Figure 107:
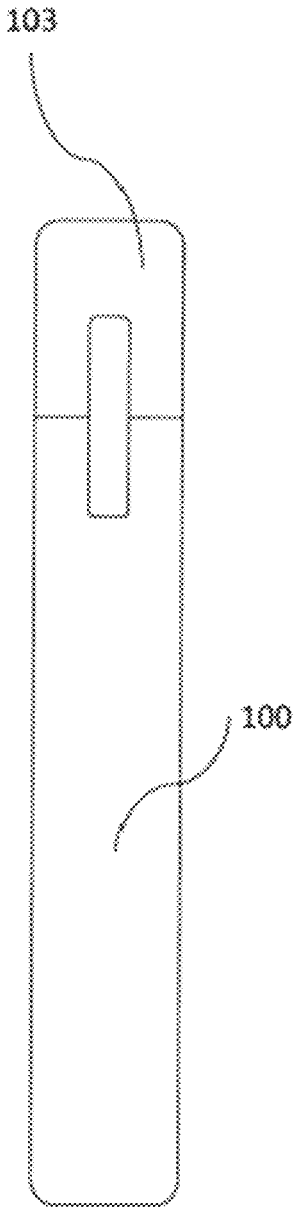
FIG. 107 shows another schematic drawing of the second arrangement of the smoking substitute system of the eleventh mode.

Referring to FIGS. 106 and 107, there is shown a smoking substitute system comprising a smoking substitute device 100 and a consumable 103. The consumable 103 combines the functionality of the cartomizer 101 and the flavor pod 102. In FIG. 106, the consumable 103 and the smoking substitute device 100 are shown separated from one another. In FIG. 107, the consumable 103 and the smoking substitute device 100 are engaged with each other.

Figure 108:
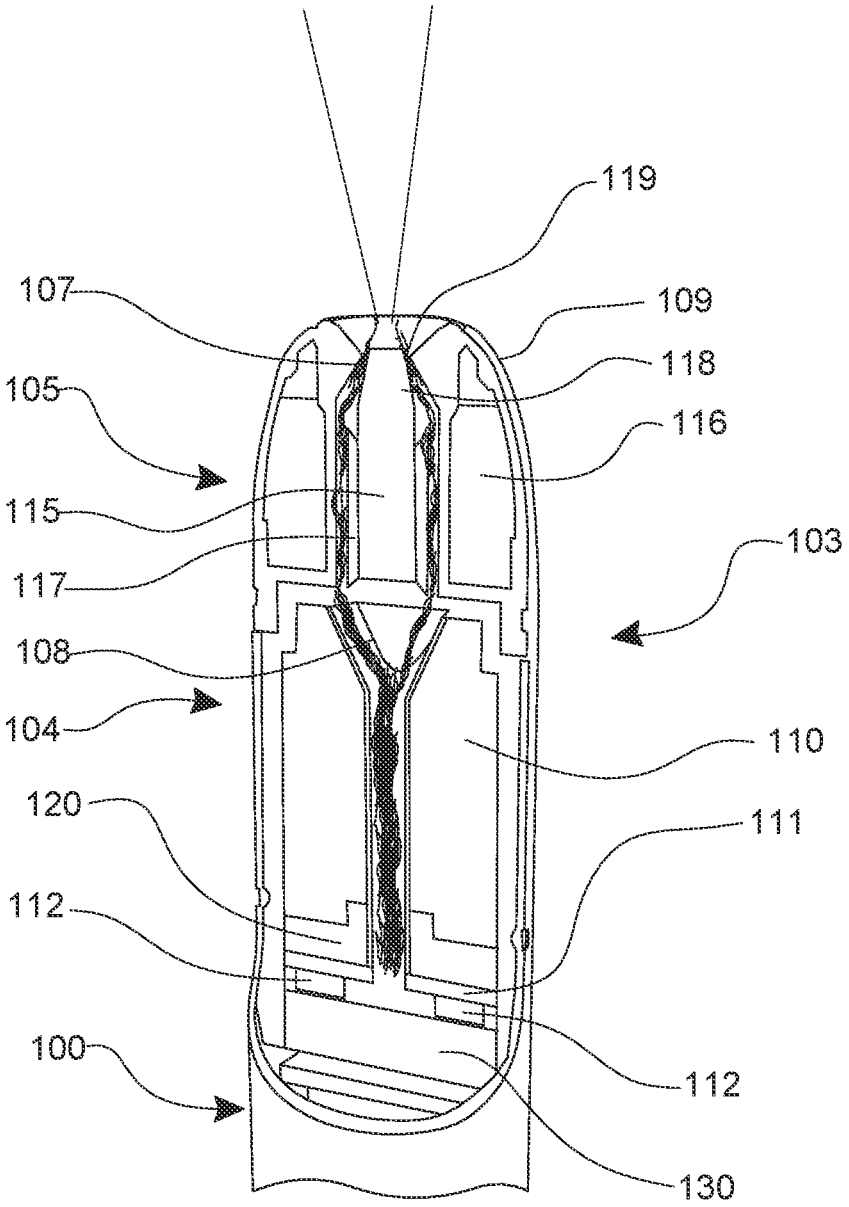
FIG. 108 shows a cutaway view of part of a third arrangement of a smoking substitute system of the eleventh mode.

Referring to FIG. 108, there is shown a consumable 103 engaged with a smoking substitute device 100 via a push-fit engagement. The consumable 103 may be considered to have two portions—a cartomizer portion 104 and a flavor pod portion 105, both of which are located within a single component (as in FIGS. 106 and 107).

The consumable 103 includes an upstream airflow inlet 106 and a downstream airflow outlet 107. In other examples a plurality of inlets and/or outlets are included. Between and fluidly connecting the inlet 106 and the outlet 107 there is an airflow passage 108. The outlet 107 is located at the mouthpiece 109 of the consumable 103, and is formed by a mouthpiece aperture.

As above, the consumable 103 includes a flavor pod portion 105. The flavor pod portion 105 is configured to generate a first (flavor) aerosol for output from the outlet 107 of the mouthpiece 109 of the consumable 103. The flavor pod portion 105 of the consumable 103 includes a member 115. The member 115 acts as a passive aerosol generator (i.e., an aerosol generator which does not use heat to form the aerosol, also referred to as a "first aerosol generator" in this example), and is formed of a porous material. The member 115 comprises a supporting portion 117, which is located inside a housing, and an aerosol generator portion 118, which is located in the airflow passage 108. In this example, the aerosol generator portion 118 is a porous nib.

A first storage reservoir 116 (in this example a tank) for storing a first aerosol precursor (i.e., a flavor liquid) is fluidly connected to the member 115. The porous nature of the member 115 means that flavor liquid from the first storage 116 is drawn into the member 115. As the first aerosol precursor in the member 115 is depleted in use, further flavor liquid is drawn from the first storage reservoir 116 into the member 115 via a wicking action.

As described above, the aerosol generator portion 118 is located within the airflow passage 108 through the consumable 103. The aerosol generator portion 118 therefore constricts or narrows the airflow passage 108. The aerosol generator portion 118 occupies some of the area of the airflow passage, resulting in constriction of the airflow passage 108. The airflow passage 108 is narrowest adjacent to the aerosol generator portion 118. Since the constriction results in increased air velocity and corresponding reduction in air pressure at the aerosol generator portion 118, the constriction is a Venturi aperture 119.

The cartomizer portion 104 of the consumable 103 includes a second storage reservoir 110 (in this example a tank) for storing a second aerosol precursor (i.e., e-liquid, which may contain nicotine). At one end of the second storage reservoir 110 is a wick support element 120, which supports a wick 111. As will be described in more detail later, aerosol precursor passes through one or more bores (not shown in FIG. 108) in the wick support element 120 to reach the wick 111. The surface of the wick furthest from the reservoir then acts as an activation surface from which aerosol precursor will be released in the form of a vapor, or a mixture of vapor and aerosol.

A heater 112 is a configured to heat the wick 111. The heater 112 may be in the form of one or more resistive heating filaments that abut the wick 111. The wick 111, the heater 112 and the e-liquid storage reservoir 110 together act as an active aerosol generator (i.e., an aerosol generator which uses heat to form the aerosol, referred to as a "second aerosol generator" in this example). The second storage reservoir 110, the wick support element, and the wick 111 form a fluid-transfer article, as they transfer aerosol precursor to the activation surface to be heated by the heater 112.

The heater 112 is supported in the smoking substitute device 100 by a heater support element 130. There may be one or more passages (not shown in FIG. 108) through the heater support element 130 to allow air to reach the activation surface of the wick 111 from an inlet (again not shown in FIG. 108) of the smoking substitute device.

The smoking substitute device 100 includes an electrical power source (not shown), for example a battery. That battery is then connected via suitable electrical connections to the heater 112. The heater 112, the battery, and other components of the smoking substitute system device 100 form a non-consumable part of the device from which the consumable 103 may be connected and disconnected.

In the arrangement of the smoking substitute device 100 of FIG. 108, and in the arrangement to be described later, the consumable 103 is separable from the rest of the smoking substitute device 100. This allows the consumable 103 to be replaced, or possibly refilled, when the first and/or second aerosol precursor have been consumed by the user. Since the consumable 103 includes the wick 111 and the wick support element 120, these components will be removed when the consumable 103 is separated from the rest of the smoking substitute device 100. The heater 112, on the other hand, will remain when the consumable 103 is removed, so that it is non-consumable.

In use, a user draws (or "sucks", or "pulls") on the mouthpiece 109 of the consumable 103, which causes a drop in air pressure at the outlet 107, thereby generating air flow through the inlet, through the passages in the heater support element 130, past the activation surface of the wick 111, along the airflow passage 108, out of the outlet 107 and into the user's mouth.

When the heater 112 is activated (by passing an electric current through one or more heating filaments in response to the user drawing on the mouthpiece 109) the e-liquid (aerosol precursor) located in the wick 111 at the activation surface adjacent to the or each heating filament is heated and vaporized to form a vapor. The vapor condenses to form the second aerosol within the airflow passage 108. Accordingly, the second aerosol is entrained in an airflow along the airflow flow passage 108 to the outlet 107 and ultimately out from the mouthpiece 109 for inhalation by the user when the user 10 draws on the mouthpiece 109.

The substitute smoking device 100 supplies electrical current to the heating filament or filaments of the heater 112 and the heating filament or filaments heat up. As described, the heating of the heating filament or filaments causes vaporization of the e-liquid in the wick 111 to form the second aerosol.

As the air flows up through the airflow passage 108, it encounters the aerosol generator portion 118. The constriction of the airflow passage 108 caused by the aerosol generator portion 118 results in an increase in air velocity and corresponding decrease in air pressure in the airflow in the vicinity of the porous surface 118 of the aerosol generator portion 115. The corresponding low-pressure region causes the generation of the first (flavor) aerosol from the porous surface 118 of the aerosol generator portion 118. The first (flavor) aerosol is entrained into the airflow and ultimately is output from the outlet 107 of the consumable 103 and thus from the mouthpiece 109 into the user's mouth.

The first aerosol may be sized to inhibit pulmonary penetration. The first aerosol may be formed of particles with a mass median aerodynamic diameter that is greater than or equal to 15 microns, in particular, greater than 30 microns, more particularly greater than 50 microns, yet more particularly greater than 60 microns, and even more particularly greater than 70 microns.

The first aerosol may be sized for transmission within at least one of a mammalian oral cavity and a mammalian nasal cavity. The first aerosol may be formed by particles having a maximum mass median aerodynamic diameter that is less than 300 microns, in particular less than 200 microns, yet more particularly less than 100 microns. Such a range of mass median aerodynamic diameter will produce aerosols which are sufficiently small to be entrained in an airflow caused by a user drawing air through the flavor element and to enter and extend through the oral and or nasal cavity to activate the taste and/or olfactory receptors.

The second aerosol generated may be sized for pulmonary penetration (i.e., to deliver an active ingredient such as nicotine to the user's lungs). The second aerosol may be formed of particles having a mass median aerodynamic diameter of less than or equal to 10 microns, preferably less than 8 microns, more preferably less than 5 microns, yet more preferably less than 1 micron. Such sized aerosols tend to penetrate into a human user's pulmonary system, with smaller aerosols generally penetrating the lungs more easily. The second aerosol may also be referred to as a vapor.

The size of aerosol formed without heating is typically smaller than that formed by condensation of a vapor.

As a brief aside, it will be appreciated that the mass median aerodynamic diameter is a statistical measurement of the size of the particles/droplets in an aerosol. That is, the mass median aerodynamic diameter quantifies the size of the droplets that together form the aerosol. The mass median aerodynamic diameter may be defined as the diameter at which 50% of the particles/droplets by mass in the aerosol are larger than the mass median aerodynamic diameter and 50% of the particles/droplets by mass in the aerosol are smaller than the mass median aerodynamic diameter. The "size of the aerosol", as may be used herein, refers to the size of the particles/droplets that are comprised in the particular aerosol.

Figure 109:
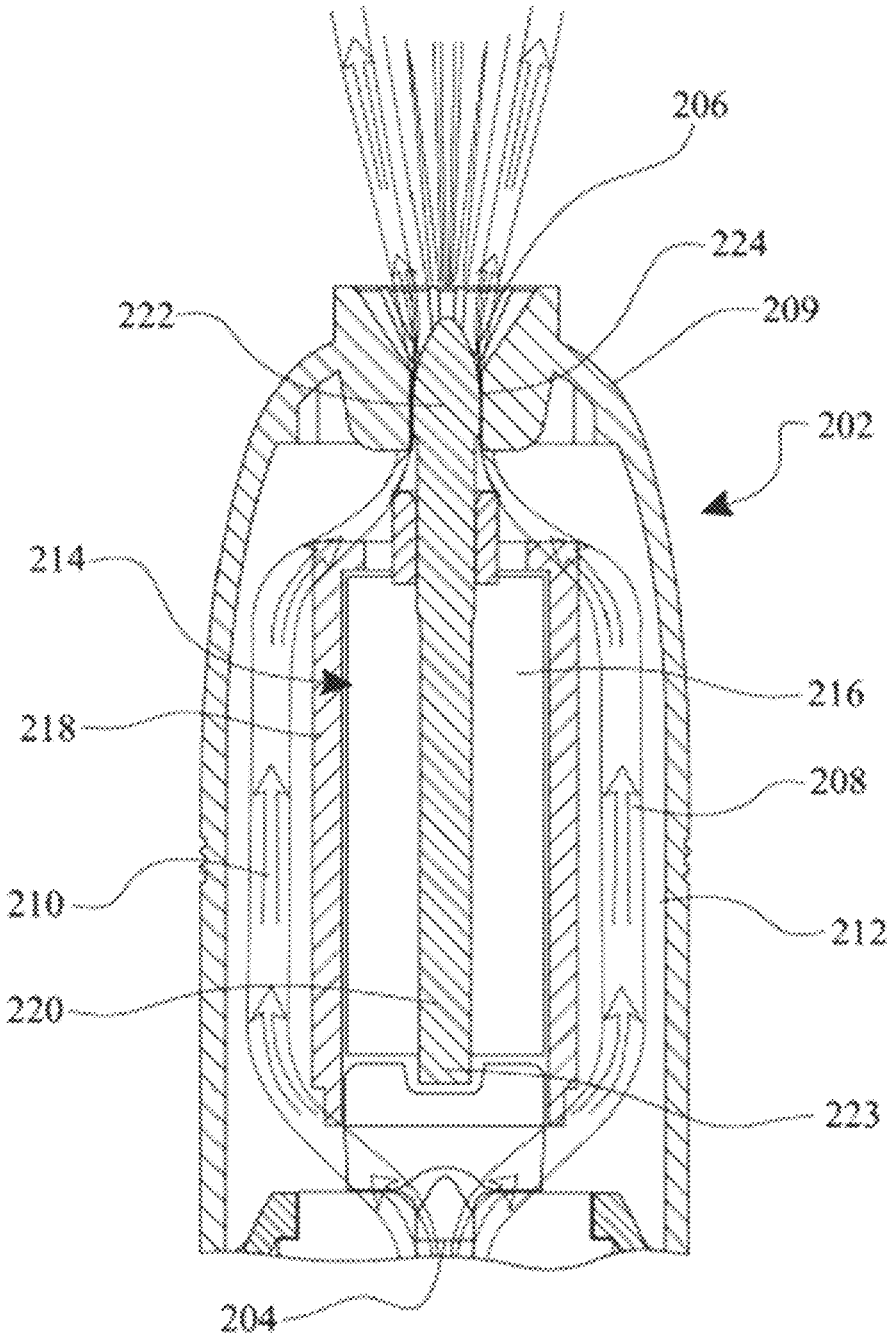
FIG. 109 shows a cross-sectional view of an arrangement of a flavor pod of the eleventh mode.

Referring to FIG. 109, there is shown a flavor pod portion 202 of a consumable, the consumable providing an aerosol delivery device in accordance with the disclosure. The consumable further comprises a cartomizer portion (not shown in FIG. 109) having all of the features of the cartomizer portion 104 described above with respect to FIG. 108.

The flavor pod portion 202 comprises an upstream (i.e., upstream with respect to flow of air in use) inlet 204 and a downstream (i.e., downstream with respect to flow of air in use) outlet 206. Between and fluidly connecting the inlet 204 and the outlet 206 the flavor pod portion 204 comprises an airflow passage 208. The airflow passage 208 comprises a first airflow branch 210 and a second airflow branch 212, each of the first airflow branch 210 and the second airflow branch 212 fluidly connecting the inlet 204 and the outlet 206. In other examples the airflow passage 208 may have an annular shape. The outlet 206 is located at the mouthpiece 209 of the consumable 103, and is also referred to as a mouthpiece aperture 206.

The flavor pod portion 202 comprises a storage 214, which stores a first aerosol precursor. The storage 214 comprises a reservoir 216 located within a chamber 218. The reservoir 216 is formed of a first porous material.

The flavor pod portion 202 comprises a member 220, which comprises an aerosol generator portion 222 and a supporting portion 223. The aerosol generator portion 222 is located at a downstream end (an upper end in FIG. 109) of the member 220, while the supporting portion 223 makes up the rest of the member 220. The supporting portion 223 is elongate and substantially cylindrical. The aerosol generator portion 222 is bulb-shaped, and comprises a portion which is wider than the supporting portion 223. The aerosol generator portion 222 tapers to a tip at a downstream end of the aerosol generator portion 222.

The member 220 extends into and through the storage 214. The member 220 is in contact with the reservoir 216. More specifically, the supporting portion 223 extends into and through the storage 204 and is in contact with the reservoir 216. The member 220 is located in a substantially central position within the reservoir 216 and is substantially parallel to a central axis of the consumable. The member 220 is formed of a second porous material.

The first and second airflow branches 210, 212 are located on opposite sides of the member 220. Additionally, the first and second airflow branches 210, 212 are located on opposite sides of the reservoir 216. The first and second airflow branches 210, 212 branch in a radial outward direction (with respect to the central axis of the consumable 200) downstream of the inlet 204 to reach the opposite sides of the reservoir 216.

The aerosol generator portion 222 is located in the airflow passage 208 downstream of the first and second airflow branches 210, 212. The first and second airflow branches 210, 212 turn in a radially inward direction to merge at the member 220, at a point upstream of the aerosol generator portion 222.

The aerosol generator portion 222 is located in a narrowing section 224 of the airflow passage 208. The narrowing section 224 is downstream of the point at which the first and second airflow branches 210 212 merge, but upstream of the mouthpiece aperture 207. The mouthpiece aperture 207 flares outwardly in the downstream direction, such that a width of the mouthpiece aperture 207 increases in the downstream direction.

In use, when a user draws on the mouthpiece 209, air flow is generated through the air flow passage 208. Air (comprising the second aerosol from the cartomizer portion as explained above with respect to FIG. 108) flows through the inlet 204 before the airflow splits to flow through the first and second airflow branches 210, 212. Further downstream, the first and second airflow branches 210, 212 provide inward airflow towards the member 220 and the aerosol generator portion 222.

As air flows past the aerosol generator portion in the narrowing section 224, the velocity of the air increases, resulting in a drop in air pressure. This means that the air picks up the first aerosol precursor from the aerosol generator portion 222 to form the first aerosol. The first aerosol has the particle size and other properties described above with respect to FIG. 108.

As the first aerosol precursor is picked up by the air, the member 220 transfers further first aerosol precursor from the storage 214 to the aerosol generator portion 222. More specifically, the member 220 wicks the first aerosol precursor from the storage 214 to the aerosol generator portion 223.

In other examples, the storage 214 comprises a tank containing the first aerosol precursor as free liquid, rather than the reservoir 216 and the chamber 218. In such examples, the member 220 still extends into the tank to transfer first aerosol precursor from the tank to the aerosol generator portion 223.

Further arrangements of the present disclosure will now be described, which arrangements incorporate one or more features of the aspects of the present disclosure. In the subsequent arrangements, the smoking substitute device 100 includes a consumable 103 in the form of a cartomizer, but does not include a flavor pod. However, the smoking substitute device 100 of the subsequent arrangements may be modified to incorporate a flavor pod in a way similar to the arrangement of FIGS. 108 and 109.

Figure 110:
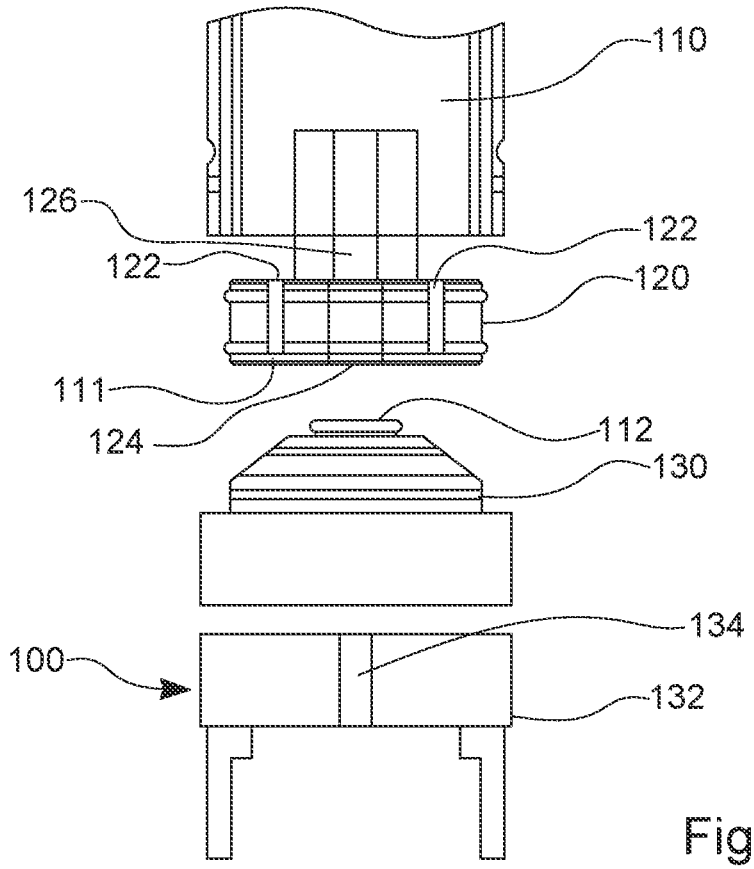
FIG. 110 shows in detail parts of another arrangement of a smoking substitute system of the eleventh mode.

As mentioned above, the wick 111 is supported by a wick support element 120. FIG. 110 illustrates an arrangement of a smoking substitute system in which these components are illustrated in more detail, and in an exploded view. The wick support element 120 is mounted at an end of the second storage reservoir 111 and has bores 122 therethrough to allow aerosol precursor in the second storage reservoir 110 to pass to the wick 110. These bores may be sized so that aerosol precursor may flow therethrough in a non-capillary manner. Although, two bores 122 are visible in FIG. 110, there may be more arranged around the wick support element 120.

In the arrangement of FIG. 110, the wick support element 120 is made of a resilient material, such as rubber, and thus may deform when force is applied thereto. In particular, when the consumable 103 is mounted on the main body 100, the wick 111 is brought into contact with the heater 112, and is held thereto by the resilience of the wick support element 120. The wick support element 120 may be sized so that it deforms slightly when the wick 111 is in contact with the heater 112, so as to provide a biasing force to urge the wick 111 into firm contact with the heater 112.

The wick 111 has an opening 124 at its center, which is aligned with a passageway 126 through the wick support element 122. The passageway 126 communicates with the air-flow passage 108 shown in FIG. 108 so that air, together with vapor or a mixture of vapor and aerosol, will pass to the user. The surface of the wick 111 closest to the heater 112 acts as an activation surface for the aerosol precursor and, as the wick 111 is heated by the heater 112, aerosol precursor is released from the activation surface in the form of vapor or a mixture of vapor and aerosol, it can then pass through the opening 124 and the passageway 126 into the air-flow passage 108.

Figure 111:
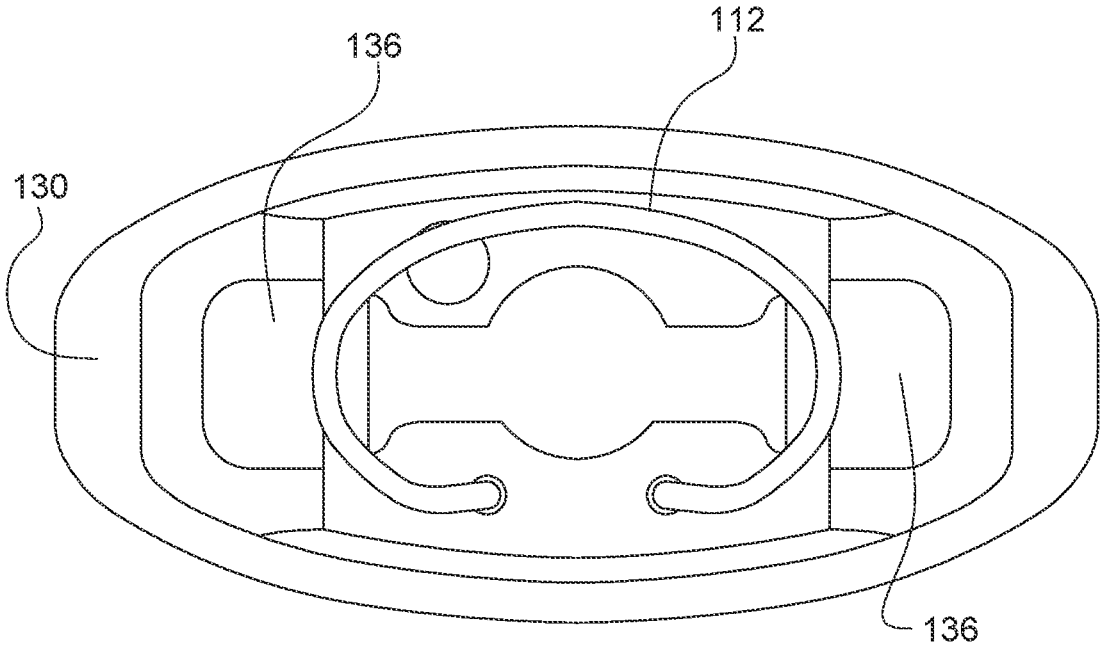
FIG. 111 shows detail of the heater and the heater support in the arrangement of FIG. 110 of the eleventh mode.

As illustrated in FIG. 110, the heater 112 is mounted on a heater support element 130, which may act as an end wall of a battery housing and which may itself be supported by a support wall 132. The casing of the main body 100 (not shown in FIG. 110) will enclose the support wall 132 and parts of the heater support element 130. In order for air to flow from the activation surface of the wick 111 through the opening 124 and into the passage 126, air must first reach the activation surface of the wick 111. The support wall 132 may thus have a bore 134 therethrough, which communicates with passages 136 (not shown in FIG. 110) through the heater support element 130. FIG. 111 illustrates these passages 136 and shows that they open immediately adjacent the heater 112 and hence adjacent the activation surface of the wick 111. The casing of the main body 100 may be provided with an inlet at a suitable location, to allow air to reach the bore 134, and hence to flow to the passages 136 in the heater support element 130. Hence, when the user draws on the mouthpiece 109 of the consumable 103, air is drawn into the casing of the main body 100 through the bore 134 and the passages 136 to reach the activation surface of the wick 111 adjacent the heater 112. That air then passes, together with vapor or mixture of aerosol and vapor generated by heating of the aerosol precursor by the heater 112, through the opening 124 in the wick 111 to the passage 126, and hence to the air-flow passage 108, and then to user, as has previously been described.

Note that in the arrangement of FIGS. 110 and 111, the heater 112 will need to be connected to a power source, such as a battery, and there may then need to be additional bores (not shown in FIGS. 110 and 111) through the heater support element 130 and the support wall 132 to allow electrical leads to pass therethrough.

Figure 112:
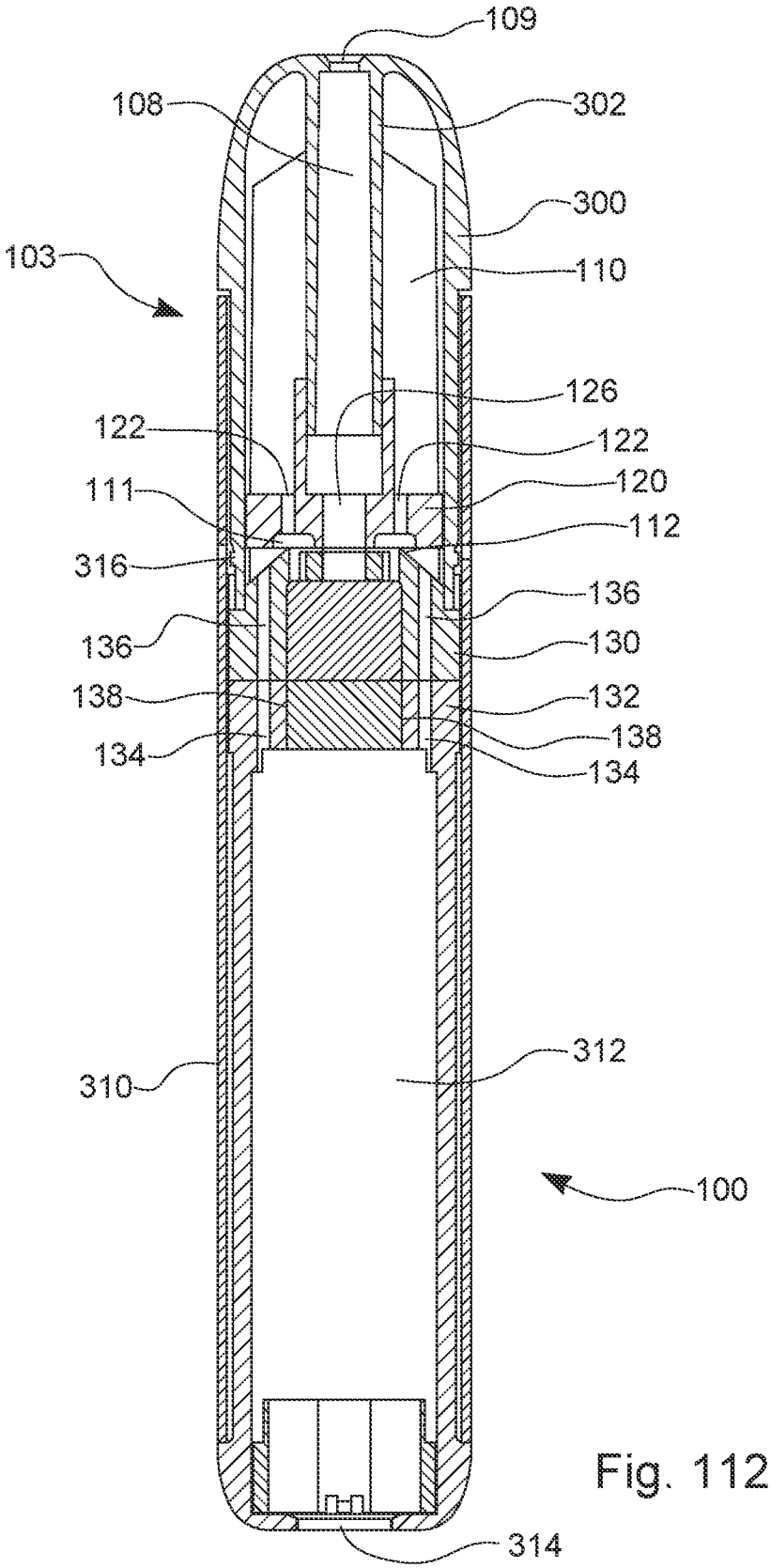
FIG. 112 shows another arrangement of a smoking substitute system of the eleventh mode.

FIG. 112 illustrates another arrangement of a smoking substitute system, in which the consumable has a single reservoir for aerosol precursor which corresponds to the second storage reservoir 110 in the embodiment of FIG. 108 In this arrangement, the consumable does not have a flavor pod portion. For simplicity, parts corresponding to those of FIGS. 108 to 111 are indicated by the same reference numerals. Note that in FIG. 112, the support wall 132 has multiple bores 134 therethrough, aligned with the passages 136 in the heater support element 130.

FIG. 112 also shows the casings of the device. In particular, there is a casing 300 (the "first" casing), being a casing of the consumable 103. That casing contains the reservoir 110 for aerosol precursor, and also supports the wick support element 120 and the wick 111. A tube 302 within that first casing 300 forms a bounding wall of the air-flow passage 108, and the mouthpiece 109 is formed at an end of the first casing 300. The main device 100 also has a casing 310 (the "second" casing) on which are mounted the support wall 132 and the heater support element 130. There is a space 312 within the second casing 310 for a battery and other electronic components used to power the heater 112, and the second casing 310 may also have an inlet 314 to allow air to enter the space 312 and hence pass to the bores 134 and the passages 136 to enable it to reach the activation surface of the wick 110.

FIG. 112 also shows electrical leads 138 which extend through the support wall 132 and the heater support element 130 to enable the heater 112 to be connected to a battery in space 312. Small bores may be formed in the heater support element 130 and the support wall 132 through which the leads 138 may pass. The first and second casings 300, 310 are separable and held together by a "click" engagement 316. When the two casings 300,310 are interconnected, as shown in FIG. 112, the wick 111 is forced into contact with the heater 112 by the resilience of the wick support element 120, so that good heating of the activation surface of the wick 111 will occur when the heater 112 is active. The separability of the two casing 300, 310 allows the consumable 103 to be removed from the main body 100, and replaced, e.g., when the aerosol precursor in the reservoir 110 is exhausted.

Figure 113:
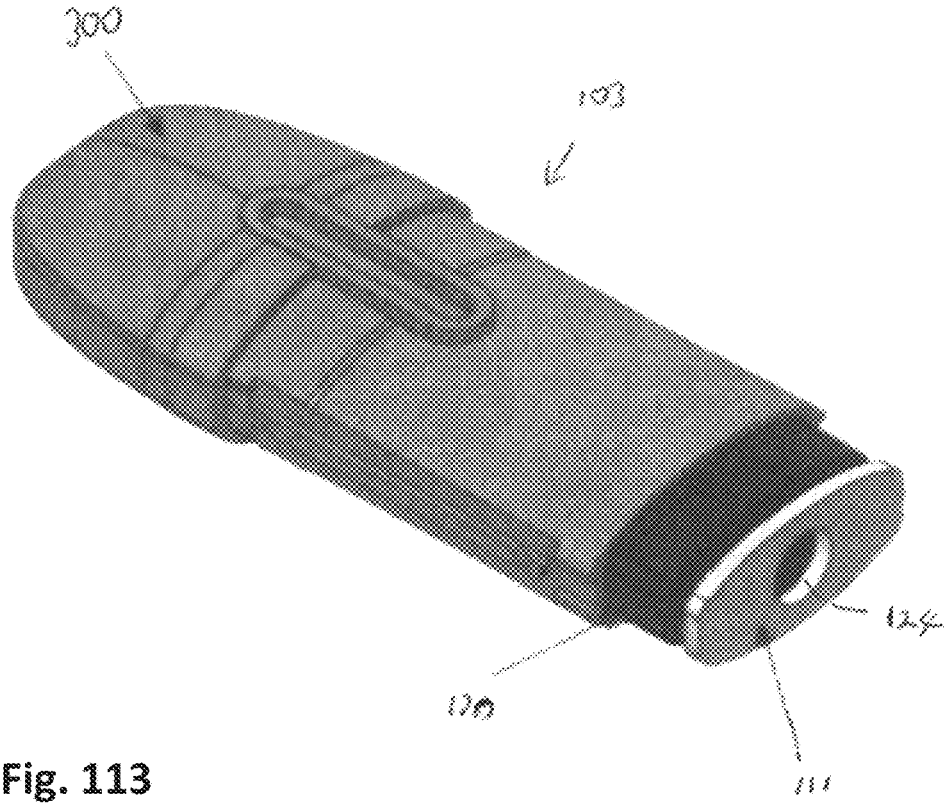
FIG. 113 shows detail of part of a smoking substitute system of the eleventh mode.

FIG. 113 shows a perspective view of the consumable 103 in FIG. 112, with the part of the first casing 300 removed so that the wick 111 and the wick support element 120 are clearly visible. It can be seen from FIG. 113 that the wick 111 is flat and so has a planar activation surface (the exposed surface of the wick 111 in FIG. 113). FIG. 113 also shows clearly the opening 124 in the wick 111, which allows communication with the passageway 126 through the wick support element 120. The wick support element 120 in this embodiment, and in some other embodiments, is preferably made of rubber material. In a similar way, the wick 111 is preferably made of silica material, which material is suitably porous to allow the aerosol precursor to pass therethrough. Alternatively, the wick may be of fibrous material, woven material or porous ceramic material.

Figure 114:
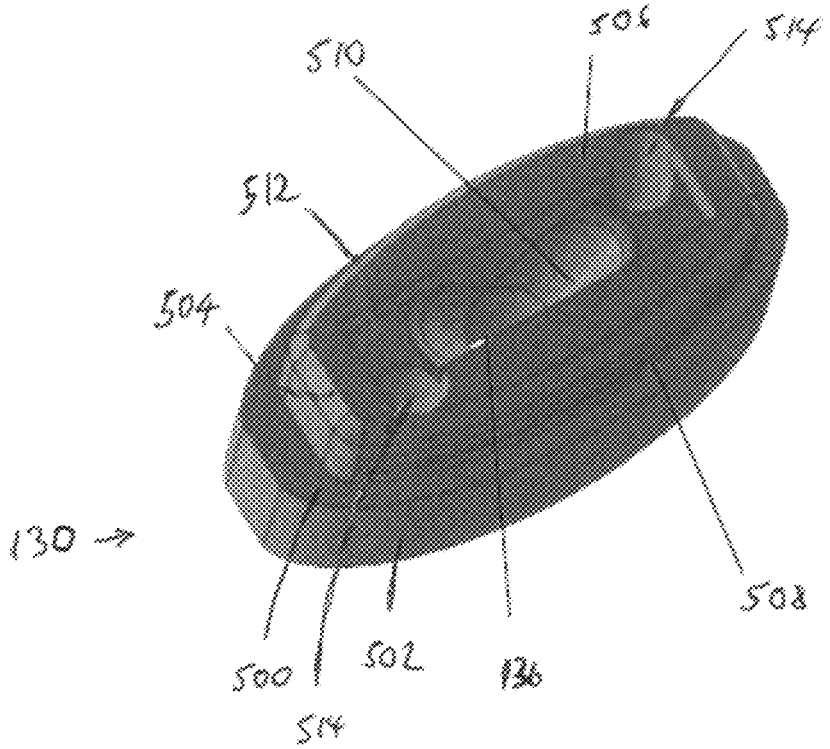
FIG. 114 shows detail of a heater support which may be used in a smoking substitute system of the eleventh mode.
Figure 115:
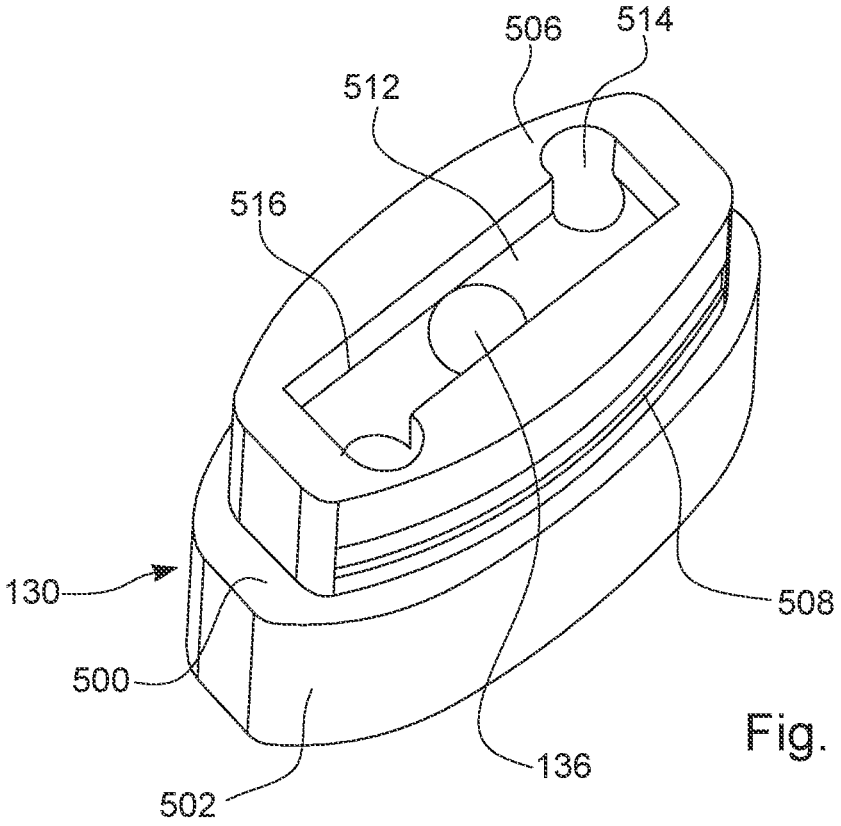
FIG. 115 shows detail of an alternative heater support which may be used in a smoking substitute system of the eleventh mode.

FIGS. 114 and 115 illustrate two alternative configurations of a heater support element 130 which may be used in the present disclosure. They differ in the shape of the mouth of the passage 136 through the heater support element 130 which allows air to pass through the heater support element from e.g., the interior of the casing of the main body 100 to the vicinity of the heater 112 and the activation surface of the wick 111. Note that, in FIGS. 114 and 12, the heater itself is not shown and there is a single passage 134 through the heater support element 132. In each of the alternative configurations, the heater support element 130 is preferably made of resilient material, which must also be suitable to resist the heat generated by the heater 112.

In FIG. 114, the heater support element 130 comprises a body part 500 which has a peripheral seal surface 502 which seals to the casing 310 (not shown in FIG. 114). The seal between the seal surface 502 and the casing 310 needs to be sufficiently strong to prevent, or at least significantly resist, movement of the heater support element 130 in the casing 310, particularly when the consumable 103 is removed from the main body 100.

A projecting part 504 projects from the body part 500, terminating in a flat heater support face 506. The periphery of the projecting part 504 seals to the casing 300 of the consumable 103, and for this purpose may have ribs 508 on its side surface. However, unlike the sealing of the seal surface 502 to the casing 310 of the main body 100, the sealing of the projecting part 504 to the casing 300 of the consumable 103 needs to allow the consumable 103 to be removed to allow another consumable 103 to be mounted thereon without too much resistance. Nevertheless, the sealing must be sufficiently good to limit leakage of any aerosol precursor which has passed through the wick 111 but has not been vaporized by the heater 112. As in the arrangement of FIG. 112, the passage 136 passes through the heater support element 130 to enable air to pass towards the heater 112 and the wick 111. In the heater support element 130 shown in FIG. 114, the passage 136 terminates in a splayed or funneled mouth 510, which opens into a slot 512 in the heater support surface 506, so that air which has passed through the bore 136 can expand in the funneled mouth 510 before reaching the heater 112.

FIG. 114 also shows bores 514 through which pass leads from the heater 112, which leads will provide electrical connection to the battery.

The heater support element 130 shown in FIG. 114 is resilient and is preferably made of silicone material, with provision to resist high temperatures which may be generated by the heater 112. For example, the material known as Polygraft HT-3120 silicone, which is a two-part mix, may be a suitable material from which the heater support element 132 may be made. The configuration shown in FIG. 114 will normally be made by molding the silicone material in a suitable mold.

FIG. 115 illustrates an alternative heater support element 130. It is generally similar to the heater support element 130 shown in FIG. 114 and the same reference numerals indicate corresponding parts. It may be made of the same materials as the heater support element 130 of FIG. 114 The heater support element 130 of FIG. 115 differs from that of FIG. 114 in that the passage 136 opens directly into the channel 512 in the heater support surface 506. There is thus a flat face 516 at the bottom of the channel 516, rather than the funnel mouth 510 shown in FIG. 114.

Figure 116:
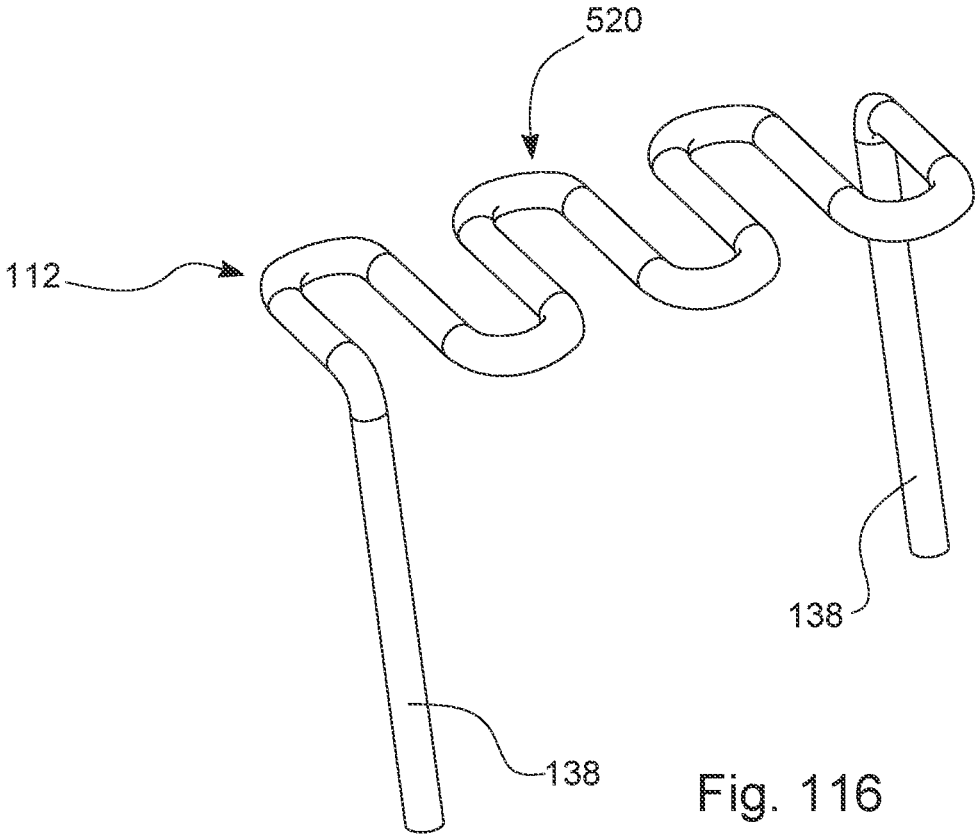
FIG. 116 shows detail of a heater which may be used in a smoking substitute system of the eleventh mode.

FIG. 116 shows a heater that may be used with the heater support element 130 shown in FIG. 114 or FIG. 115 The heater comprises a heater filament 520 which is generally flat and rests on the heater support face 506 of the heater support element 130. For this reason, the filament 520 is not straight but meanders in its plane. FIG. 116 also shows the leads 138 which extend through the bores 514 of the heater support 130 shown in FIG. 114 or FIG. 115, to enable the heater 112 to be connected to a battery.

Figure 117:
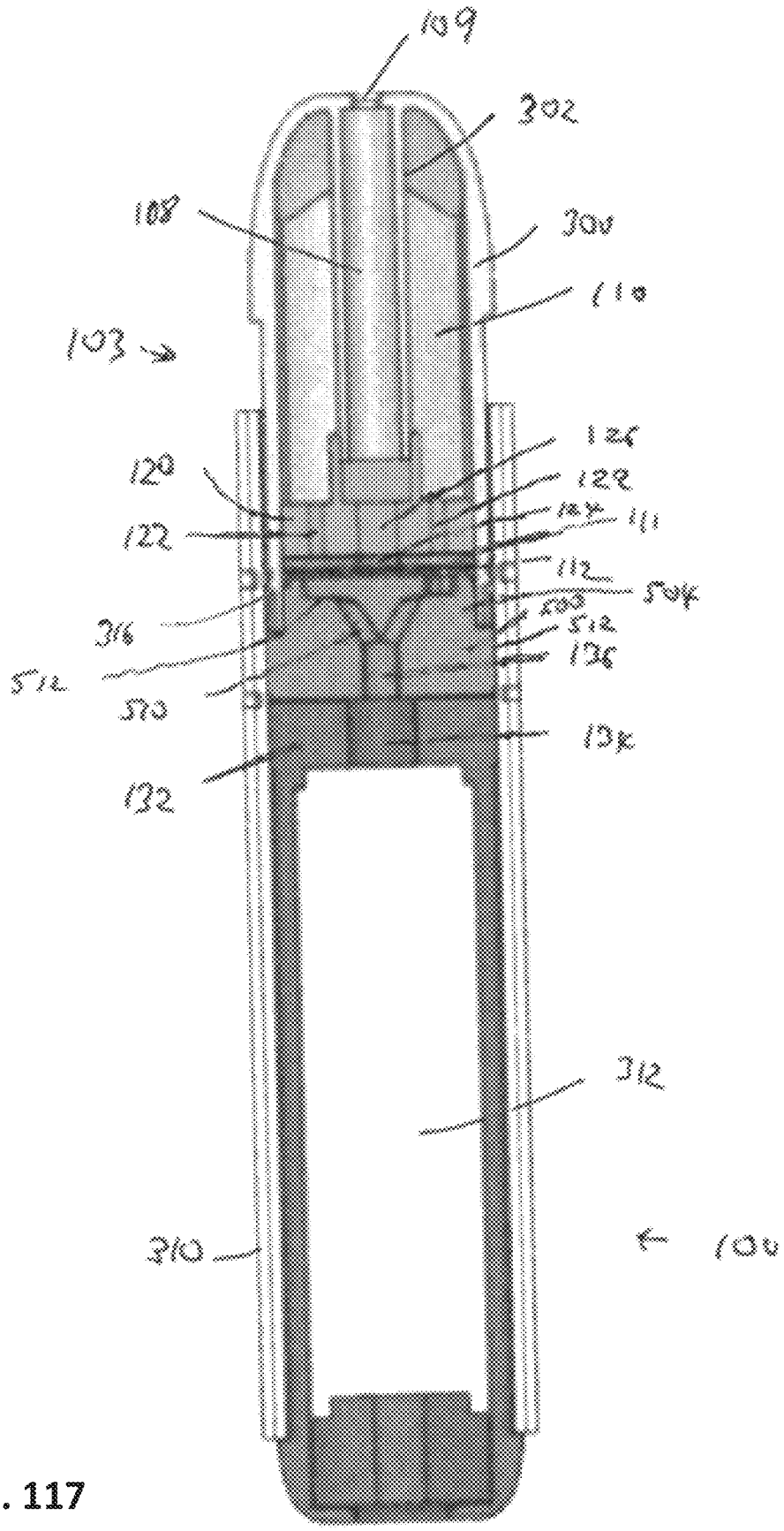
FIG. 117 shows yet another arrangement of a smoking substitute system of the eleventh mode.

FIG. 117 illustrates an arrangement of a smoking substitute system which incorporates the heater support element 132 of FIG. 114, and also the heater 112 of FIG. 117 The arrangement of FIG. 117 is generally similar to that of FIG. 112, and corresponding parts are indicated by the same reference numerals. As mentioned previously, when the heater support element 132 of FIG. 114 is used, there is only a single bore 136 therein for air, hence there is only a single bore 134 in the support 132 in the main body 100. The bore 136 extends to the funneled mouth 510 which opens into the slot 512 directly below the heater 112. Note that the leads 138 of the heater 112 are not visible in FIG. 117.

FIG. 117 illustrates how the seal surface 502 of the main body 500 seals to the second casing 310, and the projecting part 504 seals to the first casing 300. This sealing is illustrated in more detail in the enlarged view of FIG. 118 In particular, the first casing 300 of the consumable 103 extends sufficiently far within the second casing 310 of the main body 100 so as to contact the projecting part 504 of the heater support element 130 at a sealing interface 518. Similarly, the main body 500 of the heater support element 130 seals at a sealing interface 520 with the casing 310 of the main body 100. As mentioned previously, the degrees of sealing at these two sealing interfaces 518 and 520 are preferably different, since the heater support element 130 does not normally release from the second casing 310, but must release from the first casing 300 when the consumable 103 is removed.

Figure 118:
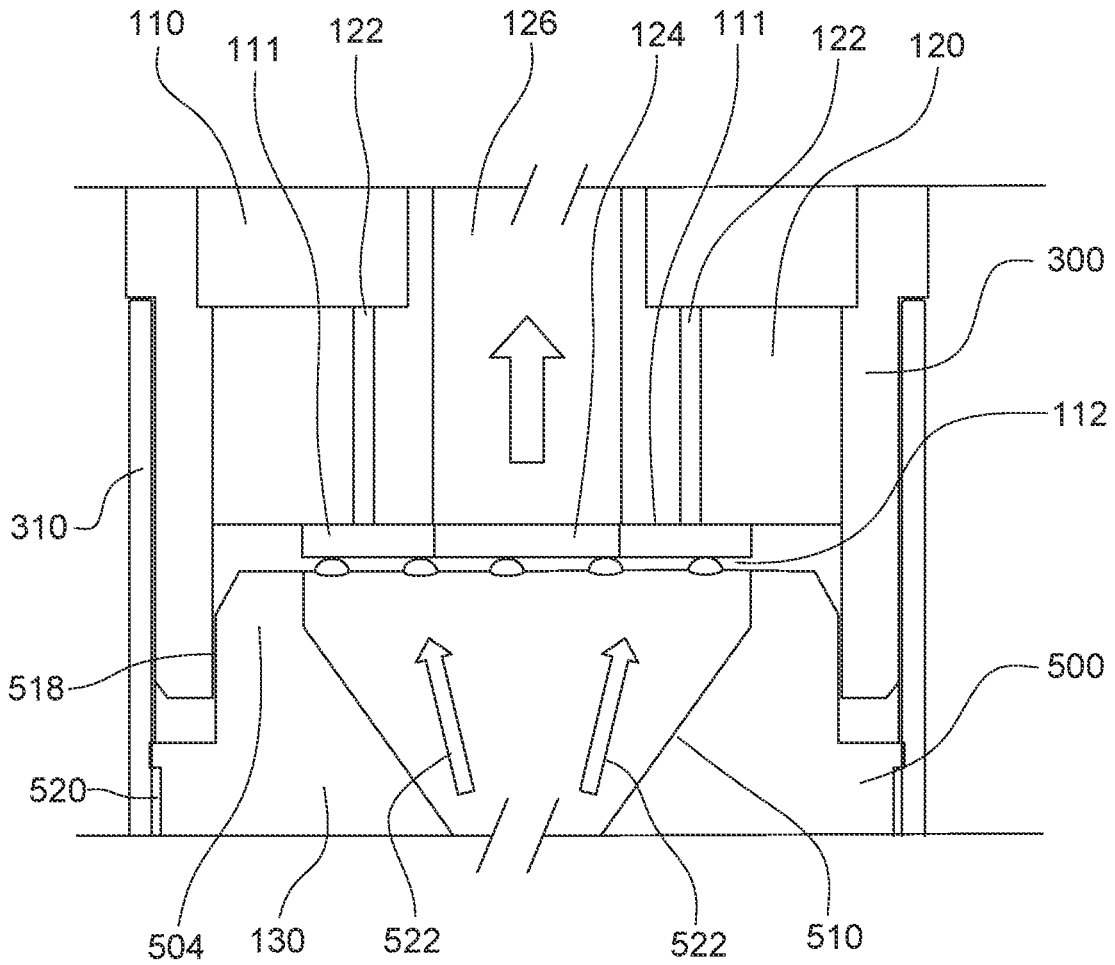

FIG. 118 also shows how the funneled mouth 510 of the passage 136 opens within the heater support element 130 towards the heater 112 and the wick 111. This causes the air flow from the passage 136 to expand, as illustrated by the arrows 522, so that there is a good air flow where the heater 112 meets the wick 111, to entrain vapor therein prior to flow to the passage 126 in the wick support element 120.

With the arrangement shown in FIG. 118, as in the other arrangements, the sealing between the first casing 300 and the heater support element 130 at the sealing interface 518 prevents any leakage of aerosol precursor which has come from the wick 111 and has not been vaporized by the heater 112. Hence, when the consumable 103 is fitted in place on the main body 100, the only escape route for the aerosol precursor is via the airflow passage 108 and the mouthpiece 109. This helps to ensure efficient consumption of the aerosol precursor.

The arrangement of FIG. 117 also differs from the arrangement of FIG. 112 (and also that of FIG. 118), in that the wick 111 extends across the whole of the end face of the wick support element 120, as in the arrangement of FIG. 113 As before, the wick 111 has an opening 124 therein to allow air to pass through the wick 111 and into the passage 126, and hence through the air-flow passage 108 so that it can reach the outlet 109 and thus pass to the user.

Figure 119:
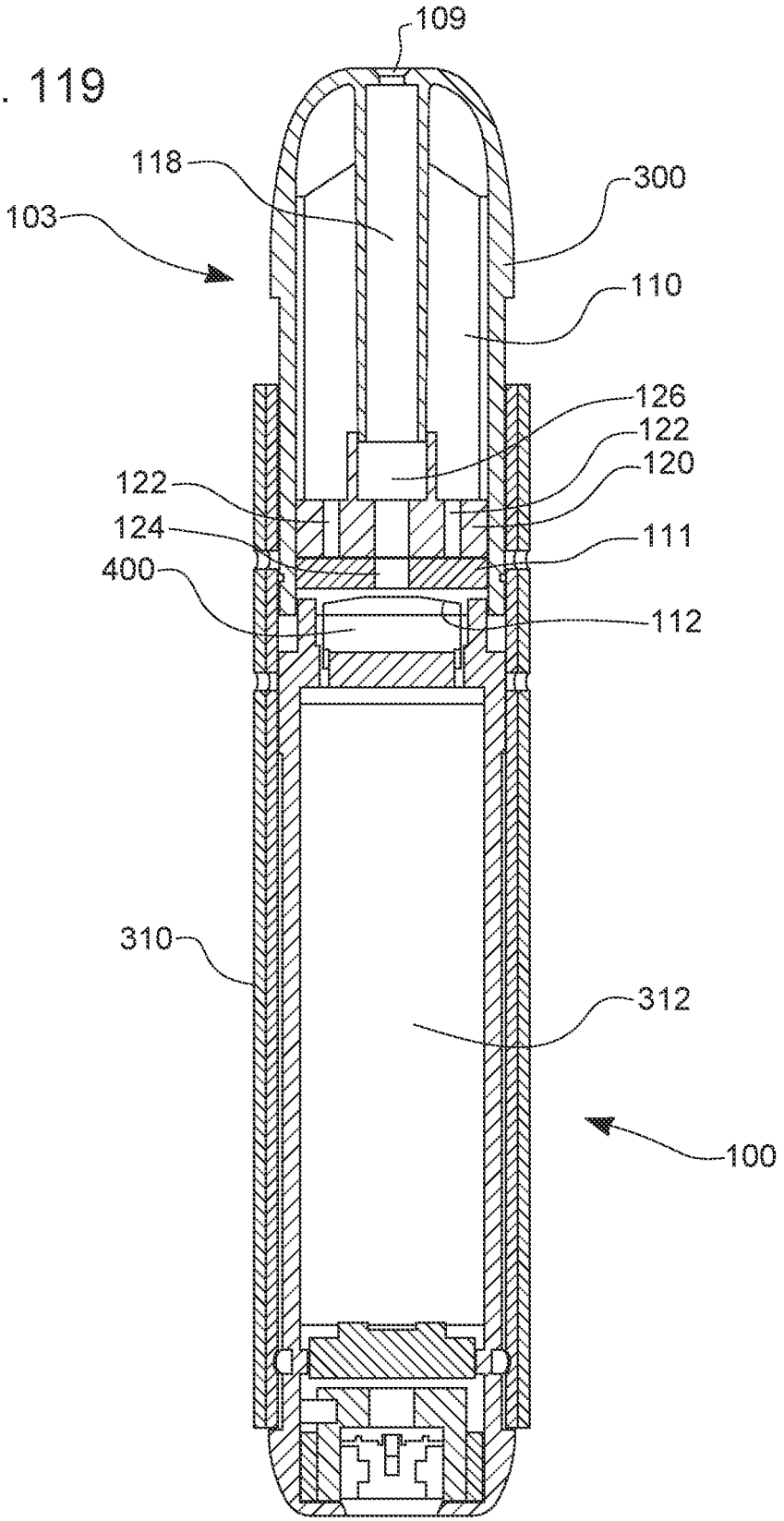

FIG. 119 shows another arrangement of a smoking substitute system, which is generally similar to that of the embodiment of FIGS. 112 and 113 and corresponding parts are indicated by the same reference numerals. In the embodiment of FIG. 119, however, there is no heater support element 130, and instead the heater 112 is a coil or other filament held within the second casing 310, which has a space 400 adjacent thereto. The space 400 communicates with inlets (not shown in FIG. 119) which allow air to enter the casing 310 and pass to the activation surface of the wick 111. Again, the wick 111 is forced into contact with the heater 112 by the resilience of the wick support element 120. In this arrangement, the flow of air to the activation surface is not restricted by the size of the passage or passages through the heater support element 130. In this arrangement the heater 112 needs to be sufficiently stiff that it is not deformed when the wick 111 is urged into contact therewith by the resilient wick support element 120.

Figure 120:
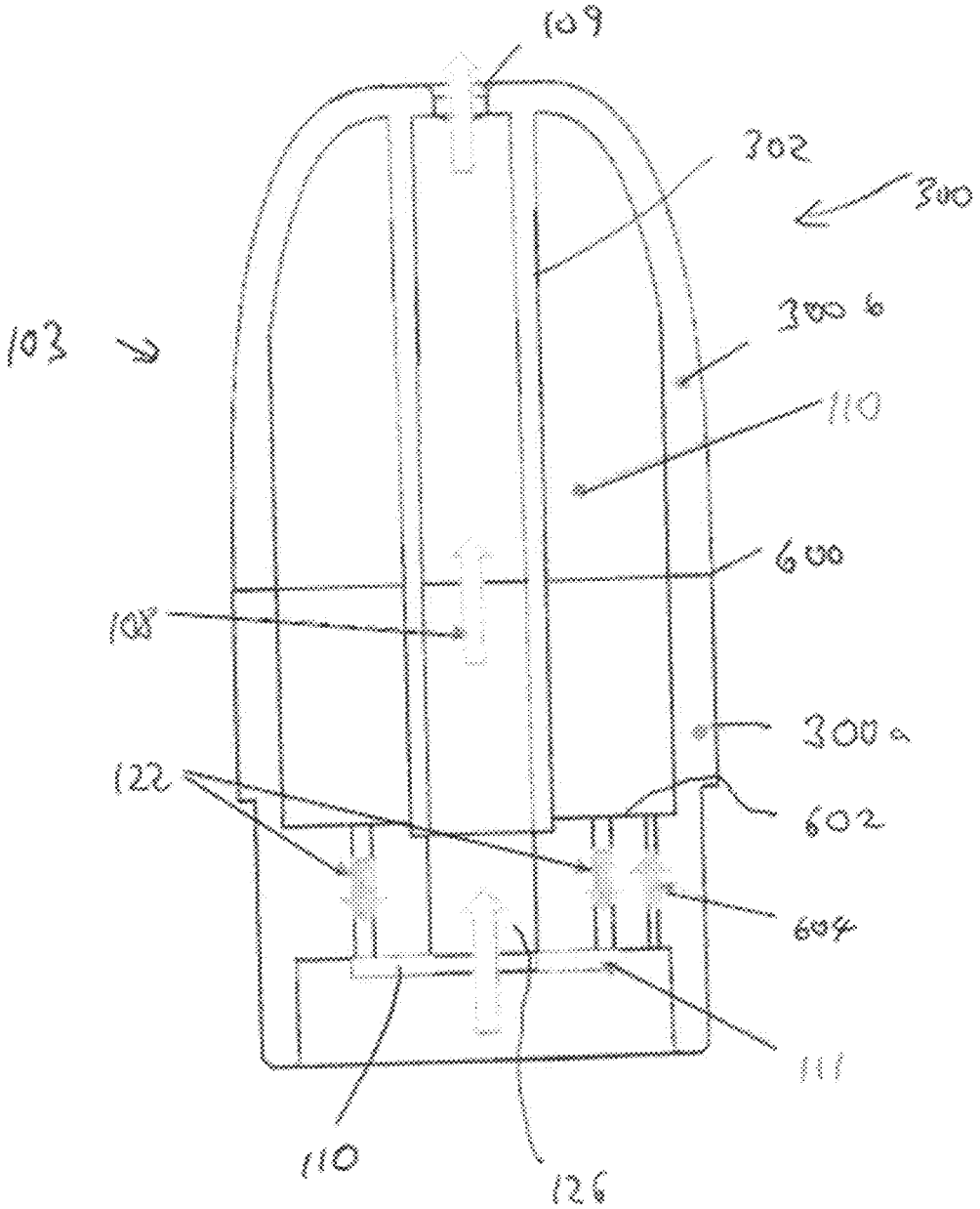

In the arrangements of the smoking substitute system described above, the wick support element 120 is a separate element from the first casing 300 of the consumable 103. FIG. 120 illustrates an alternative arrangement, in which the wick support element is integral with part of the first casing 300.

In the arrangement of FIG. 120, parts which correspond to arrangements described previously are indicated by the same reference numerals. Note that, in FIG. 120, the main body 100 is not shown. It may be the same as in the other arrangements of a smoking substitute system described previously.

In the arrangement of FIG. 120, the first casing 300 has a lower part 300*a* and an upper part 300*b*. The mouthpiece 109 is in the upper part 300*b*, and the tube 302 is also integral with that upper part 300*b*.

The lower part 300*a* has an upper rim which meets a lower rim of the upper part 300*b* at a sealing surface 600, and has an internal flange 602 adjacent its lower end. The internal flange 602 corresponds to the wick support element 120 of the arrangements previously described. The internal flange 602 has a central bore forming passage 126, which passage is aligned with the passage 108 within the tube 302. The end of the tube 302 furthest from the mouth piece 109 engages the flange 602 and is sealed thereto.

The interiors of the upper and lower parts 300*b* and 300*a* of the casing 300 are hollow, and form the reservoir 110. There are bores 122 in the flange 602 to allow the reservoir 110 to communicate with the wick 111, in the same way as the bores 122 in the earlier arrangements described previously. Thus, aerosol precursor in the reservoir 110 may pass through the bores 122 to saturate the wick 111, and then be heated by the heater 112 (not visible in FIG. 120). The arrangement of FIG. 120 prevents any leakage of aerosol precursor between the wick support element 120 and the casing 300. Whilst there could be leakage between the upper and lower parts 300*b*, 300*a* of the casing 300, this can be prevented by suitable configuration of the sealing interface 600. However, if the sealing of the reservoir 110 is too good, air may not be able to enter it to replace aerosol precursor which has been consumed.

Therefore, FIG. 120 shows that there may be at least one additional bore 604 in the flange 602, to allow passage of air to the reservoir 110 from outside the first casing. The or each additional bore 604 needs to be sufficiently small that it will not allow a significant amount of aerosol precursor to pass therethrough. For example, the or each additional bore 604 may be e.g., 0.2 to 0.5 mm in diameter, more preferably 0.32 to 0.5 mm, even more preferably 0.32 to 0.4 mm. If the flange has a thickness of e.g., 0.5 to 5 mm, preferably 1 to 5 mm, aerosol precursor should not be able to escape reservoir 110 through the or each additional bore 604. In general, the thicker the flange 602, the greater the possible diameter of the or each additional bore 604 may be, without it allowing aerosol precursor to flow therethrough. A thin flange 602 (which thinness may be desirable for manufacture) will thus need the diameter of the or each additional bore to be small.

The upper and lower parts 300*a*, 300*b* of the casing 300 may be separable to allow for refiling of the reservoir 110 once the aerosol precursor wherein has been consumed. In such an arrangement, the sealing at the sealing surface 640 needs to be sufficiently good to prevent leakage of aerosol precursor therethrough when the smoking substitute system is in use. Alternatively, the seal at the sealing surface 600 may be a permanent one, with the upper and lower parts 300*a* and 300*b* if the casing bonded together. In such an arrangement, the reservoir 110 may not be refillable, and the consumable 101 would need to be replaced once the aerosol precursor in the reservoir 110 had been consumed.

In the arrangements described previously, the bores 122 in the wick support element 120 (or in the flange 602 in the case of FIG. 120) were described as being sized so that aerosol precursor may flow therethrough in a non-capillary manner. In an alternative, applicable to all the arrangements described previously, the bores 122 may be capillary ducts (hereinafter referred to as capillary bores) which allow aerosol precursor to flow therethrough in a capillary manner. The capillary bores allow the flow of aerosol precursor to the wick 111, in a controlled manner, so that there is less chance of there being excess aerosol precursor at the wick 111. In general, the capillary bores may have a diameter range of 0.3 mm to 2 mm, as a diameter of less than 0.3 mm will generally not allow sufficient aerosol precursor to pass to the wick 111. Preferably, the diameter is at least 0.5 mm, preferably 0.8 to 1.5 mm, and more preferably 1 mm or 1.3 mm. In practice, the diameter of the capillary bores may be affected by the thickness of the wick support element 120, which can have a thickness of e.g., 0.5 mm to 5 mm, more preferably 1 to 5 mm, such as 4 mm, 3 mm, 2 mm and 1 mm. In general, the width of the capillary bores will need to be greater with greater thickness of the wick support element 120.

Figure 121:
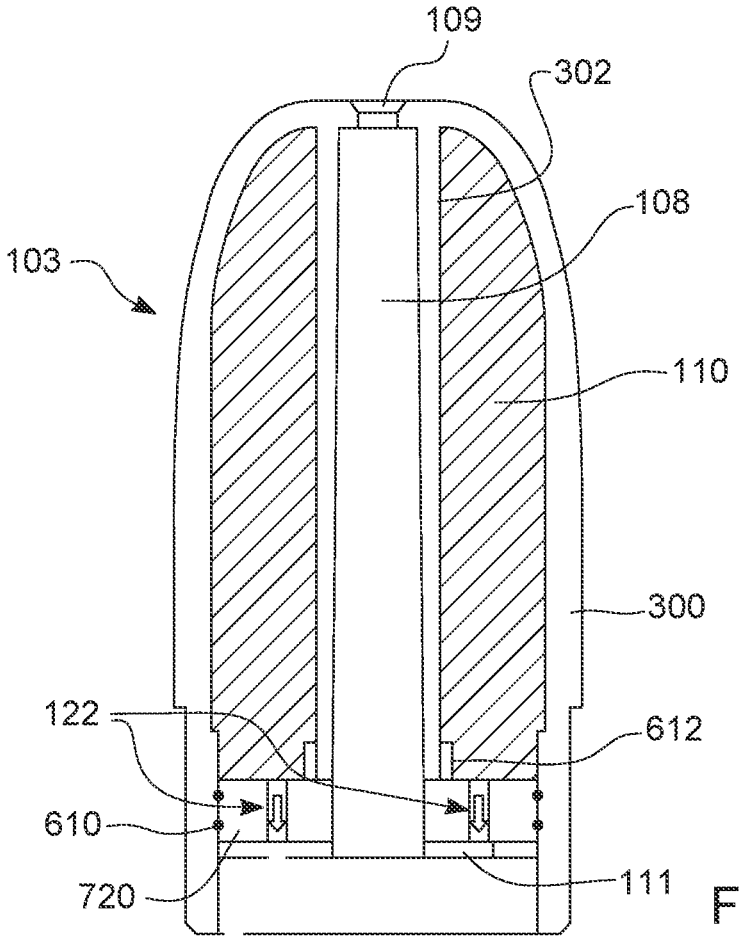
Figure 122:
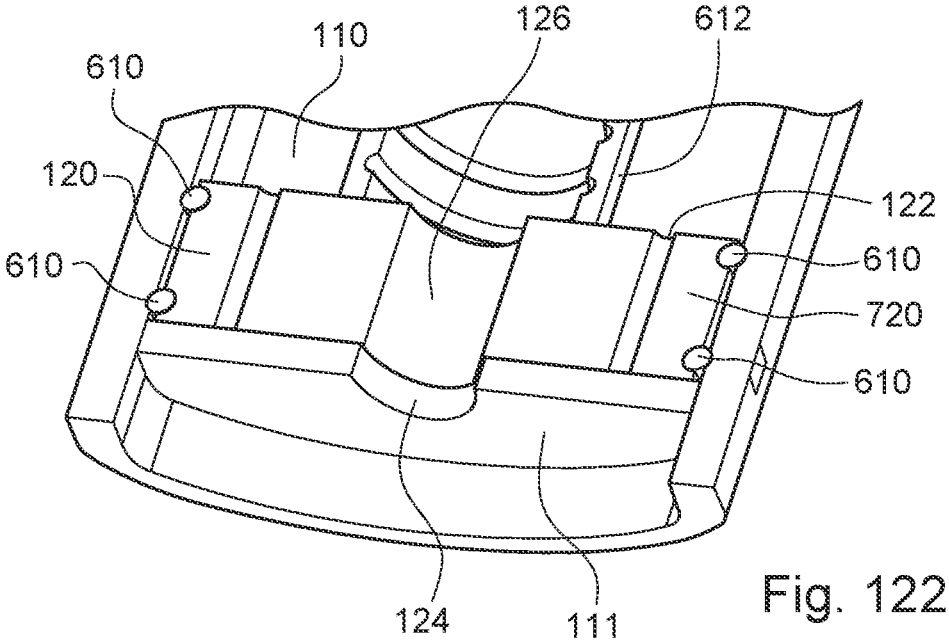

In the arrangements of FIGS. 109 to 119, the wick support element 120 is made of resilient material such as rubber. In the arrangement of FIG. 120 on the other hand, the support for the wick 111 is rigid, because it was formed by the internal flange 602 which was integral with, and therefore made of the same material as, the casing 300. FIGS. 121 and 122 then illustrate another arrangement in which the wick is supported by a rigid element. Unlike the arrangement of FIG. 120, however, in the arrangement of FIGS. 121 and 122, that rigid element is a separate wick support element 720. In FIGS. 121 and 122, parts which correspond to parts of earlier arrangements are indicated by the same reference numerals. Moreover, as in FIG. 120, only the consumable 103 is illustrated. The main part 100 may be the same as in earlier arrangements.

In particular, in the arrangements of FIGS. 121 and 122, the rigid wick support element 720 is formed at an end of the reservoir 110, within the first casing 300. Bores 122 through the wick support element 720 allow aerosol precursor from the reservoir 110 to pass to wick 111. Whilst the bores 122 may be non-capillary bores, they are preferably capillary bores. The diameter of the capillary bores may be as previously described, as may the thickness of the wick support element 720. Although not illustrated in FIGS. 121 and 122, there may need to be an additional bore or bores in the wick support element 720 to allow passage of air to the reservoir 110, corresponding to the at least one additional bore 604 in FIG. 120.

In order to prevent escape of liquid from the reservoir, the wick support element 720 is preferably sealed to the first casing 300 by seals 610. For example, the seals 610 may be O-ring seals extending around the wick support element 120. The seals can be seen clearly in FIG. 122, as can the opening 124 in the wick 111, which leads to the passage 126 through the wick support element 720 to the air-flow passage 108. The wick support element 720 also needs to be sealed to the tube 302, to prevent escape of aerosol precursor from the reservoir 110. To achieve this, the wick support element 720 may have an upstanding ring 612, which then seals (e.g., by O-rings and/or an interference fit) to the tube 302. Grooves for those O-rings are illustrated in FIG. 122 Another possibility is for the tube 302 to be integral with the wick support element 720, with the end of the tube 302 being sealed to the casing 300 adjacent the mouthpiece 109.

The rigidity of the wick support element 720 and the tube 302 means that the positioning of the wick support element 720 on the tube 302 and the positioning of the tube 302 relative to the casing 300 may be determined to good precision. This ensures that the wick 111 is accurately positioned relative to the casing 300, and hence accurately positioned relative to the casing 310 and the heater 112.

In the arrangement of FIGS. 121 and 122, the wick support element 720 may be made of the same material as the casing 300 (and the casing 310) such as being made from molded polypropylene plastics material. Other suitable materials to form the wick support element 720 include ABS and PEAK materials. The seals 610 may be O-rings of e.g., rubber material or silicone seals co-molded with the wick support element 720, but preferably are nitrile or thermoplastic polymer O-ring seals. The molding of the wick support element 720 and the first and second casings 300, 310 simplifies manufacture.

Because the wick support element 720 is rigid in the arrangement of FIGS. 121 and 122, it may be thinner than the resilient wick support elements 120 described with reference to e.g., FIGS. 108 to 119. Thus, it may then be possible to have a wick support element 720 with a thickness of e.g., 0.5 to 2 mm, preferably 1 mm, allowing the bores 122 to have a small diameter, and still provide a capillary effect. The same is true in the arrangement of FIG. 120 Thus, at least in the arrangements of FIGS. 120 to 122, the bores 122 may have a diameter of 0.3 mm to 2 mm, most preferably 0.5 mm. If one or more additional bores are provided, corresponding to the additional bores 604 in the arrangement of FIG. 121, to allow air to enter the reservoir volume to replace aerosol precursor which has passed to the wick 111, those additional bores will have small diameters, due to the reduced thickness of the wick support element 720, so e.g., less than 0.3 mm. The diameter of the additional bores will always be less than the diameter of the capillary bores. It should be noted that, even in the arrangements of FIGS. 108 to 119, it may be possible to have small diameter capillary bores, if the wick support element 120 is thin enough.

In the arrangements of FIGS. 120 to 122, the position of the wick 111 is precisely determined, relative to the casing 300, either because the wick support element is part of the casing itself, as in the arrangement of FIG. 120, or because the position of the wick support element 720 is determined by a component of the casing such as the tube 302, as in the arrangement of FIGS. 121 and 122. This precise positioning of the wick 111 in the casing 300 means that manufacture will be consistent and hence replacement of one consumable with another will not alter the relationship between the wick 111 and the heater 112, and so will not affect the efficiency of the smoking substitute device.

The use of capillary bores 122 in the wick support element 720 in the arrangements of FIGS. 120 to 122 mean that it is possible to optimize the flow of aerosol precursor to the wick 111 to minimize leakage.

The length and diameter of the capillary bores 122 may be chosen to control the flow of a specific aerosol precursor formulation to the wick 111, based on the viscosity and liquid characteristics of that aerosol precursor. When aerosol precursor is vaporized from the wick 111 by the heater 112, there will be an available volume of air in the wick 111 allowing additional aerosol precursor to flow into the wick 111, so that the wick 111 is maintained in a saturated state when the device is in use. The rigid nature of the wick support element 720 improves the consistency of liquid flow to the wick 111, compared to a wick support element 120 of resilient material, so that efficient operation may be achieved.

The sealing configuration in the arrangement of FIGS. 121 and 122 makes use of O-rings, with the effect of minimizing leakage in use and in transit, as a robust seal is created between the wick support element 720 and the casing 300, so that there is no leakage path therebetween. O-ring technology is well established, so it is straight forward to put in to practice in the smoking substitute device to reduce or eliminate variation between parts, improving repeatability of manufacture.

The use of a rigid wick support element 720 in the arrangements of FIGS. 120 to 122 means that the wick support element 720 is easy to manufacture with high precision, and the assembly of the consumable may easily be automated. This ensures efficient manufacture, thereby reducing costs.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

What is claimed is:

1. An aerosol-generation apparatus comprising a heater and a fluid-transfer article, said fluid-transfer article having a first region, and a second region comprising an activation surface, the first region being for holding an aerosol precursor and for transferring said aerosol precursor to the activation surface, said activation surface being disposed and configured for thermal interaction with a heating surface of said heater;

said second region comprising at least one discontinuity in said activation surface to form a corresponding at least one channel between said second region and said heating surface and being configured such that, when the fluid transfer article is arranged with respect to said heating surface of the heater for thermal interaction therebetween, the or each channel opposes and opens towards said heating surface, and provides an air-flow pathway across said heating surface;

wherein the heater comprises a substrate defining said heating surface, and at least one heating element formed on a part of said heating surface; and wherein said at least one channel opposes a further part of said heating surface other than said part of said heating surface on which the at least one heating element is formed, such that the at least one heating element is not aligned with any of the or each channel, but is aligned with a part or parts of the activation surface that projects towards the heater.

2. An aerosol-generation apparatus according to claim 1, wherein said activation surface is configured such that the or each said discontinuity is spaced apart from said heating surface.

3. An aerosol-generation apparatus according to claim 1, wherein the or each said channel is at least partly defined by a pair of spaced apart side walls, and an arcuate surface portion extending between said side walls to form a ceiling portion of said channel.

4. An aerosol-generation apparatus according to claim 3, wherein said arcuate surface portion blends smoothly with each of said side walls, thereby eliminating a sharp corner therebetween.

5. An aerosol-generation apparatus according to claim 1, wherein the or each channel is at least partially defined by a pair of spaced apart side walls and a flat surface portion, said flat surface portion extending between said side walls to form a ceiling portion of said channel.

6. An aerosol-generation apparatus according to claim 1, wherein the or each channel is at least partially defined by a pair of side walls, said side walls being inclined relative to each other to meet at an apex portion of said channel.

7. An aerosol-generation apparatus according to claim 3, wherein said side walls are substantially planar.

8. An aerosol-generation apparatus according to claim 1, wherein at least said second region is formed from a polymeric wicking material.

9. An aerosol-generation apparatus according to claim 8, wherein said first and second regions are both formed from said polymeric wicking material.

10. An aerosol-generation apparatus according to claim 8, wherein said polymeric wicking material is porous.

11. An aerosol-generation apparatus according to claim 10, wherein said polymeric wicking material is configured such that a pore diameter in said first region is greater than a pore diameter in said second region.

12. An aerosol-generation apparatus according to claim 8, wherein said polymeric wicking material is heat resistant.

13. An aerosol-generation apparatus according to claim 8, wherein said polymeric wicking material is a hydrophilic material that is configured to transfer fluid from said first region to said second region.

14. An aerosol-generation apparatus according to claim 8, wherein said polymeric wicking material is of greater hydrophilicity in said second region than said first region.

15. An aerosol delivery system comprising an aerosol-generation apparatus according to claim 1, and a carrier, the carrier having a housing containing said heater and said fluid-transfer article.

16. An aerosol delivery system according to claim 15, wherein said housing has an inlet and an outlet, said air-flow pathway extending to said inlet and said outlet.

* * * * *